US011166100B2

(12) United States Patent
Palmer et al.

(10) Patent No.: US 11,166,100 B2
(45) Date of Patent: Nov. 2, 2021

(54) BASS OPTIMIZATION FOR AUDIO SYSTEMS AND DEVICES

(71) Applicant: Wing Acoustics Limited, Auckland (NZ)

(72) Inventors: David John Palmer, Auckland (NZ); Michael Ian Palmer, Auckland (NZ)

(73) Assignee: WING ACOUSTICS LIMITED, Auckland (NZ)

( * ) Notice: Subject to any disclaimer, the term of this patent is extended or adjusted under 35 U.S.C. 154(b) by 0 days.

(21) Appl. No.: 16/494,216

(22) PCT Filed: Mar. 15, 2017

(86) PCT No.: PCT/IB2017/051519
§ 371 (c)(1),
(2) Date: Sep. 13, 2019

(87) PCT Pub. No.: WO2018/167538
PCT Pub. Date: Sep. 20, 2018

(65) Prior Publication Data

US 2020/0092647 A1 Mar. 19, 2020

(51) Int. Cl.
*H04R 3/08* (2006.01)
*H04R 1/02* (2006.01)
(Continued)

(52) U.S. Cl.
CPC ..... *H04R 3/08* (2013.01); *H04R 1/025* (2013.01); *H04R 3/12* (2013.01); *H04R 25/305* (2013.01);
(Continued)

(58) Field of Classification Search
CPC ... H04R 1/16; H04R 1/20; H04R 1/22; H04R 1/32; H04R 3/00; H04R 3/002;
(Continued)

(56) References Cited

U.S. PATENT DOCUMENTS 1,035,577 A 8/1912 Grace
1,536,116 A 5/1925 Martin
(Continued)

FOREIGN PATENT DOCUMENTS

CA 2 600 015 A1 9/2006
DE 3378456 12/1988
(Continued)

OTHER PUBLICATIONS

BeyerDynamic, DT 990 Pro Product Sheet (BeyerDynamic) (retrieved from https://north-america.beyerdynamic.com/dt-990-pro.html) (last accessed Sep. 24, 2020) (Year: 2020).*
(Continued)

*Primary Examiner* — Walter F Briney, III
(74) *Attorney, Agent, or Firm* — Alston & Bird LLP

(57) ABSTRACT

The invention relates to audio transducer technology, including audio tuning systems to be utilised in personal audio devices, such as headphone, earphones, mobile phones and the like. The audio tuning system optimises the frequency response of the personal audio device by using Diffuse Field curve characteristics. The audio transducers of the personal audio device incorporate low resonance designs, including low resonance transducer and diaphragm suspensions to further optimise the sound quality of the device. The invention also relates to an audio transducer diaphragm construction that includes a three-dimensional lattice which may be utilised in any audio transducer application.

43 Claims, 43 Drawing Sheets

(51) Int. Cl.
*H04R 3/12* (2006.01)
*H04R 25/00* (2006.01)
*H04R 29/00* (2006.01)

(52) U.S. Cl.
CPC ..... *H04R 25/407* (2013.01); *H04R 25/50* (2013.01); *H04R 29/001* (2013.01); *H04R 2499/11* (2013.01)

(58) Field of Classification Search
CPC . H04R 3/007; H04R 3/04; H04R 3/12; H04R 3/14; H04R 25/00; H04R 25/30; H04R 25/305; H04R 25/356; H04R 25/50; H04R 25/502; H04R 25/505; H04R 29/00; H04R 29/001; H04R 29/002; H04R 29/003; H04R 2430/00; H04R 2430/01; H03G 1/00; H03G 1/04; H03G 3/00; H03G 3/001; H03G 3/002; H03G 3/02; H03G 3/20; H03G 5/005; H03G 5/02; H03G 5/025; H03G 5/16; H03G 5/165; H03G 9/00; H03G 9/005; H03G 9/02
See application file for complete search history.

(56) References Cited

U.S. PATENT DOCUMENTS 1,562,165 A 11/1925 Harrison
1,579,864 A 4/1926 Hobart, Jr.
1,614,327 A 1/1927 Thomas
1,633,170 A 6/1927 Fischer
1,683,946 A 9/1928 Baldwin
1,693,223 A 11/1928 Danziger et al.
1,786,465 A 12/1930 Wagenen
1,821,547 A 9/1931 Hartley
2,035,104 A 3/1936 Thomas
2,049,784 A 8/1936 Thomas
2,075,774 A 3/1937 Allen
2,077,170 A 4/1937 Harrison
2,078,469 A 4/1937 Thomas
2,085,198 A 6/1937 Lindsay
2,239,837 A 4/1941 Bottorff
2,278,966 A 4/1942 Williams
2,304,022 A 12/1942 Sanders, Jr.
3,578,921 A 5/1971 Knauert
3,761,956 A 9/1973 Takahashi
4,182,937 A 1/1980 Greenwood
4,239,090 A 12/1980 Dahlquist
4,313,040 A 1/1982 Tsukamoto
4,385,210 A 5/1983 Marquiss
4,426,552 A 1/1984 Cowans et al.
4,430,529 A 2/1984 Nakagawa et al.
4,593,160 A 6/1986 Nakamura
4,628,907 A 12/1986 Epley
4,763,358 A * 8/1988 Danley ..... H04R 23/00 310/80
5,140,641 A 8/1992 Danley et al.
5,191,618 A 3/1993 Hisey
5,255,328 A 10/1993 Akiniwa et al.
5,313,127 A 5/1994 Danley et al.
5,317,642 A 5/1994 Danley et al.
5,633,552 A 5/1997 Lee et al.
5,660,397 A 8/1997 Holtkamp
5,694,476 A 12/1997 Klippel
5,704,613 A 1/1998 Holtkamp
5,802,189 A 9/1998 Blodget
5,825,901 A 10/1998 Hisey
5,848,173 A 12/1998 Sato et al.
5,872,853 A 2/1999 Marquiss
6,097,829 A 8/2000 Guenther et al.
6,151,402 A 11/2000 Azima et al.
6,160,898 A 12/2000 Bachmann et al.
6,178,314 B1 * 1/2001 Whikehart ..... H03G 5/005 455/188.1
6,192,136 B1 2/2001 Azima et al.
6,347,149 B1 2/2002 Bachmann et al.
6,384,550 B1 5/2002 Mikyakawa et al.
6,466,682 B2 10/2002 An
6,560,348 B1 5/2003 Bachmann et al.
6,567,525 B1 5/2003 Sapiejewski
6,748,090 B1 6/2004 Bachmann et al.
6,985,596 B2 1/2006 Bank et al.
7,088,839 B2 8/2006 Geschiere et al.
7,206,428 B2 4/2007 Geschiere et al.
7,302,068 B2 11/2007 Longbottom et al.
7,369,674 B2 5/2008 Miura
7,403,632 B2 7/2008 Goldberg
7,471,805 B2 12/2008 Goldberg
7,729,504 B2 6/2010 Tsuda et al.
7,747,035 B1 6/2010 Heavner
7,860,265 B2 12/2010 Gaudreault
8,014,556 B2 9/2011 Goldberg
8,023,668 B2 9/2011 Pfaffinger
8,064,630 B2 11/2011 Goldberg
8,073,181 B2 12/2011 Bakalos et al.
8,073,187 B2 12/2011 Hashimoto et al.
8,085,955 B2 12/2011 Henry
8,116,508 B2 2/2012 Xu et al.
8,131,005 B2 3/2012 Lemarquand et al.
8,139,813 B2 3/2012 Kobayashi et al.
8,144,380 B2 3/2012 Takeuchi
8,280,096 B2 10/2012 Milot
8,295,536 B2 10/2012 Carlmark et al.
8,295,537 B2 10/2012 Carlmark et al.
8,457,344 B2 6/2013 Kobayashi et al.
8,659,211 B1 2/2014 Butler et al.
8,705,774 B2 4/2014 Jilani et al.
8,965,024 B2 2/2015 Graham
9,247,365 B1 1/2016 Ellis et al.
10,244,325 B2 3/2019 Palmer et al.
2002/0122560 A1 9/2002 An
2002/0146141 A1 10/2002 Geschiere et al.
2004/0062404 A1 4/2004 Negishi et al.
2004/0202338 A1 10/2004 Longbotttom et al.
2005/0180592 A1 8/2005 Miura
2005/0269906 A1 12/2005 Allan et al.
2006/0028751 A1 2/2006 Takeuchi
2006/0198541 A1 9/2006 Henry
2006/0239488 A1 10/2006 Geschiere et al.
2007/0258617 A1 11/2007 Henry
2007/0263886 A1 11/2007 Starnes et al.
2008/0025533 A1 1/2008 Livingstone et al.
2008/0069385 A1 3/2008 Revit
2008/0232636 A1 9/2008 Thurber et al.
2008/0247595 A1 10/2008 Henry
2009/0028374 A1 1/2009 Hashimoto et al.
2009/0034780 A1 2/2009 Gaudreault
2009/0226028 A1 9/2009 Suganuma
2011/0069859 A1 3/2011 Kobayashi et al.
2011/0243365 A1 10/2011 Carlmark et al.
2011/0243366 A1 10/2011 Carlmark et al.
2011/0261979 A1 10/2011 Yang et al.
2011/0299716 A1 12/2011 Reckert
2012/0033818 A1* 2/2012 De Poortere ..... H04R 3/14 381/17
2012/0045073 A1 2/2012 Kobayashi et al.
2012/0257778 A1 10/2012 Hall et al.
2014/0003624 A1 1/2014 Stromback
2014/0049983 A1 2/2014 Nichol et al.
2014/0140559 A1 5/2014 Graham
2014/0254805 A1* 9/2014 Su ..... H04R 3/007 381/55
2014/0321668 A1* 10/2014 Kimura ..... H04R 3/04 381/101
2014/0369519 A1* 12/2014 Leschka ..... G06F 3/165 381/74
2015/0281830 A1* 10/2015 Gauger, Jr. ..... H04R 1/1083 381/71.6
2016/0337747 A1 11/2016 Litovsky et al.
2016/0373858 A1* 12/2016 Lawrence ..... H04R 3/04

(56) References Cited

U.S. PATENT DOCUMENTS

| | | | |
|---|---|---|---|
| 2017/0078798 A1 | 3/2017 | Palmer et al. | |
| 2018/0014115 A1* | 1/2018 | Crosby | H04R 1/2819 |

FOREIGN PATENT DOCUMENTS

| | | | |
|---|---|---|---|
| DE | 3908402 | A1 | 9/1990 |
| EP | 0 114 910 | A1 | 8/1984 |
| EP | 0 114 910 | B1 | 11/1988 |
| EP | 0 609 873 | A2 | 8/1994 |
| EP | 0 609 873 | A3 | 8/1994 |
| EP | 0 701 386 | A2 | 3/1996 |
| EP | 0 720 810 | A1 | 7/1996 |
| EP | 0 735 795 | A2 | 10/1996 |
| EP | 1 248 496 | A2 | 10/2002 |
| EP | 0 735 795 | A3 | 7/2003 |
| EP | 1 248 496 | A3 | 11/2005 |
| EP | 1 752 016 | A1 | 2/2007 |
| EP | 1 854 332 | A2 | 11/2007 |
| EP | 1 940 199 | A1 | 7/2008 |
| EP | 2 023 657 | A2 | 2/2009 |
| EP | 1 752 016 | B1 | 2/2010 |
| EP | 2 124 480 | B1 | 3/2012 |
| EP | 2 023 657 | A3 | 6/2013 |
| GB | 325543 | A | 2/1930 |
| JP | S 54-103340 | A | 8/1979 |
| JP | S54147028 | A | 11/1979 |
| JP | S5553996 | A | 4/1980 |
| JP | S5555696 | A | 4/1980 |
| JP | S 56-131298 | A | 10/1981 |
| JP | S 58-151200 | A | 9/1983 |
| JP | S59161996 | A | 9/1984 |
| JP | S59191998 | A | 10/1984 |
| JP | S60259086 | A | 12/1985 |
| JP | S60259087 | A | 12/1985 |
| JP | S60259089 | A | 12/1985 |
| JP | S60259090 | A | 12/1985 |
| JP | S60259095 | A | 12/1985 |
| JP | S619098 | A | 1/1986 |
| JP | S61103393 | A | 5/1986 |
| JP | S 61-157000 | A | 7/1986 |
| JP | S61144200 | A | 7/1986 |
| JP | S 61-214897 | A | 9/1986 |
| JP | S6253099 | A | 3/1987 |
| JP | 64-29098 | A | 1/1989 |
| JP | H01264098 | A | 10/1989 |
| JP | H04357799 | A | 12/1992 |
| JP | H 05-236595 | A | 9/1993 |
| JP | H06217390 | A | 8/1994 |
| JP | 62-53099 | A | 9/1994 |
| JP | H09084179 | A | 3/1997 |
| JP | H09084181 | A | 3/1997 |
| JP | H09084182 | A | 3/1997 |
| JP | H09084186 | A | 3/1997 |
| JP | H0998496 | A | 4/1997 |
| JP | H09098497 | A | 4/1997 |
| JP | H09233582 | A | 9/1997 |
| JP | H09275289 | A | 10/1997 |
| JP | H10066194 | A | 3/1998 |
| JP | H 11-355876 | A | 12/1999 |
| JP | H11355876 | A | 12/1999 |
| JP | 2002-354853 | A | 12/2002 |
| JP | 2004-200745 | A | 7/2004 |
| JP | 2004-274206 | A | 9/2004 |
| JP | 2005-260510 | A | 9/2005 |
| JP | 2005-311951 | A | 11/2005 |
| JP | 2005-328209 | A | 11/2005 |
| JP | 2006-013671 | A | 1/2006 |
| JP | 38-63884 | B2 | 12/2006 |
| JP | 2008-532422 | A | 8/2008 |
| JP | 2009-098496 | A | 5/2009 |
| JP | 2009-219067 | A | 9/2009 |
| JP | 2010-050764 | A | 3/2010 |
| JP | 2010-263362 | A | 11/2010 |
| JP | 2010-263363 | A | 11/2010 |
| JP | 2011-228863 | A | 11/2011 |
| JP | 2013-090309 | A | 5/2013 |
| JP | 2013-232872 | A | 11/2013 |
| WO | WO 1994/019914 | A1 | 9/1994 |
| WO | WO 2003/001841 | A2 | 1/2003 |
| WO | WO 2004/030407 | A2 | 4/2004 |
| WO | WO 2005/104614 | A1 | 11/2005 |
| WO | WO 2005/104617 | A1 | 11/2005 |
| WO | WO 2006/069056 | A2 | 6/2006 |
| WO | WO 2006/093876 | A2 | 9/2006 |
| WO | WO 2007/034781 | A1 | 3/2007 |
| WO | WO 2011/123265 | A1 | 10/2011 |
| WO | WO 2011/123266 | A1 | 10/2011 |
| WO | WO 2015/128237 | A1 | 9/2015 |
| WO | WO 2017/046716 | A1 | 3/2017 |

OTHER PUBLICATIONS

International Search Report and Written Opinion for Application No. PCT/IB2017/051519 dated Jun. 21, 2017, 20 pages.

Borwick, J., *Loudspeaker and Headphone Handbook*, 3rd Revised Edition (Mar. 27, 2001), 733 pages.

Georg Neumann GmbH, *The Dummy Head—Theory and Practice*, Brochure, Berlin, 28 pages (undated).

Hammershol, D. et al., *Determination of Noise Emission From Sound Sources Close to the Ears*, Acta Acustica, vol. 94, No. 1 (Jan. 2008) 114-129.

Olive, S. E. et al., *Factors That Influence Listeners' Preferred Base and Treble Balance in Headphones*, AES Convention Paper 9382 Presented at the 139th Convention (Oct.-Nov. 2015) 12 pages.

Extended European Search Report for European Application No. 16845811.5 dated Apr. 5, 2019.

Fern Acoustics [online] [retrieved Jan. 29, 2018]. Retrieved from the Internet: <URL: http://www.fertinacoustics.com/en_tecnology.html>. 3 pages.

International Search Report and Written Opinion for Application No. PCT/IB2016/055472 dated Jan. 3, 2017.

international Search Report and Written Opinion for Application No. PCT/IB2018/051881 dated Jul. 3, 2018, 11 pages.

* cited by examiner

SECTION B-B

SECTION AV-AV

SECTION AX-AX

SECTION AO-AO

SECTION A-A

SECTION B-B

SECTION C-C

SECTION D-D

SECTION E-E

SECTION F-F

SECTION I-I

SECTION A-A

SECTION F-F

BASS OPTIMIZATION FOR AUDIO SYSTEMS AND DEVICES

CROSS-REFERENCE TO RELATED APPLICATIONS

The present application is a national phase entry of International Application No. PCT/IB2017/051519, filed Mar. 15, 2017, the contents of which are incorporated herein by reference in its entirety.

FIELD OF THE INVENTION

The present invention relates to audio transducer technologies, such as loudspeaker, microphones and the like, and includes improvements in or relating to: audio tuning systems for personal audio applications and/or audio transducer diaphragm constructions.

BACKGROUND TO THE INVENTION

Sound generated from a personal audio device that is intended to be located at or adjacent a user's ear, such as a headphone, earphone, mobile phone, hearing aid and the like, is exhibited differently by a user from sound that is generated by a relatively distal sound source, such a home speaker system for example. The reason for this is that sound pressure from a personal audio device is exposed to a different acoustic environment to sound pressure propagating in open space from a distal source. For instance, when a listener's ear is unobstructed by a headphone or similar ('directly applied') sound source, the ear amplifies incoming sound by an amount that varies with frequency in a way that is unique to each listener. The geometry of the concha, the ear canal and the pinna for example can each, individually affect the frequency response of a listener's ear. The brain is aware of/inherently calibrated to the body's unique frequency response and therefore takes this property into account when reproducing sound. When a headphone or other sound source is directly coupled to the ear, this amplification effect is compromised by the foreign structure surrounding the ear which reduces the listener's ability to reproduce the output sound clearly. Personal audio devices that are designed to be directly coupled to a listener's ears, such as headphones or hearing aids for example, must therefore compensate for their placement relative to the ears in order to produce high-quality sound.

Equalisation is the process of adjusting the balance between frequency components within an electronic audio signal to alter the acoustic characteristics of the signal and improve subjective sound quality. Equalisation techniques may therefore be used to improve subjective sound quality in the output channels of personal audio devices. No single optimal target frequency response for personal audio devices has yet been determined or agreed by speaker manufacturers and scientists. Rather, there are a number of schools of thought, one of which is the diffuse field frequency response curve.

One way to achieve diffuse field listening conditions in an anechoic chamber is to surround a listener, or test rig, with flat-response sound sources. According to one theory, to achieve the same subjective effect using a personal audio device, such as headphones, the frequency response of the device should match the non-flat diffuse field response shown in FIG. 1, for example as described in D. Hammershøi and H. Møller, "Determination of Noise Emission from Sound Sources Close to the Ears," *Acta Acustica, Vol.* 94 No. 1 (January 2008).

In some personal audio applications, it is advantageous to modify the frequency response of a personal audio device to mimic the diffuse field target of FIG. 1 in order to achieve high subjective quality of sound. Equalisation techniques can therefore be used to adjust the frequency components of an electric audio signal to achieve output audio with diffuse field characteristics.

In practice only a small number of headphone and earphones attempt to replicate a diffuse field target response. In the majority of hi-fidelity personal audio devices currently available, the upper-bass volume is louder than the upper-mid-range and treble frequency ranges, compared to a diffuse field target curve. The response generally drops gradually with increasing frequency. This is different to, for example, home audio speakers, which usually provide a more closely 'flat' response.

Also, whilst equalisation can have a positive effect on the frequency response of an output audio signal, it may not affect the time domain response which is also an important factor for subjective sound quality. Two audio systems can exhibit steady state frequency responses that appear to be similar in terms of the overall response level at different frequencies while sounding different and exhibiting very different looking time-domain responses. This implies that there may be system characteristics that are clearly visible in a frequency response plot yet not in a time domain response plot, and likewise, there may be other system characteristics that show strongly in a time domain response plot yet not in a frequency response plot.

Therefore, using an equaliser to optimise the frequency response of an inexpensive and relatively more resonance-prone audio system may not be sufficient for achieving a desired level of subjective sound quality.

Another field relating to audio technology is audio transducer diaphragm design. Relatively thick and substantially rigid diaphragms designs are desirable in some applications however tend to have an increased mass that can be difficult to implement in a number of audio applications.

It is an object of the present invention to provide an improved or alternative audio system, method and/or device that overcomes some of the shortcomings of existing systems, methods and/or devices to improve subjective sound quality, or to at least provide the public with a useful choice.

SUMMARY OF THE INVENTION

In one aspect, the present invention broadly consists in an audio system comprising:

- a personal audio device for use in a personal audio application where the device is intended to be located within approximately 10 centimetres of a user's ears in use, the audio device having at least one output audio channel and each output audio channel comprising:
- a housing; and
- at least one electro-acoustic transducer within the housing that is operable to convert an input audio signal into sound, each electro-acoustic transducer being mounted within the housing via a suspension system, wherein the suspension system flexibly mounts the electro-acoustic transducer relative to the housing to at least partially alleviate mechanical transmission of vibration between the electro-acoustic transducer and the housing during operation; and an audio tuning system configured to operatively couple the output audio channel(s) of the personal audio device and to optimise input audio signals for the output audio channel(s), the audio tuning system comprising an equaliser configured to receive input audio signals for the output channel(s) and alter a balance between frequency components of the input audio signals to generate equalised output signals for the output audio channel(s).

In some embodiments the audio tuning system is on-board the personal audio device. Preferably the audio tuning system is located on-board are located within the housing of at least one output audio channel. The audio tuning system may be located in the housing of one of the output audio channel(s) only, or it may be located in multiple output audio channels in a personal audio device having multiple output audio channels.

In some embodiments the audio tuning system is on-board a device separate to, but configured to operate with, the personal audio device, such as an audio source device.

In some embodiments the audio system further comprises an audio source device having one or more audio source channels that are configured to operatively couple the output audio channel(s) of the personal audio device, and wherein the audio tuning system is configured to receive the input audio signals from the audio source channel(s). The audio tuning system may be on-board the audio source device.

The audio source device may be any one of a mobile phone, a portable music player, a tablet computer, a laptop, a desktop computer and the like. The audio source channel(s) of the audio source device may be operatively coupled to each of the electro-acoustic transducer(s) of the personal audio device output audio channel(s) via cable or wirelessly via any suitable communications protocol that is well-known in the art, such as Bluetooth™, Wi-Fi and/or Near Field Communication (NFC) for example.

Preferably the equaliser is configured to alter a frequency response of the audio system in accordance with an equalisation frequency response.

Preferably the equaliser comprises an equalisation frequency response for each of the output audio channels. There may be a single equalisation frequency response for all output audio channel(s) or multiple equalisation frequency response(s) for multiple output audio channel(s).

In some embodiments the equalisation frequency response for each output channel is based on a diffuse field frequency response.

In some embodiments the equalisation frequency response is determined from a diffuse field frequency response comprising:

a substantially continuously increasing magnitude from approximately 0 dB at approximately 100 Hz to approximately 15 dB at approximately 2500 Hz; and a substantially uniform magnitude from approximately 2500 Hz to approximately 3200 Hz; and a substantially decreasing magnitude from approximately 15 db at approximately 3200 Hz to approximately 7 dB at approximately 10 kHz.

Preferably the magnitude between approximately 100 Hz and approximately 2500 Hz comprises a substantially curved profile, e.g. an approximately increasing gradient from 100 Hz to 2500 Hz.

Preferably the magnitude between approximately 3200 Hz and 10 kHz comprises a substantially stepped profile.

In some embodiments the equalisation frequency response is determined from a diffuse field frequency response comprising:

a first frequency band between approximately 100 Hz and approximately 400 Hz with a magnitude rising from approximately 0 dB to approximately 2 dB;

a second frequency band between approximately 400 Hz and approximately 1000 Hz with a magnitude rising from approximately 2 dB to approximately 4.5 dB;

a third frequency band between approximately 1000 Hz and approximately 2500 Hz with a magnitude rising from approximately 4.5 dB to approximately 15 dB;

a fourth frequency band between approximately 2500 Hz and 3200 Hz with a substantially uniform magnitude of approximately 15 dB;

a fifth frequency band between approximately 3200 Hz to 5200 Hz with a magnitude decreasing from approximately 15 dB to approximately 10.5 dB;

a seventh frequency band between approximately 5200 Hz and 8200 Hz with magnitude decreasing from approximately 10.5 dB to approximately 9 dB; and an eight frequency band between approximately 8200 Hz and 14 kHz with a magnitude decreasing from approximately 9 dB to approximately 2 dB.

In some embodiments the equalisation frequency response is determined from a diffuse field frequency response comprising:

an average magnitude of approximately 2.7 dB over a frequency range of approximately 300 to approximately 1000 Hz;

an average magnitude of approximately 13.4 dB over a frequency range of approximately 2 kHz to approximately 6 kHz; and an average magnitude of approximately 7.3 dB over a frequency range of approximately 6 kHz to approximately 14 kHz.

In some embodiments the equalisation frequency response is determined from a diffuse field frequency response comprising:

an average magnitude over a frequency range of approximately 2 kHz to approximately 6 kHz that is approximately 8-12 dB higher than an average magnitude over a frequency range of approximately 300 kHz to approximately 1000 Hz; and an average magnitude over a frequency range of approximately 6 kHz to approximately 14 kHz that is approximately 3-6 dB higher than an average magnitude over a frequency range of approximately 300 Hz to approximately 1000 Hz.

Preferably the equalisation frequency response comprises an increasing magnitude from approximately 400 Hz to approximately 2000 Hz. The increase magnitude may have an approximately increasing gradient from approximately 400 Hz to approximately 2000 Hz. Preferably the equalisation frequency response comprises a higher average magnitude across a treble frequency range relative to mid-level and/or bass frequency ranges.

Preferably the equalisation frequency response is configured to alter the frequency response of the audio system such that the frequency response of the audio system comprises a profile of varying magnitude over frequency that is shaped approximately 1 dB less compared to a diffuse field frequency response profile within a frequency band of 6 kHz and 14 kHz.

Preferably the frequency response of the audio system is a frequency response observed at the output of the one or more electro-acoustic audio transducers of each output audio channel.

Preferably the equalisation frequency response is configured to alter the frequency response of the audio system such that the frequency response of the audio system comprises a profile of varying magnitude over frequency that is within approximately 3 dB of the average response of the diffuse field frequency response profile shape, over the frequency band of approximately 6 kHz to approximately 14 kHz. More preferably the frequency response of the audio system to be within approximately 2 dB of the average response of the diffuse field frequency response profile shape, over the frequency band of 6 kHz to approximately 14 kHz.

Preferably the equalisation frequency response is configured to alter the frequency response of the audio system such that the frequency response of the audio system comprises an average magnitude over the frequency range of approximately 6 kHz to approximately 14 kHz that is approximately 1-6 dB greater than an average magnitude over a reference range of approximately 300 Hz to approximately 1000 Hz. More preferably the frequency response of the audio system comprises an average magnitude over the frequency range of approximately 6 kHz to approximately 14 kHz that is approximately 2-5 dB greater than the average magnitude over a reference frequency range of approximately 300 Hz to 1000 Hz. Most preferably the frequency response of the audio system comprises an average magnitude over the frequency range of approximately 6 kHz to approximately 14 kHz that is 3-4 dB greater than the average magnitude over the reference frequency range of approximately 300 Hz to approximately 1000 Hz.

Preferably the equalisation frequency response is configured to alter the frequency response of the audio system such that the frequency response of the audio system comprises a profile of varying magnitude over frequency that is shaped approximately 1 dB less compared to a diffuse field frequency response profile within a frequency band of 2 kHz to 6 kHz.

Preferably the equalisation frequency response is configured to alter the frequency response of the audio system such that the frequency response of the audio system comprises a profile of varying magnitude over frequency that is within approximately 3 dB of the average response of the diffuse field frequency response profile shape, over the frequency band of approximately 2 kHz to approximately 6 kHz. More preferably the frequency response of the audio system to be within approximately 2 dB of the average response of the diffuse field frequency response profile shape, over the frequency band of 2 kHz to approximately 6 kHz.

In some embodiments the predetermined equalisation frequency response causes the frequency response of the audio system to have an average magnitude over the frequency range of approximately 2 khz to approximately 6 kHz that is 7-12 dB greater than the average level over a reference frequency range of approximately 300 Hz to approximately 1000 Hz. More preferably the predetermined equalisation causes the frequency response of the audio system to have an average magnitude over the frequency range of approximately 2 kHz to approximately 6 kHz that is 8-11 dB greater than the average level over a reference frequency range of approximately 300 Hz to approximately 1000 Hz. Most preferably the predetermined equalisation causes the frequency response of the audio system to have an average magnitude over the frequency range of approximately 2 kHz to approximately 6 kHz that is 9-10 dB greater than the average level over a reference range 300-1000 Hz.

In some embodiments, the equaliser comprises an adjustable frequency response, and wherein a default frequency response is in accordance with any one of the above preferably statements and embodiments. The equaliser may be adjustable via an equalisation adjustment module of the audio tuning system. Preferably the equalisation adjustment module is configured to receive data indicative of one or more equalisation setting parameters, adjust parameter settings of the equaliser in accordance with the received data.

In some embodiments the equalisation frequency response o is configured to adjust the frequency response of the audio system to include a bass boost component. Preferably the bass boost component comprises an increased magnitude over a bass frequency band of approximately 20 Hz to 200 Hz relative to a diffuse field frequency response magnitude over the bass frequency band.

In some embodiments the equalisation frequency response is configured to adjust the audio signal delivered to the associated electro-acoustic transducer such that the frequency response increases the voltage passed into the associated electro-acoustic transducer at low bass frequencies, relative to the voltage over the range of approximately 200 Hz to 400 Hz.

In some embodiments the equalisation frequency response of one or more of the equalisers is based on a predetermined frequency response of a respective output channel including the one or more electro-acoustic transducers associated with the output channel. In some embodiments the equaliser comprises an equalisation frequency response for a single output audio channel. In some embodiments the equaliser comprises a plurality of equalisation frequency response for a plurality of output audio channels of the personal audio device. In some embodiments the equaliser comprises a single equalisation frequency response for a plurality of output audio channels of the personal audio device.

Preferably an equalisation frequency response for the equaliser is predetermined for each output channel based on any combination of one or more of: the diffuse field frequency response, a frequency response of each of the electro-acoustic transducer(s) of the respective output channel and a bass boost component. Preferably the equalisation frequency response for the equaliser is predetermined based on all of these responses.

In some embodiments the equaliser comprises one or more signal processing components. The signal processing components may be digital, analogue or any combination thereof. The signal processing components may comprise one or more filters that are collectively configured to alter the frequency response of the received audio signal in accordance with the equalisation frequency response.

In some embodiments the one or more filters comprise any combination of one or more of the following filter types: passive or active filters; linear or non-linear filters; analogue or digital filters; infinite impulse response or finite impulse response filters; linear phase filters; and/or high-pass, low-pass, band-pass or band-stop filters.

In some embodiments the equaliser comprises one or more digital filters. The one or more digital filters may be implemented in one or more processing devices, such as a central processing unit or a digital signal processor (DSP).

Preferably the one or more digital filters are operable to:

receive a digital audio signal comprising data indicative of sound pressure over an audible frequency range;

alter a frequency response of the digital audio signal in accordance with the equalisation frequency response to generate an adjusted output digital audio signal.

Preferably the one or more digital filters comprise one or more digital equalisation filter functions operable to alter the frequency response of the received audio signal in accordance with the equalisation frequency response.

In some embodiments the one or more digital equalisation filter functions are pre-programmed with the equalisation frequency response.

In alternative embodiments the one or more digital equalisation filter functions are programmable with the equalisation frequency response via retrieval of the equalisation frequency response from a computer readable medium that is associated with the equaliser. The computer readable medium may be local to the equaliser or remotely located in a separate device.

Preferably the audio tuning system further comprises:

an analogue-to-digital (ADC) convertor operatively coupled to an input of the one or more digital filters for converting an input analogue audio signal into a digital audio signal to be received the one or more DSPs; and/or a digital-to-analogue (DAC) convertor operatively coupled to an output of the one or more digital filters for converting the adjusted output digital audio signal into an adjusted analogue audio signal.

In some embodiments the equaliser comprises one or more analogue filters collectively operable to:

receive audio signal(s) for one or more of the output channel(s) indicative of sound over an audible frequency range;

alter a frequency response of the audio signal in accordance with an equalisation frequency response to generate an adjusted output audio signal for one or more of the output channel(s).

Preferably the one or more analogue filters are preconfigured to collectively alter the frequency response of the received audio signal in accordance with the equalisation frequency response.

Preferably the analogue filter(s) comprise a capacitor in series with the electro-acoustic transducer(s) of each output channel. Preferably said capacitor acts as a high pass filter over a mid-range bandwidth. Preferably a lower frequency roll-off starts from between 700 Hz and 2.5 kHz, more preferably from between 900 Hz and 1.5 kHz. Preferably a lower frequency roll-off rate is approximately 6 dB per octave.

Preferably the analogue filter(s) also comprise a resistor in parallel with said capacitor. Preferably the resistor acts to create a low-frequency shelf limiting the high-pass behaviour below a certain frequency. Preferably the transition from the high pass filter behaviour imposed by the capacitor to the shelf imposed by the resistor occurs from between 100 Hz and 500 Hz, more preferably between 150 Hz and 400 Hz. Preferably the overall drop in level down to the low frequency shelf is at least 3 dB, more preferably at least 4 dB, and most preferably is at least 5 dB.

In some embodiments the audio tuning system further comprises a phase improvement module operatively coupled to the electro-acoustic transducer(s) of one or more of the output channel(s), and wherein the phase improvement module is configured to receive input audio signal(s) and generate phase adjusted output audio signals for each respective output audio channel.

Preferably the equalisation frequency response of the equaliser for each output audio channel is based on a predetermined frequency response of the phase improvement module.

In some embodiments the equaliser comprises the phase improvement module.

In some embodiments the phase improvement module is operatively coupled to the equaliser.

In some embodiments the audio tuning system may further comprise a high-pass filter operatively coupled between the output of the equaliser and the input of the phase improvement module.

Preferably the phase improvement module is configured to adjust a phase of an input audio signal within a first frequency band below a fundamental resonance frequency of the associated electro-acoustic transducer(s). Preferably the first frequency band corresponds to a stiffness-controlled region of operation of the associated electro-acoustic transducer(s). Preferably the phase of the adjusted output audio signal in the first frequency band is substantially the same or similar or at least relatively closer compared to the input signal, to a phase of the input audio signal at a second frequency band that is above a fundamental resonance frequency of the associated electro-acoustic transducer(s). Preferably the second frequency band corresponds to a mass-controlled region of operation of the associated electro-acoustic transducer.

Preferably the phase improvement module is configured to adjust a phase of an input audio signal at a third frequency or frequency band that is substantially similar to or overlaps with a fundamental resonance frequency of the associated electro-acoustic transducer(s). Preferably the third frequency or third frequency band corresponds to a damping controlled region of the associated electro-acoustic transducer(s). Preferably the phase of the adjusted output audio signal in the third frequency or frequency band is substantially the same or similar, or at least relatively closer compared to the input signal, to the phase of the input audio signal at the second frequency band.

In some embodiments the phase improvement module comprises at least one integrator that is operable to adjust a phase of an input audio signal by integrating the input audio signal. Preferably the phase improvement module comprises a first integrator configured to receive an input audio signal and generate an integrated audio signal. Preferably the phase improvement module further comprises a second integrator operably coupled in series to the first integrator to receive the integrated audio signal and generate double-integrated audio signal.

Preferably one or more of the first and second integrators comprises a low-pass filter, implemented in analogue or digital circuitry.

Preferably each integrator is a voltage integrator.

Preferably one of more of the first and second integrators further comprises a high pass filter. Each high pass filter may comprise a cut-off frequency below 20 Hz, e.g. within approximately 5-15 Hz.

Preferably the phase improvement module further comprises at least one audio mixer associated with each series of first and second integrators, wherein each audio mixer is configured to receive any combination of two or more of: the input audio signal received by the first integrator, the integrated audio signal and the double-integrated audio signal and combine the received signals to generate an output phase improved audio signal.

Preferably the audio mixer is configured to combine the input audio signal received by the first integrator, the integrated audio signal and the double-integrated audio signal to generate the output phase improved audio signal.

Preferably the audio mixer is configured to add the received signals.

Preferably the audio mixer is configured to scale each of the received signals in accordance with predetermined characteristics of a respective output audio channel of the audio system.

Preferably the predetermined characteristics comprise mass-spring-damper characteristics of the respective output audio channel.

Preferably the mass-spring-damper characteristics include one or more of:

- a coefficient value, m, indicative of a combined moving mass of a diaphragm assembly and air load of the respective output audio channel;
- a coefficient value, c, indicative of a combined damping acting on the diaphragm assembly due to mechanical, electrical and/or acoustical sources;
- a coefficient value, k, indicative of a combined stiffness acting on the diaphragm assembly due to mechanical and/or acoustical sources; and/or
- a coefficient value, E, indicative of a total responsiveness of the audio system.

Preferably the mixer is configured to scale the received signals and generate the phase improved output signal in accordance with the following formula:

$$V=E(m\ddot{x}+c\dot{x}+kx)$$

wherein:

- V is a value indicative of a voltage of the phase improved output signal;
- x is a value indicative of the double-integrated signal;
- $\dot{x}$ is a value indicative of integrated signal; and
- $\ddot{x}$ is a value indicative of input audio signal received by the first integrator.

Preferably the predetermined characteristics further comprise maximum operational thresholds of an associated output audio channel, including maximum operational voltage threshold of the electro-acoustic transducer, or maximum operational current threshold of the electro-acoustic transducer, or maximum diaphragm displacement threshold of the electro-acoustic transducer, or maximum output of the amplifier, or any combination thereof.

In some embodiments the phase improvement module is implemented in digital circuitry. Preferably each integrator comprises digital filters. Preferably each audio mixer comprises a digital mixer. In some embodiments the phase improvement module is implemented in a digital signal processor. Preferably the phase improvement module and the associated equaliser are implemented in a common digital signal processor.

In some embodiments the phase improvement module is implemented in analogue circuitry. Each integrator may comprise analogue filters. Each audio mixer may be an analogue audio mixer.

In some embodiments the audio tuning system further comprises a bass optimisation module configured to optimise the bass of received audio signals for one or more of the output audio channel(s).

In some embodiments the bass optimisation module comprises the phase improvement module and/or is operatively coupled to the phase improvement module.

Preferably the bass optimisation module is configured to receive input audio signals and adjust a lower cut-off frequency of a frequency response of the audio system based on one or more predetermined characteristics of an associated output audio channel of the personal audio device.

Preferably the one or more predetermined characteristics comprise one or more operating parameter thresholds. The operating parameter thresholds may include any combination of one or more of: a maximum operating voltage threshold of the electro-acoustic transducer(s) of the associated output audio channel and/or a maximum operational current threshold of the electro-acoustic transducer(s) of the associated output audio channel and/or a maximum diaphragm displacement threshold of the electro-acoustic transducer(s) of the associated output audio channel and/or a maximum output of an amplifier of the associated output audio channel.

Preferably the bass optimisation module is configured to compare a value or values of one or more operating parameters of the associated output audio channel with the corresponding operating parameter threshold or thresholds and adjust a lower cut-off frequency of the audio system frequency response for the associated output audio channel accordingly.

Preferably the bass optimisation module is configured to:

- determine from the input audio signal one or more values of one or more operating parameters of the associated output audio channel;
- compare the value(s) of the operating parameter(s) to the corresponding operating parameter(s) threshold criteria; and
- adjust a lower cut-off frequency of the audio system frequency response in accordance with the comparison.

In some embodiments the bass optimisation module is configured to:

- determine from the input audio signal at least one value indicative of a maximum diaphragm displacement that is or would be exhibited by the electro-acoustic transducer(s) of a respective output audio channel(s) when subjected to the input audio signal, wherein each maximum diaphragm displacement value is associated with a particular lower cut-off frequency of the audio system frequency response;
- compare each maximum displacement value to a predetermined maximum diaphragm displacement threshold for the respective output audio channel(s); and
- adjust the lower cut-off frequency of the audio system frequency response according to the comparison to ensure the maximum diaphragm displacement of the electro-acoustic transducer(s) of the respective output audio channel(s) is at or below the predetermined maximum diaphragm displacement threshold.

In some embodiments the bass optimisation module is configured to adjust the lower cut-off frequency of the audio system frequency response for respective output audio channel(s) to correspond to the lower cut-off frequency that is associated with the diaphragm displacement value that is at or below the predetermined maximum diaphragm displacement threshold.

Preferably the bass optimisation module is configured to:

- determine from the input audio signal multiple values of a maximum diaphragm displacement, wherein each maximum diaphragm displacement value is associated with a different lower cut-off frequency of the audio system frequency response;
- compare each maximum displacement value to a predetermined maximum diaphragm displacement threshold; and
- adjust the lower cut-off frequency of the audio system frequency response based on the lower cut-off frequency associated with the maximum diaphragm displacement value that is at or lower than the threshold.

In some embodiments the bass optimisation module is configured to determine a value indicative of diaphragm displacement from a mathematical model of the audio system behaviour. Preferably diaphragm moving mass (optionally including any air load), total diaphragm stiffness (in situ) and total diaphragm damping (in situ), or at least variables related to such, are included in the model. Preferably such determination happens in advance of an output voltage being passed to an amplifier in order that the bass level may be adjusted gradually to reduce or eliminate audibility.

In some embodiments instigation of audio playback causes the device to immediately play a signal with reduced bass. Subsequently, determination of a value indicative of diaphragm displacement and/or maximum voltage and/or maximum current proceeds ahead of playback, at which point the system may be able to predict that it is safe to increase bass levels.

In some embodiments the bass optimisation module is configured to determine a value indicative of diaphragm displacement from the input audio signal by subjecting the audio signal to at least one integrator. Preferably the input audio signal is subjected to a double-integrator. Preferably each integrator comprises a low pass filter. Each integrator may also comprise a high pass filter.

In some embodiments the bass optimisation module is configured to adjust the lower cut-off frequency by selecting one of two or more pre-integration high-pass filters to subject the input audio signal, wherein each pre-integration high pass filter has a different lower cut-off frequency. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter.

In some embodiments the bass optimisation module comprises multiple audio streams to which the input audio signal is subjected to, each audio stream having a pre-integration high pass filter of a different lower cut-off frequency, and wherein the bass optimisation module is configured to adjust a lower cut-off frequency of the input audio signal frequency response by selecting a filtered output audio signal from one of the multiple audio streams based on a value indicative of diaphragm displacement associated with the filtered output audio signal of each audio stream. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter. In some embodiments the bass optimisation module further comprise a cross-fader configured to cross-fade between the audio streams during adjustment of the lower cut-off frequency of the input audio signal.

In some embodiments the bass optimisation module may adjust the lower cut-off frequency by adjusting the lower cut-off frequency of an adjustable pre-integration high pass filter to which the input audio signal is subjected. Preferably the pre-integration high pass filter is a finite impulse response filter. Preferably the pre-integration high pass filter is a linear phase filter.

In some embodiments the bass optimisation module is configured to:

determine from the input audio signal at least one value indicative of a maximum voltage or maximum current that is or would be applied to the associated electro-acoustic transducer, wherein each maximum voltage or maximum current value is associated with a particular lower cut-off frequency of the audio system frequency response;

compare each maximum voltage or maximum current value to a predetermined maximum electro-acoustic transducer voltage or current threshold; and adjust the lower cut-off frequency of the input audio system frequency response according to the comparison to ensure the maximum electro-acoustic transducer voltage or current is at or below the predetermined maximum voltage or current threshold.

In some embodiments each bass optimisation module is configured to adjust the lower cut-off frequency of the audio system frequency response to correspond to the lower cut-off frequency that is associated with the maximum voltage or current value that is at or below the predetermined maximum electro-acoustic transducer voltage or current threshold.

Preferably the bass optimisation module is configured to:

determine from the input audio signal multiple values of a maximum electro-acoustic transducer voltage or current, wherein each maximum voltage or current value is associated with a different lower cut-off frequency of the audio system frequency response;

compare each maximum voltage or current value to a predetermined maximum voltage or current threshold; and adjust the lower cut-off frequency of the audio system frequency response based on the lower cut-off frequency associated with the maximum voltage or current value that is at or lower than the threshold.

In some embodiments the bass optimisation module is configured to determine a value indicative of maximum electro-acoustic transducer voltage or current from the input audio signal by subjecting the audio signal to at least one integrator. Preferably the input audio signal is subjected to a first and second integrator in series. Preferably each integrator comprises a low pass filter. Each integrator may also comprise a high pass filter.

Preferably the bass optimisation module further comprises at least one audio mixer associated with each series of first and second integrators, wherein each audio mixer is configured to receive any combination of two or more of: the input audio signal received by the first integrator, the integrated audio signal and the double-integrated audio signal and combine the received signals to generate an output audio signal for determining one or more of values indicative of maximum electro-acoustic transducer voltage or current that would be applied to the electro-acoustic transducer(s) of the respective output audio channel.

Preferably the audio mixer is configured to combine the input audio signal received by the first integrator, the integrated audio signal and the double-integrated audio signal to generate the output audio signal.

Preferably the audio mixer is configured to add the received signals.

Preferably the audio mixer is configured to scale each of the received signals in accordance with predetermined characteristics of an associated output audio channel of the audio system.

Preferably the predetermined characteristics are mass-spring-damper characteristics of the associated output audio channel(s).

Preferably the mass-spring-damper characteristics include one or more of:

a coefficient value, m, indicative of a combined moving mass of a diaphragm assembly and air load of the associated output audio channel(s);

a coefficient value, c, indicative of a combined damping acting on the diaphragm assembly due to mechanical, electrical and/or acoustical sources;

a coefficient value, k, indicative of a combined stiffness acting on the diaphragm assembly due to mechanical and/or acoustical sources; and/or a coefficient value, E, indicative of a total responsiveness of the audio system.

Preferably the mixer is configured to scale the received signals and generate the output signal in accordance with the following formula:

$$V=E(m\ddot{x}+c\dot{x}+kx)$$

wherein:

V is a value indicative of a voltage of the phase improved output signal;

x is a value indicative of the double-integrated signal;

$\dot{x}$ is a value indicative of integrated signal; and $\ddot{x}$ is a value indicative of input audio signal received by the first integrator.

Preferably the maximum voltage or current value is determined from V.

In some embodiments the bass optimisation module is configured to adjust the lower cut-off frequency by selecting one of two or more pre-integration high-pass filters to subject the input audio signal, wherein each pre-integration high pass filter has a different lower cut-off frequency. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter.

In some embodiments the bass optimisation module comprises multiple audio streams to which the input audio signal is subjected to, each audio stream having a pre-integration high pass filter of a different lower cut-off frequency, and wherein the bass optimisation module is configured to adjust a lower cut-off frequency of the input audio signal frequency response by selecting a filtered output audio signal from one of the multiple audio streams based on a value indicative of maximum electro-acoustic transducer voltage or current associated with the filtered output audio signal of each audio stream. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter. In some embodiments the bass optimisation module further comprise a cross-fader configured to cross-fade between the audio streams during adjustment of the lower cut-off frequency of the input audio signal.

In some embodiments the bass optimisation module may adjust the lower cut-off frequency by adjusting the lower cut-off frequency of an adjustable pre-integration high pass filter to which the input audio signal is subjected. Preferably the pre-integration high pass filter is a finite impulse response filter. Preferably each pre-integration high pass filter is a linear phase filter.

In some embodiments the bass optimisation module is configured to:

determine from the input audio signal at least one value indicative of a maximum amplifier output that is or would be applied to the respective output channel(s), wherein each maximum amplifier output value is associated with a particular lower cut-off frequency of the audio system frequency response;

compare each maximum amplifier output value to a predetermined maximum amplifier output value; and adjust the lower cut-off frequency of the input audio system frequency response according to the comparison to ensure the maximum amplifier output is at or below the predetermined maximum amplifier threshold.

In some embodiments each bass optimisation module is configured to adjust the lower cut-off frequency of the audio system frequency response to correspond to the lower cut-off frequency that is associated with the maximum amplifier output that is at or below the predetermined maximum amplifier output threshold.

Preferably the bass optimisation module is configured to:

determine from the input audio signal multiple values of a maximum amplifier output, wherein each maximum amplifier output value is associated with a different lower cut-off frequency of the audio system frequency response;

compare each maximum amplifier output value to a predetermined maximum amplifier output threshold; and adjust the lower cut-off frequency of the audio system frequency response based on the lower cut-off frequency associated with the maximum amplifier output value that is at or lower than the threshold.

In some embodiments the bass optimisation module is configured to determine a value indicative of maximum amplifier output from the input audio signal by subjecting the audio signal to at least one integrator. Preferably the input audio signal is subjected to a first and second integrator in series. Preferably each integrator comprises a low pass filter. Each integrator may also comprise a high pass filter.

Preferably the bass optimisation module further comprises at least one audio mixer associated with each series of first and second integrators, wherein each audio mixer is configured to receive any combination of two or more of: the input audio signal received by the first integrator, the integrated audio signal and the double-integrated audio signal and combine the received signals to generate an output audio signal for determining one or more of values indicative of maximum amplifier output that would be applied the respective output audio channel(s).

Preferably the audio mixer is configured to combine the input audio signal received by the first integrator, the integrated audio signal and the double-integrated audio signal to generate the output audio signal.

Preferably the audio mixer is configured to add the received signals.

Preferably the audio mixer is configured to scale each of the received signals in accordance with predetermined characteristics of an associated output audio channel of the audio system.

Preferably the predetermined characteristics are mass-spring-damper characteristics of the associated output audio channel(s).

In some embodiments the equaliser may comprise the bass optimisation module.

In some embodiments, an input of the bass optimisation module is operatively coupled to an output of the equaliser.

In some embodiments the bass optimisation module is implemented in digital circuitry. Preferably each integrator comprises digital filters. Preferably each audio mixer comprises a digital mixer. Preferably each pre-integration high pass filter is a digital high pass filter. In some embodiments one or more of the adaptive lower cut-off frequency circuits is/are implement in a digital signal processor. Preferably one or more of the adaptive lower cut-off frequency circuits and the associated equaliser is/are implemented in a common digital signal processor.

In some embodiments one or more of the adaptive lower cut-off frequency circuits is/are implemented in analogue circuitry.

In some embodiments the system further comprises one or more adaptive volume control module, each configured to:

receive a signal indicative of a value of an operating parameter of an associated output audio channel;

compare the value of the operating parameter to one or more predetermined threshold criteria; and adjust a received audio signal to generate a volume adjusted output signal if the value of the operating parameter is not in accordance with the one or more predetermined threshold criteria.

Preferably the operating parameter is a diaphragm displacement parameter of one or more associated electro-acoustic transducer(s) of the respective output audio channel.

Preferably the predetermined threshold criteria comprises a maximum diaphragm displacement threshold. Preferably the maximum diaphragm displacement threshold is stored in electronic memory accessible by the one or more adaptive volume control module. The memory may be on board the personal audio device or alternatively it may be externally stored, for example within an audio source device and/or a remote server.

In some embodiments the signal indicative of the value of the diaphragm displacement parameter is a signal obtained from a displacement sensor associated with the diaphragm of the associated electro-acoustic transducer of the respective output audio channel.

In some embodiments the signal indicative of the value of the diaphragm displacement parameter is obtained from a voltage sensor, or a current sensor, or both located at an input of the associated electro-acoustic transducer. Preferably the adaptive volume control module is configured to determine or predict the value of the operating parameter from an output of the voltage or current sensor, or from both outputs.

In some embodiments the adaptive volume control module is implemented in a digital signal processor. Preferably the one or more predetermined threshold criteria are stored in electronic memory of the digital signal processor.

In some embodiments the adaptive volume control module is configured to determine a value indicative of diaphragm displacement from a mathematical model of the audio system behaviour. Preferably diaphragm moving mass (optionally including any air load), total diaphragm stiffness (in situ) and total diaphragm damping (in situ), or at least variables related to such, are included in the model. Preferably such determination happens in advance of an output voltage being passed to an amplifier in order that the bass level may be adjusted gradually to reduce or eliminate audibility.

In some embodiments instigation of audio playback causes the device to immediately play a signal with reduced volume. Subsequently, determination a value indicative of diaphragm displacement and/or maximum voltage and/or maximum current proceeds ahead of playback, at which point the system may be able to predict that it is safe to increase volume levels.

In some embodiments the system further comprises a volume adjustment circuit operatively coupled to a user input device, wherein the volume adjustment circuit is configured to adjust a magnitude of an input audio signal in accordance with a signal indicative of user input from the user input device.

The volume adjustment circuit may be implemented in digital or analogue circuitry.

Preferably the volume adjustment circuit is implemented in a digital signal processor. Preferably an output of the volume adjustment circuit is operatively coupled to an input of the one or more equalisers.

In some embodiments the audio tuning system comprises a digital signal processor having implemented therein any combination of one or more of: the equaliser, the phase improvement module, the bass optimisation module and/or the volume adjustment module.

In some embodiments the digital signal processor is located in one of the housings of the personal audio device.

In some embodiments the digital signal processor is located in a separate housing to the housings of the output audio channel(s).

In other embodiments the digital signal processor is located in an audio source device configured for use with the personal audio device. Preferably each output audio channel is configured to operatively couple the audio source device. The audio source device may be any one of a mobile phone, a portable music player, a tablet computer, a laptop, a desktop computer and the like. The audio source device may be operatively coupled to each of output audio channel(s) via cable or wirelessly via any suitable communications protocol that is well-known in the art, such as Bluetooth™, Wi-Fi and/or Near Field Communication (NFC) for example.

In some embodiments the equaliser is implemented in an audio source device, comprising:

a processing component; and electronic readable memory having stored therein a software program that is configured to:

obtain data indicative of characteristics associated with the output audio channel(s) of a personal audio device;

determine from the output audio channel characteristics data an equalisation frequency response for the equaliser.

In some embodiments the electro-acoustic transducer characteristics data is obtained from a local memory component. In other embodiments the data is obtained from a remote memory component, for example from the personal audio device or from a remote server.

In some embodiments the software is further configured to receive identification data associated with the personal audio device and obtain the characteristics data using the identification data.

In some embodiments the electro-acoustic transducer characteristics data includes data indicative of a frequency response of the electro-acoustic transducer(s) of the respective output audio channel(s).

In some embodiments the software is further configured to subject the electro-acoustic transducer(s) of the respective output audio channel(s) to an audio signal and determine various characteristics of the output audio channel(s) accordingly. For example, the software may be further configured to receive an output signal from an acousto-electric transducer closely associated with the electro-acoustic transducer(s) of the respective output audio channel(s), said output signal being indicative of:

the frequency response of the output audio channel;

a coefficient value, m, indicative of a combined moving mass of a diaphragm assembly and air load of the output audio channel;

a coefficient value, c, indicative of a combined damping acting on the diaphragm assembly due to mechanical, electrical and/or acoustical sources;

a coefficient value, k, indicative of a combined stiffness acting on the diaphragm assembly due to mechanical and/or acoustical sources; and/or a coefficient value, E, indicative of a total responsiveness of the audio system;

maximum operational thresholds of the electro-acoustic transducer including maximum diaphragm displacement threshold; and/or non-linear behaviour(s) of the transducer.

In some embodiments the software is further configured to obtain additional data relating to any one or more of: a bass boost frequency response, a phase improvement module frequency response, and/or a bass optimisation module frequency response; and determine from the additional data in combination with the output audio channel characteristics data the equalisation frequency response for the equaliser.

The additional data may be indicative of mass-spring-damper characteristics of an output audio channel or channels, including one or more of:

a coefficient value, m, indicative of a combined moving mass of a diaphragm assembly and air load of the output audio channel(s);

a coefficient value, c, indicative of a combined damping acting on the diaphragm assembly due to mechanical, electrical and/or acoustical sources;

a coefficient value, k, indicative of a combined stiffness acting on the diaphragm assembly due to mechanical and/or acoustical sources;

a coefficient value, E, indicative of a total responsiveness of the audio system; and/or coefficient(s) describing non-linearity(ies) of the audio system.

The additional data may further comprise maximum operational thresholds, including maximum operational voltage threshold of the electro-acoustic transducer, or maximum diaphragm displacement threshold of the electro-acoustic transducer, or both.

The additional data may be obtained from a local memory component or remotely from the personal audio device or a remote server for example, optionally utilizing identification data associated with the personal audio device.

Alternatively the additional data may be obtained by subjecting the associated output audio channel(s) to one or more audio signals, receiving one or more output signals and determining from the output system the mass-spring-damper characteristics of the output audio channel(s).

In some embodiments the software is further configured to operate any one or more of:

an equaliser of the audio source device or the personal audio device using the determined equalisation frequency response;

a phase improvement module of the audio source device or the personal audio device using the additional data indicative of mass-spring-damper characteristics of associated output audio channel(s); and/or frequency bass optimisation module of the audio source device or the personal audio device using the additional data indicative of mass-spring-damper characteristics of associated output audio channel(s).

In some embodiments, each output channel further comprises one or more amplifiers, each amplifier being operatively coupled between an output of the equaliser and/or phase improvement module and/or bass optimisation module and an input of the one or more associated electro-acoustic transducers.

In some embodiments one or more of the electro-acoustic transducers comprise a moveable diaphragm and an excitation mechanism configured to act on the diaphragm to move the diaphragm in use in response to an electronic audio signal to generate sound pressure. Preferably the excitation mechanism comprises an electrically conducting coil that is rigidly attached to the diaphragm and a magnetic element or structure that generates a magnetic field and wherein the electrically conducting component is located in the magnetic field in situ to move within the magnetic field during operation. Preferably the electrically conducting component comprises a coil.

Preferably actuation is provided by a moving coil that operates in a magnetic field. Preferably the magnetic field is provided by a permanent magnet.

Preferably there is a magnet or magnetic pole piece face on one side of the coil winding and another, having opposite magnetic polarity on an opposite side of the coil winding.

In some embodiments one or more of the electro-acoustic transducers of the personal audio device comprises a fundamental diaphragm resonant frequency of at least approximately 100 Hz in situ, more preferably at least approximately 110 Hz, and even more preferably at least approximately 120 Hz.

In some embodiments one or more of the electro-acoustic transducers is/are linear action transducers comprising a linearly reciprocating diaphragm.

In some embodiments one or more of the electro-acoustic transducers comprise a substantially rigid diaphragm. Preferably the diaphragm remains rigid during operation over the electro-acoustic transducers frequency range of operation and/or substantially over the audible frequency. Preferably the diaphragm comprises a body that is formed from a material having specific modulus greater than approximately 8 MPa/(kg/m$^3$). More preferably the specific modulus of the material is greater than approximately 20 MPa/(kg/m$^3$). For example, the diaphragm may consist of an aluminium, titanium and/or beryllium body.

In some embodiments one or more of the electro-acoustic transducers comprise a diaphragm having a body formed from a substantially flexible material, for example having a specific modulus less than 4 MPa/(kg/m$^3$). Preferably the diaphragm further comprises a coating formed from a substantially rigid material, for example having a specific modulus greater than approximately 20 MPa/(kg/m$^3$). Preferably the coating is less than half the thickness of the diaphragm body, at least over most of the area involved in flexing to facilitate diaphragm motion.

In some embodiments the personal audio device may further comprise a grille adjacent a major face of a diaphragm of one or more of the electro-acoustic transducers, and wherein the transducer is coupled to the grille via a transducer suspension system (i.e. it is decoupled), the transducer suspension system being configured to at least partially alleviate mechanical transmission of vibration between the diaphragm and the grille. Preferably the transducer suspension system flexibly mounts the diaphragm to the grille and housing to at least partially alleviate mechanical transmission of vibration between the diaphragm and the grille. Preferably the diaphragm suspension system substantially eliminates or at least reduces mechanical transmission of vibration between the diaphragm and the grille.

In some embodiment the suspension system comprises a flexible and/or resilient element coupled between the diaphragm and the grille. Preferably the element is made from silicone rubber or natural rubber. Alternatively the element is formed from metal springs.

In some embodiments one or more of the electro-acoustic transducers comprise a diaphragm having a major face that is moveable during operation to generate sound pressure and a grille adjacent the major face of the diaphragm, and wherein the transducer is rigidly coupled to the grille and the transducer and grille assembly is coupled to the associated housing via the suspension system to at least partially alleviate mechanical transmission of vibration between the transducer/grille assembly and the housing. Preferably the suspension system flexibly mounts the transducer/grille assembly to the housing to at least partially alleviate mechanical transmission of vibration between the grille and the housing. Preferably the suspension system substantially eliminates mechanical transmission of vibration between the transducer/grille assembly and the housing.

In some embodiment the suspension system comprises a flexible and/or resilient element coupled between the housing and the grille. Preferably the element is made from silicone rubber or natural rubber. Alternatively the element is formed from metal springs.

In some embodiments the personal audio device may further comprise a grille adjacent a major face of a diaphragm of one or more of the electro-acoustic transducers, and wherein the grille is rigidly coupled to a transducer base structure of the electro-acoustic transducer. Preferably the grille comprises a material having specific modulus greater than approximately 8 MPa/(kg/m$^3$). More preferably the grille comprises a material having specific modulus greater than approximately 20 MPa/(kg/m$^3$). For example, the grille may be formed from an aluminium or stainless steel or fibre reinforced plastic.

Preferably a thickness of the grille is greater than approximately 10% of a shortest distance across the diaphragm.

In some embodiments the grille is substantially thick. For example, the thickness of the grille is more than approximately 8% of a greatest dimension (such as the maximum diameter), or more preferably more than approximately 10% of the greatest dimension.

In some embodiments one or more of the electro-acoustic transducers is/are rotational action transducers comprising a rotatable diaphragm. Preferably the electro-acoustic transducer comprises a hinge system for rotatably coupling a diaphragm of the transducer to a transducer base structure of the transducer.

In some embodiments a diaphragm of one or more of the electro-acoustic transducers comprises one or more peripheral regions that are free from physical connection with an interior of the housing.

Preferably the one or more peripheral regions that are free from physical connection with the interior of the housing constitute at least 20% of a length or perimeter of an outer periphery of the diaphragm.

Preferably the one or more peripheral regions constitute approximately an entire length or perimeter of an outer periphery of the diaphragm.

In some embodiments the one or more peripheral regions of the diaphragm that are free from physical connection with an interior of the housing are supported by a fluid.

Preferably the fluid is a ferromagnetic fluid. Preferably the ferromagnetic fluid seals against or is in direct contact with the one or more peripheral regions supported by ferromagnetic fluid such that it substantially prevents the flow of air therebetween and/or provides significant support to the diaphragm in one or more directions parallel to the coronal plane.

In some embodiments the one or more peripheral regions of the diaphragm are separated from the interior of the housing by a relatively small air gap.

In some embodiments the housing associated with each output audio channel comprises at least one fluid passage from a first cavity on one side of the diaphragm to a second cavity located on an opposing side of the device to the first cavity, or from the first cavity to a volume of air external to the device, or both.

Preferably at least one fluid passage provides a substantially restrictive fluid passage for substantially restricting the flow of gases therethrough, in situ and during operation.

Preferably the interface device comprises a first fluid passage extending between a first front cavity on a side of the diaphragm configured to locate adjacent the user's ear in use, and a second rear cavity on an opposing side of the diaphragm.

Preferably the interface device comprises a fluid passage from the first front cavity to an external volume of air.

Preferably at least one fluid passage comprises multiple apertures of a diameter that is less than approximately 0.5 mm.

Preferably the diameter of the apertures is less than approximately 0.03 mm.

Preferably the fluid passages are distributed across a distance greater than a shortest distance across a major face of the diaphragm.

In some embodiments the personal audio device is a headphone comprising:

- a first headphone output audio channel including a housing configured to couple about a user's ear and at least one transducer located within the housing; and
- a second headphone output audio channel including a housing configured to couple about the user's other ear and at least one transducer located within the housing.

In some embodiments the personal audio device is an earphone comprising:

- a first earphone output audio channel including a housing configured to locate inside a user's ear and at least one transducer located within the housing; and
- a second earphone output audio channel including a housing configured to locate inside the user's other ear and at least one transducer located within the housing.

In some embodiments the personal audio device is a hearing aid device comprising:

- a first hearing aid output audio channel including a housing configured to locate inside a user's ear and at least one transducer located within the housing; and
- a second hearing output audio channel including a housing configured to locate inside the user's other ear and at least one transducer located within the housing.

In some embodiments the personal audio device is a mobile phone comprising one or more output audio channels.

In another aspect, the present invention broadly consists in a personal audio device configured to be located within approximately 10 centimetres of a user's ears in use, the personal audio device comprising:

- at least one output audio channel having:
  - at least one housing;
  - at least one electro-acoustic transducer that is operable to convert an input audio signal into sound pressure, each electro-acoustic transducer being located with a housing and coupled thereto via at least one suspension system, wherein the suspension system flexibly couples the electro-acoustic transducer to the housing to at least partially alleviate mechanical transmission of vibration between the electro-acoustic transducer and the housing; and an audio tuning system configured to operatively couple the output audio channel(s) of the personal audio device and to optimise input audio signals for the output audio channel(s), the audio tuning system comprising an equaliser configured to receive input audio signals for the output channel(s) and alter a balance between frequency components of the input audio signals to generate equalised output signals for the output audio channel(s).

In another aspect, the present invention broadly consists in a headphone device comprising:

a pair of output audio channels, each comprising;

a headphone interface including a housing configured to couple about a user's ear; and at least one electro-acoustic transducer that is operable to convert an input audio signal into sound, each electro-acoustic transducer being located with a housing and coupled thereto via a suspension system, wherein the suspension system flexibly couples the electro-acoustic transducer to the housing to at least partially alleviate mechanical transmission of vibration between the electro-acoustic transducer and the housing; and an audio tuning system configured to operatively couple the pair of output audio channels and to optimise input audio signals for the output audio channels, the audio tuning system comprising an equaliser configured to receive input audio signals and alter a balance between frequency components of the input audio signals to generate equalised output signals for the output audio channels.

In some embodiments the headphone device further comprises a headband coupled between the pair of output audio channels.

Preferably the equaliser comprises an equalisation frequency response. In some embodiments the equaliser comprises a common equalisation frequency response for both output audio channels. In other embodiments the equaliser comprises a unique equalisation frequency response for each output audio channel.

In another aspect, the present invention broadly consists in an earphone device comprising:

a pair of output audio channels, each comprising;

an earphone interface including a housing configured to couple within a user's ear; and at least one electro-acoustic transducer that is operable to convert an input audio signal into sound, each electro-acoustic transducer being located with a housing and coupled thereto via a suspension system, wherein the suspension system flexibly couples the electro-acoustic transducer to the housing to at least partially alleviate mechanical transmission of vibration between the electro-acoustic transducer and the housing; and an audio tuning system configured to operatively couple the pair of output audio channels and to optimise input audio signals for the output audio channels, the audio tuning system comprising an equaliser configured to receive input audio signals and alter a balance between frequency components of the input audio signals to generate equalised output signals for the output audio channels.

In another aspect, the present invention broadly consists in a hearing aid device comprising:

at least one output audio channel comprising;

a hearing aid interface having a housing configured to couple within a user's ear; and at least one electro-acoustic transducer that is operable to convert an input audio signal into sound, each electro-acoustic transducer being located with a housing and coupled thereto via a suspension system, wherein the suspension system flexibly couples the electro-acoustic transducer to the housing to at least partially alleviate mechanical transmission of vibration between the electro-acoustic transducer and the housing; and an audio tuning system configured to operatively couple the output audio channel(s) and to optimise input audio signals for the output audio channel(s), the audio tuning system comprising an equaliser configured to receive input audio signals for the output channel(s) and alter a balance between frequency components of the input audio signals to generate equalised output signals for the output audio channel(s).

In another aspect, the present invention broadly consists in a mobile phone device comprising at least one output audio channel having:

at least one electro-acoustic transducer that is operable to convert an input audio signal into sound pressure, each electro-acoustic transducer being located with a housing of the mobile phone device and coupled thereto a suspension system, wherein the suspension system flexibly couples the electro-acoustic transducer to the housing to at least partially alleviate mechanical transmission of vibration between the electro-acoustic transducer and the housing; and an audio tuning system configured to operatively couple the output audio channel(s) and to optimise input audio signals for the output audio channel(s), the audio tuning system comprising an equaliser configured to receive input audio signals for the output channel(s) and alter a balance between frequency components of the input audio signals to generate equalised output signals for the output audio channel(s).

In another aspect the invention may broadly be said to consist of a method for operating a personal audio device configured to be located within approximately 10 centimetres of a user's ears in use, the personal audio device having:

at least one output audio channel comprising of:

a housing; and at least one electro-acoustic transducer that is operable to convert an input audio signal into sound, each electro-acoustic transducer being located with a housing and coupled thereto via a suspension system, wherein the suspension system flexibly couples the electro-acoustic transducer to the housing to at least partially alleviate mechanical transmission of vibration between the electro-acoustic transducer and the housing; and wherein the method comprises:

receiving input audio signal(s) from an audio source for one or more of the output audio channel(s);

altering the frequency response of the received input audio signal(s) to generate an equalised output audio signal for the respective output audio channel(s); and operating the at least one electro-acoustic transducer of the output audio channel(s) in accordance with the equalised output audio signal.

Preferably the step of altering the frequency response of the received audio signal(s) for each respective output audio channel comprises subjecting the input audio signal to an equaliser having an equalisation frequency response.

In some embodiments the method further comprises generating an equalisation frequency response for one or more output audio channel(s) and storing the equalisation frequency response in electronic memory associated with the equaliser.

Preferably the step of generating an equalisation frequency response comprises obtaining data indicative of characteristics of the associated output audio channel(s) and generating the equalisation frequency response in accordance with the characteristics data.

Preferably the characteristics data includes data indicative of a frequency response of the electro-acoustic transducer(s) of the respective output audio channel(s).

In some embodiments the method comprises obtaining characteristics data from a memory component on-board the personal audio device. In other embodiments the data is obtained from a memory component separate to the personal audio device, for example from an audio source device or from a remote server.

In some embodiments the method further comprises receiving identification data associated with the personal audio device and obtaining the characteristics data using the identification data.

In some embodiments the step of obtaining the characteristics data comprises subjecting the one or more of the output audio channel(s) to an audio signal and determining the frequency response of each associated electro-acoustic transducer of the respective output audio channel(s) accordingly. For example, the method may further comprise the step of receiving an output signal from an acousto-electric transducer closely associated with the electro-acoustic transducer(s), and determining from the output signal the frequency response of the electro-acoustic transducer(s).

In some embodiments the step of generating an equalisation frequency response for a respective output audio channel(s) further comprises obtaining additional data relating to any one or more of: a bass boost frequency response, a phase improvement module frequency response, and/or a bass optimisation module frequency response; and determining from the additional data in combination with the characteristics data the equalisation frequency response for the output audio channel.

The additional data may be indicative of mass-spring-damper characteristics of the output audio channel, including one or more of:

- a coefficient value, m, indicative of a combined moving mass of a diaphragm assembly and air load of the associated output audio channel;
- a coefficient value, c, indicative of a combined damping acting on the diaphragm assembly due to mechanical, electrical and/or acoustical sources;
- a coefficient value, k, indicative of a combined stiffness acting on the diaphragm assembly due to mechanical and/or acoustical sources;
- a coefficient value, E, indicative of a total responsiveness of the audio system; and/or
- coefficient(s) describing non-linearity(ies) of the audio system.

The data may further comprise maximum operational thresholds associated with the respective output audio channel(s) including maximum operational voltage threshold of the one or more electro-acoustic transducer(s), maximum operational current threshold of the electro-acoustic transducer(s), maximum amplifier output, or maximum diaphragm displacement threshold of the electro-acoustic transducer(s), or any combination thereof.

The additional data may be obtained from a memory component located in the personal device, in an audio source device or in a remote server for example. Alternatively the additional data may be obtained by subjecting the associated output audio channel to one or more input audio signals, receiving one or more output audio signals via an acoustic sensor and determining from the output signals the mass-spring-damper characteristics of the output audio channel.

In some embodiments the method further comprises prior to operating the at least one electro-acoustic transducer of the respective output audio channel in accordance with the equalised output audio signal, the step or steps of:

- subjecting the equalised audio signal to a phase improvement module using the additional data indicative of mass-spring-damper characteristics of the output audio channel to adjust the phase of the equalised output audio signal; and/or
- subjecting the equalised audio signal to a bass optimisation module using the additional data indicative of mass-spring-damper characteristics of the output audio channel to adjust the low cut-off frequency of the equalised output audio signal.

In another aspect, the present invention broadly consists in a personal audio device configured to be located within approximately 10 centimetres of a user's ears in use, the personal audio device comprising:

- at least one output audio channel, each comprising:
  - a housing;
  - at least one electro-acoustic transducer that is operable to convert an input audio signal into sound, each electro-acoustic transducer being located with the housing and coupled thereto via a suspension system, wherein the suspension system flexibly couples the electro-acoustic transducer to the housing to at least partially alleviate mechanical transmission of vibration between the electro-acoustic transducer and the housing;
- at least one processor;
- at least one electronic memory component configured to store data indicative of operating characteristics associated with each output audio channel; and
- a communication interface for communicating with an audio source device to receive audio signals for playback through the at least one output audio channel; and wherein the communication interface is further configured to communicate the stored operating characteristics data to the audio source device for calibrating an audio tuning system comprising an equaliser of the audio source device such that the audio signals received by the communication interface are equalised for the respective output audio channel(s).

In some embodiments the operating characteristics comprise a frequency response of each output audio channel.

In some embodiments the operating characteristics comprise mass-spring-damper characteristics of each output audio channel, including one or more of:

- a coefficient value, m, indicative of a combined moving mass of a diaphragm assembly and air load of the respective output audio channel;
- a coefficient value, c, indicative of a combined damping acting on the diaphragm assembly due to mechanical, electrical and/or acoustical sources;

a coefficient value, k, indicative of a combined stiffness acting on the diaphragm assembly due to mechanical and/or acoustical sources;

a coefficient value, E, indicative of a total responsiveness of the audio system; and/or coefficient(s) describing non-linearity(ies) of the audio system.

In some embodiments the operating characteristics alternatively or additional comprise maximum operational thresholds for the one or more output audio channels, including maximum operational voltage or current threshold of the electro-acoustic transducer(s) of the output channel(s), or maximum diaphragm displacement threshold of the electro-acoustic transducer(s) of the output channel(s), or maximum amplifier output for the output channel(s), or any combination thereof.

In some embodiments the stored data indicative of operating characteristics may be an identification code associated with the personal audio device and wherein the communication interface is configured to transmit the identification code to a remote device to acquire the operating characteristics of the personal audio device. The remote device may be the audio source device or a remote server. The obtained operating characteristics may be stored in the memory component of the personal audio device or on the audio source device.

In some embodiments calibration of the equaliser results in an equalisation frequency response for each output audio channel.

In some embodiments the equalisation frequency response is based on the operating characteristics of the respective output audio channel(s). Preferably the equalisation frequency response is further based on a diffuse field frequency response.

Preferably the equalisation frequency response comprises an increasing magnitude from approximately 400 Hz to approximately 2000 Hz. Preferably the equalisation frequency response comprises a higher average magnitude across a treble frequency range relative to mid-level and/or bass frequency ranges.

Preferably the diffuse field frequency response comprises:

a substantially continuously increasing magnitude from approximately 0 dB at approximately 100 Hz to approximately 15 dB at approximately 2500 Hz; and a substantially uniform magnitude from approximately 2500 Hz to approximately 3200 Hz; and a substantially decreasing magnitude from approximately 15 db at approximately 3200 Hz to approximately 7 dB at approximately 10 kHz.

In some embodiments the received audio signals are further subjected to a bass boost frequency response, a phase improvement module frequency response, and/or a bass optimisation module frequency response prior to reception.

Preferably the bass boost frequency response comprises an increased magnitude, of the entire audio system, over a bass frequency band of approximately 20 Hz to 200 Hz relative to a diffuse field frequency response magnitude over the bass frequency band.

Preferably the bass optimisation module frequency response is based on the audio signal to be received and the operating characteristics. Preferably a lower cut-off frequency of a frequency response of a respective output audio channel is based on the operating characteristics of the output audio channel. Preferably the operating characteristics comprise one or more operating parameter thresholds. The operating parameter thresholds may include any combination of one or more of: a maximum operating voltage and/or current threshold of associated electro-acoustic transducer(s) of the output audio channel and/or maximum amplifier output of the output audio channel, and/or a maximum diaphragm displacement threshold of the associated electro-acoustic transducer(s) of the output audio channel.

In some embodiments one or more of the electro-acoustic transducers comprise a moveable diaphragm and an excitation mechanism configured to act on the diaphragm to move the diaphragm in use in response to an electronic audio signal to generate sound pressure. Preferably the excitation mechanism comprises an electrically conducting coil that is rigidly attached to the diaphragm and a magnetic element or structure that generates a magnetic field and wherein the electrically conducting component is located in the magnetic field in situ to move within the magnetic field during operation. Preferably the electrically conducting component comprises a coil.

Preferably actuation is provided by a moving coil that operates in a magnetic field. Preferably the magnetic field is provided by a permanent magnet.

Preferably there is a magnet or magnetic pole piece face on one side of the coil winding and another, having opposite magnetic polarity on an opposite side of the coil winding.

In some embodiments one or more of the electro-acoustic transducers of the personal audio device comprises a fundamental diaphragm resonant frequency of at least approximately 100 Hz in situ, more preferably at least approximately 110 Hz, and even more preferably at least approximately 120 Hz.

In some embodiments one or more of the electro-acoustic transducers is/are linear action transducers comprising a linearly reciprocating diaphragm.

In some embodiments one or more of the electro-acoustic transducers comprise a substantially rigid diaphragm. Preferably the diaphragm remains rigid during operation over the electro-acoustic transducers frequency range of operation and/or substantially over the audible frequency. Preferably the diaphragm comprises a body that is formed from a material having specific modulus greater than approximately 8 MPa/(kg/m$^3$). More preferably the specific modulus of the material is greater than approximately 20 MPa/(kg/m$^3$). For example, the diaphragm may consist of an aluminium, titanium and/or beryllium body.

In some embodiments one or more of the electro-acoustic transducers comprise a diaphragm having a body formed from a substantially flexible material, for example having a specific modulus less than 4 MPa/(kg/m$^3$). Preferably the diaphragm further comprises a coating formed from a substantially rigid material, for example having a specific modulus greater than approximately 20 MPa/(kg/m$^3$). Preferably the coating is less than half the thickness of the diaphragm body, at least over most of the area involved in flexing to facilitate diaphragm motion.

In some embodiments the personal audio device may further comprise a grille adjacent a major face of a diaphragm of one or more of the electro-acoustic transducers, and wherein the transducer is coupled to the grille via a transducer suspension system (i.e. it is decoupled), the transducer suspension system being configured to at least partially alleviate mechanical transmission of vibration between the diaphragm and the grille. Preferably the transducer suspension system flexibly mounts the diaphragm to the grille and housing to at least partially alleviate mechanical transmission of vibration between the diaphragm and the grille. Preferably the diaphragm suspension system substantially eliminates or at least reduces mechanical transmission of vibration between the diaphragm and the grille.

In some embodiment the suspension system comprises a flexible and/or resilient element coupled between the diaphragm and the grille. Preferably the element is made from silicone rubber or natural rubber. Alternatively the element is formed from metal springs.

In some embodiments one or more of the electro-acoustic transducers comprise a diaphragm having a major face that is moveable during operation to generate sound pressure and a grille adjacent the major face of the diaphragm, and wherein the transducer is rigidly coupled to the grille and the transducer and grille assembly is coupled to the associated housing via the suspension system to at least partially alleviate mechanical transmission of vibration between the transducer/grille assembly and the housing. Preferably the suspension system flexibly mounts the transducer/grille assembly to the housing to at least partially alleviate mechanical transmission of vibration between the grille and the housing. Preferably the suspension system substantially eliminates mechanical transmission of vibration between the transducer/grille assembly and the housing.

In some embodiment the suspension system comprises a flexible and/or resilient element coupled between the housing and the grille. Preferably the element is made from silicone rubber or natural rubber. Alternatively the element is formed from metal springs.

In some embodiments the personal audio device may further comprise a grille adjacent a major face of a diaphragm of one or more of the electro-acoustic transducers, and wherein the grille is rigidly coupled to a transducer base structure of the electro-acoustic transducer. Preferably the grille comprises a material having specific modulus greater than approximately 8 MPa/(kg/m$^3$). More preferably the grille comprises a material having specific modulus greater than approximately 20 MPa/(kg/m$^3$). For example, the grille may be formed from an aluminium or stainless steel or fibre reinforced plastic.

Preferably a thickness of the grille is greater than approximately 10% of a shortest distance across the diaphragm.

In some embodiments the grille is substantially thick. For example, the thickness of the grille is more than approximately 8% of a greatest dimension (such as the maximum diameter), or more preferably more than approximately 10% of the greatest dimension.

In some embodiments one or more of the electro-acoustic transducers is/are rotational action transducers comprising a rotatable diaphragm. Preferably the electro-acoustic transducer comprises a hinge system for rotatably coupling a diaphragm of the transducer to a transducer base structure of the transducer.

In some embodiments a diaphragm of one or more of the electro-acoustic transducers comprises one or more peripheral regions that are free from physical connection with an interior of the housing.

Preferably the one or more peripheral regions that are free from physical connection with the interior of the housing constitute at least 20% of a length or perimeter of an outer periphery of the diaphragm.

Preferably the one or more peripheral regions constitute approximately an entire length or perimeter of an outer periphery of the diaphragm.

In some embodiments the one or more peripheral regions of the diaphragm that are free from physical connection with an interior of the housing are supported by a fluid.

Preferably the fluid is a ferromagnetic fluid. Preferably the ferromagnetic fluid seals against or is in direct contact with the one or more peripheral regions supported by ferromagnetic fluid such that it substantially prevents the flow of air therebetween and/or provides significant support to the diaphragm in one or more directions parallel to the coronal plane.

In some embodiments the one or more peripheral regions of the diaphragm are separated from the interior of the housing by a relatively small air gap.

In another aspect, the present invention broadly consists in an audio system comprising:

- a personal audio device for use in a personal audio application where the device is intended to be located within approximately 10 centimetres of a user's ears in use, the audio device having:
  - at least one output audio channel having, each output channel having:
  - a housing; and
    - at least one electro-acoustic transducer associated with the housing that is operable to convert an input audio signal into sound, each electro-acoustic transducer being located within the housing and coupled thereto via a suspension system, wherein the suspension system flexibly couples the electro-acoustic transducer to the housing to at least partially alleviate mechanical transmission of vibration between the electro-acoustic transducer and the housing; and
- an audio tuning system comprising an equaliser associated with each output audio channel, the equaliser being configured to receive audio signal(s) for the respective output audio channel(s) and a balance between frequency components of the input audio signals to generate equalised output signals for the output audio channel(s) using an equalisation frequency response; wherein the equalisation frequency response achieves a frequency response of the audio system that does not comprise a treble reduction of approximately −3 dB from approximately 2000 Hz, relative to a diffuse field target.

Preferably the equalisation frequency response is further based on a diffuse field frequency response in the mid-level frequency range.

Preferably the equalisation frequency response comprises an increasing magnitude from approximately 400 Hz to approximately 2000 Hz. Preferably the equalisation frequency response comprises a higher average magnitude across a treble frequency range relative to mid-level and/or bass frequency ranges.

Preferably the diffuse field frequency response comprises:

- a substantially continuously increasing magnitude from approximately 0 dB at approximately 100 Hz to approximately 15 dB at approximately 2500 Hz; and
- a substantially uniform magnitude from approximately 2500 Hz to approximately 3200 Hz; and
- a substantially decreasing magnitude from approximately 15 db at approximately 3200 Hz to approximately 7 dB at approximately 10 kHz.

In some embodiments the equaliser further comprises a base boost component.

Preferably the bass boost component results in an increased magnitude, of the frequency response of the audio system, over a bass frequency band of approximately 20 Hz to 200 Hz relative to a diffuse field frequency response magnitude over the bass frequency band.

In some embodiments the system further comprises a bass optimisation module.

Preferably the bass optimisation module is configured to receive an input audio signal and adjust a lower cut-off frequency of a frequency response of the audio system based on one or more predetermined characteristics of the respective output audio channel(s) of the personal audio device.

In some embodiments the operating characteristics alternatively or additional comprise maximum operational thresholds for the one or more output audio channels, including maximum operational voltage or current threshold of the electro-acoustic transducer(s) of the output channel(s), or maximum diaphragm displacement threshold of the electro-acoustic transducer(s) of the output channel(s), or maximum amplifier output for the output channel(s), or any combination thereof.

Preferably the bass optimisation module is configured to compare a value or values of one or more operating parameters of the associated output audio channel with the corresponding operating parameter threshold or thresholds and adjust a lower cut-off frequency of the audio system frequency response accordingly.

In some embodiments one or more of the electro-acoustic transducers comprise a moveable diaphragm and an excitation mechanism configured to act on the diaphragm to move the diaphragm in use in response to an electronic audio signal to generate sound pressure. Preferably the excitation mechanism comprises an electrically conducting coil that is rigidly attached to the diaphragm and a magnetic element or structure that generates a magnetic field and wherein the electrically conducting component is located in the magnetic field in situ to move within the magnetic field during operation. Preferably the electrically conducting component comprises a coil.

Preferably actuation is provided by a moving coil that operates in a magnetic field. Preferably the magnetic field is provided by a permanent magnet.

Preferably there is a magnet or magnetic pole piece face on one side of the coil winding and another, having opposite magnetic polarity on an opposite side of the coil winding.

In some embodiments one or more of the electro-acoustic transducers of the personal audio device comprises a fundamental diaphragm resonant frequency of at least approximately 100 Hz in situ, more preferably at least approximately 110 Hz, and even more preferably at least approximately 120 Hz.

In some embodiments one or more of the electro-acoustic transducers is/are linear action transducers comprising a linearly reciprocating diaphragm.

In some embodiments one or more of the electro-acoustic transducers comprise a substantially rigid diaphragm. Preferably the diaphragm remains rigid during operation over the electro-acoustic transducers frequency range of operation and/or substantially over the audible frequency. Preferably the diaphragm comprises a body that is formed from a material having specific modulus greater than approximately 8 MPa/(kg/m$^3$). More preferably the specific modulus of the material is greater than approximately 20 MPa/(kg/m$^3$). For example, the diaphragm may consist of an aluminium, titanium and/or beryllium body.

In some embodiments one or more of the electro-acoustic transducers comprise a diaphragm having a body formed from a substantially flexible material, for example having a specific modulus less than 4 MPa/(kg/m$^3$). Preferably the diaphragm further comprises a coating formed from a substantially rigid material, for example having a specific modulus greater than approximately 20 MPa/(kg/m$^3$). Preferably the coating is less than half the thickness of the diaphragm body, at least over most of the area involved in flexing to facilitate diaphragm motion.

In some embodiments the personal audio device may further comprise a grille adjacent a major face of a diaphragm of one or more of the electro-acoustic transducers, and wherein the transducer is coupled to the grille via a transducer suspension system (i.e. it is decoupled), the transducer suspension system being configured to at least partially alleviate mechanical transmission of vibration between the diaphragm and the grille. Preferably the transducer suspension system flexibly mounts the diaphragm to the grille and housing to at least partially alleviate mechanical transmission of vibration between the diaphragm and the grille. Preferably the diaphragm suspension system substantially eliminates or at least reduces mechanical transmission of vibration between the diaphragm and the grille.

In some embodiment the suspension system comprises a flexible and/or resilient element coupled between the diaphragm and the grille. Preferably the element is made from silicone rubber or natural rubber. Alternatively the element is formed from metal springs.

In some embodiments one or more of the electro-acoustic transducers comprise a diaphragm having a major face that is moveable during operation to generate sound pressure and a grille adjacent the major face of the diaphragm, and wherein the transducer is rigidly coupled to the grille and the transducer and grille assembly is coupled to the associated housing via the suspension system to at least partially alleviate mechanical transmission of vibration between the transducer/grille assembly and the housing. Preferably the suspension system flexibly mounts the transducer/grille assembly to the housing to at least partially alleviate mechanical transmission of vibration between the grille and the housing. Preferably the suspension system substantially eliminates mechanical transmission of vibration between the transducer/grille assembly and the housing.

In some embodiment the suspension system comprises a flexible and/or resilient element coupled between the housing and the grille. Preferably the element is made from silicone rubber or natural rubber. Alternatively the element is formed from metal springs.

In some embodiments the personal audio device may further comprise a grille adjacent a major face of a diaphragm of one or more of the electro-acoustic transducers, and wherein the grille is rigidly coupled to a transducer base structure of the electro-acoustic transducer. Preferably the grille comprises a material having specific modulus greater than approximately 8 MPa/(kg/m$^3$). More preferably the grille comprises a material having specific modulus greater than approximately 20 MPa/(kg/m$^3$). For example, the grille may be formed from an aluminium or stainless steel or fibre reinforced plastic.

Preferably a thickness of the grille is greater than approximately 10% of a shortest distance across the diaphragm.

In some embodiments the grille is substantially thick. For example, the thickness of the grille is more than approximately 8% of a greatest dimension (such as the maximum diameter), or more preferably more than approximately 10% of the greatest dimension.

In some embodiments one or more of the electro-acoustic transducers is/are rotational action transducers comprising a rotatable diaphragm. Preferably the electro-acoustic transducer comprises a hinge system for rotatably coupling a diaphragm of the transducer to a transducer base structure of the transducer.

In some embodiments a diaphragm of one or more of the electro-acoustic transducers comprises one or more peripheral regions that are free from physical connection with an interior of the housing.

Preferably the one or more peripheral regions that are free from physical connection with the interior of the housing constitute at least 20% of a length or perimeter of an outer periphery of the diaphragm.

Preferably the one or more peripheral regions constitute approximately an entire length or perimeter of an outer periphery of the diaphragm.

In some embodiments the one or more peripheral regions of the diaphragm that are free from physical connection with an interior of the housing are supported by a fluid.

Preferably the fluid is a ferromagnetic fluid. Preferably the ferromagnetic fluid seals against or is in direct contact with the one or more peripheral regions supported by ferromagnetic fluid such that it substantially prevents the flow of air therebetween and/or provides significant support to the diaphragm in one or more directions parallel to the coronal plane.

In some embodiments the one or more peripheral regions of the diaphragm are separated from the interior of the housing by a relatively small air gap.

In another aspect, the present invention broadly consists in a headphone device comprising:

a pair of output audio channels, each comprising;

a headphone interface including a housing configured to couple about a user's ear; and at least one electro-acoustic transducer that is operable to convert an input audio signal into sound, each electro-acoustic transducer being located with a housing and coupled thereto via a suspension system, wherein the suspension system flexibly couples the electro-acoustic transducer to the housing to at least partially alleviate mechanical transmission of vibration between the electro-acoustic transducer and the housing; and an audio tuning system configured to operatively couple the pair of output audio channels and to optimise input audio signals for the output audio channels, the audio tuning system comprising:

an equaliser configured to receive input audio signals and alter a balance between frequency components of the input audio signals to generate equalised output signals for the output audio channels; and a bass optimisation module configured to receive input audio signal(s) and adjust a lower cut-off frequency of a frequency response of the audio system based on the input audio signal(s) and one or more predetermined characteristics of one or both of the output audio channel(s) of the personal audio device.

In some embodiments the operating characteristics alternatively or additional comprise maximum operational thresholds for the one or more output audio channels, including maximum operational voltage or current threshold of the electro-acoustic transducer(s) of the output channel(s), or maximum diaphragm displacement threshold of the electro-acoustic transducer(s) of the output channel(s), or maximum amplifier output for the output channel(s), or any combination thereof.

Preferably the bass optimisation module is configured to compare a value or values of one or more operating parameters of the associated output audio channel with the corresponding operating parameter threshold or thresholds and adjust a lower cut-off frequency of the audio system frequency response accordingly.

Preferably the equaliser comprises an equalisation frequency response. In some embodiments the equaliser comprises a common equalisation frequency response for both output audio channels. In other embodiments the equaliser comprises a unique equalisation frequency response for each output audio channel.

In another aspect, the present invention broadly consists in a personal audio device intended to be located within approximately 10 centimetres of a user's ears in use, the audio device comprising:

at least one output audio channel, each channel having:

a housing; and at least one electro-acoustic transducer within the housing that is operable to convert an input audio signal into sound, each electro-acoustic transducer being mounted within the housing via a suspension system, wherein the suspension system flexibly mounts the electro-acoustic transducer relative to the housing to at least partially alleviate mechanical transmission of vibration between the electro-acoustic transducer and the housing during operation; and wherein the personal audio device is intended for use with an audio tuning system configured to operatively couple the output audio channel(s) of the personal audio device and to optimise input audio signals for the output audio channel(s), the audio tuning system comprising an equaliser configured to receive input audio signals for the output channel(s) and alter a balance between frequency components of the input audio signals to generate equalised output signals for the output audio channel(s).

Preferably the equaliser is configured to alter a frequency response of the audio system in accordance with an equalisation frequency response.

Preferably the equaliser comprises an equalisation frequency response for each of the output audio channels. There may be a single equalisation frequency response for all output audio channel(s) or multiple equalisation frequency response(s) for multiple output audio channel(s).

In some embodiments the equalisation frequency response for each output channel is based on a diffuse field frequency response.

In some embodiments the equalisation frequency response is determined from a diffuse field frequency response comprising:

a substantially continuously increasing magnitude from approximately 0 dB at approximately 100 Hz to approximately 15 dB at approximately 2500 Hz; and a substantially uniform magnitude from approximately 2500 Hz to approximately 3200 Hz; and a substantially decreasing magnitude from approximately 15 db at approximately 3200 Hz to approximately 7 dB at approximately 10 kHz.

Preferably the magnitude between approximately 100 Hz and approximately 2500 Hz comprises a substantially curved profile, e.g. an approximately increasing gradient from 100 Hz to 2500 Hz.

Preferably the magnitude between approximately 3200 Hz and 10 kHz comprises a substantially stepped profile.

In some embodiments the equalisation frequency response is determined from a diffuse field frequency response comprising:

an average magnitude over a frequency range of approximately 2 kHz to approximately 6 kHz that is approximately 8-12 dB higher than an average magnitude over a frequency range of approximately 300 kHz to approximately 1000 Hz; and an average magnitude over a frequency range of approximately 6 kHz to approximately 14 kHz that is approximately 3-6 dB higher than an average magnitude over a frequency range of approximately 300 Hz to approximately 1000 Hz.

Preferably the equalisation frequency response comprises an increasing magnitude from approximately 400 Hz to approximately 2000 Hz. The increase magnitude may have an approximately increasing gradient from approximately 400 Hz to approximately 2000 Hz. Preferably the equalisation frequency response comprises a higher average magnitude across a treble frequency range relative to mid-level and/or bass frequency ranges.

Preferably the equalisation frequency response is configured to alter the frequency response of the audio system such that the frequency response of the audio system comprises a profile of varying magnitude over frequency that is shaped approximately 1 dB less compared to a diffuse field frequency response profile within a frequency band of 6 kHz and 14 kHz.

Preferably the frequency response of the audio system is a frequency response observed at the output of the one or more electro-acoustic audio transducers of each output audio channel.

Preferably the equalisation frequency response is configured to alter the frequency response of the audio system such that the frequency response of the audio system comprises a profile of varying magnitude over frequency that is within approximately 3 dB of the average response of the diffuse field frequency response profile shape, over the frequency band of approximately 6 kHz to approximately 14 kHz. More preferably the frequency response of the audio system to be within approximately 2 dB of the average response of the diffuse field frequency response profile shape, over the frequency band of 6 kHz to approximately 14 kHz.

Preferably the equalisation frequency response is configured to alter the frequency response of the audio system such that the frequency response of the audio system comprises an average magnitude over the frequency range of approximately 6 kHz to approximately 14 kHz that is approximately 1-7 dB greater than an average magnitude over a reference range of approximately 300 Hz to approximately 1000 Hz. More preferably the frequency response of the audio system comprises an average magnitude over the frequency range of approximately 6 kHz to approximately 14 kHz that is approximately 2-5 dB greater than the average magnitude over a reference frequency range of approximately 300 Hz to 1000 Hz. Most preferably the frequency response of the audio system comprises an average magnitude over the frequency range of approximately 6 kHz to approximately 14 kHz that is 3-4 dB greater than the average magnitude over the reference frequency range of approximately 300 Hz to approximately 1000 Hz.

Preferably the equalisation frequency response is configured to alter the frequency response of the audio system such that the frequency response of the audio system comprises a profile of varying magnitude over frequency that is shaped approximately 1 dB less compared to a diffuse field frequency response profile within a frequency band of 2 kHz to 6 kHz.

Preferably the equalisation frequency response is configured to alter the frequency response of the audio system such that the frequency response of the audio system comprises a profile of varying magnitude over frequency that is within approximately 3 dB of the average response of the diffuse field frequency response profile shape, over the frequency band of approximately 2 kHz to approximately 6 kHz. More preferably the frequency response of the audio system to be within approximately 2 dB of the average response of the diffuse field frequency response profile shape, over the frequency band of 2 kHz to approximately 6 kHz.

In some embodiments the predetermined equalisation frequency response causes the frequency response of the audio system to have an average magnitude over the frequency range of approximately 2 khz to approximately 6 kHz that is 7-12 dB greater than the average level over a reference frequency range of approximately 300 Hz to approximately 1000 Hz. More preferably the predetermined equalisation causes the frequency response of the audio system to have an average magnitude over the frequency range of approximately 2 kHz to approximately 6 kHz that is 8-11 dB greater than the average level over a reference frequency range of approximately 300 Hz to approximately 1000 Hz. Most preferably the predetermined equalisation causes the frequency response of the audio system to have an average magnitude over the frequency range of approximately 2 kHz to approximately 6 kHz that is 9-10 dB greater than the average level over a reference range 300-1000 Hz.

In some embodiments, the equaliser comprises an adjustable frequency response, and wherein a default frequency response is in accordance with any one of the above preferably statements and embodiments. The equaliser may be adjustable via an equalisation settings module of the audio tuning system. Preferably the equalisation settings module is configured to receive data indicative of one or more equalisation setting parameters, adjust parameter settings of the equaliser in accordance with the received data.

In another aspect the present invention broadly consists in an equaliser configured for use with a personal audio device intended to be located within approximately 10 centimetres of a user's ears in use, the equaliser being operable to:

receive an input audio signal from an audio source;

alter the frequency response of the audio system by subjecting the input audio signal to an equalisation frequency response to generate an equalised output audio signal; and output an equalised output audio signal to one or more channels of the personal audio device; wherein the equalisation frequency response alters the audio system frequency response to approximate a diffuse field frequency response and wherein the equalisation frequency response is based on characteristics of a personal audio device having one or more output audio channels and each channel having: a housing and at least one electro-acoustic transducer that is operable to convert an input audio signal into sound, each electro-acoustic transducer being located with a housing and coupled thereto via at least one suspension system, wherein the suspension system flexibly couples the electro-acoustic transducer to the housing to at least partially alleviate mechanical transmission of vibration between the electro-acoustic transducer and the housing.

In some embodiments the equaliser is implemented in a digital signal processing device. In other embodiments the equaliser is implemented in software that is stored in electronic memory of and executable by a processing device.

A computer readable medium having a computer executable modules of an audio tuning system stored therein, the audio tuning system being configured for use with a personal audio device configured to be located within approximately 10 centimetres of a user's ear in use, the modules comprising and equaliser being operable to:

receive an input audio signal from an audio source;

alter the frequency response of the audio system by subjecting the input audio signal to an equalisation frequency response to generate an equalised output audio signal; and output an equalised output audio signal to one or more channels of the personal audio device; wherein the equalisation frequency response alters the audio system frequency response to approximate a diffuse field frequency response and wherein the equalisation frequency response is based on characteristics of a personal audio device having one or more output audio channels and each channel having: a housing and at least one electro-acoustic transducer that is operable to convert an input audio signal into sound, each electro-acoustic transducer being located with a housing and coupled thereto via at least one suspension system, wherein the suspension system flexibly couples the electro-acoustic transducer to the housing to at least partially alleviate mechanical transmission of vibration between the electro-acoustic transducer and the housing.

In another aspect, the present invention broadly consists in a personal audio device intended to be located within approximately 10 centimetres of a user's ears in use, the audio device comprising:

at least one output audio channel, each channel having:

a housing; and at least one electro-acoustic transducer within the housing that is operable to convert an input audio signal into sound, each electro-acoustic transducer being mounted within the housing via a suspension system, wherein the suspension system flexibly mounts the electro-acoustic transducer relative to the housing to at least partially alleviate mechanical transmission of vibration between the electro-acoustic transducer and the housing during operation; at least one electronic memory component configured to store data indicative of operating characteristics associated with each output channel of the personal audio device; and an equaliser associated with each output channel configured to equalise a frequency response of a the audio device based on operating characteristics associated with the respective output channel(s); and a second equaliser associated with each output channel configured to alter a frequency response of a received audio signal.

In some embodiments the operating characteristics comprise a frequency response of each output audio channel.

In some embodiments the operating characteristics comprise mass-spring-damper characteristics of each output audio channel, including one or more of:

a coefficient value, m, indicative of a combined moving mass of a diaphragm assembly and air load of the respective output audio channel;

a coefficient value, c, indicative of a combined damping acting on the diaphragm assembly due to mechanical, electrical and/or acoustical sources;

a coefficient value, k, indicative of a combined stiffness acting on the diaphragm assembly due to mechanical and/or acoustical sources;

a coefficient value, E, indicative of a total responsiveness of the audio system; and/or coefficient(s) describing non-linearity(ies) of the audio system.

In some embodiments the equalisation frequency response of the second equaliser is based on a diffuse field frequency response.

Preferably the equalisation frequency response comprises an increasing magnitude from approximately 400 Hz to approximately 2000 Hz. Preferably the equalisation frequency response comprises a higher average magnitude across a treble frequency range relative to mid-level and/or bass frequency ranges.

Preferably the diffuse field frequency response comprises:

a substantially continuously increasing magnitude from approximately 0 dB at approximately 100 Hz to approximately 15 dB at approximately 2500 Hz; and a substantially uniform magnitude from approximately 2500 Hz to approximately 3200 Hz; and a substantially decreasing magnitude from approximately 15 db at approximately 3200 Hz to approximately 7 dB at approximately 10 kHz.

In another aspect, the present invention broadly consists in an audio system comprising:

a personal audio device for use in a personal audio application where the device is intended to be located within approximately 10 centimetres of a user's ears in use, the audio device having at least one output audio channel and each output audio channel comprising:

a housing; and at least one electro-acoustic transducer within the housing that is operable to convert an input audio signal into sound, each electro-acoustic transducer having: a diaphragm, and an excitation mechanism configured to act on the diaphragm to move the diaphragm in use in response to an electronic signal to generate sound; wherein the diaphragm of one or more electro-acoustic transducers comprises one or more peripheral regions that are free from physical connection with an interior of the housing; and an audio tuning system configured to operatively couple the output audio channel(s) of the personal audio device and to optimise input audio signals for the output audio channel(s), the audio tuning system comprising an equaliser configured to receive input audio signals for the output channel(s) and alter a balance between frequency components of the input audio signals to generate equalised output signals for the output audio channel(s).

In some embodiments the one or more peripheral regions that are free from physical connection with the interior of the housing constitute at least 20% of a length or perimeter of an outer periphery of the diaphragm.

Preferably the one or more peripheral regions constitute approximately an entire length or perimeter of an outer periphery of the diaphragm.

In some embodiments the one or more peripheral regions of the diaphragm that are free from physical connection with an interior of the housing are supported by a fluid.

Preferably wherein the fluid is a ferromagnetic fluid.

Preferably the ferromagnetic fluid seals against or is in direct contact with the one or more peripheral regions supported by ferromagnetic fluid such that it substantially prevents the flow of air therebetween and/or provides significant support to the diaphragm in one or more directions parallel to the coronal plane.

In some embodiments the one or more peripheral regions of the diaphragm are separated from the interior of the housing by a relatively small air gap.

In some embodiments the audio tuning system is on-board the personal audio device. Preferably the audio tuning system is located on-board are located within the housing of at least one output audio channel. The audio tuning system may be located in the housing of one of the output audio channel(s) only, or it may be located in multiple output audio channels in a personal audio device having multiple output audio channels.

In some embodiments the audio tuning system is on-board a device separate to, but configured to operate with, the personal audio device, such as an audio source device.

In some embodiments the audio system further comprises an audio source device having one or more audio source channels that are configured to operatively couple the output audio channel(s) of the personal audio device, and wherein the audio tuning system is configured to receive the input audio signals from the audio source channel(s). The audio tuning system may be on-board the audio source device.

The audio source device may be any one of a mobile phone, a portable music player, a tablet computer, a laptop, a desktop computer and the like. The audio source channel(s) of the audio source device may be operatively coupled to each of the electro-acoustic transducer(s) of the personal audio device output audio channel(s) via cable or wirelessly via any suitable communications protocol that is well-known in the art, such as Bluetooth™, Wi-Fi and/or Near Field Communication (NFC) for example.

Preferably the equaliser is configured to alter a frequency response of the audio system in accordance with an equalisation frequency response.

Preferably the equaliser comprises an equalisation frequency response for each of the output audio channels. There may be a single equalisation frequency response for all output audio channel(s) or multiple equalisation frequency response(s) for multiple output audio channel(s).

In some embodiments the equalisation frequency response for each output channel is based on a diffuse field frequency response.

In some embodiments the equalisation frequency response is determined from a diffuse field frequency response comprising:

- a substantially continuously increasing magnitude from approximately 0 dB at approximately 100 Hz to approximately 15 dB at approximately 2500 Hz; and
- a substantially uniform magnitude from approximately 2500 Hz to approximately 3200 Hz; and
- a substantially decreasing magnitude from approximately 15 db at approximately 3200 Hz to approximately 7 dB at approximately 10 kHz.

Preferably the magnitude between approximately 100 Hz and approximately 2500 Hz comprises a substantially curved profile, e.g. an approximately increasing gradient from 100 Hz to 2500 Hz.

Preferably the magnitude between approximately 3200 Hz and 10 kHz comprises a substantially stepped profile.

In some embodiments the equalisation frequency response is determined from a diffuse field frequency response comprising:

- a first frequency band between approximately 100 Hz and approximately 400 Hz with a magnitude rising from approximately 0 dB to approximately 2 dB;
- a second frequency band between approximately 400 Hz and approximately 1000 Hz with a magnitude rising from approximately 2 dB to approximately 4.5 dB;
- a third frequency band between approximately 1000 Hz and approximately 2500 Hz with a magnitude rising from approximately 4.5 dB to approximately 15 dB;
- a fourth frequency band between approximately 2500 Hz and 3200 Hz with a substantially uniform magnitude of approximately 15 dB;
- a fifth frequency band between approximately 3200 Hz to 5200 Hz with a magnitude decreasing from approximately 15 dB to approximately 10.5 dB;
- a seventh frequency band between approximately 5200 Hz and 8200 Hz with magnitude decreasing from approximately 10.5 dB to approximately 9 dB; and
- an eight frequency band between approximately 8200 Hz and 14 kHz with a magnitude decreasing from approximately 9 dB to approximately 2 dB.

In some embodiments the equalisation frequency response is determined from a diffuse field frequency response comprising:

- an average magnitude of approximately 2.7 dB over a frequency range of approximately 300 to approximately 1000 Hz;
- an average magnitude of approximately 13.4 dB over a frequency range of approximately 2 kHz to approximately 6 kHz; and
- an average magnitude of approximately 7.3 dB over a frequency range of approximately 6 kHz to approximately 14 kHz.

In some embodiments the equalisation frequency response is determined from a diffuse field frequency response comprising:

- an average magnitude over a frequency range of approximately 2 kHz to approximately 6 kHz that is approximately 8-12 dB higher than an average magnitude over a frequency range of approximately 300 kHz to approximately 1000 Hz; and
- an average magnitude over a frequency range of approximately 6 kHz to approximately 14 kHz that is approximately 3-6 dB higher than an average magnitude over a frequency range of approximately 300 Hz to approximately 1000 Hz.

Preferably the equalisation frequency response comprises an increasing magnitude from approximately 400 Hz to approximately 2000 Hz. The increase magnitude may have an approximately increasing gradient from approximately 400 Hz to approximately 2000 Hz. Preferably the equalisation frequency response comprises a higher average magnitude across a treble frequency range relative to mid-level and/or bass frequency ranges.

Preferably the equalisation frequency response is configured to alter the frequency response of the audio system such that the frequency response of the audio system comprises a profile of varying magnitude over frequency that is shaped approximately 1 dB less compared to a diffuse field frequency response profile within a frequency band of 6 kHz and 14 kHz.

Preferably the frequency response of the audio system is a frequency response observed at the output of the one or more electro-acoustic audio transducers of each output audio channel.

Preferably the equalisation frequency response is configured to alter the frequency response of the audio system such that the frequency response of the audio system comprises a profile of varying magnitude over frequency that is within approximately 3 dB of the average response of the diffuse field frequency response profile shape, over the frequency band of approximately 6 kHz to approximately 14 kHz. More preferably the frequency response of the audio system to be within approximately 2 dB of the average response of the diffuse field frequency response profile shape, over the frequency band of 6 kHz to approximately 14 kHz.

Preferably the equalisation frequency response is configured to alter the frequency response of the audio system such that the frequency response of the audio system comprises an average magnitude over the frequency range of approximately 6 kHz to approximately 14 kHz that is approximately 1-7 dB greater than an average magnitude over a reference range of approximately 300 Hz to approximately 1000 Hz. More preferably the frequency response of the audio system comprises an average magnitude over the frequency range of approximately 6 kHz to approximately 14 kHz that is approximately 2-5 dB greater than the average magnitude over a reference frequency range of approximately 300 Hz to 1000 Hz. Most preferably the frequency response of the audio system comprises an average magnitude over the frequency range of approximately 6 kHz to approximately 14 kHz that is 3-4 dB greater than the average magnitude over the reference frequency range of approximately 300 Hz to approximately 1000 Hz.

Preferably the equalisation frequency response is configured to alter the frequency response of the audio system such that the frequency response of the audio system comprises a profile of varying magnitude over frequency that is shaped approximately 1 dB less compared to a diffuse field frequency response profile within a frequency band of 2 kHz to 6 kHz.

Preferably the equalisation frequency response is configured to alter the frequency response of the audio system such that the frequency response of the audio system comprises a profile of varying magnitude over frequency that is within approximately 3 dB of the average response of the diffuse field frequency response profile shape, over the frequency band of approximately 2 kHz to approximately 6 kHz. More preferably the frequency response of the audio system to be within approximately 2 dB of the average response of the diffuse field frequency response profile shape, over the frequency band of 2 kHz to approximately 6 kHz.

In some embodiments the predetermined equalisation frequency response causes the frequency response of the audio system to have an average magnitude over the frequency range of approximately 2 khz to approximately 6 kHz that is 7-12 dB greater than the average level over a reference frequency range of approximately 300 Hz to approximately 1000 Hz. More preferably the predetermined equalisation causes the frequency response of the audio system to have an average magnitude over the frequency range of approximately 2 kHz to approximately 6 kHz that is 8-11 dB greater than the average level over a reference frequency range of approximately 300 Hz to approximately 1000 Hz. Most preferably the predetermined equalisation causes the frequency response of the audio system to have an average magnitude over the frequency range of approximately 2 kHz to approximately 6 kHz that is 9-10 dB greater than the average level over a reference range 300-1000 Hz.

In some embodiments, the equaliser comprises an adjustable frequency response, and wherein a default frequency response is in accordance with any one of the above preferably statements and embodiments. The equaliser may be adjustable via an equalisation settings module of the audio tuning system. Preferably the equalisation settings module is configured to receive data indicative of one or more equalisation setting parameters, adjust parameter settings of the equaliser in accordance with the received data.

In some embodiments the equalisation frequency response o is configured to adjust the frequency response of the audio system to include a bass boost component. Preferably the bass boost component comprises an increased magnitude over a bass frequency band of approximately 20 Hz to 200 Hz relative to a diffuse field frequency response magnitude over the bass frequency band.

In some embodiments the equalisation frequency response is configured to adjust the audio signal delivered to the associated electro-acoustic transducer such that the frequency response increases the voltage passed into the associated electro-acoustic transducer at low bass frequencies, relative to the voltage over the range of approximately 200 Hz to 400 Hz.

In some embodiments the equalisation frequency response of one or more of the equalisers is based on a predetermined frequency response of a respective output channel including the one or more electro-acoustic transducers associated with the output channel. In some embodiments the equaliser comprises an equalisation frequency response for a single output audio channel. In some embodiments the equaliser comprises a plurality of equalisation frequency response for a plurality of output audio channels of the personal audio device. In some embodiments the equaliser comprises a single equalisation frequency response for a plurality of output audio channels of the personal audio device.

Preferably an equalisation frequency response for the equaliser is predetermined for each output channel based on any combination of one or more of: the diffuse field frequency response, a frequency response of each of the electro-acoustic transducer(s) of the respective output channel and a bass boost component. Preferably the equalisation frequency response for the equaliser is predetermined based on all of these responses.

In some embodiments the equaliser comprises one or more signal processing components. The signal processing components may be digital, analogue or any combination thereof. The signal processing components may comprise one or more filters that are collectively configured to alter the frequency response of the received audio signal in accordance with the equalisation frequency response.

In some embodiments the one or more filters comprise any combination of one or more of the following filter types: passive or active filters; linear or non-linear filters; analogue or digital filters; infinite impulse response or finite impulse response filters; linear phase filters; and/or high-pass, low-pass, band-pass or band-stop filters. In some embodiments the equaliser comprises one or more digital filters. The one or more digital filters may be implemented in one or more processing devices, such as a central processing unit or a digital signal processor (DSP).

Preferably the one or more digital filters are operable to:

receive a digital audio signal comprising data indicative of sound pressure over an audible frequency range;

alter a frequency response of the digital audio signal in accordance with the equalisation frequency response to generate an adjusted output digital audio signal.

Preferably the one or more digital filters comprise one or more digital equalisation filter functions operable to alter the frequency response of the received audio signal in accordance with the equalisation frequency response.

In some embodiments the one or more digital equalisation filter functions are pre-programmed with the equalisation frequency response.

In alternative embodiments the one or more digital equalisation filter functions are programmable with the equalisation frequency response via retrieval of the equalisation frequency response from a computer readable medium that is associated with the equaliser. The computer readable medium may be local to the equaliser or remotely located in a separate device.

Preferably the audio tuning system further comprises:

an analogue-to-digital (ADC) convertor operatively coupled to an input of the one or more digital filters for converting an input analogue audio signal into a digital audio signal to be received the one or more DSPs; and/or a digital-to-analogue (DAC) convertor operatively coupled to an output of the one or more digital filters for converting the adjusted output digital audio signal into an adjusted analogue audio signal.

In some embodiments the equaliser comprises one or more analogue filters collectively operable to:

receive audio signal(s) for one or more of the output channel(s) indicative of sound over an audible frequency range;

alter a frequency response of the audio signal in accordance with an equalisation frequency response to generate an adjusted output audio signal for one or more of the output channel(s).

Preferably the one or more analogue filters are preconfigured to collectively alter the frequency response of the received audio signal in accordance with the equalisation frequency response.

Preferably the analogue filter(s) comprise a capacitor in series with the electro-acoustic transducer(s) of each output channel. Preferably said capacitor acts as a high pass filter over some mid-range bandwidth. Preferably the roll-off starts from between 700 Hz and 2.5 kHz, more preferably from between 900 Hz and 1.5 kHz. Preferably the roll-off rate is approximately 6 dB per octave.

Preferably the analogue filter(s) also comprise a resistor in parallel with said capacitor. Preferably the resistor acts to create a low-frequency shelf limiting the high-pass behaviour below a certain frequency. Preferably the transition from the high pass filter behaviour imposed by the capacitor to the shelf imposed by the resistor occurs from between 100 Hz and 500 Hz, more preferably between 150 Hz and 400 Hz. Preferably the overall drop in level down to the low frequency shelf is at least 3 dB, more preferably at least 4 dB, and most preferably is at least 5 dB.

In some embodiments the audio tuning system further comprises a phase improvement module operatively coupled to the electro-acoustic transducer(s) of one or more of the output channel(s), and wherein the phase improvement module is configured to receive input audio signal(s) and generate phase adjusted output audio signals for each respective output audio channel.

Preferably the equalisation frequency response of the equaliser for each output audio channel is based on a predetermined frequency response of the phase improvement module.

In some embodiments the equaliser comprises the phase improvement module.

In some embodiments the phase improvement module is operatively coupled to the equaliser.

In some embodiments the audio tuning system may further comprise a high-pass filter operatively coupled between the output of the equaliser and the input of the phase improvement module.

Preferably the phase improvement module is configured to adjust a phase of an input audio signal within a first frequency band below a fundamental resonance frequency of the associated electro-acoustic transducer(s). Preferably the first frequency band corresponds to a stiffness-controlled region of operation of the associated electro-acoustic transducer(s). Preferably the phase of the adjusted output audio signal in the first frequency band is substantially the same or similar or at least relatively closer compared to the input signal, to a phase of the input audio signal at a second frequency band that is above a fundamental resonance frequency of the associated electro-acoustic transducer(s). Preferably the second frequency band corresponds to a mass-controlled region of operation of the associated electro-acoustic transducer.

Preferably the phase improvement module is configured to adjust a phase of an input audio signal at a third frequency or frequency band that is substantially similar to or overlaps with a fundamental resonance frequency of the associated electro-acoustic transducer(s). Preferably the third frequency or third frequency band corresponds to a damping controlled region of the associated electro-acoustic transducer(s). Preferably the phase of the adjusted output audio signal in the third frequency or frequency band is substantially the same or similar, or at least relatively closer compared to the input signal, to the phase of the input audio signal at the second frequency band.

In some embodiments the phase improvement module comprises at least one integrator that is operable to adjust a phase of an input audio signal by integrating the input audio signal. Preferably the phase improvement module comprises a first integrator configured to receive an input audio signal and generate an integrated audio signal. Preferably the phase improvement module further comprises a second integrator operably coupled in series to the first integrator to receive the integrated audio signal and generate double-integrated audio signal.

Preferably one or more of the first and second integrators comprises a low-pass filter, implemented in analogue or digital circuitry.

Preferably each integrator is a voltage integrator.

Preferably one of more of the first and second integrators further comprises a high pass filter. Each high pass filter may comprise a cut-off frequency below 20 Hz, e.g. within approximately 5-15 Hz.

Preferably the phase improvement module further comprises at least one audio mixer associated with each series of first and second integrators, wherein each audio mixer is configured to receive any combination of two or more of: the input audio signal received by the first integrator, the integrated audio signal and the double-integrated audio signal and combine the received signals to generate an output phase improved audio signal.

Preferably the audio mixer is configured to combine the input audio signal received by the first integrator, the integrated audio signal and the double-integrated audio signal to generate the output phase improved audio signal.

Preferably the audio mixer is configured to add the received signals.

Preferably the audio mixer is configured to scale each of the received signals in accordance with predetermined characteristics of a respective output audio channel of the audio system.

Preferably the predetermined characteristics comprise mass-spring-damper characteristics of the respective output audio channel.

Preferably the mass-spring-damper characteristics include one or more of:

a coefficient value, m, indicative of a combined moving mass of a diaphragm assembly and air load of the respective output audio channel;

a coefficient value, c, indicative of a combined damping acting on the diaphragm assembly due to mechanical, electrical and/or acoustical sources;

a coefficient value, k, indicative of a combined stiffness acting on the diaphragm assembly due to mechanical and/or acoustical sources; and/or a coefficient value, E, indicative of a total responsiveness of the audio system.

Preferably the mixer is configured to scale the received signals and generate the phase improved output signal in accordance with the following formula:

$$V=E(m\ddot{x}+c\dot{x}+kx)$$

wherein:

V is a value indicative of a voltage of the phase improved output signal;

x is a value indicative of the double-integrated signal;

$\dot{x}$ is a value indicative of integrated signal; and $\ddot{x}$ is a value indicative of input audio signal received by the first integrator.

Preferably the predetermined characteristics further comprise maximum operational thresholds of an associated output audio channel, including maximum operational voltage threshold of the electro-acoustic transducer, or maximum operational current threshold of the electro-acoustic transducer, or maximum diaphragm displacement threshold of the electro-acoustic transducer, or maximum output of the amplifier, or any combination thereof.

In some embodiments the phase improvement module is implemented in digital circuitry. Preferably each integrator comprises digital filters. Preferably each audio mixer comprises a digital mixer. In some embodiments the phase improvement module is implemented in a digital signal processor. Preferably the phase improvement module and the associated equaliser are implemented in a common digital signal processor.

In some embodiments the phase improvement module is implemented in analogue circuitry. Each integrator may comprise analogue filters. Each audio mixer may be an analogue audio mixer.

In some embodiments the audio tuning system further comprises a bass optimisation module configured to optimise the bass of received audio signals for one or more of the output audio channel(s).

In some embodiments the bass optimisation module comprises the phase improvement module and/or is operatively coupled to the phase improvement module.

Preferably the bass optimisation module is configured to receive input audio signals and adjust a lower cut-off frequency of a frequency response of the audio system based on one or more predetermined characteristics of an associated output audio channel of the personal audio device.

Preferably the one or more predetermined characteristics comprise one or more operating parameter thresholds. The operating parameter thresholds may include any combination of one or more of: a maximum operating voltage threshold of the electro-acoustic transducer(s) of the associated output audio channel and/or a maximum operational current threshold of the electro-acoustic transducer(s) of the associated output audio channel and/or a maximum diaphragm displacement threshold of the electro-acoustic transducer(s) of the associated output audio channel and/or a maximum output of an amplifier of the associated output audio channel.

Preferably the bass optimisation module is configured to compare a value or values of one or more operating parameters of the associated output audio channel with the corresponding operating parameter threshold or thresholds and adjust a lower cut-off frequency of the audio system frequency response for the associated output audio channel accordingly.

Preferably the bass optimisation module is configured to:

determine from the input audio signal one or more values of one or more operating parameters of the associated output audio channel;

compare the value(s) of the operating parameter(s) to the corresponding operating parameter(s) threshold criteria; and adjust a lower cut-off frequency of the audio system frequency response in accordance with the comparison.

In some embodiments the bass optimisation module is configured to:

determine from the input audio signal at least one value indicative of a maximum diaphragm displacement that is or would be exhibited by the electro-acoustic transducer(s) of a respective output audio channel(s) when subjected to the input audio signal, wherein each maximum diaphragm displacement value is associated with a particular lower cut-off frequency of the audio system frequency response;

compare each maximum displacement value to a predetermined maximum diaphragm displacement threshold for the respective output audio channel(s); and adjust the lower cut-off frequency of the audio system frequency response according to the comparison to ensure the maximum diaphragm displacement of the electro-acoustic transducer(s) of the respective output audio channel(s) is at or below the predetermined maximum diaphragm displacement threshold.

In some embodiments the bass optimisation module is configured to adjust the lower cut-off frequency of the audio system frequency response for respective output audio channel(s) to correspond to the lower cut-off frequency that is associated with the diaphragm displacement value that is at or below the predetermined maximum diaphragm displacement threshold.

Preferably the bass optimisation module is configured to:

determine from the input audio signal multiple values of a maximum diaphragm displacement, wherein each maximum diaphragm displacement value is associated with a different lower cut-off frequency of the audio system frequency response;

compare each maximum displacement value to a predetermined maximum diaphragm displacement threshold; and adjust the lower cut-off frequency of the audio system frequency response based on the lower cut-off frequency associated with the maximum diaphragm displacement value that is at or lower than the threshold.

In some embodiments the bass optimisation module is configured to determine a value indicative of diaphragm displacement from a mathematical model of the audio system behaviour. Preferably diaphragm moving mass (optionally including any air load), total diaphragm stiffness (in situ) and total diaphragm damping (in situ), or at least variables related to such, are included in the model. Preferably such determination happens in advance of an output voltage being passed to an amplifier in order that the bass level may be adjusted gradually to reduce or eliminate audibility.

In some embodiments instigation of audio playback causes the device to immediately play a signal with reduced bass. Subsequently, determination of a value indicative of diaphragm displacement and/or maximum voltage and/or maximum current proceeds ahead of playback, at which point the system may be able to predict that it is safe to increase bass levels.

In some embodiments the bass optimisation module is configured to determine a value indicative of diaphragm displacement from the input audio signal by subjecting the audio signal to at least one integrator. Preferably the input audio signal is subjected to a double-integrator. Preferably each integrator comprises a low pass filter. Each integrator may also comprise a high pass filter.

In some embodiments the bass optimisation module is configured to adjust the lower cut-off frequency by selecting one of two or more pre-integration high-pass filters to subject the input audio signal, wherein each pre-integration high pass filter has a different lower cut-off frequency. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter.

In some embodiments the bass optimisation module comprises multiple audio streams to which the input audio signal is subjected to, each audio stream having a pre-integration high pass filter of a different lower cut-off frequency, and wherein the bass optimisation module is configured to adjust a lower cut-off frequency of the input audio signal frequency response by selecting a filtered output audio signal from one of the multiple audio streams based on a value indicative of diaphragm displacement associated with the filtered output audio signal of each audio stream. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter. In some embodiments the bass optimisation module further comprise a cross-fader configured to cross-fade between the audio streams during adjustment of the lower cut-off frequency of the input audio signal.

In some embodiments the bass optimisation module may adjust the lower cut-off frequency by adjusting the lower cut-off frequency of an adjustable pre-integration high pass filter to which the input audio signal is subjected. Preferably the pre-integration high pass filter is a finite impulse response filter. Preferably the pre-integration high pass filter is a linear phase filter.

In some embodiments the bass optimisation module is configured to:

- determine from the input audio signal at least one value indicative of a maximum voltage or maximum current that is or would be applied to the associated electro-acoustic transducer, wherein each maximum voltage or maximum current value is associated with a particular lower cut-off frequency of the audio system frequency response;
- compare each maximum voltage or maximum current value to a predetermined maximum electro-acoustic transducer voltage or current threshold; and
- adjust the lower cut-off frequency of the input audio system frequency response according to the comparison to ensure the maximum electro-acoustic transducer voltage or current is at or below the predetermined maximum voltage or current threshold.

In some embodiments each bass optimisation module is configured to adjust the lower cut-off frequency of the audio system frequency response to correspond to the lower cut-off frequency that is associated with the maximum voltage or current value that is at or below the predetermined maximum electro-acoustic transducer voltage or current threshold.

Preferably the bass optimisation module is configured to:

- determine from the input audio signal multiple values of a maximum electro-acoustic transducer voltage or current, wherein each maximum voltage or current value is associated with a different lower cut-off frequency of the audio system frequency response;
- compare each maximum voltage or current value to a predetermined maximum voltage or current threshold; and
- adjust the lower cut-off frequency of the audio system frequency response based on the lower cut-off frequency associated with the maximum voltage or current value that is at or lower than the threshold.

In some embodiments the bass optimisation module is configured to determine a value indicative of maximum electro-acoustic transducer voltage or current from the input audio signal by subjecting the audio signal to at least one integrator. Preferably the input audio signal is subjected to a first and second integrator in series. Preferably each integrator comprises a low pass filter. Each integrator may also comprise a high pass filter.

Preferably the bass optimisation module further comprises at least one audio mixer associated with each series of first and second integrators, wherein each audio mixer is configured to receive any combination of two or more of: the input audio signal received by the first integrator, the integrated audio signal and the double-integrated audio signal and combine the received signals to generate an output audio signal for determining one or more of values indicative of maximum electro-acoustic transducer voltage or current that would be applied to the electro-acoustic transducer(s) of the respective output audio channel.

Preferably the audio mixer is configured to combine the input audio signal received by the first integrator, the integrated audio signal and the double-integrated audio signal to generate the output audio signal.

Preferably the audio mixer is configured to add the received signals.

Preferably the audio mixer is configured to scale each of the received signals in accordance with predetermined characteristics of an associated output audio channel of the audio system.

Preferably the predetermined characteristics are mass-spring-damper characteristics of the associated output audio channel(s).

Preferably the mass-spring-damper characteristics include one or more of:

- a coefficient value, m, indicative of a combined moving mass of a diaphragm assembly and air load of the associated output audio channel(s);
- a coefficient value, c, indicative of a combined damping acting on the diaphragm assembly due to mechanical, electrical and/or acoustical sources;
- a coefficient value, k, indicative of a combined stiffness acting on the diaphragm assembly due to mechanical and/or acoustical sources; and/or
- a coefficient value, E, indicative of a total responsiveness of the audio system.

Preferably the mixer is configured to scale the received signals and generate the output signal in accordance with the following formula:

$$V=E(m\ddot{x}+c\dot{x}+kx)$$

wherein:

V is a value indicative of a voltage of the phase improved output signal;

x is a value indicative of the double-integrated signal;

$\dot{x}$ is a value indicative of integrated signal; and $\ddot{x}$ is a value indicative of input audio signal received by the first integrator.

Preferably the maximum voltage or current value is determined from V.

In some embodiments the bass optimisation module is configured to adjust the lower cut-off frequency by selecting one of two or more pre-integration high-pass filters to subject the input audio signal, wherein each pre-integration high pass filter has a different lower cut-off frequency. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter.

In some embodiments the bass optimisation module comprises multiple audio streams to which the input audio signal is subjected to, each audio stream having a pre-integration high pass filter of a different lower cut-off frequency, and wherein the bass optimisation module is configured to adjust a lower cut-off frequency of the input audio signal frequency response by selecting a filtered output audio signal from one of the multiple audio streams based on a value indicative of maximum electro-acoustic transducer voltage or current associated with the filtered output audio signal of each audio stream. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter. In some embodiments the bass optimisation module further comprise a cross-fader configured to cross-fade between the audio streams during adjustment of the lower cut-off frequency of the input audio signal.

In some embodiments the bass optimisation module may adjust the lower cut-off frequency by adjusting the lower cut-off frequency of an adjustable pre-integration high pass filter to which the input audio signal is subjected. Preferably the pre-integration high pass filter is a finite impulse response filter. Preferably each pre-integration high pass filter is a linear phase filter.

In some embodiments the bass optimisation module is configured to:

determine from the input audio signal at least one value indicative of a maximum amplifier output that is or would be applied to the respective output channel(s), wherein each maximum amplifier output value is associated with a particular lower cut-off frequency of the audio system frequency response;

compare each maximum amplifier output value to a predetermined maximum amplifier output value; and adjust the lower cut-off frequency of the input audio system frequency response according to the comparison to ensure the maximum amplifier output is at or below the predetermined maximum amplifier threshold.

In some embodiments each bass optimisation module is configured to adjust the lower cut-off frequency of the audio system frequency response to correspond to the lower cut-off frequency that is associated with the maximum amplifier output that is at or below the predetermined maximum amplifier output threshold.

Preferably the bass optimisation module is configured to:

determine from the input audio signal multiple values of a maximum amplifier output, wherein each maximum amplifier output value is associated with a different lower cut-off frequency of the audio system frequency response;

compare each maximum amplifier output value to a predetermined maximum amplifier output threshold; and adjust the lower cut-off frequency of the audio system frequency response based on the lower cut-off frequency associated with the maximum amplifier output value that is at or lower than the threshold.

In some embodiments the bass optimisation module is configured to determine a value indicative of maximum amplifier output from the input audio signal by subjecting the audio signal to at least one integrator. Preferably the input audio signal is subjected to a first and second integrator in series. Preferably each integrator comprises a low pass filter. Each integrator may also comprise a high pass filter.

Preferably the bass optimisation module further comprises at least one audio mixer associated with each series of first and second integrators, wherein each audio mixer is configured to receive any combination of two or more of: the input audio signal received by the first integrator, the integrated audio signal and the double-integrated audio signal and combine the received signals to generate an output audio signal for determining one or more of values indicative of maximum amplifier output that would be applied the respective output audio channel(s).

Preferably the audio mixer is configured to combine the input audio signal received by the first integrator, the integrated audio signal and the double-integrated audio signal to generate the output audio signal.

Preferably the audio mixer is configured to add the received signals.

Preferably the audio mixer is configured to scale each of the received signals in accordance with predetermined characteristics of an associated output audio channel of the audio system.

Preferably the predetermined characteristics are mass-spring-damper characteristics of the associated output audio channel(s).

In some embodiments the equaliser may comprise the bass optimisation module.

In some embodiments, an input of the bass optimisation module is operatively coupled to an output of the equaliser.

In some embodiments the bass optimisation module is implemented in digital circuitry. Preferably each integrator comprises digital filters. Preferably each audio mixer comprises a digital mixer. Preferably each pre-integration high pass filter is a digital high pass filter. In some embodiments one or more of the adaptive lower cut-off frequency circuits is/are implement in a digital signal processor. Preferably one or more of the adaptive lower cut-off frequency circuits and the associated equaliser is/are implemented in a common digital signal processor.

In some embodiments one or more of the adaptive lower cut-off frequency circuits is/are implemented in analogue circuitry.

In some embodiments the system further comprises one or more adaptive volume control module, each configured to:

receive a signal indicative of a value of an operating parameter of an associated output audio channel;

compare the value of the operating parameter to one or more predetermined threshold criteria; and adjust a received audio signal to generate a volume adjusted output signal if the value of the operating parameter is not in accordance with the one or more predetermined threshold criteria.

Preferably the operating parameter is a diaphragm displacement parameter of one or more associated electro-acoustic transducer(s) of the respective output audio channel.

Preferably the predetermined threshold criteria comprises a maximum diaphragm displacement threshold. Preferably the maximum diaphragm displacement threshold is stored in electronic memory accessible by the one or more adaptive volume control module. The memory may be on board the personal audio device or alternatively it may be externally stored, for example within an audio source device and/or a remote server.

In some embodiments the signal indicative of the value of the diaphragm displacement parameter is a signal obtained from a displacement sensor associated with the diaphragm of the associated electro-acoustic transducer of the respective output audio channel.

In some embodiments the signal indicative of the value of the diaphragm displacement parameter is obtained from a voltage sensor, or a current sensor, or both located at an input of the associated electro-acoustic transducer. Preferably the adaptive volume control module is configured to determine or predict the value of the operating parameter from an output of the voltage or current sensor, or from both outputs.

In some embodiments the adaptive volume control module is implemented in a digital signal processor. Preferably the one or more predetermined threshold criteria are stored in electronic memory of the digital signal processor.

In some embodiments the adaptive volume control module is configured to determine a value indicative of diaphragm displacement from a mathematical model of the audio system behaviour. Preferably diaphragm moving mass (optionally including any air load), total diaphragm stiffness (in situ) and total diaphragm damping (in situ), or at least variables related to such, are included in the model. Preferably such determination happens in advance of an output voltage being passed to an amplifier in order that the bass level may be adjusted gradually to reduce or eliminate audibility.

In some embodiments instigation of audio playback causes the device to immediately play a signal with reduced volume. Subsequently, determination a value indicative of diaphragm displacement and/or maximum voltage and/or maximum current proceeds ahead of playback, at which point the system may be able to predict that it is safe to increase volume levels.

In some embodiments the system further comprises a volume adjustment circuit operatively coupled to a user input device, wherein the volume adjustment circuit is configured to adjust a magnitude of an input audio signal in accordance with a signal indicative of user input from the user input device.

The volume adjustment circuit may be implemented in digital or analogue circuitry.

Preferably the volume adjustment circuit is implemented in a digital signal processor. Preferably an output of the volume adjustment circuit is operatively coupled to an input of the one or more equalisers.

In some embodiments the audio tuning system comprises a digital signal processor having implemented therein any combination of one or more of: the equaliser, the phase improvement module, the bass optimisation module and/or the volume adjustment module.

In some embodiments the digital signal processor is located in one of the housings of the personal audio device.

In some embodiments the digital signal processor is located in a separate housing to the housings of the output audio channel(s).

In other embodiments the digital signal processor is located in an audio source device configured for use with the personal audio device. Preferably each output audio channel is configured to operatively couple the audio source device. The audio source device may be any one of a mobile phone, a portable music player, a tablet computer, a laptop, a desktop computer and the like. The audio source device may be operatively coupled to each of output audio channel(s) via cable or wirelessly via any suitable communications protocol that is well-known in the art, such as Bluetooth™, Wi-Fi and/or Near Field Communication (NFC) for example.

In some embodiments the equaliser is implemented in an audio source device, comprising:

a processing component; and electronic readable memory having stored therein a software program that is configured to:

obtain data indicative of characteristics associated with the output audio channel(s) of a personal audio device;

determine from the output audio channel characteristics data an equalisation frequency response for the equaliser.

In some embodiments the electro-acoustic transducer characteristics data is obtained from a local memory component. In other embodiments the data is obtained from a remote memory component, for example from the personal audio device or from a remote server.

In some embodiments the software is further configured to receive identification data associated with the personal audio device and obtain the characteristics data using the identification data.

In some embodiments the electro-acoustic transducer characteristics data includes data indicative of a frequency response of the electro-acoustic transducer(s) of the respective output audio channel(s).

In some embodiments the software is further configured to subject the electro-acoustic transducer(s) of the respective output audio channel(s) to an audio signal and determine various characteristics of the output audio channel(s) accordingly. For example, the software may be further configured to receive an output signal from an acousto-electric transducer closely associated with the electro-acoustic transducer(s) of the respective output audio channel(s), said output signal being indicative of:

the frequency response of the output audio channel;

a coefficient value, m, indicative of a combined moving mass of a diaphragm assembly and air load of the output audio channel;

a coefficient value, c, indicative of a combined damping acting on the diaphragm assembly due to mechanical, electrical and/or acoustical sources;

a coefficient value, k, indicative of a combined stiffness acting on the diaphragm assembly due to mechanical and/or acoustical sources; and/or a coefficient value, E, indicative of a total responsiveness of the audio system;

maximum operational thresholds of the electro-acoustic transducer including maximum diaphragm displacement threshold; and/or non-linear behaviour(s) of the transducer.

In some embodiments the software is further configured to obtain additional data relating to any one or more of: a bass boost frequency response, a phase improvement module frequency response, and/or a bass optimisation module frequency response; and determine from the additional data in combination with the output audio channel characteristics data the equalisation frequency response for the equaliser.

The additional data may be indicative of mass-spring-damper characteristics of an output audio channel or channels, including one or more of:

a coefficient value, m, indicative of a combined moving mass of a diaphragm assembly and air load of the output audio channel(s);

a coefficient value, c, indicative of a combined damping acting on the diaphragm assembly due to mechanical, electrical and/or acoustical sources;

a coefficient value, k, indicative of a combined stiffness acting on the diaphragm assembly due to mechanical and/or acoustical sources;

a coefficient value, E, indicative of a total responsiveness of the audio system; and/or coefficient(s) describing non-linearity(ies) of the audio system.

The additional data may further comprise maximum operational thresholds, including maximum operational voltage threshold of the electro-acoustic transducer, or maximum diaphragm displacement threshold of the electro-acoustic transducer, or both.

The additional data may be obtained from a local memory component or remotely from the personal audio device or a remote server for example, optionally utilizing identification data associated with the personal audio device.

Alternatively the additional data may be obtained by subjecting the associated output audio channel(s) to one or more audio signals, receiving one or more output signals and determining from the output system the mass-spring-damper characteristics of the output audio channel(s).

In some embodiments the software is further configured to operate any one or more of:

an equaliser of the audio source device or the personal audio device using the determined equalisation frequency response;

a phase improvement module of the audio source device or the personal audio device using the additional data indicative of mass-spring-damper characteristics of associated output audio channel(s); and/or frequency bass optimisation module of the audio source device or the personal audio device using the additional data indicative of mass-spring-damper characteristics of associated output audio channel(s).

In some embodiments, each output channel further comprises one or more amplifiers, each amplifier being operatively coupled between an output of the equaliser and/or phase improvement module and/or bass optimisation module and an input of the one or more associated electro-acoustic transducers.

In some embodiments one or more of the electro-acoustic transducers comprise a moveable diaphragm and an excitation mechanism configured to act on the diaphragm to move the diaphragm in use in response to an electronic audio signal to generate sound pressure. Preferably the excitation mechanism comprises an electrically conducting coil that is rigidly attached to the diaphragm and a magnetic element or structure that generates a magnetic field and wherein the electrically conducting component is located in the magnetic field in situ to move within the magnetic field during operation. Preferably the electrically conducting component comprises a coil.

Preferably actuation is provided by a moving coil that operates in a magnetic field.

Preferably the magnetic field is provided by a permanent magnet.

Preferably there is a magnet or magnetic pole piece face on one side of the coil winding and another, having opposite magnetic polarity on an opposite side of the coil winding.

In some embodiments one or more of the electro-acoustic transducers of the personal audio device comprises a fundamental diaphragm resonant frequency of at least approximately 100 Hz in situ, more preferably at least approximately 110 Hz, and even more preferably at least approximately 120 Hz.

In some embodiments one or more of the electro-acoustic transducers is/are linear action transducers comprising a linearly reciprocating diaphragm.

In some embodiments one or more of the electro-acoustic transducers comprise a substantially rigid diaphragm. Preferably the diaphragm remains rigid during operation over the electro-acoustic transducers frequency range of operation and/or substantially over the audible frequency. Preferably the diaphragm comprises a body that is formed from a material having specific modulus greater than approximately 8 MPa/(kg/m$^3$). More preferably the specific modulus of the material is greater than approximately 20 MPa/(kg/m$^3$). For example, the diaphragm may consist of an aluminium, titanium and/or beryllium body.

In some embodiments one or more of the electro-acoustic transducers comprise a diaphragm having a body formed from a substantially flexible material, for example having a specific modulus less than 4 MPa/(kg/m$^3$). Preferably the diaphragm further comprises a coating formed from a substantially rigid material, for example having a specific modulus greater than approximately 20 MPa/(kg/m$^3$). Preferably the coating is less than half the thickness of the diaphragm body, at least over most of the area involved in flexing to facilitate diaphragm motion.

In some embodiments the personal audio device may further comprise a grille adjacent a major face of a diaphragm of one or more of the electro-acoustic transducers, and wherein the transducer is coupled to the grille via a transducer suspension system (i.e. it is decoupled), the transducer suspension system being configured to at least partially alleviate mechanical transmission of vibration between the diaphragm and the grille. Preferably the transducer suspension system flexibly mounts the diaphragm to the grille and housing to at least partially alleviate mechanical transmission of vibration between the diaphragm and the grille. Preferably the diaphragm suspension system substantially eliminates or at least reduces mechanical transmission of vibration between the diaphragm and the grille.

In some embodiment the suspension system comprises a flexible and/or resilient element coupled between the diaphragm and the grille. Preferably the element is made from silicone rubber or natural rubber. Alternatively the element is formed from metal springs.

In some embodiments one or more of the electro-acoustic transducers comprise a diaphragm having a major face that is moveable during operation to generate sound pressure and a grille adjacent the major face of the diaphragm, and wherein the transducer is rigidly coupled to the grille and the transducer and grille assembly is coupled to the associated housing via the suspension system to at least partially alleviate mechanical transmission of vibration between the transducer/grille assembly and the housing. Preferably the suspension system flexibly mounts the transducer/grille assembly to the housing to at least partially alleviate mechanical transmission of vibration between the grille and the housing. Preferably the suspension system substantially eliminates mechanical transmission of vibration between the transducer/grille assembly and the housing.

In some embodiment the suspension system comprises a flexible and/or resilient element coupled between the housing and the grille. Preferably the element is made from silicone rubber or natural rubber. Alternatively the element is formed from metal springs.

In some embodiments the personal audio device may further comprise a grille adjacent a major face of a diaphragm of one or more of the electro-acoustic transducers, and wherein the grille is rigidly coupled to a transducer base structure of the electro-acoustic transducer. Preferably the grille comprises a material having specific modulus greater than approximately 8 MPa/(kg/m$^3$). More preferably the grille comprises a material having specific modulus greater than approximately 20 MPa/(kg/m$^3$). For example, the grille may be formed from an aluminium or stainless steel or fibre reinforced plastic.

Preferably a thickness of the grille is greater than approximately 10% of a shortest distance across the diaphragm.

In some embodiments the grille is substantially thick. For example, the thickness of the grille is more than approximately 8% of a greatest dimension (such as the maximum diameter), or more preferably more than approximately 10% of the greatest dimension.

In some embodiments one or more of the electro-acoustic transducers is/are rotational action transducers comprising a rotatable diaphragm. Preferably the electro-acoustic transducer comprises a hinge system for rotatably coupling a diaphragm of the transducer to a transducer base structure of the transducer.

In some embodiments the housing associated with each output audio channel comprises at least one fluid passage from a first cavity on one side of the diaphragm to a second cavity located on an opposing side of the device to the first cavity, or from the first cavity to a volume of air external to the device, or both.

Preferably at least one fluid passage provides a substantially restrictive fluid passage for substantially restricting the flow of gases therethrough, in situ and during operation.

Preferably the interface device comprises a first fluid passage extending between a first front cavity on a side of the diaphragm configured to locate adjacent the user's ear in use, and a second rear cavity on an opposing side of the diaphragm.

Preferably the interface device comprises a fluid passage from the first front cavity to an external volume of air.

Preferably at least one fluid passage comprises multiple apertures of a diameter that is less than approximately 0.5 mm.

Preferably the diameter of the apertures is less than approximately 0.03 mm.

Preferably the fluid passages are distributed across a distance greater than a shortest distance across a major face of the diaphragm.

In some embodiments the personal audio device is a headphone comprising:

- a first headphone output audio channel including a housing configured to couple about a user's ear and at least one transducer located within the housing; and
- a second headphone output audio channel including a housing configured to couple about the user's other ear and at least one transducer located within the housing.

In some embodiments the personal audio device is an earphone comprising:

- a first earphone output audio channel including a housing configured to locate inside a user's ear and at least one transducer located within the housing; and
- a second earphone output audio channel including a housing configured to locate inside the user's other ear and at least one transducer located within the housing.

In some embodiments the personal audio device is a hearing aid device comprising:

- a first hearing aid output audio channel including a housing configured to locate inside a user's ear and at least one transducer located within the housing; and
- a second hearing output audio channel including a housing configured to locate inside the user's other ear and at least one transducer located within the housing.

In some embodiments the personal audio device is a mobile phone comprising one or more output audio channels.

In another aspect, the present invention broadly consists in a personal audio device for use in a personal audio application where the device is intended to be located within approximately 10 centimetres of a user's ears in use, the audio device having at least one output audio channel and each output audio channel comprising:

- a housing; and
- at least one electro-acoustic transducer within the housing that is operable to convert an input audio signal into sound, each electro-acoustic transducer having: a diaphragm, and an excitation mechanism configured to act on the diaphragm to move the diaphragm in use in response to an electronic signal to generate sound; wherein the diaphragm of one or more electro-acoustic transducers comprises one or more peripheral regions that are free from physical connection with an interior of the housing; and
- an audio tuning system configured to operatively couple the output audio channel(s) of the personal audio device and to optimise input audio signals for the output audio channel(s), the audio tuning system comprising an equaliser configured to receive input audio signals for the output channel(s) and alter a balance between frequency components of the input audio signals to generate equalised output signals for the output audio channel(s).

In another aspect the present invention broadly consists in an equaliser configured for use with a personal audio device intended to be located within approximately 10 centimetres of a user's ears in use, the equaliser being operable to:

- receive an input audio signal from an audio source;
- alter the frequency response of the audio system by subjecting the input audio signal to an equalisation frequency response to generate an equalised output audio signal; and
- output an equalised output audio signal to one or more channels of the personal audio device; wherein the equalisation frequency response approximates a diffuse field frequency response and is based on characteristics of a personal audio device having at least one housing and at least one electro-acoustic transducer associated with each housing that is operable to convert an input audio signal into sound pressure, each electro-acoustic transducer having: a diaphragm, and an excitation mechanism configured to act on the diaphragm to move the diaphragm in use in response to an electronic signal to generate sound; wherein the diaphragm of one or more electro-acoustic transducers comprises one or more peripheral regions that are free from physical connection with an interior of the housing.

In some embodiments the equaliser is implemented in a digital signal processing device. In other embodiments the equaliser is implemented in software that is stored in electronic memory of and executable by a processing device.

In another aspect the invention broadly consists of a computer readable medium having a computer executable modules of an audio tuning system stored therein, the audio tuning system being configured for use with a personal audio device configured to be located within approximately 10 centimetres of a user's ear in use, the modules comprising and equaliser being operable to:

receive an input audio signal from an audio source;

alter the frequency response of the audio system by subjecting the input audio signal to an equalisation frequency response to generate an equalised output audio signal; and output an equalised output audio signal to one or more channels of the personal audio device; wherein the equalisation frequency response approximates a diffuse field frequency response and is based on characteristics of a personal audio device having at least one housing and at least one electro-acoustic transducer associated with each housing that is operable to convert an input audio signal into sound pressure, each electro-acoustic transducer having: a diaphragm, and an excitation mechanism configured to act on the diaphragm to move the diaphragm in use in response to an electronic signal to generate sound; wherein the diaphragm of one or more electro-acoustic transducers comprises one or more peripheral regions that are free from physical connection with an interior of the housing.

In another aspect, the present invention broadly consists in an audio system comprising:

a personal audio device for use in a personal audio application where the device is intended to be located within approximately 10 centimetres of a user's ears in use, the audio device having:

at least one output audio channel comprising:

a housing; and at least one electro-acoustic transducer associated with the housing that is operable to convert an input audio signal into sound; and an audio tuning system operatively coupled to the one or more output audio channels, comprising:

a bass optimisation module configured to adaptively adjust lower cut-off frequency of a frequency response of the audio system based on one or more predetermined characteristics associated with the respective output audio channel(s) of the personal audio device; and an equaliser configured to adjust the frequency response of the audio system such that the frequency response increases the voltage passed into each output channel at low bass frequencies, relative to the voltage over the range of approximately 200 Hz to 400 Hz.

In some embodiments the equaliser comprises a predetermined equalisation frequency response which is based on a predetermined frequency response of the respective output channel(s) including the one or more electro-acoustic transducers.

In some embodiments the predetermined equalisation frequency response is based on a diffuse field frequency response.

In some embodiments one or more of the electro-acoustic(s) transducer is/are coupled to the associated housing via a suspension system, wherein the suspension system flexibly couples the electro-acoustic transducer to the housing to at least partially alleviate mechanical transmission of vibration between the electro-acoustic transducer and the housing.

In some embodiments one or more of the electro-acoustic(s) transducer comprises: a diaphragm, and an excitation mechanism configured to act on the diaphragm to move the diaphragm in use in response to an electronic signal to generate sound; wherein the diaphragm of the electro-acoustic transducer(s) comprises one or more peripheral regions that are free from physical connection with an interior of the housing In another aspect, the present invention broadly consists in an audio system comprising:

a personal audio device for use in a personal audio application where the device is intended to be located within approximately 10 centimetres of a user's ears in use, the audio device having at least one output audio channel and each output audio channel comprising:

a housing; and at least one electro-acoustic transducer within the housing that is operable to convert an input audio signal into sound, each electro-acoustic transducer being mounted within the housing via a suspension system, wherein the suspension system flexibly mounts the electro-acoustic transducer relative to the housing to at least partially alleviate mechanical transmission of vibration between the electro-acoustic transducer and the housing during operation; and an audio tuning system operatively coupled to the output channels of the personal audio device and comprising a bass optimisation module configured to adaptively adjust lower cut-off frequency of a frequency response of the audio system based on one or more predetermined characteristics associated with the respective output audio channel(s) of the personal audio device.

Preferably the one or more predetermined characteristics comprise one or more operating parameter thresholds. The operating parameter thresholds may include any combination of one or more of: a maximum operating voltage threshold of the electro-acoustic transducer(s) of the associated output audio channel and/or a maximum operational current threshold of the electro-acoustic transducer(s) of the associated output audio channel and/or a maximum diaphragm displacement threshold of the electro-acoustic transducer(s) of the associated output audio channel and/or a maximum output of an amplifier of the associated output audio channel.

Preferably the bass optimisation module is configured to compare a value or values of one or more operating parameters of the associated output audio channel with the corresponding operating parameter threshold or thresholds and adjust a lower cut-off frequency of the audio system frequency response for the associated output audio channel accordingly.

Preferably the bass optimisation module is configured to:

determine from the input audio signal one or more values of one or more operating parameters of the associated output audio channel;

compare the value(s) of the operating parameter(s) to the corresponding operating parameter(s) threshold criteria; and adjust a lower cut-off frequency of the audio system frequency response in accordance with the comparison.

In some embodiments the bass optimisation module is configured to:

determine from the input audio signal at least one value indicative of a maximum diaphragm displacement that is or would be exhibited by the electro-acoustic transducer(s) of a respective output audio channel(s) when subjected to the input audio signal, wherein each maximum diaphragm displacement value is associated with a particular lower cut-off frequency of the audio system frequency response;

compare each maximum displacement value to a predetermined maximum diaphragm displacement threshold for the respective output audio channel(s); and adjust the lower cut-off frequency of the audio system frequency response according to the comparison to ensure the maximum diaphragm displacement of the electro-acoustic transducer(s) of the respective output audio channel(s) is at or below the predetermined maximum diaphragm displacement threshold.

In some embodiments the bass optimisation module is configured to adjust the lower cut-off frequency of the audio system frequency response for respective output audio channel(s) to correspond to the lower cut-off frequency that is associated with the diaphragm displacement value that is at or below the predetermined maximum diaphragm displacement threshold.

Preferably the bass optimisation module is configured to:

determine from the input audio signal multiple values of a maximum diaphragm displacement, wherein each maximum diaphragm displacement value is associated with a different lower cut-off frequency of the audio system frequency response;

compare each maximum displacement value to a predetermined maximum diaphragm displacement threshold; and adjust the lower cut-off frequency of the audio system frequency response based on the lower cut-off frequency associated with the maximum diaphragm displacement value that is at or lower than the threshold.

In some embodiments the bass optimisation module is configured to determine a value indicative of diaphragm displacement from a mathematical model of the audio system behaviour. Preferably diaphragm moving mass (optionally including any air load), total diaphragm stiffness (in situ) and total diaphragm damping (in situ), or at least variables related to such, are included in the model. Preferably such determination happens in advance of an output voltage being passed to an amplifier in order that the bass level may be adjusted gradually to reduce or eliminate audibility.

In some embodiments instigation of audio playback causes the device to immediately play a signal with reduced bass. Subsequently, determination of a value indicative of diaphragm displacement and/or maximum voltage and/or maximum current proceeds ahead of playback, at which point the system may be able to predict that it is safe to increase bass levels.

In some embodiments the bass optimisation module is configured to determine a value indicative of diaphragm displacement from the input audio signal by subjecting the audio signal to at least one integrator. Preferably the input audio signal is subjected to a double-integrator. Preferably each integrator comprises a low pass filter. Each integrator may also comprise a high pass filter.

In some embodiments the bass optimisation module is configured to adjust the lower cut-off frequency by selecting one of two or more pre-integration high-pass filters to subject the input audio signal, wherein each pre-integration high pass filter has a different lower cut-off frequency. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter.

In some embodiments the bass optimisation module comprises multiple audio streams to which the input audio signal is subjected to, each audio stream having a pre-integration high pass filter of a different lower cut-off frequency, and wherein the bass optimisation module is configured to adjust a lower cut-off frequency of the input audio signal frequency response by selecting a filtered output audio signal from one of the multiple audio streams based on a value indicative of diaphragm displacement associated with the filtered output audio signal of each audio stream. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter. In some embodiments the bass optimisation module further comprise a cross-fader configured to cross-fade between the audio streams during adjustment of the lower cut-off frequency of the input audio signal.

In some embodiments the bass optimisation module may adjust the lower cut-off frequency by adjusting the lower cut-off frequency of an adjustable pre-integration high pass filter to which the input audio signal is subjected. Preferably the pre-integration high pass filter is a finite impulse response filter. Preferably the pre-integration high pass filter is a linear phase filter.

In some embodiments the bass optimisation module is configured to:

determine from the input audio signal at least one value indicative of a maximum voltage or maximum current that is or would be applied to the associated electro-acoustic transducer, wherein each maximum voltage or maximum current value is associated with a particular lower cut-off frequency of the audio system frequency response;

compare each maximum voltage or maximum current value to a predetermined maximum electro-acoustic transducer voltage or current threshold; and adjust the lower cut-off frequency of the input audio system frequency response according to the comparison to ensure the maximum electro-acoustic transducer voltage or current is at or below the predetermined maximum voltage or current threshold.

In some embodiments each bass optimisation module is configured to adjust the lower cut-off frequency of the audio system frequency response to correspond to the lower cut-off frequency that is associated with the maximum voltage or current value that is at or below the predetermined maximum electro-acoustic transducer voltage or current threshold.

Preferably the bass optimisation module is configured to:

determine from the input audio signal multiple values of a maximum electro-acoustic transducer voltage or current, wherein each maximum voltage or current value is associated with a different lower cut-off frequency of the audio system frequency response;

compare each maximum voltage or current value to a predetermined maximum voltage or current threshold; and adjust the lower cut-off frequency of the audio system frequency response based on the lower cut-off frequency associated with the maximum voltage or current value that is at or lower than the threshold.

In some embodiments the bass optimisation module is configured to determine a value indicative of maximum electro-acoustic transducer voltage or current from the input audio signal by subjecting the audio signal to at least one integrator. Preferably the input audio signal is subjected to a first and second integrator in series. Preferably each integrator comprises a low pass filter. Each integrator may also comprise a high pass filter.

Preferably the bass optimisation module further comprises at least one audio mixer associated with each series of first and second integrators, wherein each audio mixer is configured to receive any combination of two or more of: the input audio signal received by the first integrator, the integrated audio signal and the double-integrated audio signal and combine the received signals to generate an output audio signal for determining one or more of values indicative of maximum electro-acoustic transducer voltage or current that would be applied to the electro-acoustic transducer(s) of the respective output audio channel.

Preferably the audio mixer is configured to combine the input audio signal received by the first integrator, the integrated audio signal and the double-integrated audio signal to generate the output audio signal.

Preferably the audio mixer is configured to add the received signals.

Preferably the audio mixer is configured to scale each of the received signals in accordance with predetermined characteristics of an associated output audio channel of the audio system.

Preferably the predetermined characteristics are mass-spring-damper characteristics of the associated output audio channel(s).

Preferably the mass-spring-damper characteristics include one or more of:

a coefficient value, m, indicative of a combined moving mass of a diaphragm assembly and air load of the associated output audio channel(s);

a coefficient value, c, indicative of a combined damping acting on the diaphragm assembly due to mechanical, electrical and/or acoustical sources;

a coefficient value, k, indicative of a combined stiffness acting on the diaphragm assembly due to mechanical and/or acoustical sources; and/or a coefficient value, E, indicative of a total responsiveness of the audio system.

Preferably the mixer is configured to scale the received signals and generate the output signal in accordance with the following formula:

$$V=E(m\ddot{x}+c\dot{x}+kx)$$

wherein:

V is a value indicative of a voltage of the phase improved output signal;

x is a value indicative of the double-integrated signal;

$\dot{x}$ is a value indicative of integrated signal; and $\ddot{x}$ is a value indicative of input audio signal received by the first integrator.

Preferably the maximum voltage or current value is determined from V.

In some embodiments the bass optimisation module is configured to adjust the lower cut-off frequency by selecting one of two or more pre-integration high-pass filters to subject the input audio signal, wherein each pre-integration high pass filter has a different lower cut-off frequency. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter.

In some embodiments the bass optimisation module comprises multiple audio streams to which the input audio signal is subjected to, each audio stream having a pre-integration high pass filter of a different lower cut-off frequency, and wherein the bass optimisation module is configured to adjust a lower cut-off frequency of the input audio signal frequency response by selecting a filtered output audio signal from one of the multiple audio streams based on a value indicative of maximum electro-acoustic transducer voltage or current associated with the filtered output audio signal of each audio stream. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter. In some embodiments the bass optimisation module further comprise a cross-fader configured to cross-fade between the audio streams during adjustment of the lower cut-off frequency of the input audio signal.

In some embodiments the bass optimisation module may adjust the lower cut-off frequency by adjusting the lower cut-off frequency of an adjustable pre-integration high pass filter to which the input audio signal is subjected. Preferably the pre-integration high pass filter is a finite impulse response filter. Preferably each pre-integration high pass filter is a linear phase filter.

In some embodiments the bass optimisation module is configured to:

determine from the input audio signal at least one value indicative of a maximum amplifier output that is or would be applied to the respective output channel(s), wherein each maximum amplifier output value is associated with a particular lower cut-off frequency of the audio system frequency response;

compare each maximum amplifier output value to a predetermined maximum amplifier output value; and adjust the lower cut-off frequency of the input audio system frequency response according to the comparison to ensure the maximum amplifier output is at or below the predetermined maximum amplifier threshold.

In some embodiments each bass optimisation module is configured to adjust the lower cut-off frequency of the audio system frequency response to correspond to the lower cut-off frequency that is associated with the maximum amplifier output that is at or below the predetermined maximum amplifier output threshold.

Preferably the bass optimisation module is configured to:

determine from the input audio signal multiple values of a maximum amplifier output, wherein each maximum amplifier output value is associated with a different lower cut-off frequency of the audio system frequency response;

compare each maximum amplifier output value to a predetermined maximum amplifier output threshold; and adjust the lower cut-off frequency of the audio system frequency response based on the lower cut-off frequency associated with the maximum amplifier output value that is at or lower than the threshold.

In some embodiments the bass optimisation module is configured to determine a value indicative of maximum amplifier output from the input audio signal by subjecting the audio signal to at least one integrator. Preferably the input audio signal is subjected to a first and second integrator in series. Preferably each integrator comprises a low pass filter. Each integrator may also comprise a high pass filter.

Preferably the bass optimisation module further comprises at least one audio mixer associated with each series of first and second integrators, wherein each audio mixer is configured to receive any combination of two or more of: the input audio signal received by the first integrator, the integrated audio signal and the double-integrated audio signal and combine the received signals to generate an output audio signal for determining one or more of values indicative of maximum amplifier output that would be applied the respective output audio channel(s).

Preferably the audio mixer is configured to combine the input audio signal received by the first integrator, the integrated audio signal and the double-integrated audio signal to generate the output audio signal.

Preferably the audio mixer is configured to add the received signals.

Preferably the audio mixer is configured to scale each of the received signals in accordance with predetermined characteristics of an associated output audio channel of the audio system.

Preferably the predetermined characteristics are mass-spring-damper characteristics of the associated output audio channel(s).

In some embodiments the equaliser may comprise the bass optimisation module.

In some embodiments, an input of the bass optimisation module is operatively coupled to an output of the equaliser.

In some embodiments the bass optimisation module is implemented in digital circuitry. Preferably each integrator comprises digital filters. Preferably each audio mixer comprises a digital mixer. Preferably each pre-integration high pass filter is a digital high pass filter. In some embodiments one or more of the adaptive lower cut-off frequency circuits is/are implement in a digital signal processor. Preferably one or more of the adaptive lower cut-off frequency circuits and the associated equaliser is/are implemented in a common digital signal processor.

In some embodiments one or more of the adaptive lower cut-off frequency circuits is/are implemented in analogue circuitry.

In some embodiments the personal audio system further comprises one or more equalisers configured to further adjust the input audio signal based on a predetermined equalisation frequency response.

In some embodiments the predetermined equalisation frequency response is based on a diffuse field frequency response.

Preferably the equalisation frequency response comprises an increasing magnitude from approximately 400 Hz to approximately 2000 Hz. Preferably the equalisation frequency response comprises a higher average magnitude across a treble frequency range relative to mid-level and/or bass frequency ranges.

Preferably the diffuse field frequency response comprises:

a substantially continuously increasing magnitude from approximately 0 dB at approximately 100 Hz to approximately 15 dB at approximately 2500 Hz; and a substantially uniform magnitude from approximately 2500 Hz to approximately 3200 Hz; and a substantially decreasing magnitude from approximately 15 db at approximately 3200 Hz to approximately 7 dB at approximately 10 kHz.

Preferably the magnitude between approximately 100 Hz and approximately 2500 Hz comprises a substantially curved profile.

Preferably the magnitude between approximately 3200 Hz and 10 kHz comprises a substantially stepped profile.

In one aspect, the present invention broadly consists in an audio system comprising:

a personal audio device for use in a personal audio application where the device is intended to be located within approximately 10 centimetres of a user's ears in use, the audio device having:

at least one housing; and at least one electro-acoustic transducer associated with each housing that is at least one electro-acoustic transducer associated with each housing that is operable to convert an input audio signal into sound pressure, each electro-acoustic transducer having: a diaphragm, and an excitation mechanism configured to act on the diaphragm to move the diaphragm in use in response to an electronic signal to generate sound; wherein the diaphragm of one or more electro-acoustic transducers comprises one or more peripheral regions that are free from physical connection with an interior of the housing; and one or more of adaptive lower cut-off frequency circuit(s) configured to adaptively adjust lower cut-off frequency of an input audio signal received for playback through one or more of the electro-acoustic transducers based on one or more predetermined characteristics the associated electro-acoustic transducer of the personal audio device.

Preferably the one or more predetermined characteristics comprise one or more operating parameter thresholds. The operating parameter thresholds may include any combination of one or more of: a maximum operating voltage and/or current threshold of the electro-acoustic transducer and/or amplifier, and/or a maximum diaphragm displacement threshold of the electro-acoustic transducer.

Preferably the one or more of adaptive lower cut-off frequency circuit(s) is(are) configured to compare a value or values of one or more operating parameters of the associated electro-acoustic transducer with the corresponding operating parameter threshold or thresholds and adjust a lower cut-off frequency of the input audio signal frequency response accordingly.

Preferably the one or more of adaptive lower cut-off frequency circuit(s) is(are) configured to:

determine from the input audio signal one or more values of one or more operating parameters;

compare the value(s) of the operating parameter(s) to the corresponding operating parameter(s) threshold criteria; and adjust a lower cut-off frequency of the input audio signal frequency response in accordance with the comparison.

In some embodiments one or more of adaptive lower cut-off frequency circuit(s) is(are) configured to:

determine from the input audio signal at least one value indicative of a maximum diaphragm displacement that is or would be exhibited by the associated electro-acoustic transducer when subjected to the input audio signal, wherein each maximum diaphragm displacement value is associated with a particular lower cut-off frequency of the audio signal frequency response;

compare each maximum displacement value to a predetermined maximum diaphragm displacement threshold; and adjust the lower cut-off frequency of the input audio signal frequency response according to the comparison to ensure the maximum diaphragm displacement of the associated electro-acoustic transducer is at or below the predetermined maximum diaphragm displacement threshold.

In some embodiments one or more of adaptive lower cut-off frequency circuit(s) is(are) configured to adjust the lower cut-off frequency of the input audio signal frequency response to correspond to the lower cut-off frequency that is associated with the diaphragm displacement value that is at or below the predetermined maximum diaphragm displacement threshold.

Preferably the one or more adaptive lower cut-off frequency circuit(s) is(are) configured to:

determine from the input audio signal multiple values of a maximum diaphragm displacement, wherein each maximum diaphragm displacement value is associated with a different lower cut-off frequency of the audio signal frequency response;

compare each maximum displacement value to a predetermined maximum diaphragm displacement threshold; and adjust the lower cut-off frequency of the input audio signal based on the lower cut-off frequency associated with the maximum diaphragm displacement value that is at or lower than the threshold.

In some embodiments one or more adaptive lower cut-off frequency circuits is/are configured to determine a value indicative of diaphragm displacement from the input audio signal by subjecting the audio signal to at least one integrator. Preferably the input audio signal is subjected to a double-integrator. Preferably each integrator comprises a low pass filter. Each integrator may also comprise a high pass filter.

In some embodiments the bass optimisation module is configured to adjust the lower cut-off frequency by selecting one of two or more pre-integration high-pass filters to subject the input audio signal, wherein each pre-integration high pass filter has a different lower cut-off frequency. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter.

In some embodiments one or more of adaptive lower cut-off frequency circuit(s) comprises multiple audio streams to which the input audio signal is subjected to, each audio stream having a pre-integration high pass filter of a different lower cut-off frequency, and wherein the bass optimisation module is configured to adjust a lower cut-off frequency of the input audio signal frequency response by selecting a filtered output audio signal from one of the multiple audio streams based on a value indicative of diaphragm displacement associated with the filtered output audio signal of each audio stream. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter. In some embodiments the adaptive lower cut-off frequency circuit(s) further comprise a cross-fader configured to cross-fade between the audio streams during adjustment of the lower cut-off frequency of the input audio signal.

In some embodiments one or more of adaptive lower cut-off frequency circuit(s) may adjust the lower cut-off frequency by adjusting the lower cut-off frequency of an adjustable pre-integration high pass filter to which the input audio signal is subjected. Preferably the pre-integration high pass filter is a finite impulse response filter. Preferably each pre-integration high pass filter is a linear phase filter.

In some embodiments one or more of adaptive lower cut-off frequency circuit(s) is(are) configured to:

determine from the input audio signal at least one value indicative of a maximum voltage that is or would be exhibited by the associated electro-acoustic transducer when subjected to the input audio signal, wherein each maximum voltage value is associated with a particular lower cut-off frequency of the audio signal frequency response;

compare each maximum voltage value to a predetermined maximum electro-acoustic transducer voltage threshold; and adjust the lower cut-off frequency of the input audio signal frequency response according to the comparison to ensure the maximum electro-acoustic transducer voltage is at or below the predetermined maximum voltage threshold.

In some embodiments each bass optimisation module is configured to adjust the lower cut-off frequency of the input audio signal frequency response to correspond to the lower cut-off frequency that is associated with the maximum voltage value that is at or below the predetermined maximum electro-acoustic transducer voltage threshold.

Preferably the bass optimisation module is configured to:

determine from the input audio signal multiple values of a maximum electro-acoustic transducer voltage, wherein each maximum voltage value is associated with a different lower cut-off frequency of the audio signal frequency response;

compare each maximum voltage value to a predetermined maximum voltage threshold; and adjust the lower cut-off frequency of the input audio signal based on the lower cut-off frequency associated with the maximum voltage value that is at or lower than the threshold.

In some embodiments one or more of adaptive lower cut-off frequency circuit(s) is(are) configured to determine a value indicative of maximum electro-acoustic transducer voltage from the input audio signal by subjecting the audio signal to at least one integrator. Preferably the input audio signal is subjected to a first and second integrator in series. Preferably each integrator comprises a low pass filter. Each integrator may also comprise a high pass filter.

Preferably the one or more lower cut-off frequency circuit(s) further comprises at least one audio mixer associated with each series of first and second integrators, wherein each audio mixer is configured to receive any combination of two or more of: the input audio signal received by the first integrator, the integrated audio signal and the double-integrated audio signal and combine the received signals to generate an output audio signal for determining one or more of values indicative of maximum electro-acoustic transducer voltage.

Preferably the audio mixer is configured to combine the input audio signal received by the first integrator, the integrated audio signal and the double-integrated audio signal to generate the output audio signal.

Preferably the audio mixer is configured to add the received signals.

Preferably the audio mixer is configured to scale each of the received signals in accordance with predetermined characteristics of an associated audio reproduction structure of the audio system; wherein the associated audio reproduction structure includes any one or more of the personal audio device, an associated interface device of the personal audio device including one of the housings and its associated electro-acoustic transducer(s), or the associated electro-acoustic transducer.

Preferably the predetermined characteristics are mass-spring-damper characteristics of the associated audio structure.

Preferably the mass-spring-damper characteristics include one or more of:

- a coefficient value, m, indicative of a combined moving mass of a diaphragm assembly and air load of the associated audio reproduction structure;
- a coefficient value, c, indicative of a combined damping acting on the diaphragm assembly due to mechanical, electrical and/or acoustical sources;
- a coefficient value, k, indicative of a combined stiffness acting on the diaphragm assembly due to mechanical and/or acoustical sources; and/or
- a coefficient value, E, indicative of a total responsiveness of the audio system.

Preferably the mixer is configured to scale the received signals and generate the output signal in accordance with the following formula:

$$V=E(m\ddot{x}+c\dot{x}+kx)$$

wherein:

- V is a value indicative of a voltage of the phase improved output signal;
- x is a value indicative of the double-integrated signal;
- $\dot{x}$ is a value indicative of integrated signal; and
- $\ddot{x}$ is a value indicative of input audio signal received by the first integrator.

Preferably the maximum voltage value is determined from V.

In some embodiments one or more of adaptive lower cut-off frequency circuit(s) is(are) configured to adjust the lower cut-off frequency by selecting one of two or more pre-integration high-pass filters to subject the input audio signal, wherein each pre-integration high pass filter has a different lower cut-off frequency. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter.

In some embodiments one or more of adaptive lower cut-off frequency circuit(s) comprises multiple audio streams to which the input audio signal is subjected to, each audio stream having a pre-integration high pass filter of a different lower cut-off frequency, and wherein the bass optimisation module is configured to adjust a lower cut-off frequency of the input audio signal frequency response by selecting a filtered output audio signal from one of the multiple audio streams based on a value indicative of maximum electro-acoustic transducer voltage associated with the filtered output audio signal of each audio stream. For instance a first filter may have a lower cut-off frequency of between 50 Hz and 100 Hz, a second filter may have a lower cut-off frequency of between 25 Hz and 50 Hz and a third filter may have a lower cut-off frequency of between 5 Hz and 25 Hz. Preferably each pre-integration high pass filter is a finite impulse response filter. Preferably each pre-integration high pass filter is a linear phase filter. In some embodiments the adaptive lower cut-off frequency circuit(s) further comprise a cross-fader configured to cross-fade between the audio streams during adjustment of the lower cut-off frequency of the input audio signal.

In some embodiments one or more of adaptive lower cut-off frequency circuit(s) may adjust the lower cut-off frequency by adjusting the lower cut-off frequency of an adjustable pre-integration high pass filter to which the input audio signal is subjected. Preferably the pre-integration high pass filter is a finite impulse response filter. Preferably each pre-integration high pass filter is a linear phase filter.

In some embodiments one or more of the equalisers may include one or more of the adaptive lower cut-off frequency circuits.

In some embodiments, an input of one or more adaptive lower cut-off frequency circuits is operatively coupled to an output of the associated equaliser.

In some embodiments one or more of the adaptive lower cut-off frequency circuits is/are implemented in digital circuitry. Preferably each integrator comprises digital filters. Preferably each audio mixer comprises a digital mixer. Preferably each pre-integration high pass filter is a digital high pass filter. In some embodiments one or more of the adaptive lower cut-off frequency circuits is/are implement in a digital signal processor. Preferably one or more of the adaptive lower cut-off frequency circuits and the associated equaliser is/are implemented in a common digital signal processor.

In some embodiments one or more of the adaptive lower cut-off frequency circuits is/are implemented in analogue circuitry. Each integrator may comprise analogue filters. Each audio mixer may be an analogue audio mixer. Each pre-integration filter may comprise an analogue high-pass filter.

Any one or more of the above embodiments or preferred features can be combined with any one or more of the above aspects.

In another aspect, the present invention broadly consists in an audio transducer diaphragm comprising a body formed from a three-dimensional lattice having a plurality of interconnected cells of a predetermined three-dimensional cell shape.

In another aspect, the present invention broadly consists in an audio transducer diaphragm comprising a body formed from a three-dimensional lattice having a plurality of interconnected and predetermined node units, each node unit consisting of a three-dimensional arrangement of a plurality of elongate members connected at a central node.

Preferably the body comprises at least one major side of a substantially smooth profile for moving air when the diaphragm is in use. Preferably the body comprises a pair of opposed major sides of substantially smooth profiles. Preferably the major sides comprise a substantially planar profile.

Preferably the diaphragm comprises a substantially solid membrane layer on at least one major side of the diaphragm body for moving air when the diaphragm is in use. Preferably the diaphragm comprises a substantially solid membrane layer on two opposed major sides of the diaphragm body.

In some embodiments each membrane consists of normal stress reinforcement for resisting compression-tension stresses experienced at or adjacent the respective side of the diaphragm in use.

In some embodiments the lattice comprises of cells of substantially uniform shape. In some embodiments the lattice comprises of one or more sections of repeated and interconnected cells of substantially uniform shape. In some embodiments a substantial portion of the entire lattice comprise of repeated cells of substantially uniform shape.

In some embodiments the lattice is configured to transmit loads across the body and/or along the body via direction compression-tension pathways.

In some embodiments a majority of cells are open cells having interstices. In some embodiments each cell is an open cell having interstices.

In some embodiments the outer periphery of the diaphragm body is substantially sealed using one or more membrane layers.

In some embodiments some or all interstices are filled with a relatively lightweight and solid material to seal a related section or all of the lattice.

In some embodiments each cell is formed by a plurality of interconnected members forming a predetermined three-dimensional cell shape. Preferably each member is substantially elongate or longitudinal strut. Preferably each strut is substantially linear.

Preferably each member is substantially rigid. Preferably each node and/or the connected between the members is substantially rigid.

In some embodiments the lattice is formed from members having a relatively high maximum specific modulus, for example, preferably at least 8 MPa/(kg/m^3), or most preferably at least 20 MPa/(kg/m^3). Preferably the lattice is formed from aluminium or titanium members.

In some embodiments the lattice comprises a network of nodes interconnected by members, and wherein each node connects to at least six members. Preferably one or more nodes connect to at least 7 members. Preferably one or more nodes connect to at least 8 members.

In some embodiments at least approximately fifty percent of a total mass of the nodes in the lattice are connected to six members each. More preferably at least approximately seventy percent of a total mass of the nodes in the lattice are connected to six members each.

In some embodiments at least approximately fifty percent of a total mass of the nodes in the lattice are connected to seven members each. More preferably at least approximately seventy percent of a total mass of the nodes in the lattice are connected to seven members each.

In some embodiments at least approximately fifty percent of a total mass of the nodes in the lattice are connected to eight members each. More preferably at least approximately seventy percent of a total mass of the nodes in the lattice are connected to eight members each.

In some embodiments at least approximately fifty percent of a total mass of nodes in the lattice are connected to less than ten members each. More preferably at least approximately seventy percent of a total mass of nodes in the lattice are connected to less than ten members each.

In some embodiments at least approximately fifty percent of a total mass of nodes in the lattice are connected to less than nine members each. More preferably at least approximately seventy percent of a total mass of nodes in the lattice are connected to less than nine members each.

In some embodiments the members are oriented such that the lattice substantially resists and/or substantially mitigates shear deformation experienced by the body during operation.

In some embodiments at least fifty percent of a total mass of the lattice members comprises of members that are at an angle of between approximately thirty degrees and approximately ninety degrees relative to a coronal plane of the diaphragm body. Preferably at least sixty percent of a total mass of the lattice members comprises of members that are at an angle of between approximately thirty degrees and approximately ninety degrees relative to a coronal plane of the diaphragm body. More preferably at least seventy percent of a total mass of the lattice members comprises of members that are at an angle of between approximately thirty degrees and approximately ninety degrees relative to a coronal plane of the diaphragm body.

In some embodiments the members of the lattice reduce in thickness towards one end of the diaphragm body. Preferably the members of the lattice substantially gradually and/or substantially uniformly reduce in thickness from one end to an opposing end of the diaphragm body. Preferably the diaphragm body reduces in thickness towards the one end. Preferably the diaphragm body substantially gradually and/or substantially uniformly reduces in thickness from one end to an opposing end to maintain at least one substantially planar major side for moving air when the diaphragm is in use.

In some embodiments member length reduces toward one end of the diaphragm body. Preferably member length substantially gradually and/or substantially uniformly reduces from one end to an opposing end.

In some embodiments a spacing between nodes reduces toward one end of the diaphragm body. Preferably the spacing between nodes substantially gradually and/or substantially uniformly reduces from one end to an opposing end.

In some embodiments some of the lattice members are substantially hollow.

Preferably a majority of the lattice members are substantially hollow. Preferably a substantial portion of the lattice comprises substantially hollow members. Preferably approximately an entire portion of the lattice comprises substantially hollow members.

In some embodiments, the diaphragm further comprises normal stress reinforcement coupled to or adjacent at least one major side of the core for resisting compression-tension stresses experienced at or adjacent the respective side when the diaphragm is in use. Preferably the diaphragm comprises normal stress reinforcement coupled to or adjacent both major side of the core.

Preferably the normal stress reinforcement is formed from material having a relatively high maximum specific modulus, for example, preferably at least 8 MPa/(kg/m$^3$), or more preferably at least 20 MPa/(kg/m$^3$), or at least 100 MPa/(kg/m$^3$) in some direction. The normal stress reinforcement may be formed from an aluminium or a carbon fibre reinforced plastic, for example.

Preferably the normal stress reinforcement comprises one or more normal stress reinforcement plates or members each coupled adjacent one of said major sides of the body. Preferably the normal stress reinforcement comprises a pair of reinforcement plates or members respectively coupled to or directly adjacent a pair of opposing major sides of the diaphragm body. Preferably each normal stress reinforcement plate or member is bonded to the corresponding major side of the diaphragm body via relatively thin layers of adhesive, such as epoxy adhesive for example. Preferably each normal stress reinforcement plate is bonded to the diaphragm body lattice via relatively thin layers of epoxy adhesive. Preferably the adhesive is less than approximately 70% of a weight of the corresponding reinforcement plate. More preferably it is less than 60%, or less than 50% or less than 40%, or less than 30%, or most preferably less than 25% of a weight of the corresponding reinforcement plate.

In some embodiment at least one normal stress reinforcement plate is a substantially solid reinforcement plate.

In some embodiments each normal stress reinforcement plate or member comprises one or more elongate struts coupled along a corresponding major side of the diaphragm body. Preferably one or more struts extend substantially longitudinally along the major side. Preferably each normal stress reinforcement plate or member comprises a plurality of spaced struts extending substantially longitudinally along the corresponding major side. Alternatively or in addition each normal stress reinforcement plate or member comprises one or more struts extending at an angle relative to the longitudinal axis of the corresponding major side. The normal stress reinforcement plate or member may comprise a network of relatively angled struts extending along a substantial portion of the corresponding major side. Preferably each strut comprises a thickness greater than $1/60^{th}$ of its width.

In some embodiments the one or more normal stress reinforcement plates or members is (are) anisotropic and exhibit a stiffness in some direction that is at least double the stiffness in other substantially orthogonal directions.

In some embodiments the normal stress reinforcement plates or members extend substantially longitudinally along a substantial portion of an entire length of the diaphragm body at or directly adjacent each major side of the diaphragm body.

In some embodiments the normal stress reinforcement on one side extends to the terminal end of the diaphragm body and connects to the normal stress reinforcement on an opposing major side of the diaphragm body.

Preferably the mass/unit area of normal reinforcement reduces towards peripheral areas remote from the centre of mass of the diaphragm and/or from an intended axis of rotation location.

Preferably the diaphragm body is substantially thick.

For example, the diaphragm body may comprise a maximum thickness that is at least about 11% of a maximum length dimension of the body. More preferably the maximum thickness is at least about 14% of the maximum length dimension of the body.

In some embodiments the body comprises a substantially tapered profile. Preferably the body comprises a substantially uniformly tapered profile.

In some embodiments the diaphragm body comprises a substantially triangular cross-section along a sagittal plane of the diaphragm body. Preferably the diaphragm body comprises a wedge-shaped form.

In some embodiments the diaphragm body comprises a substantially rectangular cross-section along the sagittal plane of the diaphragm body.

Preferably one or more peripheral faces of the diaphragm has a sealing plate adhered at the surface. Preferably all peripheral faces that move significantly have a sealing plate adhered at the surface.

Preferably a sealing plate forms a narrow gap between the diaphragm and a surround [or housing in situ. Preferably the gap size remains substantially small as the diaphragm moves. Preferably the gap size remains substantially small over the diaphragm's entire range of motion.

In some embodiments a distribution of mass associated with the diaphragm body or a distribution of mass associated with the normal stress reinforcement, or both, is such that the diaphragm comprises a relatively lower mass per unit area at one or more low mass regions of the diaphragm relative to the mass at one or more relatively high mass regions of the diaphragm.

In some embodiments the one or more low mass regions are peripheral regions distal from a centre of mass location of the diaphragm and the one or more high mass regions are at or proximal to the centre of mass location. Preferably the one or more low mass regions are peripheral regions most distal from the centre of mass location.

In some embodiments the low mass regions are at one end of the diaphragm and the high mass regions are at an opposing end.

In some embodiments the low mass regions are distributed substantially about an entire outer periphery of the diaphragm and the high mass regions are a central region of the diaphragm.

In some embodiments a distribution of mass of the normal stress reinforcement is such that a relatively lower amount of mass is located at the one or more low mass regions.

In some embodiments some parts or all of the low mass regions are devoid of any normal stress reinforcement on one or more sides. Preferably at least 10 percent of a total surface area of one more peripheral regions are devoid of normal stress reinforcement.

In some embodiments the normal stress reinforcement comprises a reinforcement plate associated with each major side of the body, and wherein at least one reinforcement plate comprises one or more recesses at the one or more low mass regions.

In some embodiments, the normal stress reinforcement comprises a reduced width in the lower mass region, relative to other regions.

In some embodiments, the normal stress reinforcement comprises a reduced thickness in the lower mass region, relative to other regions.

In some embodiments a distribution of mass of the diaphragm body is such that the diaphragm body comprises a relatively lower mass at the one or more low mass regions. Preferably a thickness of the diaphragm body is reduced by tapering toward the one or more low mass regions, preferably from the centre of mass location.

In some embodiments the diaphragm body comprises a relatively lower mass at or adjacent one end. Preferably the diaphragm body comprises a relatively lower thickness at the one end. In some embodiments the thickness of the diaphragm body is tapered to reduce the thickness towards the one end. In other embodiments the thickness of the diaphragm body is stepped to reduce the thickness towards the one.

In some embodiments a thickness envelope or profile between both ends is angled at at least 4 degrees relative to a coronal plane of the diaphragm body or more preferably at least approximately 5 degrees relative to a coronal plane of the diaphragm body.

In some embodiments the one or more low mass regions are located at or beyond a radius centred around the centre of mass location of the diaphragm that is 50 percent of a total distance from the centre of mass location to a most distal periphery of the diaphragm. Preferably the one or more low mass regions are located at or beyond a radius centred around the centre of mass location of the diaphragm that is 80 percent of a total distance from the centre of mass location to a most distal periphery of the diaphragm.

In another aspect, the present invention broadly consists in a method for forming a diaphragm for an audio transducer, the method comprising the steps of:

- forming a lattice by interconnecting of a plurality of interconnected cells having a predetermined three-dimensional cell shape to form a diaphragm body having at least one major side with a substantially smooth profile; and
- connecting a solid membrane layer to at least one major side by applying adhesive to exposed ends of the cells on the respective major side and coupling the membrane layer against the adhesive.

In some embodiments, the respective major side may be rested on a layer of adhesive to consistently apply adhesive along at least a portion of the major side.

In another aspect the invention may consist of an audio transducer comprising:

- a diaphragm including a diaphragm body formed from a three-dimensional lattice having a plurality of interconnected cells of a predetermined three-dimensional cell shape; and
- a housing or other surround for accommodating the diaphragm therein or therebetween; and
- wherein the diaphragm comprises a periphery that is at least partially free from physical connection with an interior of the surround.

In another aspect the invention may consist of an audio transducer comprising:

- a diaphragm including a diaphragm body formed from a three-dimensional lattice having a plurality of interconnected and predetermined node units, each node unit consisting of a three-dimensional arrangement of a plurality of elongate members connected at a central node; and
- a housing or other surround for accommodating the diaphragm therein or therebetween; and
- wherein the diaphragm comprises a periphery that is at least partially free from physical connection with an interior of the surround.

Preferably the diaphragm comprises one or more peripheral regions that are free from physical connection with the interior of the surround. Preferably the outer periphery is significantly free from physical connection such that the one or more peripheral regions [that are free from physical connection] constitute at least 20%, or more preferably at least 30% of a length or perimeter of the periphery. More preferably the outer periphery is substantially free from physical connection such that the one or more peripheral regions constitute at least 50%, or more preferably at least 80% of a length or perimeter of the periphery. Most preferably the outer periphery is approximately entirely free from physical connection such that the one or more peripheral regions constitute at approximately an entire length or perimeter of the periphery.

In some embodiments a relatively small air gap separates the one or more peripheral regions of the diaphragm from the interior of the surround.

In some embodiments the transducer contains ferromagnetic fluid between the one or more peripheral regions of the diaphragm and the interior of the surround.

Preferably the ferromagnetic fluid provides significant support to the diaphragm in direction of the coronal plane of the diaphragm.

In some embodiments the transducer further comprises a transducing mechanism operatively coupled to the diaphragm and operative in association with movement of the diaphragm.

In another aspect the present invention broadly consists in an audio transducer comprising:

- a diaphragm including a diaphragm body formed from a three-dimensional lattice having a plurality of interconnected cells of a predetermined three-dimensional cell shape;
  - a transducer base structure, wherein the diaphragm is rotatably coupled relative to the transducer base structure to rotate during operation; and
  - a transducing mechanism operatively coupled to the diaphragm to transduce sound during rotation of the diaphragm.

In another aspect the present invention broadly consists in an audio transducer comprising:

- a diaphragm including a diaphragm body formed from a three-dimensional lattice having a plurality of interconnected and predetermined node units, each node unit consisting of a three-dimensional arrangement of a plurality of elongate members connected at a central node;
  - a transducer base structure, wherein the diaphragm is rotatably coupled relative to the transducer base structure to rotate during operation; and
  - a transducing mechanism operatively coupled to the diaphragm to transduce sound during rotation of the diaphragm.

Preferably the audio transducer further comprises a hinge system rotatably coupling the diaphragm to the transducer base structure.

In some embodiments the hinge system comprises one or more parts configured to facilitate movement of the diaphragm and which contribute significantly to resisting translational displacement of the diaphragm with respect to the transducer base structure, and which has a Young's modulus of greater than approximately 8 GPa, or more preferably higher than approximately 20 GPa.

Preferably all parts of the hinge assembly that operatively support the diaphragm in use have a Young's modulus greater than approximately 8 GPa, or more preferably higher than approximately 20 GPa.

Preferably all parts of the hinge assembly that are configured to facilitate movement of the diaphragm and contribute significantly to resisting translational displacement of the diaphragm with respect to the transducer base structure, have a Young's modulus greater than approximately 8 GPa, or more preferably higher than approximately 20 GPa.

In some embodiment, the hinge system comprises a hinge assembly having one or more hinge joints, wherein each hinge joint comprises a hinge element and a contact member, the contact member having a contact surface; and wherein, during operation each hinge joint is configured to allow the hinge element to move relative to the associated contact member while maintaining a substantially consistent physical contact with the contact surface, and the hinge assembly biases the hinge element towards the contact surface.

Preferably, hinge assembly further comprises a biasing mechanism and wherein the hinge element is biased towards the contact surface by a biasing mechanism.

Preferably the biasing mechanism is substantially compliant.

Preferably the biasing mechanism is substantially compliant in a direction substantially perpendicular to the contact surface at the region of contact between each hinge element and the associated contact member during operation.

In some other embodiments, the hinge system comprises at least one hinge joint, each hinge joint pivotally coupling the diaphragm to the transducer base structure to allow the diaphragm to rotate relative to the transducer base structure about an axis of rotation during operation, the hinge joint being rigidly connected at one side to the transducer base structure and at an opposing side to the diaphragm, and comprising at least two resilient hinge elements angled relative to one another, and wherein each hinge element is closely associated to both the transducer base structure and the diaphragm, and comprises substantial translational rigidity to resist compression, tension and/or shear deformation along and across the element, and substantial flexibility to enable flexing in response to forces normal to the section during operation.

In some embodiments a thickness of the diaphragm body reduces from the axis of rotation to the opposing terminal end of the diaphragm body.

In another aspect the present invention broadly consists in an audio device including any one of the above audio transducers and further comprising a decoupling mounting system located between the diaphragm of the audio transducer and at least one other part of the audio device for at least partially alleviating mechanical transmission of vibration between the diaphragm and the at least one other part of the audio device, the decoupling mounting system flexibly mounting a first component to a second component of the audio device.

Preferably the at least one other part of the audio device is not another part of the diaphragm of an audio transducer of the device. Preferably the decoupling mounting system is coupled between the transducer base structure and one other part. Preferably the one other part is the transducer surround.

In some embodiments the audio transducer is an electroacoustic loudspeaker and further comprises a force transferring component acting on the diaphragm for causing the diaphragm to move in use.

Preferably the transducing mechanism comprises an electromagnetic mechanism. Preferably the electromagnetic mechanism comprises a magnetic structure and an electrically conductive element.

Preferably force transferring component is attached rigidly to the diaphragm

In another aspect the invention may consist of an audio device comprising two or more electro-acoustic loudspeakers incorporating any one or more of the audio transducers of the above aspects and providing two or more different audio channels through capable of reproduction of independent audio signals. Preferably the audio device is personal audio device adapted for audio use within approximately 10 cm of the user's ear.

In another aspect the invention may be said to consist of a personal audio device configured to locate within 10 cm of a user's ears in use, and incorporating any combination of one or more of the audio transducers and its related features, configurations and embodiments of any one of the previous audio transducer aspects.

In another aspect the invention may be said to consist of a personal audio device comprising a pair of interface devices configured to be worn by a user at or proximal to each ear, wherein each interface device comprises any combination of one or more of the audio transducers and its related features, configurations and embodiments of any one of the previous audio transducer aspects.

In another aspect the invention may be said to consist of a headphone apparatus comprising a pair of headphone interface devices configured to be worn on or about each ear, wherein each interface device comprises any combination of one or more of the audio transducers and its related features, configurations and embodiments of any one of the previous audio transducer aspects.

In another aspect the invention may be said to consist of an earphone apparatus comprising a pair of earphone interfaces configured to be worn within an ear canal or concha of a user's ear, wherein each earphone interface comprises any combination of one or more of the audio transducers and its related features, configurations and embodiments of any one of the previous audio transducer aspects.

In another aspect the invention may be said to consist of an audio transducer of any one of the above aspects and related features, configurations and embodiments, wherein the audio transducer is an acoustoelectric transducer.

Any one or more of the above embodiments or preferred features can be combined with any one or more of the above aspects.

The phrase "operatively coupled" as used in this specification and claims in relation to two components, devices or systems means "directly or indirectly coupled" such that analogue or digital signals or data may be transmitted between the two components, devices or systems.

The phrase "audio transducer" as used in this specification and claims is intended to encompass an electroacoustic transducer, such as a loudspeaker, or an acoustoelectric transducer such as a microphone. Although a passive radiator is not technically a transducer, for the purposes of this specification the term "audio transducer" is also intended to include within its definition passive radiators.

The phrase "force transferring component" as used in this specification and claims means a member of an associated transducing mechanism within which:

a) a force is generated which drives a diaphragm of the transducing mechanism, when the transducing mechanism is configured to convert electrical energy to sound energy; or b) physical movement of the member results in a change in force applied by the force transferring component to the diaphragm, in the case that the transducing mechanism is configured to convert sound energy to electrical energy.

The phrase "personal audio" as used in this specification and claims in relation to a transducer or a device means a loudspeaker transducer or device operable for audio reproduction and intended and/or dedicated for utilisation within close proximity to a user's ear or head during audio reproduction, such as within approximately 10 cm the user's ear or head. Examples of personal audio transducers or devices include headphones, earphones, hearing aids, mobile phones and the like.

The term "comprising" as used in this specification and claims means "consisting at least in part of". When interpreting each statement in this specification and claims that includes the term "comprising", features other than that or those prefaced by the term may also be present. Related terms such as "comprise" and "comprises" are to be interpreted in the same manner.

It is intended that reference to a range of numbers disclosed herein (for example, 1 to 10) also incorporates reference to all rational numbers within that range (for example, 1, 1.1, 2, 3, 3.9, 4, 5, 6, 6.5, 7, 8, 9 and 10) and also any range of rational numbers within that range (for example, 2 to 8, 1.5 to 5.5 and 3.1 to 4.7) and, therefore, all sub-ranges of all ranges expressly disclosed herein are hereby expressly disclosed. These are only examples of what is specifically intended and all possible combinations of numerical values between the lowest value and the highest value enumerated are to be considered to be expressly stated in this application in a similar manner.

As used herein the term "and/or" means "and" or "or", or both.

As used herein "(s)" following a noun means the plural and/or singular forms of the noun.

Frequency Range of Operation

The phrase "frequency range of operation" (herein also referred to as FRO) as used in this specification and claims in relation to a given audio transducer is intended to mean the audio-related FRO of the transducer as would be determined by persons knowledgeable and/or skilled in the art of acoustic engineering, and optionally includes any application of external hardware or software filtering. The FRO is hence the range of operation that is determined by the construction of the transducer.

As will be appreciated by those knowledgeable and/or skilled in the relevant art, the FRO of a transducer may be determined in accordance with one or more of the following interpretations:

1. In the context of a complete speaker system or audio reproduction system or personal audio device such as a headphone, earphone or hearing aid etc., the FRO is the frequency range, within the audible bandwidth of 20 Hz to 20 kHz, over which the Sound Pressure Level (SPL) is either greater than, or else is within 9 dB below (excluding any narrow bands where the response drops below 9 dB), the average SPL produced by the entire system over the frequency band 500 Hz-2000 Hz (average calculated using log-scale weightings in both SPL (i.e. dB) and frequency domain), in the case that the device is designed for accurate audio reproduction, or in other cases, such as that the device is designed for another purpose such as hearing enhancement or noise cancellation, the FRO will be as determined by person(s) knowledgeable in the art. If the speaker system etc. is a typical personal audio device then the SPL is to be measured relative to the 'Diffuse Field' target reference of Hammershoi and Moller shown in FIG. F, for example.
2. In the context of a loudspeaker driver operationally installed as part of a speaker system or audio reproduction system, the FRO is the frequency range over which the sound that the transducer produces contributes, either directly or indirectly via a port or passive radiator etc., significantly to the overall SPL of audio reproduction of the speaker or audio reproduction system within said systems FRO;
3. In the context of a passive radiator operationally installed as part of a speaker system or audio reproduction system, the FRO is the frequency range over which the sound that the passive radiator produces contributes significantly to the overall Sound Pressure Level (SPL) of audio reproduction of the speaker or audio reproduction system, within said systems FRO;
4. In the context of a microphone, the FRO is the frequency range over which the transducer contributes, either directly or indirectly, significantly to the overall level of audio recording, within the bandwidth being recorded by the overall (mono-channel) recording device of which the transducer is a component, as measured with any active and/or passive crossover filtering, that either occurs in real time or else would be intended to occur post-recording, that alters the amount of sound produced by one or more transducers in the system; or
5. In the case that the associated transducer is not operationally installed as part of a speaker system or audio reproduction system or microphone, the FRO is the bandwidth over which the transducer is considered to be suitable for proper operation as judged by those knowledgeable and/or skilled in the relevant art.

In the context of a mobile phone transducer intended for voice reproduction with the transducer located within approximately 5-10 cm of a user's ear, the FRO is considered to be the audio bandwidth normally applied in this voice reproduction scenario.

For the above set of included interpretations of the phrase FRO, the frequency range referred to in each interpretation is to be determined or measured using a typical industry-accepted method of measuring the related category of speaker or microphone system. As an example, for a typical industry-accepted method of measuring the SPL produced by a typical home audio floor standing loudspeaker system: measurement occurs on the tweeter-axis, and anechoic frequency response is measured with a 2.83 VRMS excitation signal at a distance determined by proper summing of all drivers and any resonators in the system. This distance is determined by successively conducting the windowed measurement described below starting at 3 times the largest dimension of the source and decreasing the measurement distance in steps until one step before response deviations are apparent.

The lower limit of the FRO of a particular driver in the system is either the −6 dB high-pass roll-off frequency produced by a high-pass active and/or passive crossover and/or by any applicable pre-filtering of the source signal and/or by the low frequency roll-off characteristics of the combination of the driver and/or any associated resonator (e.g. port or passive radiator etc., said resonator being associated with said driver), or else is the lower limit of the FRO of the system, whichever is the higher frequency of the two.

Typically the upper limit of the FRO of a particular driver in the system is either the −6 dB low-pass roll-off frequency produced by a low-pass active and/or passive crossover and/or other filtering and/or by any applicable pre-filtering of the source signal and/or by the high frequency roll-off characteristics of the combination of the driver, or else is the upper limit of the FRO of the system, whichever is the lower frequency of the two.

A typical headphone measurement set-up would include the use of a standard head acoustics simulator.

The invention consists in the foregoing and also envisages constructions of which the following gives examples only. Further aspects and advantages of the present invention will become apparent from the ensuing description.

BRIEF DESCRIPTION OF THE DRAWINGS

Preferred embodiments of the invention will be described by way of example only and with reference to the drawings, in which:

FIGS. 16A-O shows a hinge-action loudspeaker driver incorporating a lattice diaphragm, hinged using contact surfaces that roll against each other and a biasing force applied using a flat spring, with:

FIG. 16A being a 3D isometric view of the driver,

FIGS. 18A-H shows the right side ear cup of the pair of headphones shown in FIG. 17, incorporating the hinge-action loudspeaker driver of FIGS. 16A-O, with:

FIG. 18A being a 3D isometric view, showing the padded side of the cup,

FIG. 18B being a 3D isometric view, showing the outward facing, back side of the cup, FIG. 18C being a back side elevation view of the cup, FIG. 18D being a cross-sectional view (section D-D of FIG. 18C), FIG. 18E being a cross-sectional view (section E-E of FIG. 18D), FIG. 18F being a detail view of the decoupling mount shown in FIG. 18E;

FIG. 18G being a cross-sectional view (section F-F of FIG. 18D),

FIG. 18H being an exploded 3D isometric view;

FIGS. 23A-J show a partially free periphery implementation of a linear action transducer incorporating the lattice diaphragm of FIG. 21A with:

FIG. 23A being a 3D isometric view, angled to show the top side of the diaphragm;

FIG. 23B being a front view;

FIG. 23C being a top view;

FIG. 23D being a detail view of FIG. 23C suspension member;

FIG. 23E being a cross-sectional view A-A of FIG. 23B, with only the face cut by the section line shown;

FIG. 23F being a detail view of FIG. 23E suspension member;

FIG. 23G being a section view of F-F of FIG. 23B;

FIG. 23H being a detail view of FIG. 23G showing the gap between diaphragm and surround;

FIG. 23I being a detail view of FIG. 23G showing the ferrofluid support in the excitation mechanism;

FIG. 23J being an exploded view of the transducer;

DETAILED DESCRIPTION OF PREFERRED EMBODIMENTS

Figure 2A:
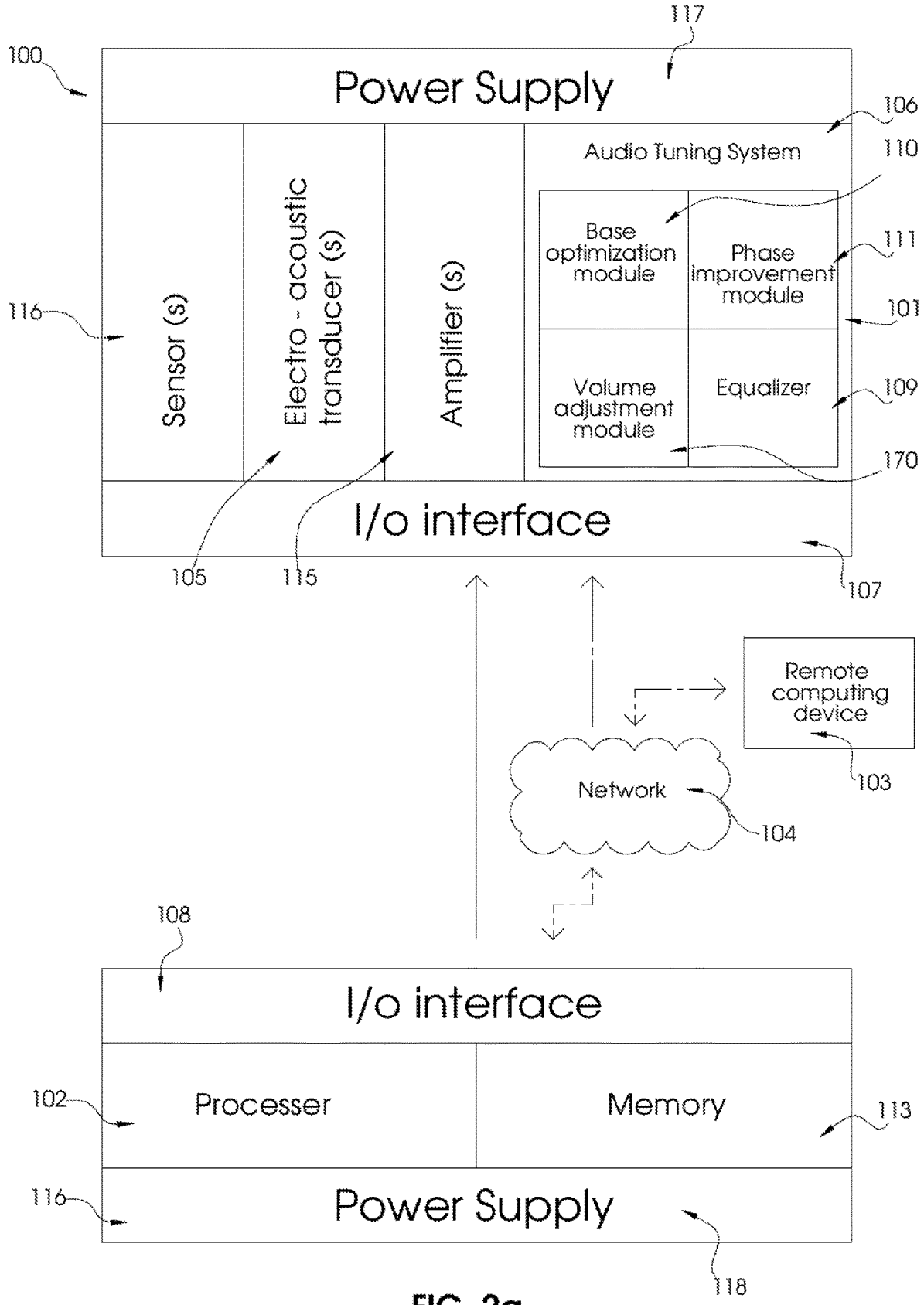
FIG. 2A is a block diagram showing a first preferred audio system of the invention incorporating an audio tuning system in a personal audio device.

Referring to FIG. 2A, a first preferred embodiment of a personal audio system 100 of the invention is shown comprising a personal audio device 101 and an audio source device 102, either or both devices 101 and 102 being optionally capable of communicating to a remote computing device 103 via a network 104.

In this specification, reference to a "personal audio system" is intended to mean an audio system including a personal audio device. A personal audio device, including for example headphones, earphones, mobile phones and hearing aids is a device that incorporates electro-acoustic transducers designed to be normally located within very close proximity of a user's head or in direct association with a user's head to transduce sound directly into the user's ears. Such devices are typically configured to locate within approximately ten centimetres or less of a user's head or ears in use, for example. Personal audio devices are typically compact and portable, and thus the electro-acoustic transducers incorporated therein are also substantially more compact than in other applications such as home audio systems, televisions, and desktop and laptop computers for example. Such size requirements typically limits flexibility for achieving a desired sound quality, as factors such as the number of electro-acoustic transducers that can be incorporated have to be considered. More often than not, a single electro-acoustic transducer may be required for providing the full audio range of the device, for example, which could potentially limit the quality of the device.

The personal audio device 101 is an electro-acoustic device comprising at least one output channel having a housing and at least one electro-acoustic transducer 105 located within the housing. During operation, the personal audio device 101 is configured to receive audio signals from the audio source 102 and direct the audio signals to the electro-acoustic transducer(s) 105 for sound generation. The personal audio system 100 further comprises an audio tuning system 106. The audio tuning system 106 is configured to optimise the sound output from the electro-acoustic transducer(s) 105, preferably based on the characteristics of the system 100 and/or device 101. In this embodiment, the audio tuning system 106 is implemented within the personal audio device 101. As will be explained in further detail, the audio tuning system 106 may otherwise be implemented in the audio source device 102 or even in a remote device, such as the remote computing device 103 in alternative embodiments. In yet another alternative, the various functions or circuits of the audio tuning system 106 may be separately implemented in multiple discrete devices, such as in any combination of two or more of the personal audio device 101, the audio source device 102 and the remote computing device 103. The audio tuning system 106 may be implemented in hardware or in software that may be stored in electronic memory and executed by a processor, or any combination thereof.

The audio source 102 may be a computing device with a media player, such as a mobile phone, a personal computer or tablet, however, the audio source 102 may include any other form of device that is capable of outputting audio signals such as a radio, a compact disc player, a video system, a communication device, a navigation system and any other device that may form part of a multimedia system for example.

The personal audio device 101 may comprise a communications interface 107 for transmission and/or reception of signals/data to/from external devices including the audio source device 102, and optionally one or more remote computing devices 103. The communication interface 107 may include for example any combination of a data port and/or a wireless transceiver, software/hardware for implementing analogue to digital converters (ADCs) and/or digital to analogue converters (DACs) and software/hardware for receiving/transmitting data in accordance with a desired communications protocol. Audio source device 102 comprises a corresponding communications interface 108 for transmission and/or reception of signals/data to/from external devices including the personal audio device 101, and optionally one or more remote computing devices 103. Communication between the personal audio device 101 and the audio source device 102 may be achieved via cable, or alternatively wirelessly via wireless transceivers and appropriate wireless communication interfaces for example. The wireless communication interfaces may operate in accordance with any suitable wireless protocol/standard known in the art, such as Bluetooth™, Wi-Fi and/or Near Field Communication (NFC) for example. The personal audio device 101 and/or audio source device 102 may communicate to one another via a network 104, such as the internet, and optionally either one or both may communicate to one or more remote devices 103 via such network 104.

The audio tuning system 106 comprises one or more tuning modules configured to optimise audio signals received from the audio source prior to playback via the electro-acoustic transducer(s) 105. A module may be a software or hardware engine or circuit or any combination thereof configured to perform one or more functions or tasks. In a preferred embodiment the audio tuning system 106 comprises an equalisation module 109 (hereinafter referred to as: equaliser 109), an adaptive bass optimisation module 110, a phase improvement module 111 and a volume adjustment module 170. These modules may be separate or otherwise two or more may be integral with one another as will be described in further detail below. Furthermore, in alternative embodiments the audio tuning system 106 may comprise any combination of one or more of the equaliser 109, adaptive bass optimisation module 110, phase improvement module 111 and/or volume adjustment module 170 and the invention is not intended to be limited to the particular combination of the preferred embodiment described herein. The audio tuning system 106 is configured to optimise at least one but preferably all output channels of the personal audio device. The audio source 102 may generate audio signals for one or more audio channels. As such the personal audio device 101 may comprise a single audio output channel or multiple audio output channels (most likely two audio output channels). In the case of the latter, the audio tuning system 106 is configured to optimise the audio signals for at least one but preferably all transducer(s) 105 of each audio output channel. There may be one or more of each of the tuning modules 109-111, 170 per electro-acoustic transducer or per output audio channel, or the channels may share a common module 109-111, 170.

The audio tuning modules 109-111, 170 of the tuning system 106 may be implemented in one or more signal processors capable of performing logic to process audio signals from the audio source 102. The signal processor(s) may be microprocessors, digital signal processor(s), application specific integrated circuits (ASICs), field programmable gate arrays (FPGAs), other programmable logic components, discrete hardware components, or any combination thereof designed to perform the functions of the modules 109-111, 170 described herein. The signal processor(s) may include signal processing components such as filters, digital-to-analogue converters (DACs), analogue-to-digital converters (DACs), signal amplifiers, decoders or other audio processing components known in the art. The functions of the modules 109-111, 170 may be implemented directly in hardware or in software executable by the signal processor(s), or in a combination of both. Software may reside in RAM memory, flash memory, ROM memory, EPROM memory, EEPROM memory, registers, hard disk, a removable disk, a CD-ROM, or any other form of electronic memory known in the art. The electronic memory is accessible by the signal processor(s) such that the processor(s) can read information from, and write information to, the memory. The electronic memory may be local to the signal processor(s), remote on a separate device, or any combination thereof. In the alternative, the electronic memory may be integral to the processor(s). Furthermore, information or data that is received, processed and/or generated by the audio tuning modules 109-111, 170 may be stored in the electronic memory. Such data may include parameter values, user input data, predetermined frequency response data, and/or any other information related to processing of audio signals as would be apparent to those skilled in the art. Some data may be stored in files that are downloadable by the audio tuning system 106 from the audio source device 102, or from a remote computing device 103 via network 104 for example.

Similarly, the audio source device 102 may comprise one or more signal processor(s) and associated electronic memory component(s) for generating audio signals for driving the electro-acoustic transducers 105 of one or more output audio channels of the personal audio device 101. Information or data associated with the audio signals may be stored in the electronic memory. Such data may include media files, user input data and/or any other information related to processing of audio signals as would be apparent to those skilled in the art. Some data may be stored in files that are downloadable from a remote computing device 103 via network 104 for example. The personal audio device 101 may further comprise one or more audio amplifiers 115 operatively coupled to the output of the audio tuning system 106 and to the input of the electro-acoustic transducer(s) 105. There may be one or more amplifier(s) 115 per channel.

The personal audio device 101 may further comprise one or more sensor(s) 116 configured to acquire data indicative of operating parameters of the associated electro-acoustic transducer(s) during operation. Such sensor(s) may include voltage or current sensors, displacement sensor(s) and/or acoustic sensors, such as acousto-electric transducer(s) for example.

The personal audio device 101 may comprise an on-board power supply 117 such as a battery or batteries which may be rechargeable, for powering the various electronic circuits of the device as is well known in the art. Similarly, the audio source device 102 may comprise an on-board power supply 118 such as a battery or batteries which are rechargeable, for powering the various electronic circuits of the device as is well known in the art.

1. Audio Tuning System Embodiments

1.1 Overview of First and Second Preferred Configurations

In a first preferred embodiment shown in FIG. 2A, the audio tuning system 106 including equaliser 109, adaptive bass optimisation module 110 and phase improvement module 111 is implemented in one or more signal processor(s) of the personal audio device 101. These may be housed in a single housing of one of the output audio channels of the device 101. In a double-channel application, such as headphones, earphones and hearing aids, they may be housed in a single housing of one of the channels of the device 101, or the audio tuning system 106 may be divided amongst the two channels and located in each housing of the respective channels. Audio signals received by from the audio source device 102 for the output audio channels, optionally by communications interface 107, are directed to the audio tuning system 106 where they are processed to optimise them for a personal audio application and in particular for the particular personal audio device 101. Some or all data relating to the operating characteristics or parameters of the personal audio device necessary for optimisation may be stored in local memory and/or some or all data relating to the operating characteristics may be obtained remotely from the audio source device 102 or another computing device 103. The audio tuning system 106 may comprise a separate system initialisation module that is operable upon reception of a trigger for obtaining such data, and/or the audio tuning system may comprise an automated data acquisition module configured to obtain some operating characteristic information in-situ upon request from another module, for instance. Also, operational feedback necessary for optimisation may also be acquired by sensor(s) 116 and fed back into the auto tuning system 106 for continuous optimisation of audio signals during playback. The optimised signals are output by the auto tuning system 106 to the amplifier 109 of each output audio channel where the signal is amplified for driving the electro-acoustic transducer(s) 105 of that channel.

Figure 2B:
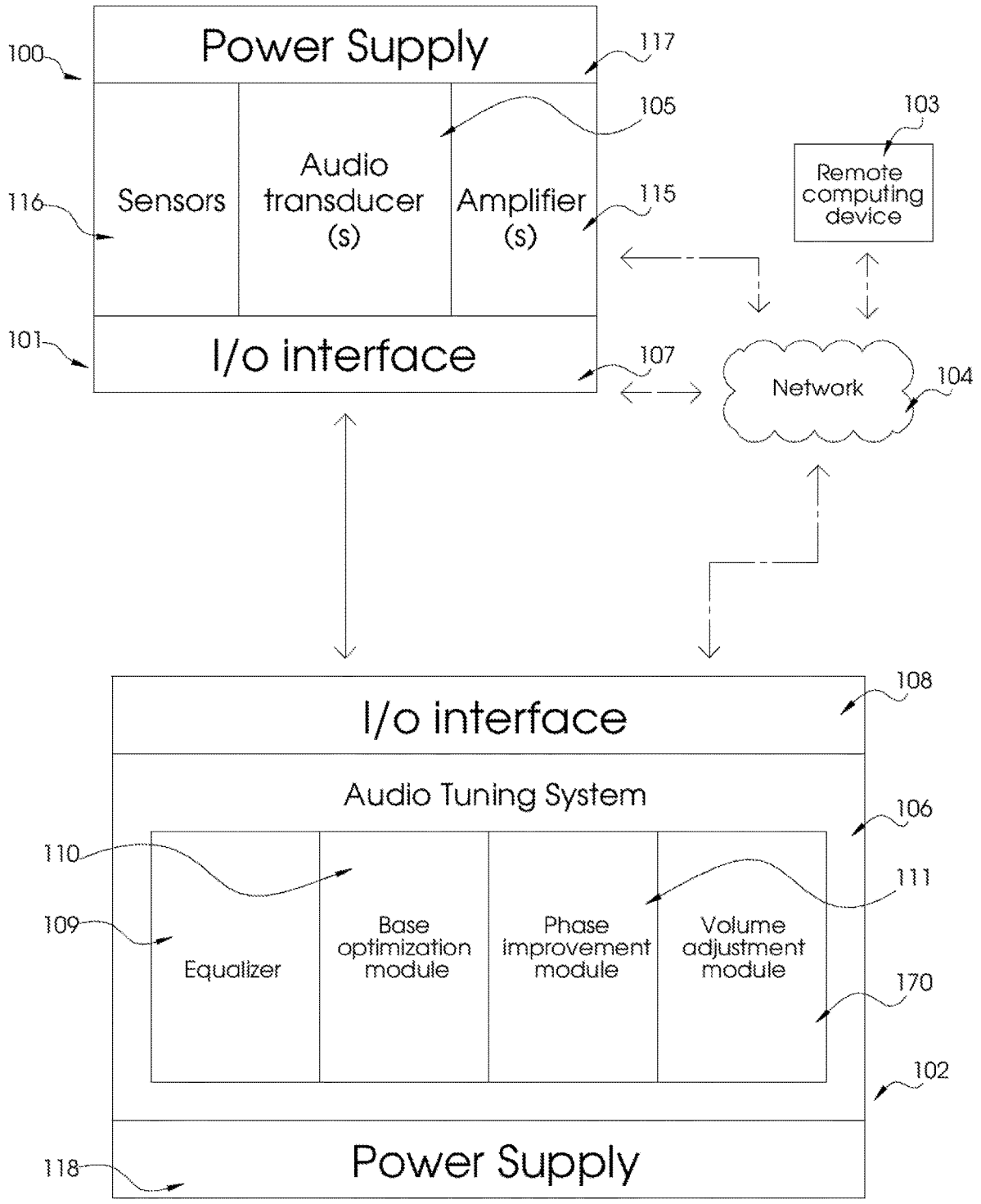
FIG. 2B is a block diagram showing a second preferred audio system of the invention incorporating an audio tuning system in an audio source device.

In a second preferred embodiment shown in FIG. 2B, the audio tuning system 106 of the invention is implemented in the audio source device 102 instead of the personal audio device 101. In such an embodiment the audio tuning modules optimise the audio signals for the one or more channels of the personal audio device 101 prior to transmission to the audio device 101. As such the audio tuning modules 109-111, 170 may be implemented in the signal processor(s) and memory of the audio source device 102. One or more amplifiers 115 may also be located on the audio source device 102, although these could also or alternatively be located in the personal audio device 101. Some or all data relating to the operating characteristics or parameters of the personal audio device necessary for optimisation may be stored in local memory and/or some or all data relating to the operating characteristics may be obtained from the personal source device 101. In another configuration some or all data may be obtained from a remote computing device 103 using an identification code associated with the personal audio device 101. The identification code may be stored locally, input by the user or otherwise obtained from the personal audio device 101 which has it stored in local memory. Operational feedback necessary for optimisation and acquired by sensor(s) 116 is sent to the auto tuning system 106 of the audio source device 102 via communications interface 107 for continuous optimisation of audio signals during playback. In this embodiment, the optimised signals are received by the communications interface 107 of the personal audio device and sent directly to the electro-acoustic transducer(s) 105 of each channel (optionally via amplifier(s) 115 for each channel).

In yet another embodiment, the audio tuning system 106 may be implemented in a software program that is accessible by a processor of an audio source device, a processor of the personal audio device, or another dedicated audio tuning processing device that is associated with the personal audio device. The software program may have implemented therein the various modules of the audio tuning system including any combination of one or more of the: equaliser 109, bass optimisation module 110, phase improvement module 111 and/or volume control module 170.

In any one of the above embodiments, the audio tuning system 106 may be configurable in accordance with a particular personal audio device and/or a particular output channel or output channels of a personal audio device. In such an implementation, the audio tuning system 106 may be operable in a calibration stage that is either automatically triggered or triggered by a user generated input for example. The calibration stage may consist of reception of information indicative of calibration settings including one or more of: equaliser parameter settings, phase improvement settings and/or bass optimisation settings. Data indicative of such settings may also be obtained during this stage. The settings may be default settings that can be updated in situ by a user or by other modules of the audio tuning system. The calibration settings may be stored in a file for example that may be obtained by the audio tuning system via the communications interface from a remote source. In any one of the above embodiments, the audio tuning system 106 may be configurable to apply one of a plurality of predetermined or user-generated audio tuning optimisation settings for each personal audio device. The settings may include any one or more of: equaliser parameter settings, phase improvement settings and/or bass optimisation settings. In this manner, one of various pre-stored setting options may be selected by a user or by the audio tuning system 106 to optimise audio signals when certain conditions are required or desired.

The functions of the modules 109-111 and 170 of the audio tuning system 106 will now be described in further detail with reference to FIG. 3.

1.2 Equalisation Module

In a preferred embodiment the audio tuning system 106 of the invention includes an equaliser 109 configured to equalise received audio signals for each output channel of the associated personal audio device 101. In personal audio applications, subjective sound quality is affected by the close proximity of the device relative to the user. The equaliser 109 optimises the frequency response of each channel of the personal audio device 101 to improve this subjective sound quality. It does so by altering the frequency response of the audio system to match or approximate an optimal frequency response curve (hereinafter referred to as: target response). The target response is preferably predetermined, or at least an initial default target response is predetermined. In some embodiments however the target response may be adjustable, either by the system or by a user in situ. There may be a plurality of target responses that are stored in memory from which the audio tuning system 106 and/or a user may select when certain audio requirements and/or conditions are to be met.

The input of the equaliser 109 is operatively coupled to an audio output of the audio source device 102 and is configured to receive audio signals for one or more channels to be equalised. The equaliser 109 may be directly coupled to the audio output of the audio source device 102 or otherwise it may be coupled indirectly through one or more other system modules or devices, such as via volume adjustment module 170 which will be described in further detail below. The equaliser 109 outputs equalised audio signals for one or more channels. The output of the equaliser 109 is operatively coupled to the electro-acoustic transducer(s) 105 of each channel to drive the transducer(s) 105 and generate sound in accordance with the equalised signals. The equaliser 109 may be directly coupled to the electro-acoustic transducer(s) 105 or otherwise indirectly coupled via one or more other system modules or devices, such as via the bass optimisation and phase improvement modules 110 and 111, and/or via one or more amplifiers 115.

The equaliser 109 comprises one or more filters for each audio channel that is/are configured to adjust the balance between frequency components of a received audio signal. The filter(s) achieve this by removing or weakening unwanted frequency components and/or accepting or enhancing wanted frequency components of the audio signal to collectively achieve the target response. As previously mentioned, the signal processing of equaliser 109 may be implemented in digital and/or analogue components. As such, the filter(s) of equaliser 109 may be any combination of one or more of the following filter types: passive or active filters; linear or non-linear filters; analogue or digital filters; infinite impulse response (IIR) or finite impulse response (FIR) filters; and/or high-pass, low-pass, band-pass or band-stop filters. This list of filter types is non-exhaustive and other types of filters known in the art may in addition or alternatively be implemented. In preferred embodiments the filters used by the equaliser are linear phase FIR filters.

Target Response

The target response may be a frequency response that a particular channel or group of channels are targeted toward. This is herein referred to as the frequency response of the audio system or of the personal audio device. In a personal audio device there are typically two output channels, both may be given the same or a different target responses. Preferably they both share the same target response. The audio system 100 may have one or more target responses, such as a different target response for different channels or it may have one common target response for all channels.

The target response may be a target curve or target function for example that is determined or predetermined and stored in a memory component associated with and accessible by the audio tuning system 106. It may be provided in a setup file for example that can be downloaded by the audio tuning system during a system initialisation stage. The target response may be generated based on previous experimentation and/or simulation, in-situ data, research or any other method for providing a desired target response for a personal audio application. In-situ data may be data that is acquired during operation using an audio sensor near one or more speakers, such as a microphone. Depending on many factors the parameters that make up a target response may be different. For example additional bass may be a desired quality for personal audio applications.

Figure 1:
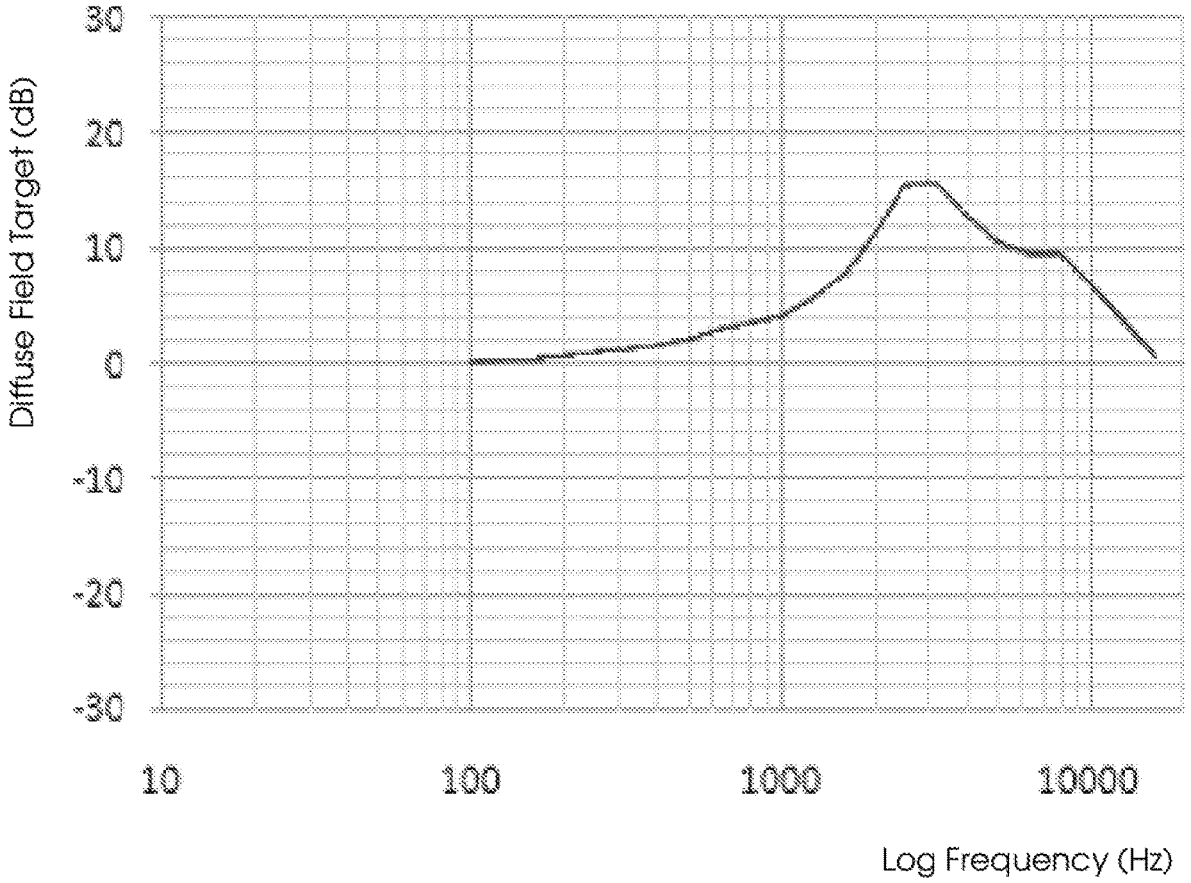
FIG. 1 is an eardrum reference diffuse field curve. Source: Determination of Noise Emission From Sound Sources Close to the Ears. Authors: Hammershøi, Dorte; Møller, Henrik. Acta Acustica united with Acustica, Volume 94, Number 1, January/February 2008, pp. 114-129(16)
Figure 4:
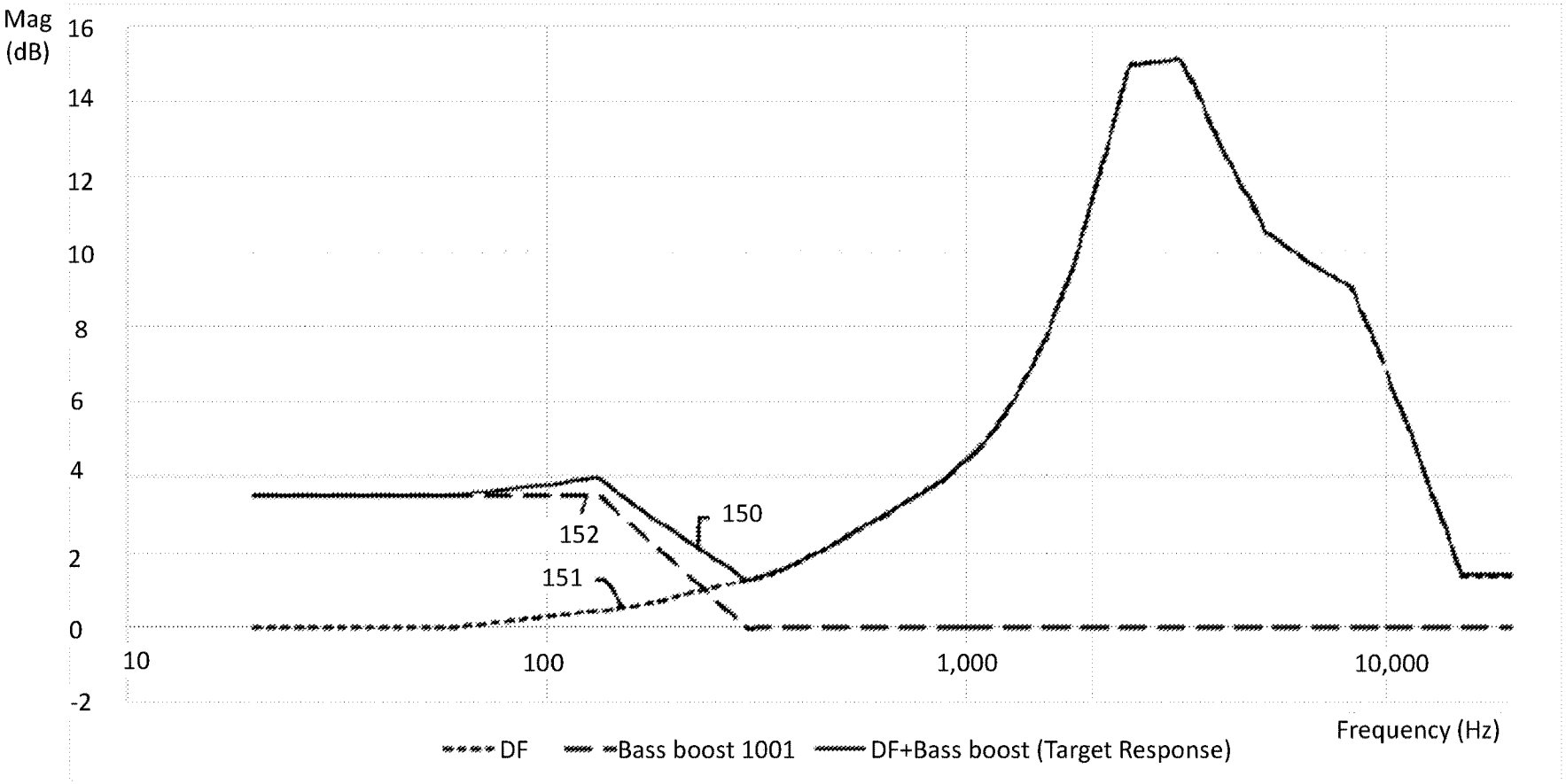
FIG. 4 is a graph showing a preferred target response of an equaliser of the audio tuning system of FIG. 3.

Referring to FIG. 4, in a preferred embodiment, the target response 150 for each output channel of the audio system 100 includes a diffuse field component 151 and a bass boost component 152. An exemplary diffuse field component 151 is shown in FIG. 4 and it is the same or similar to the diffuse field response of FIG. 1 published by Hammershoi and Moller (Hammershøi and H. Møller, "Determination of Noise Emission from Sound Sources Close to the Ears," *Acta Acustica*, Vol. 94 No. 1 (January 2008)), which is hereby incorporated by reference. In particular, the diffuse field component of the target response may be approximated by the audio tuning system 106 using any combination of one or more of the following response profiles.

A first approximation of the diffuse field response comprises:

- a substantially continuously increasing magnitude from approximately 0 dB at approximately 100 Hz to approximately 15 dB at approximately 2500 Hz; and
- a substantially uniform magnitude from approximately 2500 Hz to approximately 3200 Hz; and
- a substantially decreasing magnitude from approximately 15 db at approximately 3200 Hz to approximately 7 dB at approximately 10 kHz.

Preferably the magnitude between approximately 100 Hz and approximately 2500 Hz comprises a substantially curved profile, e.g. an approximately increasing gradient from 100 Hz to 2500 Hz.

Preferably the magnitude between approximately 3200 Hz and 10 kHz comprises a substantially stepped profile.

A second approximation of the diffuse field response comprises:

- a first frequency band between approximately 100 Hz and approximately 400 Hz with a magnitude rising from approximately 0 dB to approximately 2 dB;
- a second frequency band between approximately 400 Hz and approximately 1000 Hz with a magnitude rising from approximately 2 dB to approximately 4.5 dB;
- a third frequency band between approximately 1000 Hz and approximately 2500 Hz with a magnitude rising from approximately 4.5 dB to approximately 15 dB;
- a fourth frequency band between approximately 2500 Hz and 3200 Hz with a substantially uniform magnitude of approximately 15 dB;
- a fifth frequency band between approximately 3200 Hz to 5200 Hz with a magnitude decreasing from approximately 15 dB to approximately 10.5 dB;
- a seventh frequency band between approximately 5200 Hz and 8200 Hz with magnitude decreasing from approximately 10.5 dB to approximately 9 dB; and an eight frequency band between approximately 8200 Hz and 14 kHz with a magnitude decreasing from approximately 9 dB to approximately 2 dB.

A third approximation of the diffuse field response comprises:

an average magnitude of approximately 2.7 dB over a frequency range of approximately 300 to approximately 1000 Hz;

an average magnitude of approximately 13.4 dB over a frequency range of approximately 2 kHz to approximately 6 kHz; and an average magnitude of approximately 7.3 dB over a frequency range of approximately 6 kHz to approximately 14 kHz.

A fourth approximation of the diffuse field response comprises:

an average magnitude over a frequency range of approximately 2 kHz to approximately 6 kHz that is approximately 8-12 dB higher than an average magnitude over a frequency range of approximately 300 kHz to approximately 1000 Hz; and an average magnitude over a frequency range of approximately 6 kHz to approximately 14 kHz that is approximately 3-6 dB higher than an average magnitude over a frequency range of approximately 300 Hz to approximately 1000 Hz.

In alternative embodiments a different diffuse field target is used, such as a diffuse target specific to the equipment on which the transducer response is measured.

The audio tuning system is configured to generate or store an equalisation frequency response that is based on diffuse field response and/or any one of the first to fourth approximations identified above and/or an alternative diffuse field response. Other similar approximations may also be utilized and the invention is not intended to be limited to these examples.

In addition to the diffuse field component 151, in a preferred embodiment the target response further comprises a bass boost component 152. An exemplary bass boost component 152 is also shown in FIG. 4. The bass boost component of the target response consists of a frequency response which amplifies an audio signal within the bass frequency band of approximately 20 Hz to approximately 200 Hz relative to a diffuse field frequency response magnitude over the bass frequency band. This may for example compensate for the fact that shaking of parts of the body beyond the ear that is a normal part of the listening experience, is not replicated by the personal audio device. This may create some loss of naturalness of tone colours, however the overall effect may be more pleasing to many listeners.

The amount of amplification in the bass region of approximately 20 Hz to 200 Hz by the bass boost component may be pre-set and/or adjustable. For instance there may be a default bass boost component that the equalisation frequency response is based on, and optionally this bass boost component may be adjustable by a user and/or by other modules in the system to enhance the listening experience depending on the personal audio device characteristics, depending on the received audio signals and/or depending on user preferences. The bass boost component may be parametrically adjustable or otherwise the audio tuning system 106 may be configured to access memory having stored therein multiple predetermined bass boost components to adjust the target response accordingly.

An exemplary overall target response 150 including the diffuse field and the bass boost components is shown in FIG. 4. It will be appreciated that in alternative embodiments other target responses may be used by any one or more of the channels of the personal audio device as may be desired by the particular application. The diffuse field including bass boost target response achieves subjectively natural sound while also compensating for the lack of body shaking in personal audio devices. It will be appreciated that whilst this is the preferred response for the present invention, other equalisation frequency responses may be incorporated with departing from the scope of the invention. For instance an x-curve response may be incorporated in some implementations and/or a 'Harman' target curve such as is described in the paper 'Factors that influence Listeners' Preferred Bass and Treble Balance in Headphones' Sean E. Olive and Todd Welti, AES Convention Paper 9382 Presented at the 139th Convention, 2015 Oct. 29-Nov. 1, may be used in some implementations.

Equalisation Frequency Response

Figure 3:
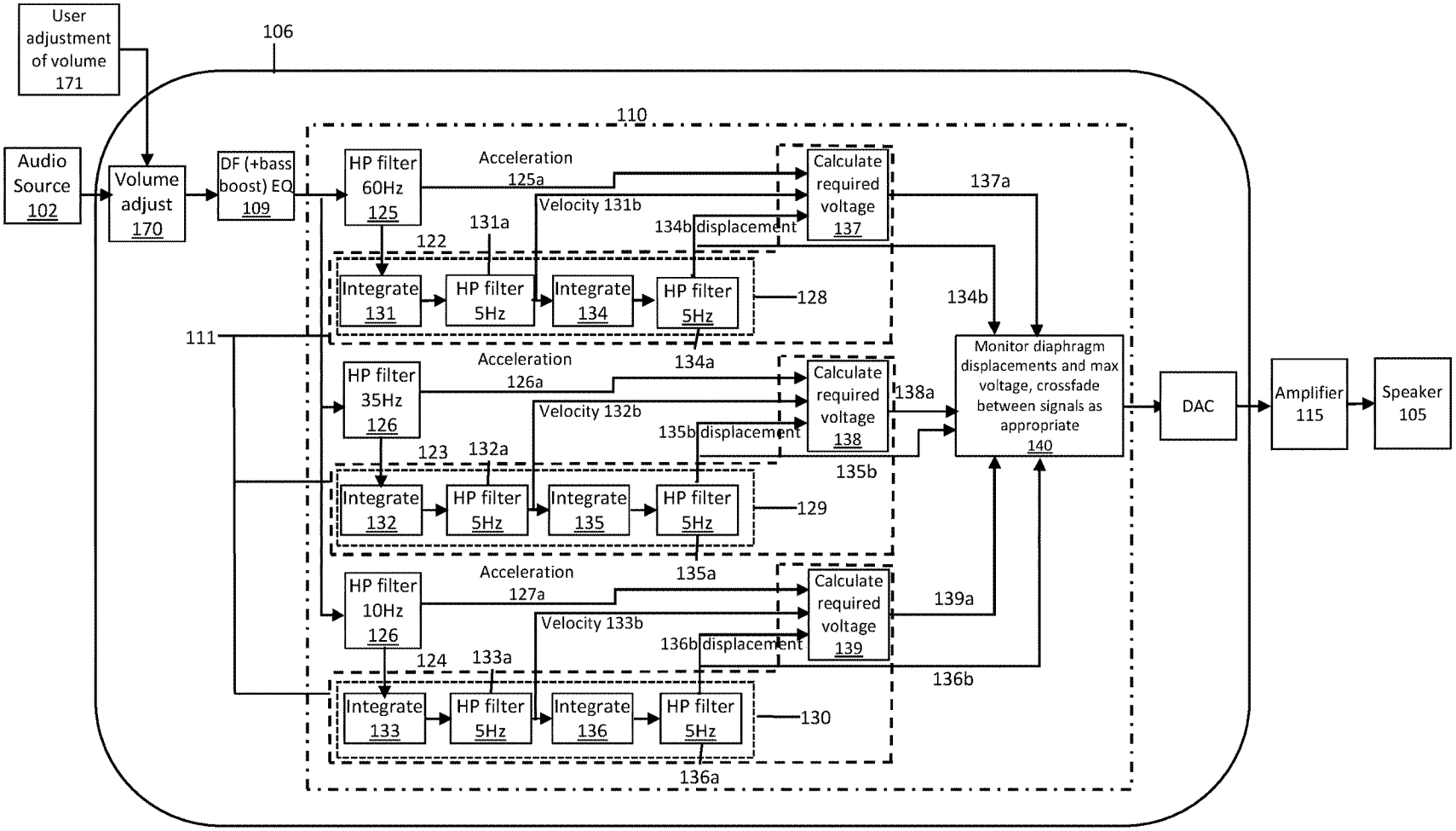
FIG. 3 is a flow diagram showing a preferred form audio tuning system of the invention.
Figure 5:
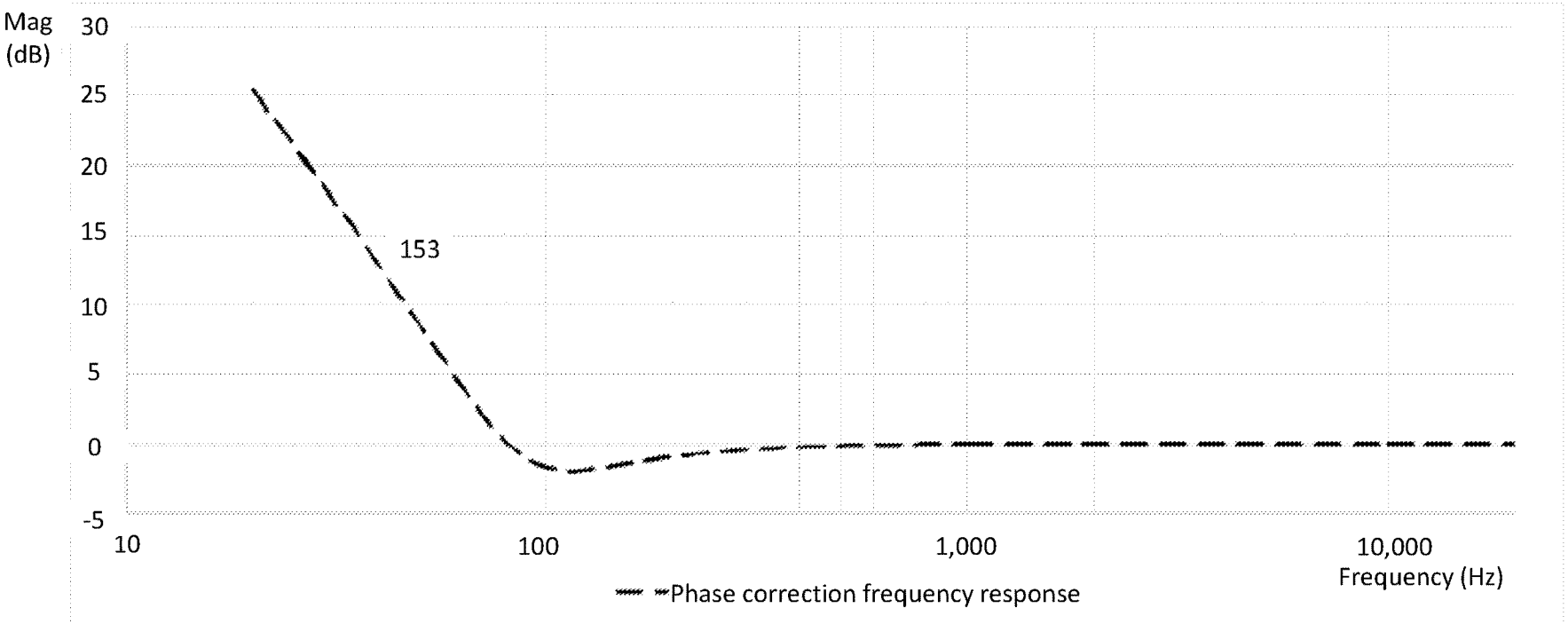
FIG. 5 is a graph showing a frequency response of a phase improvement module of the audio tuning system of FIG. 3.

Referring also to FIG. 3, in the preferred embodiments of the audio tuning system 106, the equaliser 109 comprises an equalisation frequency response that achieves an overall target response for one or more output audio channels that is the same or similar to the target response 150. Building an equaliser that achieves this target response 150 requires knowledge of the frequency response of the remainder of the personal audio system 100. This includes the frequency response of other modules in the audio tuning system 106 which do not cause deliberate or desirable frequency response behaviours. For example, the audio tuning system 106 may comprise one or more other modules or functions that may be configured to adjust the target response based on certain operational criteria. The adjustment of the frequency response by such other modules or functions may not be included in the determination of the equalisation frequency response. For instance in this embodiment filters 125-127 introduce a desirable bass roll-off that is based on the operational characteristics of the audio device's output channels and on the input audio signal. These filters adjust the overall target response in a deliberate and desirable manner and therefore are not factored in when determining the equalisation frequency response of equaliser 109. All other modules affecting the frequency response of the respective output audio channel(s) are included, such as the associated electro-acoustic transducer(s) 105 as well a phase improvement module 111. FIG. 5 shows an exemplary frequency response 153 for phase improvement module 111 of the audio tuning system 106. This module is described in further detail in the next section.

Figure 6:
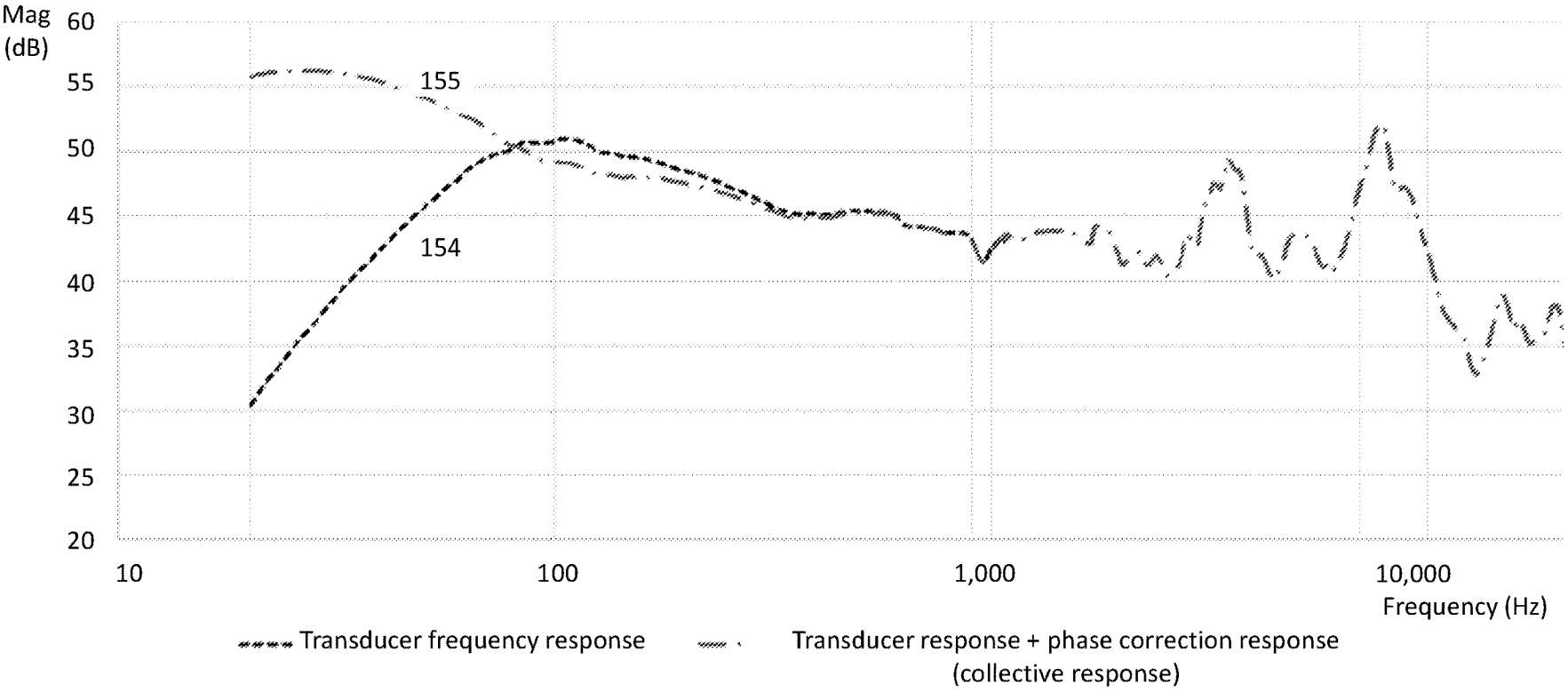
FIG. 6 is a graph showing a frequency response of an output channel of an exemplary personal audio device, and the frequency response of the output channel added to the phase improvement module frequency response of FIG. 5.

FIG. 6 shows an exemplary frequency response 154 of an output audio channel including one or more electro-acoustic transducer(s) 105 of a personal audio device 101 and any associated amplifier(s) 115. This is the frequency response of an output channel of the personal audio device 101 without the audio tuning system 106. It will be appreciated that the personal audio device will have a frequency response that is unique to each device or at least each type of device. As such this frequency response 154 may be predetermined and stored in electronic memory that is accessible by the audio tuning system during a system calibration stage for example or it may be determined in situ using acoustic sensor(s) 116 for example. The frequency response 154 may be acquired from memory that is local or remote to the audio tuning system. Alternatively, or in addition the frequency response of the personal audio device output channel may be measured in situ during the calibration stage, and then utilised to build the equaliser 109 frequency response for example. The frequency response 154 may be measured using on a calibrated test head such as a KEMAR dummy head and associated microphones, or any method as known in the art. As mentioned above, in alternative embodiments a different diffuse field target is used, such as a diffuse target specific to the equipment on which the transducer response is measured.

The combined frequency response 155 of the module 111 and of the electro-acoustic transducer(s) 105 output channel (including the transducer(s) 105 and any associated amplifier(s) 115) of this example are also shown in FIG. 6. To determine the frequency response 156 of the equaliser 109 that is necessary to achieve the target response 150, the target frequency response 150 needs to be subtracted from the collective response 155.

Figure 7:
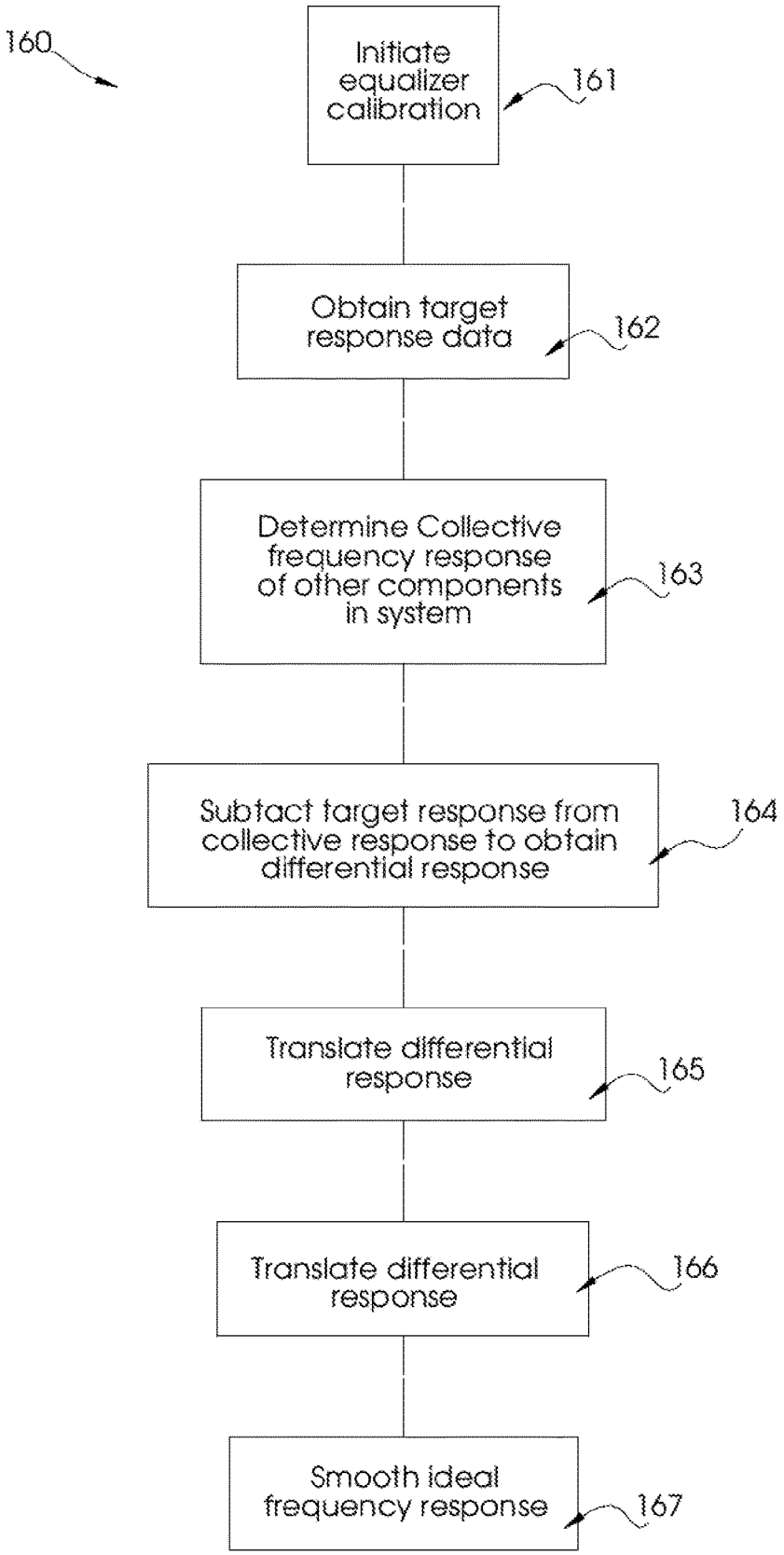
FIG. 7 is a flow diagram showing an equaliser calibration process of the invention.

Referring to FIG. 7, an exemplary method 160 for determining the equalisation frequency response for equaliser 109 for an output channel will now be described. As mentioned this method may be conducted during a calibration stage. Equaliser calibration is a function that may be initiated (step 161) and performed during manufacture or it may be initiated by a user the first time they use the personal audio device 101 or the audio tuning system 106 for example. It may be a function of a system initialisation module of the audio tuning system for example, or else it may run continuously or sporadically while the device is being used.

After initiating calibration, the audio tuning system 106 (or any other system responsible for calibrating the equaliser) will obtain from memory data relating to the target response 150 from electronic memory (step 162). As mentioned, to determine the equalisation frequency response, the system must also know the frequency response of the remainder of the components of each output channel, including module 111 and the electro-acoustic transducer(s) 105/amplifier(s) 115. At step 163 the system determines, for each channel, this collective frequency response 155 of the other components in the system 100 that audio signals are subjected to during normal operation excluding, as mentioned above, any desirable frequency response adjustments intentionally performed by other modules or functions of the system 106, such as for example bass roll-off filter functions 125-127 of bass optimisation module 110.

As mentioned, in this example the collective frequency response 155 includes the frequency response 153 of the phase improvement module 111, and also the frequency response 154 of the electro-acoustic transducer(s)/amplifier(s) of each output channel as shown in FIG. 6. The frequency response 155 may be predetermined and stored in memory and therefore obtained from memory at step 163, or alternatively it may be calculated from the frequency responses 153 and 154. For instance at step 163 the system may acquire from memory predetermined frequency response data for the phase improvement module 111. Similarly, at step 163 the system may acquire data from memory that is indicative of a predetermined frequency response for the electro-acoustic transducer(s)/amplifier(s) 105/115 of each output channel. Then the frequency response 155 may be calculated by summing frequency response 153 and 154. In yet another alternative, the frequency response 155 may be determined through measurement. For instance, at this step 163 the system may measure (either separately or collectively) the frequency response 153 of the phase improvement module and the frequency response 154 of the electro-acoustic transducer(s) 105 by subjecting the inputs of these components of the system 100 to an audio signal and measuring the output signals using a suitable sensor such as an acousto-electric transducer. For example, sensor(s) 116 may be used for this purpose.

In either one of step 162 or step 163, data obtained from memory may be pre-stored and obtained from local memory on the personal audio device 101, or alternatively it may be obtained from local memory of the audio source device 102. In yet another alternative, the personal audio device 101 or the source device 102 may request such data from a remote computing device 103 via network 104. For instance, the personal audio device may store an identification code which is accessible by the audio tuning system to request the relevant frequency response data at steps 162 or 163 from another memory component.

Figure 8:
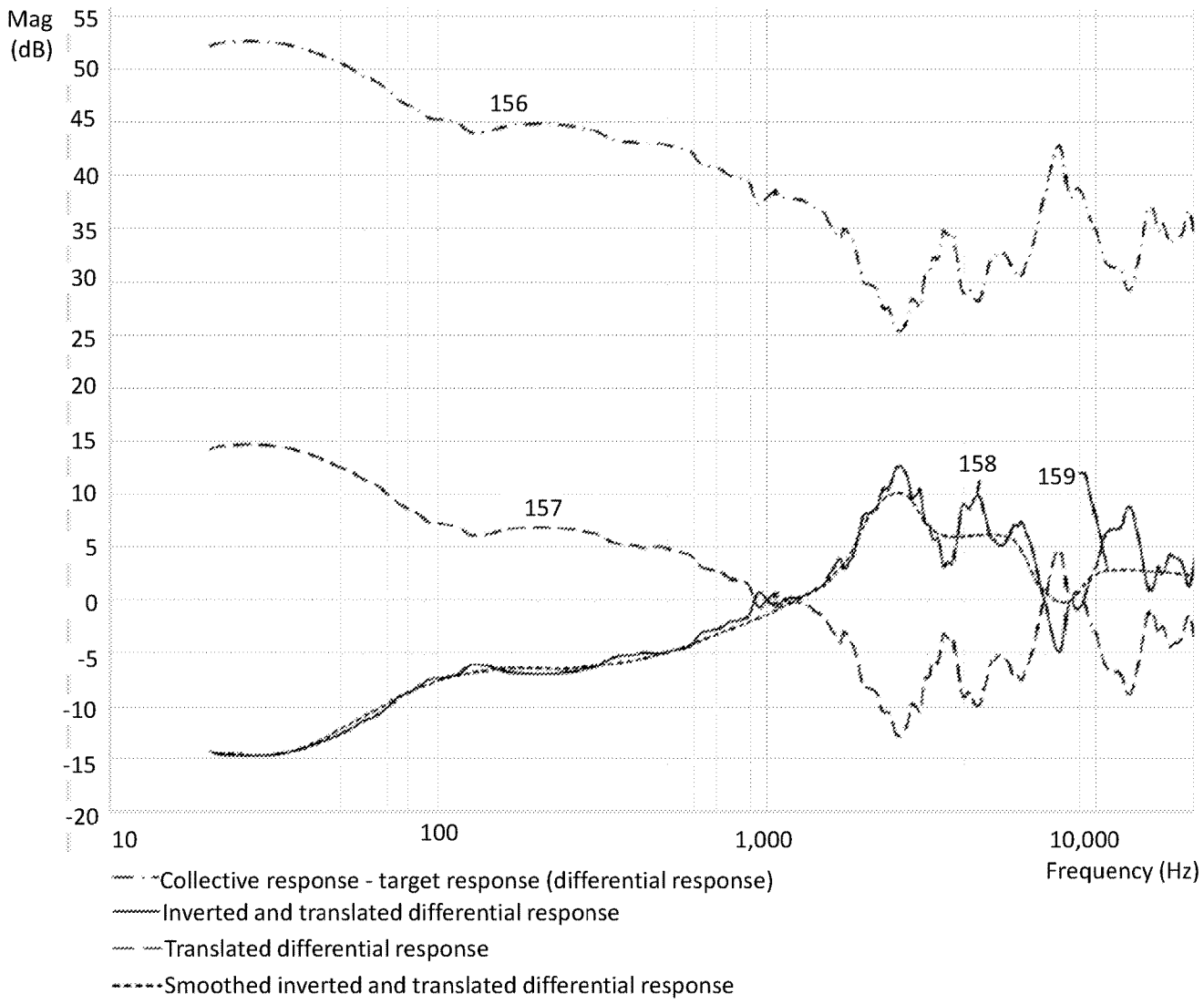
FIG. 8 is a graph showing various curves obtained during the equaliser calibration process of FIG. 7.

After obtaining data indicative of the collective frequency response 155 and data indicative of the target response 150, at step 164 the system subtracts the target response 155 from the collective frequency response 155 to obtain the differential response 156 shown in FIG. 8. The differential response represents the overall response of each output channel relative to the desired target response. In a preferred embodiment the differential response 156 is then translated to approximately 0 dB at approximately 1000 Hz at step 165. The translated differential response 157 is then inverted to give an ideal equalisation frequency response 158 at step 166. Response curve 158 is the equalisation response that, if applied by equaliser 109, would cause the output signal of each channel to approximately replicate the diffuse field plus bass boost target response 150, provided that all test conditions within which the response 154 was originally acquired (including for example the test rig, personal audio device, personal audio device fitting, ambient temperature, etc.) were perfectly replicated.

In practice the setup under which the response 154 was acquired is unlikely to be replicated perfectly during use of the perfect audio device (for example there can be manufacturing variations within the same model of personal audio device or room temperature and fitting amongst users may vary). For this reason it may be more beneficial to approximate the ideal equalisation frequency response 158 by smoothing the equalisation curve 158. Otherwise various peaks and troughs may end up being worsened depending on the conditions of use. At step 167, the ideal equalisation frequency response 158 is therefore smoothed to give the final equalisation frequency response 159 as shown in FIG. 8. The calibration system may use any smoothing function necessary to obtain the frequency response curve 159. For instance the system may utilise a linear smoother, additive smoothing, filters, moving average or any other method that is known in the art.

In preferred embodiments the equalisation frequency response 159 may also be optionally reduced subtly in level by a relatively small magnitude, for example by approximately 1 dB, relative to the ideal equalisation frequency response 158 in the frequency band of approximately 2.3 kHz to 20 kHz. The reasons for this are three-fold:

It can be seen that, despite implementation of features for addressing various resonances (including by decoupling of the driver, a metal coating on the diaphragm, the open acoustical design, and/or controlled air leaks between the front and rear cavities as is described later in section 2 of this specification), no audio device is perfect, and the treble frequency region of a personal audio device frequency response 154 still has a number of peaks and troughs in the treble frequency band. Studies have shown that frequency response peaks tend to be more subjectively audible compared to troughs, and this may be compensated by a subtle reduction in treble level;

Second, the diffuse field component 151 of the target response 150 was devised by testing a large number of subjects so it is an averaged target and is not tailored for a particular individual. In general, averaging smooths the appearance of curves, so it would be reasonable to expect that a diffuse field frequency response optimised to one person would have higher and narrower peaks, peaks at different frequencies and more numerous peaks and troughs compared to the diffuse field frequency response 151, given that the latter is constructed by averaging data from a number of people. So, even if the response of the transducer as measured on a test head shows few peaks or troughs above 2.3 kHz, there will likely still be peaks and troughs in the perceived response of many, if not most users, due to sub-optimality of the diffuse field target. So again, a subtle reduction in level at treble frequencies, at which the ear canal and other physical forms start to create response peaks and troughs, may help optimise the subjective experience by compensating for the disproportionate effect of the peaks relative to the troughs;

Thirdly, the acoustical and mechanical resonances described above tend to store vibrational or acoustical energy then release it with a delay, generating sound at frequencies that are not necessarily inherent in the source signal. Such energy storage may not be as apparent in a frequency response plot as it is in a waterfall plot. This may result in subjective harshness and a corresponding increase in subjective volume over and above the effect of the peaks and troughs in frequency response loudness. As such resonances tend to occur at high frequencies in personal audio devices, reducing the level of the treble bandwidth may compensate.

The subtle reduction in frequency response in the treble region complements other anti-resonance constructions of a personal audio device as will be explained in further detail in section 2 of this specification.

In preferred embodiments, the above-determined equalisation frequency response 159 is a pre-set configuration of the audio tuning system 106 associated with the personal audio device 101. This may be the primary or suggested or default response of the device 101 for example. As mentioned, the audio tuning system may consist of an equalisation adjustment module that is configured to receive user generated data and/or data from other modules to update equaliser settings. For instance bass boost may be user adjusted or dynamically adjusted according to operating conditions. Alternatively or in addition the diffuse field curve and/or target response may be altered or updated via this module. The equalisation adjustment module may be configured to receive data indicative of one or more equalisation setting parameters, and then may adjust parameter settings of the equaliser in accordance with the received data. The equaliser settings may adjust or update the equalisation frequency response of the equaliser 109 for one or more output audio channels.

Overall Frequency Response of Personal Audio System

The equalisation provided by equaliser 109 thus adjusts the magnitude of the audio signal of each output channel within the treble frequency range to approximately 1 dB less compared to a diffuse field frequency response profile within this range.

In preferred embodiments the overall frequency response observed at the output of each channel (including the frequency response of the audio tuning system 106 and of the transducer(s) 105) of the personal audio device 101 comprises a profile of varying magnitude over frequency that is that is shaped approximately 1 dB less compared to a diffuse field frequency response profile within a frequency band of approximately 6 kHz to 14 kHz. In other words, the overall (meaning, for example, excluding localized peaks and troughs) frequency response observed at the output of each channel comprises a profile of varying magnitude over frequency that consists of a shape that is within approximately 3 dB of the diffuse field frequency response profile shape, within the frequency band of approximately 6 kHz to approximately 14 kHz. More preferably the overall frequency response profile shape is within approximately 2 dB of the diffuse field frequency response profile shape, within the frequency band of 6 kHz to approximately 14 kHz. Most preferably the overall frequency response profile shape is within approximately 1 dB of the diffuse field frequency response profile shape, within the frequency band of 6 kHz to approximately 14 kHz In preferred embodiments the predetermined overall frequency response observed at the output of each channel of the personal audio device 101 comprises a profile that is shaped approximately 1 dB less compared to a diffuse field frequency response profile within a frequency band of 6 kHz to 14 kHz.

In addition or alternatively, in preferred embodiments the predetermined overall frequency response observed at the output of each channel of the personal audio device 101 comprises a profile that is shaped approximately similar to a diffuse field frequency response profile within a frequency band of 6 Hz to 14 kHz.

Also, the overall frequency response of the audio system 100 observed at the output of each channel of the personal audio device 101 comprises a profile of varying magnitude over frequency wherein an average magnitude over the frequency range of approximately 6 kHz to approximately 14 kHz is approximately 1-6 dB greater than an average magnitude over a reference range of approximately 300 Hz to approximately 1000 Hz. More preferably the frequency response of the audio system comprises an average magnitude over the frequency range of approximately 6 kHz to approximately 14 kHz that is approximately 2-5 dB greater than the average magnitude over a reference frequency range of approximately 300 Hz to 1000 Hz. Most preferably the frequency response of the audio system comprises an average magnitude over the frequency range of approximately 6 kHz to approximately 14 kHz that is 3-4 dB greater than the average magnitude over the reference frequency range of approximately 300 Hz to approximately 1000 Hz.

Preferably the equalisation frequency response is configured to alter the frequency response of the audio system such that the frequency response of the audio system comprises a profile of varying magnitude over frequency that is shaped approximately 1 dB less compared to a diffuse field frequency response profile within a frequency band of 2 kHz to 6 kHz.

In addition or alternatively, in preferred embodiments the predetermined overall frequency response observed at the output of each channel of the personal audio device 101 comprises a profile that is shaped approximately similar to a diffuse field frequency response profile within a frequency band of 2 kHz to 6 kHz.

Preferably the overall frequency response comprises a profile of varying magnitude over frequency that consists of a shape that is within approximately 3 dB of the diffuse field frequency response profile shape, within the frequency band of approximately 2 kHz to approximately 6 kHz. More preferably the overall frequency response profile shape is within approximately 2 dB of the diffuse field frequency response profile shape, within the frequency band of 2 kHz to approximately 6 kHz.

Preferably the overall frequency response comprises a profile of varying magnitude over frequency wherein an average magnitude over the frequency range of approximately 2 kHz to approximately 6 kHz is approximately 7 dB-12 dB greater than an average magnitude over a reference range of approximately 300 Hz to approximately 1000 Hz. More preferably the frequency response of the audio system comprises an average magnitude over the frequency range of approximately 2 kHz to approximately 6 kHz that is approximately 8-11 dB greater than the average magnitude over a reference frequency range of approximately 300 Hz to 1000 Hz. Most preferably the frequency response of the audio system comprises an average magnitude over the frequency range of approximately 2 kHz to approximately 6 kHz that is 9-10 dB greater than the average magnitude over the reference frequency range of approximately 300 Hz to approximately 1000 Hz.

In some embodiments the predetermined equalisation frequency response causes the frequency response of the audio system to have an average magnitude over the frequency range of approximately 2 kHz to approximately 6 kHz as described above.

Figure 24:
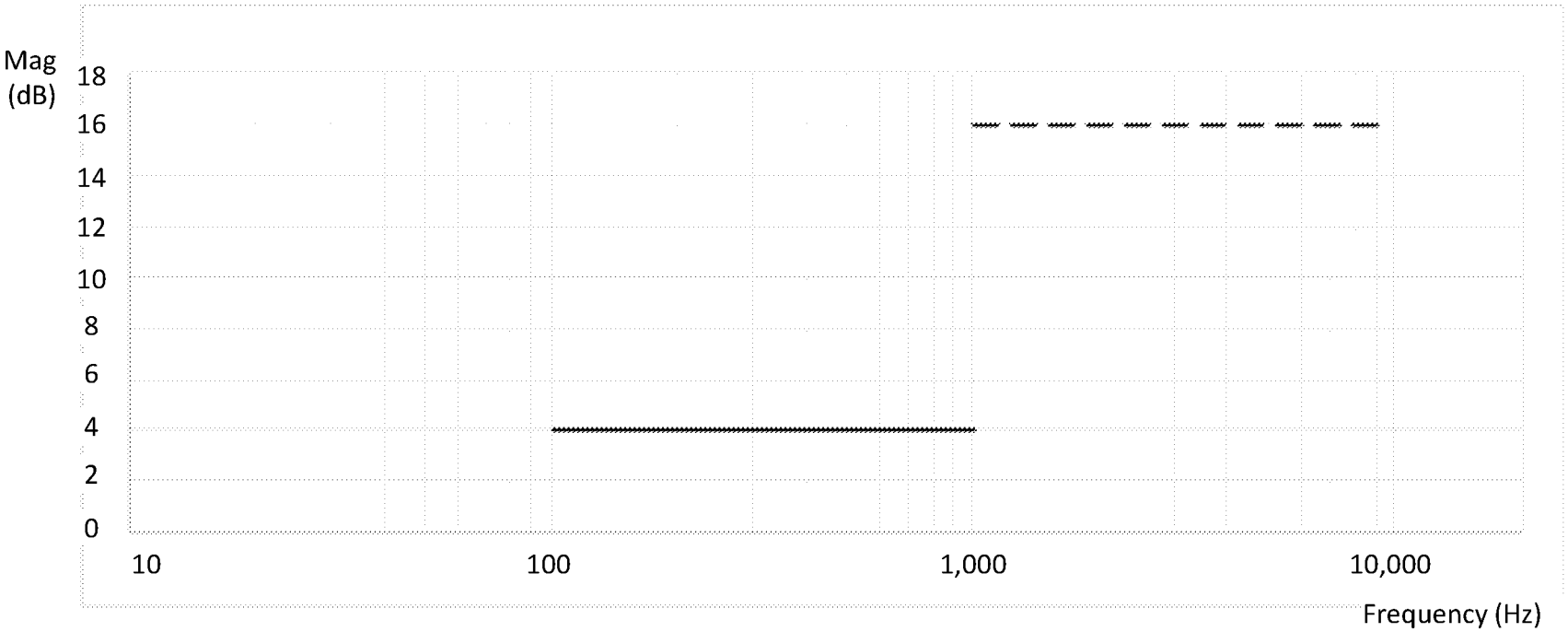
FIG. 24 shows a graph representing an example of determining an average response level.

Note that reference to an "average magnitude" within a frequency band of a frequency response, is intended to mean the height of the response line over this range, averaged per distance along the frequency-axis, when the frequency-axis is a standard logarithmic frequency scale, and the magnitude-axis is a standard dB scale. For example considering FIG. 24, a response over the range 100 Hz-10 kHz comprising level of 4 dB from 100 Hz-1000 Hz and 16 dB from 1-10 kHz is considered to have an average level of 10 dB over the range 100 Hz-10 kHz.

In preferred embodiments, the above overall system frequency response is a pre-set configuration of the audio tuning system 106 for the associated personal audio device 101. This may be the primary or suggested or default overall response associated with the particular system 100 for example.

In some embodiments equalisation may be implemented using methods described in patent WO2015128237A1.

Digital or Analogue Implementations. As mentioned, the audio tuning system 106 may be implemented in digital and/or analogue circuitry. The following are brief examples of these two types of implementations for the equaliser 109, however, it will be appreciated that many other implementations are possible without departing from the scope of the invention.

In a digital implementation the equaliser 109 may comprise one or more digital filters. The one or more digital filters may be implemented in one or more processing devices, such as a central processing unit or a digital signal processor (DSP). The one or more digital filters may be operable to: receive a digital audio signal comprising data indicative of sound pressure over an audible frequency range; alter a frequency response of the digital audio signal in accordance with the equalisation frequency response to generate an adjusted output digital audio signal.

The one or more digital filters may comprise one or more digital equalisation filter functions operable to alter the frequency response of the received audio signal in accordance with the equalisation frequency response. The filter functions may be set using one or more parameters that are representative of the equalisation frequency response. In some embodiments the one or more digital equalisation filter functions may be pre-programmed with the equalisation frequency response and/or adjustable using data indicative of equalisation settings.

The one or more digital equalisation filter functions therefore may be programmable with the equalisation frequency response via retrieval of the equalisation frequency response from a computer readable medium that is associated with the equaliser. The computer readable medium may be local to the equaliser or remotely located in a separate device.

The filters used are preferably linear phase FIR filters.

In such an implementation he audio tuning system may further comprise an analogue-to-digital (ADC) convertor operatively coupled to an input of the one or more digital filters for converting an input analogue audio signal into a digital audio signal to be received the one or more DSPs, and a digital-to-analogue (DAC) convertor operatively coupled to an output of the one or more digital filters for converting the adjusted output digital audio signal into an adjusted analogue audio signal.

In an alternative implementation, the equaliser may comprise one or more analogue filters collectively operable to receive audio signal(s) for one or more of the output channel(s) indicative of sound over an audible frequency range and alter a frequency response of the audio signal in accordance with an equalisation frequency response to generate an adjusted output audio signal for one or more of the output channel(s).

The one or more analogue filters may be preconfigured to collectively alter the frequency response of the received audio signal in accordance with the equalisation frequency response.

For example, the analogue filter(s) may comprise a capacitor in series with the electro-acoustic transducer(s) of each output channel. The capacitor acts as a high pass filter over a mid-range bandwidth. The lower frequency roll-off rate of the filter may be 6 dB per octave.

The analogue filter(s) may further comprise a resistor in parallel with said capacitor. Preferably the resistor acts to create a low-frequency shelf limiting the high-pass behaviour below a certain frequency. Preferably the overall drop in level down to the low frequency shelf is at least 3 dB, more preferably at least 4 dB, and most preferably is at least 5 dB.

Preferably a capacitor in series with a transducer applies at least 3 dB and more preferably at least 5 dB of attenuation.

The capacitors and/or resistors used may be adjustable to thereby allow adjustment of the equalisation frequency response. Alternatively they may be pre-set and non-adjustable.

Figure 25:
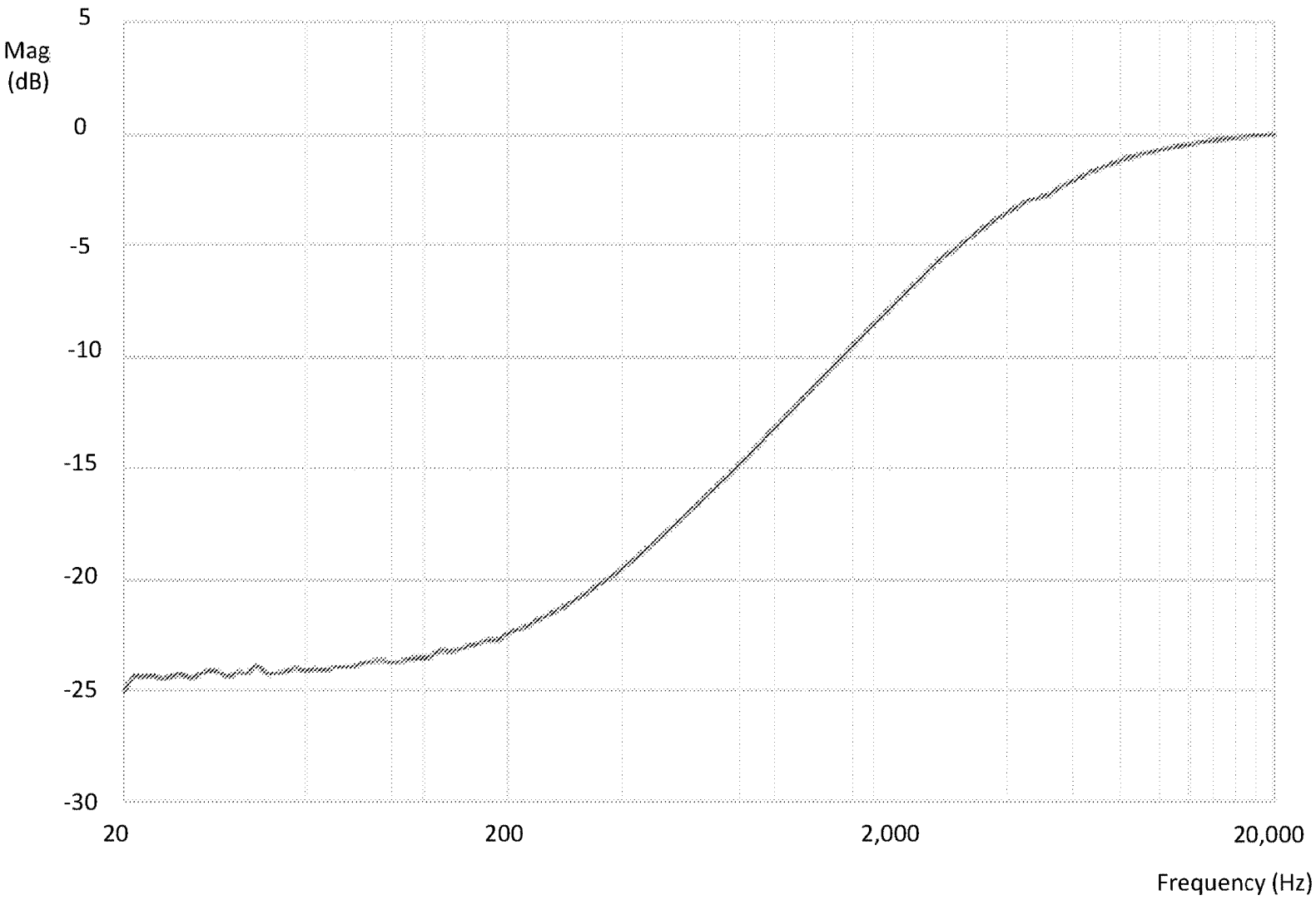
FIG. 25 is a graph showing the frequency response of an exemplary analogue implementation of the equaliser of the audio tuning system of FIG. 3.

An example preferred analogue filter circuit consists of a transducer with a DC resistance of 22 Ohms, in series with a capacitor of 1 uF and the capacitor being in parallel to a resistor of 680 Ohms. This circuit provides attenuation as per the frequency response graph shown in FIG. 25.

1.3 Bass Optimisation and Phase Improvement Modules

Referring back to FIG. 3, in a preferred embodiment of the audio tuning system 106, the system further comprises a bass optimisation module 110 and a phase improvement module 111. In this embodiment the bass optimisation module 110 is cooperatively operative with the phase improvement module 111 and hence both will be described simultaneously. In alternative embodiments however, the functions of these two modules may be separated and implemented discretely (as stand-alone modules) without departing from the scope of the invention. The audio tuning system may include one or both or none of these modules 110 and 111 in some embodiments.

In the preferred embodiment, the input of the bass optimisation and phase improvement modules 110 and 111 is operatively coupled to the output of the equaliser 109 to receive equalised audio signals for one or more audio channels. In other embodiments a non-equalised input audio signal is received by one or both of these modules 110 and 111. In some embodiments the bass optimisation module 110 and/or the phase improvement module 111 may operatively couple between the audio output of the audio source device 102 and the equaliser 109 and/or the equaliser 109 may alternatively couple between one or both of these modules 110 and 111 and the electro-acoustic transducer(s) 105.

In the bass optimisation module, a low frequency component of one or more equalised (or non-equalised) audio signals is optimised for respective output channels based on consideration of the respective electro-acoustic transducer(s) 105 being driven by the output channel and/or the amplifier(s) 115 driving the output channel. The low frequency component may be from 20 to 300 Hz, or more preferably between 20 Hz and 200 Hz and most preferably between 20 Hz and 100 Hz for example. In the phase improvement module 111, for each output channel a first frequency component of one or more equalised (or non-equalised) audio signals that is lower than a resonant frequency of the respective electro-acoustic transducer(s) 105, is shifted in phase by an amount substantially or approximately equal to the difference in phase between the first frequency component and a second frequency component that is higher than the resonant frequency of the respective electro-acoustic transducer(s) 105. Also, a third frequency component of the received audio signal(s) that is substantially equal and/or approximate to the resonant frequency of the respective electro-acoustic transducer(s) 105 is also shifted in phase by an amount that substantially or approximately equal to the difference in phase between the third frequency component and the second frequency component of the audio signal(s). The output(s) of one or both of the bass optimisation and phase improvement modules 110 and 111 are operatively coupled to the transducer(s) 105 of each respective output channel. The modules 110 and/or 111 may be coupled directly to the transducer(s) 105 or indirectly via one or more other modules or devices, such as via amplifier(s) 115 as in the preferred embodiment.

In some embodiments the bass optimisation module 110 and/or the phase improvement module 111 may be operative on audio signals intended for any electro-acoustic transducer that is operative within a low frequency range, or on any pre-selected combination of transducer(s) operative in a low frequency range. In some embodiments the bass optimisation module 110 and/or the phase improvement module 111 may only be operative on the one or more received audio signals that are intended for the "bass producing" low frequency electro-acoustic transducer(s) of the personal audio device. Low frequency electro-acoustic transducer(s) may be those configured to operate below approximately 300 Hz for example, or below approximately 200 Hz or even below approximately 100 Hz.

In other embodiments the bass optimisation module 110 and/or the phase improvement module 111 may be operative on audio signals intended for any electro-acoustic transducer that, possibly due to space or enclosure size constraints, is restricted in the amount of sound that it can produce, and the lower limit of its frequency range of operation may in face be non-bass frequencies. For example mobile phones are examples of devices which may struggle to reproduce frequencies even above 300 Hz, depending upon the audio source material and the listening volume, and as such their performance may be optimised through use of a bass optimisation module 110 and/or a phase improvement module 111 which operate on frequencies above 300 Hz.

Bass Optimisation Module A typical headphone has sufficient capability to reproduce bass for a low percentage of headphone owners who listen at very loud levels. Possibly such listeners may only have the volume up at very loud levels for very short periods relative to the overall use time of the headphones. Possibly also their music only utilises full diaphragm excursion for a very low percentage of the time spent listening at loud levels, which happens in the loudest moments of only the highest-bass tracks.

Increased bass capability is achieved by increasing diaphragm excursion and reducing the diaphragm fundamental resonance frequency, but this directly worsens unwanted diaphragm breakup resonance frequencies. This means that all users pay a price of increased resonance and degraded audio clarity in order to keep in reserve a bass capability that is only utilised for a very small fraction of the overall time the headphone is used.

The bass optimisation module 110 helps to solve this issue by continuously predicting and/or monitoring operation of the device and using this information to adjust the bass roll-off frequency depending on the source audio and the listening level. This means that bass capability is more fully utilised and means that it is possible to optimise transducer design towards addressing unwanted diaphragm resonance as will be explained further in section 2 of this specification.

The bass optimisation module 110 is configured to receive input audio signals for one or more output channels and optimise a low frequency component of the audio signals by dynamically adjusting a lower cut-off frequency of the frequency response of the audio system and/or respective output audio channel. The lower cut-off frequency is adjusted based on the received input audio signal and the operating capabilities of the associated personal audio device. This has the effect of adjusting the attenuation or amplification of a lower frequency component of the audio signal, to remove or extend a lower frequency component of the audio signals. The purpose of the bass optimisation module 110 is to optimise the low frequency component by extending the lower cut-off frequency to as low as possible without overly-exerting the personal audio device 101 beyond its capabilities and without exceeding the capabilities of the amplifier. In other words, the bass band is extended to cover (approximately) the lowest bass possible without causing damage to the device 101. As mentioned this requires consideration of the operating capabilities of the device 101 or any of its respective electro-acoustic transducer(s) 105. The operating capabilities may be defined by any combination of one or more operational parameters associated with the respective output audio channel, including for example, amplifier output capabilities, electro-acoustic transducer diaphragm excursion capabilities, and/or electro-acoustic transducer voltage or current capabilities. In the preferred embodiment, the lower cut-off frequency is determine by the bass optimisation module 110 for each respective output channel based on one or more of the following operating capabilities:

- a maximum excursion threshold associated with the diaphragm(s) of the electro-acoustic transducer(s);

a maximum voltage, current or power threshold associated with the amplifier(s) 115 of each output channel; and/or a maximum voltage, current or power threshold associated with the elector-acoustic transducer(s).

It will be appreciated however that other system operating parameters may be factored in by the bass optimisation module 110 and the invention is not intended to be limited to this exemplary embodiment.

The bass optimisation module 110 is operable to extend the lower cut-off frequency of the audio system's frequency response for each respective output channel based on the abovementioned operating capabilities and based on the requirements of the received audio signal. The bass optimisation module 110 is configured to determine, approximate and/or predict the lowest cut-off frequency acceptable for the received audio signal of each output channel. It does this by determining, approximating and/or predicting the operational requirements of the personal audio device that are necessary to transduce the received audio signal at a particular lower cut-off frequency. The determined, predicted and/or approximated operating requirements include a value for each of one or more operating parameters of the personal audio device 101. The module 110 then determines, predicts and/or approximates the suitability of a particular lower cut-off frequency for the received audio signal by comparing the value(s) of the one or more operating parameters associated with the lower cut-off frequency against predetermined parameter thresholds defining the personal audio device capabilities. Based on this comparison, the module 110 then determines, approximates and/or predicts the lowest cut-off frequency that will result in operational value(s) that remain within the operational threshold(s). The module 110 then adjusts the lower cut-off frequency for the received audio signal accordingly and outputs an audio signal with such lower cut-off frequency to the associated electro-acoustic transducer(s) 105 of each respective output channel.

The above described functionality of the bass optimisation module 110 may be implemented in a variety of ways. In some embodiments, the module 110 may include an adjustable high-pass filter that may be controlled to adjust a lower cut-off frequency of the filter based on received input adjustment parameters. The module 110 may be operable to control the filter cut-off frequency and determine the values of one or more operating parameters based on one or more filter adjustments to identify the most suitable cut-off frequency. In some embodiments, the module 110 may use an adaptive prediction model to predict the most suitable lower cut-off frequency for the received audio signal before adjusting the lower cut-off frequency of a high-pass filter, and then confirm the prediction by determining and analysing the operational parameter values associated with such a lower cut-off frequency.

Multiple Audio Streams

In preferred embodiments of the invention, the bass optimisation module 110 consists of multiple parallel audio streams that each subject a received audio signal for each output channel to high-pass filtering. Each audio stream comprises a high-pass filter of a different lower cut-off frequency to the other streams. In this way, the multiple streams output multiple variations of the input audio signal, each having a different lower cut-off frequency. FIG. 3 shows an exemplary arrangement of the bass optimisation module 110 with three audio parallel streams 122-124. It will be appreciated that there may be any number of streams and the invention is not intended to be limited to this number. Generally, the larger the number of streams, the higher the resolution of the bass optimisation module 110, however the greater the processing requirement. Each of the three streams 122-124 comprises an input high pass filter 125-127 each having a different lower cut-off frequency from one-another. The cut-off frequencies of the filters 125-127 are all in the bass-band region. For instance, stream 122 may have an input high-pass filter 125 with a lower cut-off frequency of approximately 50-150 Hz (e.g. approximately 60 Hz), stream 123 may have an input high-pass filter 126 with a lower cut-off frequency of approximately 25-50 Hz (e.g. approximately 35 Hz), and stream 124 may have an input high-pass filter 127 with a lower cut-off frequency of approximately 5-25 Hz (e.g. approximately 10 Hz). It will be appreciated that these high-pass filter lower cut-off frequencies are only exemplary and other cut-off frequencies may be used in alternative embodiments without departing from the scope of the invention.

Each audio stream 122-124 further comprises a signal integration function 128-130 configured to integrate the output audio signal from the associated high-pass filter 125-127. The purpose of the signal integration function 128-130 is two-fold. First, it is used by the bass optimisation module 110 to determine operating parameter values and assess the suitability of the filtered audio signal relative to the operating capabilities of the personal audio device. Second, the signal integration function 128-130 doubles as the phase improvement module 111 which is configured to adjust the phase of the lower frequency components of the input audio signal of each output channel to improve the overall phase response of the audio signal at the output of the bass optimisation module 110. The latter will be described in further detail below.

Each signal integration function 128-130 comprises at least one integrator, but preferably it includes a double integrator. This is however dependent on the model that is used by the bass optimisation module to determine, approximate or predict the values of the one or more operating parameters. In a first preferred embodiment, each received audio signal is considered to approximate output acceleration of the diaphragm of the electro-acoustic transducer 105 it is intended to drive. The output **125*a*-127*a* of the first high pass filter 125-127 of each stream therefore is indicative of the acceleration of an electro-acoustic transducer diaphragm driven by this output signal. An integration of the received audio signal thus results in an output signal 131*a*-133*a* that is indicative of the velocity of an electro-acoustic transducer diaphragm driven by this output signal. A second integration of the received audio signal results in an output signal 134*a*-136*a* that is indicative of the displacement of an electro-acoustic transducer diaphragm driven by this output signal. In alternative embodiments, the model used is one where received audio signals represent the velocity of an electro-acoustic transducer diaphragm driven by the signals. In such an alternative each stream 122-124** may include a differentiator for generating an output signal indicative of diaphragm acceleration and an integrator for generating an output signal indicative of displacement.

As mentioned, in the preferred embodiment each integration function 128-130 includes a first integrator 131-133 and a second integrator 134-136. Any method, device or function capable of integrating the signal may be used by the first and second integrators. In a simple example, each integrator may be configured to run a total sum of a plurality of samples taken at a particular sampling rate from the received audio signal, and divide this by the sample rate, which may be 44100 samples per second for a CD quality signal for example.

In the preferred embodiment, the bass optimisation module 110 of the audio tuning system 106 further comprises a high pass filter 131*b*-133*b* associated with the first integrator and a high-pass filter 134*b*-136*b* associated with the second integrator. The high pass filters 131*b*-133*b* and 134*b*-136*b* have a relatively low cut-off frequency to alleviate or mitigate any direct current (DC) offset created by the process of integration. The lower cut-off frequency of high-pass filters 131*b*-136*b* are preferably lower than the cut-off frequencies of the first high pass filters 125-127 of the audio stream 122-124, for example the cut-off frequency may be approximately 3-8 Hz.

In the preferred embodiment, the output audio signals 125*a*-127*a*, 131*a*-133*a* and 134*a*-136*a* of the three audio streams are fed into respective audio mixers 137-139. Each audio mixer 137-139 is configured to combine the received signals indicative of diaphragm acceleration, velocity and/or displacement and mix the signals in accordance with a predetermined model. Each audio mixer 137-139 is preferably configured to add the received signals and is configured to scale each of the received signals in accordance with the predetermined model. The predetermined model for example may utilize characteristics of the associated output channel to scale each of the received signals during the mixing stage.

In the preferred embodiment, the bass optimisation module 110 is configured to determine a value indicative of diaphragm displacement from a mathematical model of the audio system behaviour. The diaphragm moving mass (preferably including air load), total diaphragm stiffness (in situ, including mechanical and due to enclosure air) and total diaphragm damping (in situ, including mechanical and electrical), or at least variables related to such, are preferably included in the model. The determination of these parameters and/or related variable may happen in advance of an output voltage being passed to an amplifier so that the bass level may be adjusted gradually to reduce or eliminate audibility. In some embodiments, the bass optimisation module 110 is configured such that instigation of audio playback causes the personal audio device to play a signal with an initially reduced bass level (e.g. subjecting the audio signal to an audio system frequency response of a relatively high lower cut-off frequency). Subsequently, determination of a value indicative of diaphragm displacement and/or maximum electro-acoustic transducer voltage and/or current (which may proceed ahead of playback) by the bass optimisation module 110 may prompt the module to adjust the bass level to a relatively higher level (e.g. by subjecting the audio signal to an audio system frequency response of a relatively low, lower cut-off frequency) if it is safe to do so.

In the preferred embodiment a mass-spring-damper model is used to simulate the output channel, however it will be appreciated that other models for simulating an audio reproduction channel may be used without departing from the scope of the invention. For example motor nonlinearity, suspension nonlinearity, motor coil inductance and other linear and non-linear features may also be modelled.

Figure 9:
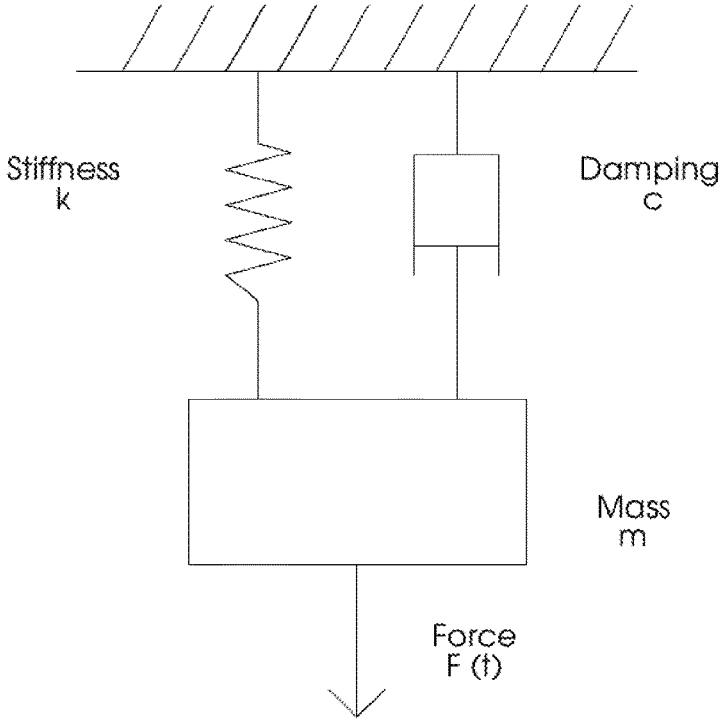
FIG. 9 is a diagrammatic representation of an audio transducer mathematical model.

Referring to FIG. 9, the mass-spring-damper model of the preferred embodiment indicates that an output channel of an audio system behaves like a mass, m at the end of a spring, having stiffness coefficient k, and a damping coefficient c, that is driven by a force, F(t). This leads to the operational equation:

$$V=E(m\ddot{x}+c\dot{x}+kx)$$

where:

- V is a value indicative of a voltage of the output signal driving the amplifiers of the electro-acoustic transducer(s);
- x is a value indicative of the diaphragm acceleration;
- $\dot{x}$ is a value indicative of diaphragm velocity;
- $\ddot{x}$ is a value indicative of diaphragm displacement;
- m, is a coefficient value indicative of a combined moving mass of a diaphragm assembly and air load of the associated output channel;
- c, is a coefficient value indicative of a combined damping acting on the diaphragm assembly due to mechanical, electrical and/or acoustical sources;
- k, is a coefficient value indicative of a combined stiffness acting on the diaphragm assembly due to mechanical and/or acoustical sources; and
- E, is a coefficient value indicative of a total responsiveness of the personal audio system.

In the case of the preferred embodiment:

- x may be represented by the output signal 134*a*-136*a* of the second integrator 134-136 of each audio stream 122-124;
- $\dot{x}$ may be represented by the output signal 131*a*-133*a* of the first integrator 131-132 of each audio stream 122-124; and
- $\ddot{x}$ may be represented by the output signal 125*a*-127*a* of the first high pass filter 125-127 of each audio stream 122-124.

Hence, according to this model, the voltage, V is what is required to be applied at the amplifier of the associated output channel to drive the electro-acoustic transducer(s) 105 so that the diaphragm can move with sufficient acceleration, velocity and/or displacement to replicate the received audio signal. The audio mixers 137-139 of each audio stream 122-124 each output a mixed audio signal 137*a*-138*a* that is fed into a signal analyser 140.

The bass optimisation module 110 therefore utilizes predetermined characteristics of each output channel, including m, c, k and E to generate an output signal and also determine a value for the required amplifier voltage, V. Such predetermined characteristics are preferably pre-stored in memory associated with the bass optimisation module 110. Such memory may be local on the personal audio device, local to the audio source device and/or local to a remote computing device that is accessible by the audio tuning system 106.

Any method known in the art for determining m, c and k may be utilised prior to populating the associated memory component with such data. Similarly, E may be determined via any method known in the art. For example, E may be determined experimentally, by applying a low frequency audio signal to the electro-acoustic transducer(s) 105 of each channel via the audio tuning system 106 and the respective amplifier(s) 115, and observing diaphragm displacement, preferably using a suitable sensor. E is determined such that diaphragm displacement variable x in the DSP processor has the same value as the displacement measured at the physical diaphragm.

The reason for the creation of multiple parallel audio streams having multiple different bass roll-off characteristics is that, as mentioned above, subsequent integrator functions modify the signal based on known output channel characteristics, and this has the effect of extending the low bass beyond the normal cut-off imposed by the fundamental resonance frequency of the electro-acoustic transducer(s) 105 of the respective channel. Since it is impractical to expect most electro-acoustic transducers to be able to reproduce all of the bass in all audio tracks all the time, some form of bass roll-off is preferably implemented, and filters 125-127 is where this occurs. In the preferred embodiment a cross-fader operatively coupled to the output of the three audio streams 122-124 crossfades between the parallel audio streams choosing which bass roll-off, out of filters 125-127, is optimal at any particular time, dependant on the audio source and the capabilities of the output channel. A signal analyser between the audio streams and the cross-fader selects the bass roll-off stream that has the most bass yet which does not cause over-excursion of the diaphragm, exert too-high acceleration on the diaphragm and/or ask the amplifier of the respective output channel to produce a voltage beyond its capability.

Signal Analyser & Cross-Fader

The bass optimisation module 110 utilises the output of the signal integration function 128-130 in addition to the output of the high-pass filter 125-127 to determine the value of one or more operating parameters for comparison against predetermined operating thresholds. Each audio stream will generate a different set of values for the operating parameters which can be compared against predetermined threshold(s) to assess the suitability of that audio stream for driving the electro-acoustic transducer(s) 105 of the related channel. As previously mentioned, the operating parameters that are assessed by the bass optimisation module in the preferred embodiment includes one or more of electro-acoustic transducer diaphragm excursion, electro-acoustic transducer voltage or current and/or amplifier output voltage, current or power.

The bass optimisation module 110 further comprises a signal analyser 140. The signal analyser 140 is configured to receive the mixed output audio signals 137*a*-139*a* of the audio mixers 137-139, as well as the double-integrated audio signals 134*a*-136*a* of the second integrators 134-136 from the multiple audio stream 122-124 to determine which audio stream should be used to drive the electro-acoustic transducer(s) 105 of the respective output channel. As mentioned, the audio signals 137*a*-139*a* output from the audio mixers 137-139 are indicative of the voltage required to drive the amplifier(s) 115 of the respective output channel, to replicate the respective filtered audio signal outputs 125*a*-127*a*. The audio signals 134*a*-136*a* output from the second integrators 134-136 are indicative of the diaphragm displacement that would be exhibited by the electro-acoustic transducer(s) 105 of the respective output channel when driven by the respective filtered audio signal outputs 125*a*-127*a*. Hence, for each audio stream 122-124 the signal analyser 140 can determine the voltage required to drive the amplifiers to replicate the respective filtered output audio signal 125*a*-127*a*, and/or the diaphragm displacement exhibited by the electro-acoustic transducer(s) if driven by the respective filtered output audio signal 125*a*-127*a*. The analyser 140 is therefore configured to conduct an audio signal analysis process involving the steps of:

- determining the diaphragm displacement requirements, the electro-acoustic transducer voltage or current requirements and/or the amplifier output requirements for each audio stream 122-124; and
- assessing whether the audio stream is suitable for the respective output channel by comparing the value of one or both of these parameters to the capabilities of the respective output channel as defined by the predetermined parameter thresholds.

For example, if the value of the electro-acoustic transducer voltage or current for a particular stream is within the predetermined voltage or current threshold, and/or the value of diaphragm displacement is within the predetermined diaphragm displacement threshold and/or the amplifier output is within the amplifier output threshold, then the respective audio stream may be considered suitable for driving the respective output channel. In some embodiments only one of these parameters is assessed, but in the preferred embodiment a combination of two or more, and most preferably all parameters are assessed by the analyser 140 and the respective thresholds must be satisfied for the respective audio stream to be considered suitable.

The analyser 140 is further configured to output the audio signal from the audio stream that consists of the lowest cut-off frequency and meets all the predetermined threshold criteria. The audio signal 140*a* that is output form the analyser 140 is preferably the output of the respective audio mixer 137*a*-139*a*. The analyser 140 may be configured to output a default audio stream, such as audio stream 124 having the lowest cut-off frequency and only alter this when the parameter values for that stream exceed the threshold criteria.

In the preferred embodiment the audio tuning system 106 further comprises a cross-fader that is cooperatively operable with the analyser 140 to cross-fade between audio stream outputs 137*a*-139*a* when an adjustment from one audio stream to another audio stream is required for a respective output channel as determined by the results of the audio signal analysis process. Crossfading consists of gradually turning down the volume of one audio stream and simultaneously turning up the volume of another audio stream. The cross-fader may form part of the analyser module 140 or it may be a separate module. In this embodiment it is shown as part of module 140.

In preferred embodiments of the audio tuning system, the high-pass filters 125-127, 131*b*-133*b* and 134*b*-136*b* are all symmetrical, linear phase FIR filters configurations. An advantage of using symmetrical FIR filters is that there will be no out-of-phase frequency components which cancel mid-way through a crossfade, however other filters, such as IIR filters, may also be implemented, particularly if the phase is matched between all three filters over at least a substantial portion of the audible bandwidth.

The signal analyser 140 may be configured to access memory that has stored therein information indicative of the operational thresholds associated with each output channel, including for example the maximum possible diaphragm displacement and/or the maximum voltage, $V_{max}$, which may be applied to the output channel without risking damage to the respective amplifier(s) 115 and/or electro-acoustic transducer(s) 105.

In the preferred embodiment, the audio tuning system 106 is configured to process audio signals received from the audio source device 102 prior to outputting the signals to the respective output channels for driving the associated electro-acoustic transducer(s) 105.

There are two different modes of switching for the cross-fader. The first mode is a temporary switch mode where some stream, although not the stream having the highest bass roll-off, (e.g. 124) is currently the default stream and the analyser and cross-fader simply manage isolated high-excursion events in the received audio signal by temporarily switching to another stream having a higher bass roll-off. The temporary switching may be for a predetermined period of time, or more preferably just until the received signal no longer requires a higher bass roll-off. For example, in this mode stream 124 may be operatively coupled to the amplifier of each output channel by default. The signal analyser will only scan signals 139*a* and 136*a* being output from this stream 133 and compare the diaphragm displacement value, x, and/or amplifier voltage value, V, from this stream to the predetermined thresholds, $x_{max}$ and $V_{mas}$. If one or both of these values are exceeded then the signal analyser will switch to the next highest bass roll-off stream 123 and cross-fade the signal output 140*a* to the output 138*a* of this stream 123, whilst also scanning the output signals 138*a* and 135*a* of this stream to determine if the operating conditions are being met by this stream. If not, then the analyser and cross-fader will switch to the next highest bass roll-off stream 122 and so on. The analyser will also continue to monitor the operating parameter values, x and V, within the default stream 124 and once these values have returned to within the operating thresholds ($x_{max}$ and $V_{max}$) then the cross-fader initiates a crossfade back to stream 124.

Such temporary crossfading may be made within 0.2 seconds or less, or at least as fast as can be determined to be inaudible or barely audible, and may be used to prevent diaphragm over-excursion due to, for example, a single kick-drum hit in some applications.

The temporary switching process may be implemented based on any combination of one or more operating parameters and their respective thresholds. For example only one parameter may need to be checked and the threshold satisfied for the stream to be selected as being suitable. Alternatively, two or more, or all parameters need to be checked and their respective thresholds satisfied for a stream to be selected. Other parameters that may be utilised include for example measured voice coil temperature data, in order to ensure that the driver coil is not damaged by overheating. As such the signal analyser 140 may also monitor and/or estimate the voice coil temperature either from the received audio signals or alternatively from external sensor data.

The second mode of switching of the cross-fader is a medium term switching mode. In this mode, the cross-fader monitors the frequency of crossfading, and if the default audio stream 124 is causing diaphragm excursion, or any other parameter limit, to be exceeded more than a predetermined amount, then the default stream may be changed to be that stream which has the next highest bass roll-off, at least until a predetermined condition is met. If the default was previously stream 124, for example, then the stream 123 may be selected instead when the frequency of switching is higher than a predetermined amount.

The signal analyser continues to monitor the predicted diaphragm displacement (or other parameter value) for the stream 124 having the next lowest bass roll-off frequency and if the source signal changes such that this other stream 124 can again be used without temporary crossfades exceeding the predetermined amount or rate then the default stream is changed back to that stream 124.

The cross-fader may be configured to operate under one or both of the temporary and medium term switching modes.

Phase Improvement Module

As mentioned above, normally an electro-acoustic transducer having a sealed enclosure will exhibit a response similar to a classical mass-spring-damper system. In such systems the phase response may be linear in the diaphragm's mass-controlled region (frequencies well above the fundamental resonance frequency), however when the applied frequency is reduced to the fundamental diaphragm resonance frequency the phase undergoes a 90-degree shift, and then a further 90 degree shift as the applied frequency is further reduced to the diaphragm's stiffness-controlled region (frequencies well below the fundamental resonance frequency).

This phase shifting is undesirable for audio reproduction. One reason is that broadband pulses, such as may be created by a hit to a kick drum, are reproduced with different phase depending on the frequency of the audio sub-components. This may cause different frequency components of a single pulse to be separated by the speaker system and reproduced at slightly different times from one-another, reducing the overall subjective impact.

Equivalent phase distortion occurs in vented-enclosure speakers as well as in speakers having other enclosure configurations. In all cases simply improving the frequency response by applying an arbitrary filter does not correct the phase response.

In the preferred embodiment of the audio tuning system 106, phase shifting distortion and the unwanted drop in steady state frequency response below the fundamental diaphragm resonance frequency are corrected, or at least improved, by a phase improvement module 110 of the system 106. The phase improvement module 111 is incorporated in the bass optimisation module 110 in this embodiment however this could be implemented separately in alternative embodiments. In particular, the phase improvement module consists of the integration function 128-130 and audio mixer 137-139, as described above, of each of the multiple audio streams 122-124. The details of operation of these components is described under the bass optimisation module section and such details will not be repeated here for conciseness.

There may be a single integration function and associated audio mixer in some embodiments to correct for phase distortion and the provision of multiple streams is not necessary for phase improvement. As described in detail for the bass optimisation module 110, each integration function 128-130 operates to integrate the received audio signal twice and the audio mixer is configured to mix the signal with its integral and double-integral using scaling that is based on system characteristics. The resulting output audio signal 137*a*-139*a* at the output of the respective audio mixer 137-139 will consist of a signal having a phase that is shifted in the stiffness controlled region (i.e. frequencies lower than fundamental resonance frequency of respective electro-acoustic transducer) and in the fundamental resonance frequency region to substantially match the phase of the signal at the mass-controlled region (i.e. frequencies higher than fundamental resonance frequency of respective electro-acoustic transducer).

The integration function of each stream essentially constitutes a filter that is programmed either with characteristics of the output channel, or at least with some representation of the system's behaviour including in terms of the phase response around the fundamental diaphragm resonance frequency, in order that said phase characteristics can be corrected or at least improved.

The phase improvement module 111 is configured to create a delay in major early-arrival frequency components, so that the arrival time is closer to other components.

Note that in a hypothetical alternative embodiment the phase improvement module 111 could be configured to add a further delay to already delayed frequency components to create a 360 degrees delay to these frequency components and thereby align the phase, at least under steady-state operating conditions.

Variations of the Bass Optimisation and/or Phase Improvement Modules

As mentioned, in this embodiment, the model that is used by the bass optimisation module 110 is based on the assumption that the audio signal 140*a* output from the module 110 is representative of diaphragm acceleration required to replicate the signal.

In many case, a microphone output may represent air velocity (as opposed to diaphragm acceleration), so an audio signal received by the audio tuning system 106 may represent air velocity. In a typical far-field device, such as a home audio speaker, making diaphragm acceleration replicate a source audio signal creates a fairly accurate frequency response. This is because as air disperses from a point source diaphragm into a 3-dimensional space the wave front shifts from being planar to spherical, and the transition creates a 6 dB/octave slope that cancels an opposite 6 dB/octave slope associated with a the device replicating a microphone/source signal as an acceleration rather than as a velocity.

The acoustical environment of a personal audio device on the other hand is different, and making diaphragm acceleration replicate the source signal may sometimes be undesirable.

As such, in alternative embodiments of the audio tuning system 106 of the invention, the phase correction module 111, which is configured for operation in accordance with the mass-spring-damper model described above, may be operable to make diaphragm velocity $\dot{x}$ replicate the received input audio signal of each output channel. In this case the output audio signal 125*a*-127*a* of first high pass filters 125-127 of each audio stream may represent $\dot{x}$ in the mass-spring-damper model, in which case 5*e* may be determined or approximated using an integrator having $\dot{x}$ as the input signal, and x may be determined using a differentiator also having $\dot{x}$ as the input signal. As such, in this alternative embodiment each audio stream 122-124 may consist of an integrator and a differentiator in parallel, the outputs of which are fed into an audio mixer 137-139 that is operable in the same manner described as for the preferred embodiment.

In yet another alternative embodiment, a mass-spring-damper model is used to directly calculate a force that causes the diaphragm to move in a manner part-way between scenario 1, where the diaphragm acceleration replicates the source audio signal, and scenario 2, where diaphragm velocity replicates the source audio signal.

For example, calculations could be made both for a scenario where $\ddot{x}$ represents diaphragm motion and for another scenario where $\dot{x}$ represents diaphragm motion. The calculated voltage variables (e.g. V or equivalent) could be summed using a predetermined proportion.

In some embodiments the model used by the bass optimisation module 110 may comprise calculation of sound pressure changes caused by air leakage from the front chamber of an electro-acoustic transducer 105 for each output channel. In a closed personal audio device embodiment air leakage from the rear chamber may also be modelled.

In some embodiments the first high-pass filter 125-127 of each audio stream 122-124 may optionally be replaced with a second lumped parameter mass-spring-damper mathematical model which calculates a target system response based on a new 'desired' (effective) diaphragm resonance frequency and damping factor for the diaphragm. Effectively this model simulates a bass roll-off of a non-physical electro-acoustic transducer diaphragm, which typically has a lower fundamental resonance frequency compared to the physical transducer, to provide a bass roll-off that can be easily controlled by changing variables such as diaphragm mass and/or stiffness and/or damping. The model may be applied to the audio signal received by the bass optimisation and phase improvement modules 110 and 111 for each respective output channel in place of high pass bass filter 125-127 in one or more streams. As is the case in the preferred embodiment, the phase improvement module 111, which represents a different computer model representing the physical transducer, may then cause the output of this new bass roll-off filter to be replicated by the acceleration of the diaphragm of a the physical electro-acoustic transducer 105. Effectively the system simulates a transducer where it is possible to alter the diaphragm mass and/or stiffness and/or damping while the transducer is operating.

One advantage of this alternative embodiment is that the bass roll-off of the entire system can be changed continuously in order to optimise bass while avoiding diaphragm over-excursion and/or excess voltage. For example if the system predicts that an over-excursion event will happen it can ramp up diaphragm stiffness and/or damping and/or ramp down diaphragm mass to the minimum degree required such that the event is managed. As has been described in relation to the preferred embodiment such changes in system bass roll-off may either be temporary or else may become a medium term default. Of course in this case there is no longer a need to have multiple audio streams having different bass roll-offs. This embodiment provides the advantage that the frequency of the bass roll-off becomes infinitely variable.

In some embodiments, instead of ramping completely to another audio stream out of 122-124, the signal analyser 140 may choose to mix two (or more, not that this is necessarily advantageous) of the audio streams in order to achieve a greater degree of variation in bass roll-off. However in the case that two signals out of 122-124 are mixed the shape of the bass roll-off may comprise an initial step down (for example as a first audio stream 'rolls off' leaving the second stream having lower bass roll-off) followed by a plateau and then a final step down (as the second audio stream also 'rolls off.') This roll-off shape may be less optimal compared to one having a single cut-off at a single optimised frequency.

In some embodiments, instead of a mass/spring/damper model, some other filter type may be used to implement a continuously variable bass roll-off. For example the filter may simulate a capacitor acting in series to create a high pass filter, and the capacitance could be continuously varied. Again, such a filter may be implemented in place of high pass filter 125-127 of one or more streams, or else it may be implemented anywhere in the audio stream.

In some embodiments the loudness and/or phase distortions of a transducer or audio system may be corrected via a DSP employing a parametric filter, a FIR filter, an IIR filter, or some other suitable filtering method. Preferably the equalisation has the overall effect that loudness and/or phase distortions, preferably including those associated with the mass-spring-damper behaviour of a transducer, are cancelled or at least reduced.

In some embodiments the bass optimisation and phase improvement modules 110 and 111 may comprise a biquad Linkwitz transform. The modules 110 and 111 may comprise electrical components such as amplifiers (for example operational amplifiers), resistors and capacitors. The circuit may be configured based on values substantially equivalent to the moving mass, total compliance and damping associated with the diaphragm of an electro-acoustic transducer of a respective output channel, for example the fundamental diaphragm resonance frequency (in situ) and a measure of the damping (in situ). Note that this means that the embodiment comprises a mass-spring-damper model of the physical electro-acoustic transducer or personal audio device. The circuit may also be configured based on a target (effective) resonance frequency of the system and a target (effective) damping of the system, as will seem to occur when the circuit and electro-acoustic transducer are operated in combination. The biquad Linkwitz transform equalisation may alternatively be implemented using an electronic circuit as described, for example, on the website 'www.linkwitzlab.com.' This may be combined with a filter, which could be based on digital or analogue circuitry that corrects the frequency response so that it is more suitable for a personal audio device such as a headphone. U.S. Pat. No. 4,426,552 describes a similar system based on an analogue circuit for example, which may be used by the audio tuning system 106.

In some embodiments the frequency and phase behaviour of the electro-acoustic transducer(s) 105 of each output channel may be improved using a servo-control design such as is implemented in products such as the Rythmik F12 Direct Servo subwoofer. Again, this may be combined with a filter, which could be digital or analogue that corrects the frequency response so that it is more suitable for a personal audio device such as a headphone.

In some embodiments comprising a personal audio device incorporating a ported enclosure, the phase improvement module may be based on a lumped parameter mathematical model of the electro-acoustic transducer behaviour. This model may include, for example, a representation of a moving mass of air contained within and adjacent to the port. The model may also comprise a mass-spring-damper model of the moving diaphragm assembly. Such systems are described in WO2015128237A1, for example, which may be used by the audio tuning system 106.

WO2015128237A1 and U.S. Pat. No. 8,023,668 describe audio improvement circuits that correct linear and nonlinear characteristics of a transducer, and which are based on lumped parameter mathematical models of transducer behaviour and DSP. Such systems may alternatively be used by audio tuning system 106.

U.S. Pat. No. 5,694,476 describes an adaptive filter for correcting the transfer characteristics of electroacoustic transducers. Such a filter may alternatively be used by audio tuning system 106.

In some embodiment the impulse response of the electro-acoustic transducer (s) 105 of each output channel or of the personal audio device is measured and used to create an inverse filter to improve the frequency and phase response. An additional filter may be applied, or incorporated into the first filter, to reduce or manage the low bass response to minimise the possibility of diaphragm over-excursion and or amplifier clipping. The phase correction may be limited to lower frequencies in order to prevent overzealous correction of acoustic characteristics of the personal audio device that are specific to a particular user or measurement system, at the expense of performance with other users or measurement systems, for example the phase correction may not affect treble frequencies. Such an embodiment may be implemented using a digital processing device such as is available from DEQX Pty. Ltd. Measurement may be taken from a personal audio device, such as a headphone via a standard measuring device such as an IEC 60318-1 type coupler.

1.3 Volume Adjustment Module

In a preferred embodiment of the audio tuning system 106, the system further comprises a volume adjustment module 170 having an input that is operatively coupled to a user interface 171 on the personal audio device 101 and/or the audio source device 102. The user interface may include a display, an input device such as volume buttons, or knobs or a touch screen. The audio source device 102 may include one or more graphical user interface screens, or some other form of display that allows viewing of input information.

The volume adjust module 170 may be implemented on the same device or a separate device to the equaliser 109, bass optimisation module 110 and/or phase improvement module 111. The volume adjust module 170 is preferably operatively coupled between the audio output of the audio source device and the equaliser 109 but it may alternatively be coupled elsewhere within the audio tuning system 106.

The module 170 is configured to receive data indicative of user specified volume setting from the user interface 171 and adjust a magnitude of the audio signal for each output channel based on the volume setting data.

The volume adjustment module 170 may be implemented in digital or analogue circuitry.

In the foregoing description, specific details are given to provide a thorough understanding of the embodiments. However, it will be understood by one of ordinary skill in the art that the embodiments may be practiced without these specific details. For example, modules, functions, circuits, etc., may be shown in block diagrams in order not to obscure the embodiments in unnecessary detail.

Also, it is noted that the embodiments may be described as a process that is depicted as a flowchart, a flow diagram, a structure diagram, or a block diagram. Although a flowchart may describe the operations as a sequential process, many of the operations can be performed in parallel or concurrently. In addition, the order of the operations may be rearranged.

One or more of the modules and functions illustrated the figures may be rearranged and/or combined into a single module or embodied in several modules without departing from the invention. Additional elements or functions or modules may also be added without departing from the invention.

In its various aspects, the invention can be embodied in a computer-implemented process, a machine (such as an electronic device, or a general purpose computer or other device that provides a platform on which computer programs can be executed), processes performed by these machines, or an article of manufacture. Such articles can include a computer program product or digital information product in which a computer readable storage medium containing computer program instructions or computer readable data stored thereon, and processes and machines that create and use these articles of manufacture.

The above described audio tuning system embodiments are configured for use with personal audio devices that have been designed to reduce or substantially mitigate unwanted resonances. Preferred embodiments of such devices will now be described.

2. Personal Audio Device Embodiments Utilising Equalisation 2.1 Introduction

An issue that is unique to devices that are worn on the head or intended to be placed near the user's head is the fact that the bandwidth requirement for the electro-acoustic transducers are often approximately the full audible bandwidth of approximately 20 Hz to 20 kHz. Considerations of cost, acoustics (getting sound to the ear without variation with positioning on ear), and aesthetics (e.g. slimness, compactness) dictate that it is advantageous to use a single electro-acoustic transducer for each output channel, or at least preferably not more than a few transducers per output channel.

In personal audio devices the speaker is much closer, and commonly seals against the head. The small size means that breakup resonances of rigid parts of the diaphragm, internal air resonances and transducer base structure resonances are relatively less problematic compared to in "far-field" speaker applications. This means that one of the most problematic design obstacles for personal audio devices is the three-way design compromise whereby the requirements to increase diaphragm excursion and reduce the diaphragm's fundamental resonance frequency, results in a wider and floppier suspension component, which in turn causes surround breakup and diaphragm rocking resonance issues at the upper end of a speaker's frequency bandwidth. In simple terms this means that increasing the level of deep bass and/or the maximum volume of bass reproduction results in damage to treble performance.

If this three-way conflict can be resolved then a substantial proportion of resonance issues affecting personal audio devices may be eliminated while maintaining sufficient bandwidth and/or expanding bandwidth. If remaining resonance issues of the device may be addressed at the same time then a high proportion of resonance issues may be mitigated or eliminated over a significant bandwidth, which may result in a noticeable improvement in the subjective quality of audio reproduction.

Subjective sound quality is also heavily affected by the overall steady state frequency response of a device, and design of personal audio devices is commonly geared towards optimising frequency response at the expense of minimising energy storage characteristics. For example, to provide acceptable bass diaphragm excursion and fundamental resonance frequency must be optimised at the expense of diaphragm breakup resonance. The result is that waterfall measurements of high-end personal audio drivers show a significantly higher degree of resonance in comparison to high-end home audio treble drivers, which have a reduced bandwidth requirement.

Another example of personal audio device design that optimises frequency response at the expense of optimisation of a waterfall plot is that in headphones. Common practice is to incorporate a resonator such as a port to extend bass response. Such resonators store energy waterfall plot and degrade phase coherence (affecting subjective 'impact') at low frequencies.

Use of equalisation and phase correction circuits customised to a transducer, as well as dynamic adjustment of a bass roll-off frequency, as described for the audio tuning system embodiments 106, may effectively expand the bandwidth requirement of an audio system, which permits mechanical and acoustic design to be focused towards resonance control.

The personal audio system embodiments of the invention are operatively coupled to any one of the audio tuning system embodiments 106 of the invention to thereby simultaneously address the above-described important aspects of audio reproduction being: the overall steady state frequency response; and time domain distortion as measured by visible ridges in a waterfall plot.

The audio tuning system embodiments help to optimise the frequency response, and they are able to do so relatively independently of the time domain performance and without causing any sharp or persistent ridges in a waterfall plot, which may be especially damaging to subjective sound quality. Relieved of some of the burden of bandwidth and part of the requirement to optimise frequency response, the personal audio device embodiments on the other hand are configured to substantially alleviate or mitigate unwanted mechanical resonances that are inherent in diaphragm designs, diaphragm suspensions, and/or electro-acoustic transducer suspensions, for example, without significantly affecting the steady state frequency response. In combination with an audio tuning system that optimises the frequency response of the device, these low-resonance personal audio device embodiments therefore may disproportionately address distortions affecting subjective sound quality in a personal audio application.

A further benefit of the invention arises from the fact that unwanted resonance affects subjective loudness beyond the effect on stead state frequency response.

Resonance may cause peaks and troughs in frequency response, and it has been shown that frequency response peaks are more audible than troughs, implying that subjective loudness may increase compared to what might be expected based on the average level of a steady state frequency response.

Furthermore, whereas frequency response peaks introduced by common filter circuits, such as parametric equalisers for example, often result in only minimal energy storage in the overall audio system, mechanical and acoustical resonances of an audio system often cause a higher degree of energy storage (which may be visible in a waterfall plot, for example.) Such energy storage results in subjective 'harshness' which, again subjectively, tends to require compensation by a reduction in steady state level at affected frequencies. This is another way that resonance and energy storage tends to increase subjective loudness.

This means that transducers having low-resonance features and characteristics may require different frequency response tunings. More specifically, higher frequencies, where most resonance occurs in conventional personal audio systems, may need to be made louder. When resonance control features are used in conjunction with equalisation circuits and higher-than-typical loudness tuning at high frequencies such resonance issues may be resolved at source, rather than requiring a Band-Aid fix being a reduction in treble levels, resulting in subjectively clearer audio reproduction.

In each of the personal audio device embodiments herein described the device comprises an electro-acoustic transducer having a diaphragm that is movably coupled relative to a base, such as a transducer base structure and/or part of a housing, support or baffle. Movement of the diaphragm generates sound. The base has a relatively higher mass than the diaphragm. A transducing mechanism associated with the diaphragm moves the diaphragm in response to electrical energy.

In the embodiments of this invention, an electromagnetic transducing mechanism is used. An electromagnetic transducing mechanism typically comprises a magnetic structure configured to generate a magnetic field, and at least one electrical coil configured to locate within the magnetic field and move in response to received electrical signals. As the electromagnetic transducing mechanism does not require coupling between the magnetic structure and the electrical coil, generally one part of the mechanism will be coupled to the transducer base structure, and the other part of the mechanism will be coupled to the diaphragm. In the preferred configurations described herein, the heavier magnetic structure forms part of the transducer base structure and the relatively lighter coil or coils form part of the diaphragm. Such magnet and moving coil motor systems may provide high excursion and linearity along with low distortion, however it will be appreciated that alternative transducing mechanisms, including for example piezoelectric, electrostatic or any other suitable mechanism known in the art, may otherwise be incorporated in each of the described embodiments without departing from the scope of the invention.

The diaphragm is moveably coupled relative to the base via a diaphragm suspension system. Two types of electro-acoustic transducers are described in this specification: rotational action electro-acoustic transducers in which the diaphragm rotatably oscillates relative to the base; and linear action electro-acoustic transducers in which the diaphragm linearly reciprocates/oscillates relative to the base.

The electro-acoustic transducer may be accommodated with a housing or surround of the personal audio device. In some embodiments, the transducer base structure may form part of the housing or surround of an electro-acoustic transducer assembly. The electro-acoustic transducer, or at least the diaphragm assembly, is mounted to the housing or surround via a transducer suspension system.

The audio tuning system 106 may be located within one or more of the housings of the personal audio device, and/or they may be located in a separate device, such as an audio source device 102 that is intended to be used with the personal audio device.

The audio tuning system 106 may be implemented in any one of the following personal audio device embodiments. However, it will be appreciated that the audio tuning system 106 may also be implemented in other personal audio device constructions, such as any one of the devices detailed in PCT patent application PCT/IB2016/055472 which is hereby incorporated by reference.

2.2 Headphone

Figure 10:
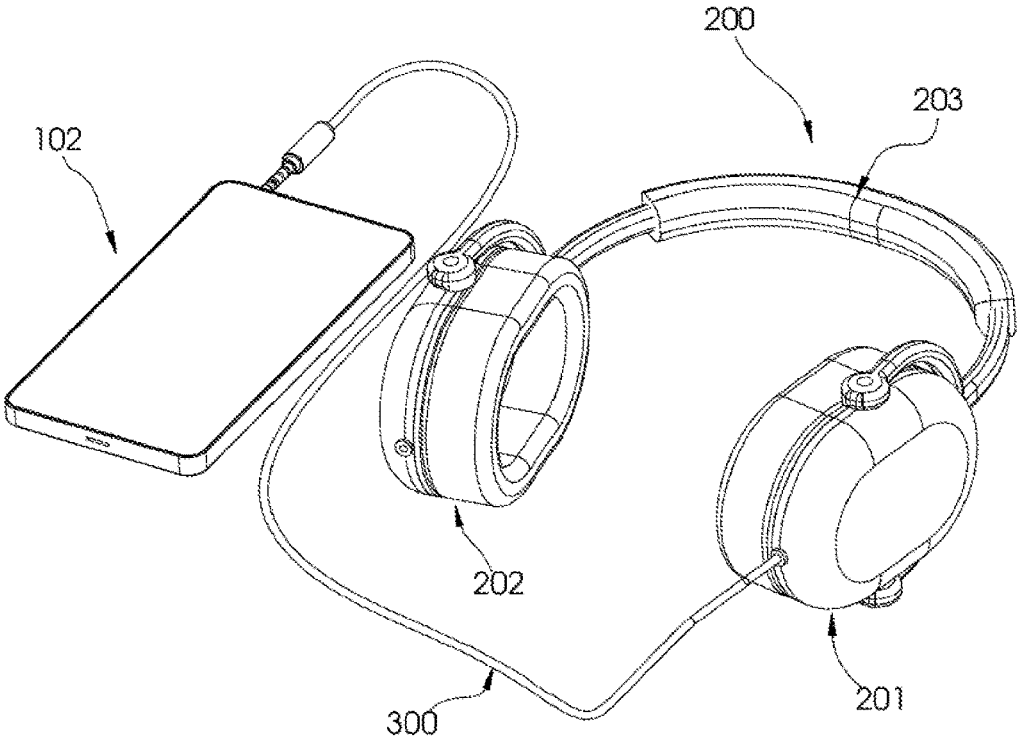
FIG. 10 is a perspective view of a headphone device incorporating the audio tuning system of FIG. 3 and connected to an audio source device.

A first personal audio device embodiment is shown in FIG. 10 in the form of a headphone 200. The headphone 200 is shown operatively coupled to an audio source device 102 via a data cable 300 for the transfer of audio related signals for the two output channels of the headphone. The cable 300 may be hardwired to the necessary port at the headphone 200 and connectable to a port of the audio source device (such as a conventional 3.5 mm audio port or a micro-USB or USB via an appropriate connector as is well known in the art. The headphone may alternatively or additionally be operatively and communicatively coupled to the audio source device 102 wirelessly via any method known in the art as previously explained. The headphone comprises left and right side headphone interface devices 202 and 201 forming the left and right output audio channels of the device. The headphone interface devices 201 and 202 are connected by a bridging headband 203.

Each headphone interface device 201, 202 comprises an electro-acoustic transducer mounted inside the cup housing 204, 205. Although this embodiment shows a headphone configuration, it will be appreciated that the various design features of the audio device may alternatively be incorporated in any other personal audio device, such as an earphone or a mobile phone device for example, without departing from the scope of the invention. The features of the headphone interface devices 201, 202 will now be described in further detail with reference to one of the interface devices 201. The other interface device 202 comprises the same or similar construction and therefore its features will not be repeated for the sake of conciseness.

The headphone device 200 incorporates or is configured to operatively couple an audio tuning system 106 as described in section 1 of this specification, including preferably any combination of one or more of an equaliser 109, a bass optimisation module 110, a phase improvement module 111 and/or a volume adjustment module 170. The equaliser 109 is preferably operable based on the operating characteristics of each audio output of the headphone 200.

Electro-Acoustic Transducer

Figure 11A:
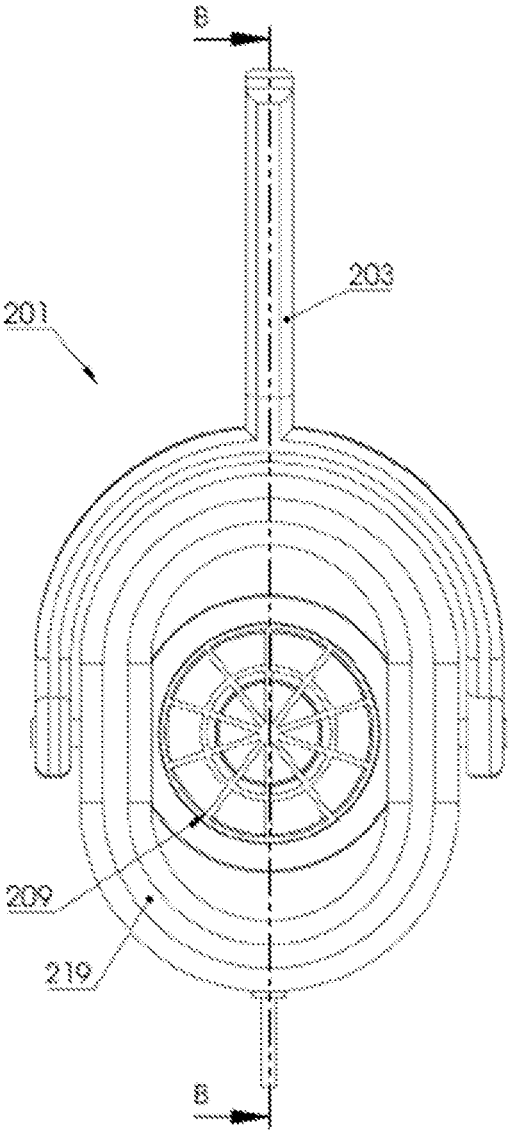
FIG. 11A is a side view of a headphone cup of the headphone device of FIG. 10.
Figure 11B:
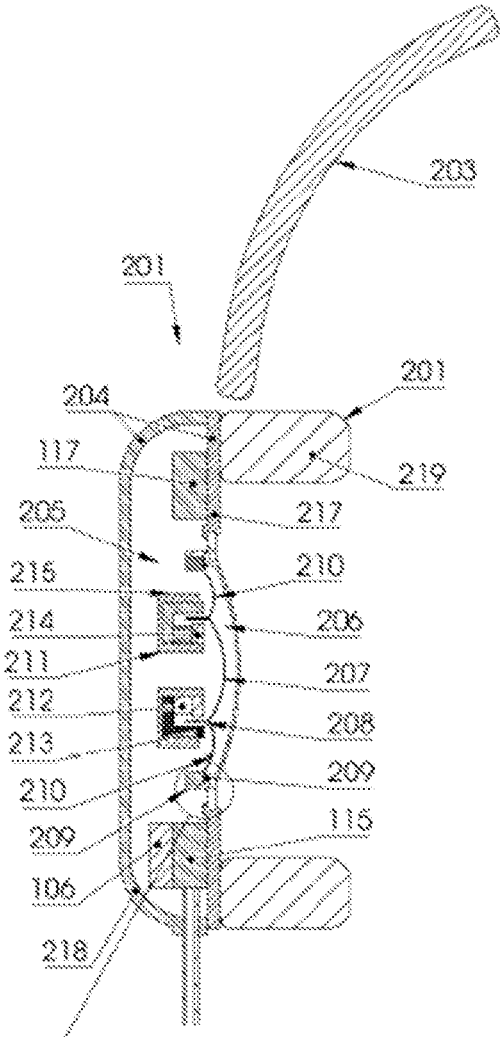
FIG. 11B is a cross-sectional view of the headphone cup of FIG. 11*a;*
Figure 11C:
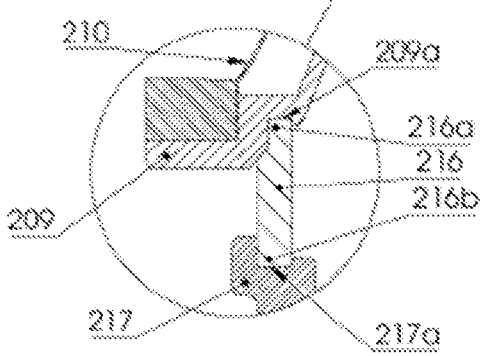
FIG. 11C is a close-up view of a suspension system used in the headphone cup of FIG. 11*a;*

Referring to FIGS. 11A-11C, the interface device 201 comprises an electro-acoustic transducer 205 located within a cup housing 204. The electro-acoustic transducer 205 is a linear action electro-acoustic transducer comprising a diaphragm 206 having a substantially rigid and domed or arcuate diaphragm body 207 with a diaphragm base frame comprising a force transferring component 208 extending laterally from the periphery of the body 207. The diaphragm 206 is coupled to a surround 209 of the electro-acoustic transducer by a sufficiently flexible suspension 210. The surround 208 extends about the periphery of the diaphragm and over one major face of the body. The surround 209 is preferably located at a side of the diaphragm configured to locate adjacent a user's ear in situ. The surround 209 is preferably substantially rigid material and may comprise a plurality of apertures to form a grille.

The suspension 210 extends about a substantial portion of the periphery of the diaphragm body 207 and allows the diaphragm 206 to reciprocate linearly relative to the surround 209 by flexing during motion. The suspension 210 may be formed from a substantially flexible material, such as a soft plastics material, or from a rigid material that is reduced in thickness or otherwise formed/shaped in a manner sufficient to induce flexure. An inner periphery of the suspension 210 may be integrally formed with the outer periphery of the diaphragm body 207, such as via co-moulding or otherwise fixedly coupled thereto via any suitable mechanism, such as adhesion. Similarly, an outer periphery of the suspension 210 may be integrally formed with the diaphragm surround 209, such as via co-moulding or otherwise fixedly coupled thereto via any suitable mechanism, such as adhesion. The suspension may be corrugated or creased (in a spiral shape for example) or otherwise stiffened to help minimise adverse effects due to induced resonance modes during operation, while still permitting sufficient degree of linear motion of the diaphragm 206.

The diaphragm body 207 is formed from a substantially rigid material such as a rigid plastics or metal based material. In one example, the diaphragm body 207 may be formed from a liquid crystal polymer material, however, other suitable materials may be utilised.

The diaphragm and suspension may also comprise a thin coating of aluminium on one or both sides. This has the effect of stiffening the diaphragm body 207 against tension and compression deformations parallel to the diaphragm body outer surface, while still permitting sufficient bending of the suspension 210. Diaphragm bending is less affected, relatively speaking, because the coating is very thin, for example approximately 0.003 mm. In a preferred embodiment coating is only located on one side of the diaphragm so that bending deformation may be facilitated primarily by stretching or compression of the body on the side of the membrane that has no coating, while the stiff coating undergoes relatively minor deformation.

An alternative coating material could also be used, however to be sufficiently effective at resisting deformation the Young's modulus of the coating material is preferably higher than approximately 8 GPa, or more preferably higher than approximately 20 GPa. To be sufficiently effective at resisting deformation without adding undue mass, the specific modulus is preferably at least 8 MPa/(kg/m^3), or more preferably at least 20 MPa/(kg/m^3.) Many metals and ceramics may be suitable for this purpose.

The relatively high-specific-modulus coating on the diaphragm helps to stiffen the diaphragm so that break-up resonance frequencies are increased which, again, improves mechanical energy storage characteristics. In combination with customised equalisation of low-bass and/or dynamic adjustment of the bass roll-off resonance, a number of critical sources affecting personal audio devices are thereby addressed, providing low-resonance behaviour over an extended effective bandwidth such as would not otherwise be possible. This in turn leads to a possibility of increasing the calibration level of parts the frequency response towards, for example lower and/or upper parts of the treble bandwidth. The level may be increased towards, or to, a diffuse field target. Such a calibration may be achieved by the equalisation module without creation or worsening of resonances.

The force transferring component 208 of the excitation mechanism comprises a former and coil wound about the former. A magnetic structure 211 forms the other part of the excitation mechanism and includes a permanent magnet 212 with an outer pole piece 213 and an inner pole piece 214 coupled to either pole of the magnet. The force transferring component 208 of the diaphragm extends through the gaps formed between the outer and inner pole pieces 213, 214 of the magnetic structure and reside with the gaps at least when the diaphragm is in the neutral/at-rest position. The gaps or spaces between the outer and inner pole pieces may comprise ferromagnetic fluid that supports and centres the force transferring component therewithin in some embodiments. In this embodiment an air gap is provided between the pole pieces of the magnetic structure. The magnetic structure 211 forms part of the transducer base structure and is rigidly coupled to an inner housing part 215 configured to surround the excitation mechanism which also forms part of the transducer base structure. The surround may comprise a cavity that accommodates the magnetic structure of the excitation mechanism. The former and coil winding 208 reciprocate within the gap of the magnetic structure during operation to in response to electrical signals being sent through the coil winding during operation.

The diaphragm 206, surround 209, force transferring component 208, and magnetic structure 211 are preferably all annular, however other cross-sectional shapes may be used without departing from the scope of the invention.

Transducer Suspension System

In the preferred embodiment, the electro-acoustic transducer 205 is mounted to the housing 204 of the interface device via a substantially flexible suspension system 216, that is configured to substantially mitigate transmission of mechanical vibration from the transducer 205 to the housing and vice versa, which effectively decouples the transducer from the housing 204. This means that vibration energy is somewhat contained within the transducer which, especially in conjunction with various features of the present invention, may be designed to be relatively resonance-free, at least compared to many home audio transducers, by virtue of its compact dimensions.

Excitation of resonances associated with other components, such as of the larger and resonance-prone housing, is minimised.

In the embodiment, the transducer 205 is mounted within a central aperture of a base 217 of the housing 204 by one or more flexible mounts 216. The flexible mounts may comprise a substantially flexible annular ring 216. The inner peripheral edge 216*a* of the suspension ring 216 may be fixedly retained within a complementary recess or groove 209*a* at the outer periphery of the diaphragm support 209. The outer peripheral edge 216*b* of the suspension ring 216 may be fixedly retained within a complementary recess or groove 217*a* at the inner periphery of the base 217. The suspension ring 216 may be rigidly coupled to the surround recess 209*a* and inner peripheral edge 216*a* of base 217 via any suitable mechanism, such as using adhesive.

The suspension ring 216 is substantially compliant and therefore is formed from a substantially flexible and/or resilient material and/or comprises a substantially flexible and/or resilient geometry. In this embodiment, the suspension ring 216 is made from silicone rubber, with a Young's modulus of approximately 2 MPa for example. Alternative many other materials and geometries are also acceptable, for example resilient steel flat springs, foam and the like. In this manner, electro-acoustic transducer 205 is compliantly coupled and suspended relative to the base 217 via the transducer suspension system 216. It will be appreciated that other flexible suspension systems may be used without departing from the scope of the invention.

The suspension system 216 is preferably sufficiently compliant in terms of relative movement between the two components to which it attaches. For instance, the system may be sufficiently flexible to allow relative movement between the two components they are attached to. The suspension 216 may comprise flexible or resilient members or materials for achieving compliance. The suspension preferably comprise a low Young's modulus relative to at least one but preferably both components it attaches to (for example relative to the transducer base structure and housing of the audio device). For instance, the suspension 216 may be made from a silicone rubber. The material is preferably also a shock and vibration absorbing material, such as a silicone rubber or for example a viscoelastic urethane polymer.

Alternatively, the suspension 216 may be formed from a flexible and/or resilient member such as metal decoupling springs. Other substantially compliant members, elements or mechanism mechanisms such as magnetic levitation that comprise a sufficient degree of compliance to movement, to suspend the transducer may also be used in alternative configurations. Some examples of possible material for the suspension 216 are (the invention is not intended to be limited to these examples):

- Silicone rubber of hardness grade 30 durometer (on the shore A scale) having a Young's Modulus value of approximately 0.7 MPa;
- Nitrile rubber of hardness grade 50 durometer (on the shore A scale) having a Young's Modulus value of approximately 1.8 MPa;
- Sorbothane of hardness grade 30 durometer (on the shore 00 scale) having a Young's Modulus value of approximately between 0.3 and 1 MPa; or
- Natural rubber of hardness grade 30 durometer (on the shore A scale) having a Young's Modulus value of approximately 10 MPa.

The suspension 216 be made from a material having a Young's Modulus value of approximately 0.5-30 MPa for example. These values are just exemplary and not intended to be limiting. Material having other Young's Modulus values may also be used as it will be appreciated that compliance is also dependent on the geometry of the material for example.

When decoupling is implemented in the manner described for the suspension 216, in combination with customised equalisation of low-bass and dynamic adjustment of the bass roll-off provided by audio tuning system 106, resonance may be addressed in relation to a number of critical sources affecting personal audio devices. So low-resonance system behaviour may be provided over an extended effective bandwidth such as would not be possible without this combination of features.

This in turn leads to a possibility of increasing the level of higher frequency regions of the frequency response towards, or up to, a diffuse field target, which may be achieved by the equalisation module 109 without creation of energy storage issues, for the reason as follows.

As described above, most personal audio devices have mechanical and acoustical resonances, causing peaks and troughs in the frequency response as well as subjective 'harshness', particularly at treble frequencies. To compensate for this, it is commonplace to reduce system loudness with increasing frequency, compared to a diffuse field target. While this may improve bass-treble balance, there is also a loss of subjective clarity in audio reproduction.

The transducer suspension system addresses a key source of resonance in personal audio devices which, optionally in combination with customised equalisation of low-bass and other features addressing unwanted resonance, facilitates a frequency response calibration that is closer to a diffuse field target. Equalisation module 109 is able to enact such calibrations without creating significant additional energy storage within the system as a whole.

Many personal audio devices based on dynamic transducers also exhibit a bass roll-off that starts, albeit gradually, from around 80 Hz in many cases. This means that there is a lack of low-bass frequencies compared to high-bass, and it is common to compensate by increasing the overall bass level.

Equalisation, preferably based on known parameters of an audio channel such as is implemented by module 109, may extend low-bass response, as can dynamic adjustment of the bass roll-off as implemented by module 110. Such improvements to the level of low-bass reduces the requirement to raise bass levels overall. This may imply that low treble frequencies may be increased relative to high-bass frequencies. So equalisation to, or closer to, a DF target 109 may be useful in combination with low bass equalisation 109 (preferably based on known parameters of an audio channel) and dynamic adjustment of the bass roll-off 110, as well as with measures such as decoupling a transducer via suspension 216 that address resonance, since these features all have an effect of improving the performance of the headphone device 200 when calibrated to a more accurate diffuse field calibration target.

Such bass extension measures, and also transducer suspension systems, may work well in conjunction with passive equalisation based on a capacitor in series with a transducer. Ordinarily the 6 dB per octave slope imposed by a capacitor may be too harsh, however when the system exhibits extended low bass and/or transducer suspension systems that address resonance, a 6 dB per octave slope may work well over a limited bandwidth. Preferably a resistor in parallel with a capacitor provides a low frequency shelf as described under section 1 of this specification.

Housing

The housing 204 of headphone interface device 201 comprises the base 217 and a cap 218. Together they form a hollow interior within which the transducer 205 is coupled via the suspension system described above. The base 217 and cap 218 are fixedly coupled at their peripheries via any suitable fixing mechanism, for example via screw fasteners, or a snap-fit engagement or adhesive. The base 217 comprises a central aperture configured to align with the diaphragm of the electro-acoustic transducer in the assembled state, and thus provides an output aperture within which the grille 209 resides and through which sound propagates from the transducer assembly during operation. A soft ear pad 219 extends about the periphery of the base 217 on an opposing side to the outer cap 218 and about the central output aperture. The soft ear pad may be formed from any suitable material well known in the art such as a foam material that is comfortable to the user. The pad 218 may be lined with a non-breathable fabric layer. Also, an open meshed fabric may extend over the base 217 and/or over the grille 209. Other layers of material and/or fabric may be applied which increase fluid resistance, for example the inner face of the ear pad 219 may be lined with a porous or permeable material, and a comfort pad may be situated facing the ear. It will be appreciated some these may be optional and depend on the desired implementation. Outer cap 218 may have perforations to permit air flow between the rear side of the diaphragm and surrounding air in order to minimise build-up of air resonances, so that this is an 'open' type headphone. Also highly restrictive fluid passages between the front chamber and surrounding air help to minimise resonances in the air cavity facing the ear. Such passages are still sufficiently restrictive in order that there is a lift in loudness at low frequencies.

Using such acoustical resonance control measures in combination with customised equalisation of low-bass and/or dynamic adjustment of the bass roll-off resonance helps to provide low-resonance behaviour over an extended effective bandwidth. This in turn helps to make possible an increase in the calibration level of parts the frequency response towards, for example, lower and/or upper parts of the treble bandwidth. The level may be increased towards, or to, a diffuse field target. Such a calibration may be achieved by the equalisation module 109 without creation or worsening of resonances.

Grille 209 is preferably rigidly connected to transducer 205, which means that it may be prone to resonance. Grille 209 is made from aluminium in order to address resonances by pushing them to high frequencies, and ideally beyond the operating bandwidth of the device. Preferably the grille has a dome-shaped curvature in order to improve stiffness and resistance to resonances. In alternative embodiments grille 209 is substantially thick, most preferably having membrane thickness that is more than approximately 8%, and more preferably more than approximately 10% of a maximum diameter, width or length dimension.

Audio Tuning System

The above describes the construction of each of the headphone interface devices 201, 202.

In this embodiment, one of the headphone interface devices 201 further comprises an audio tuning system 106, one or more amplifier(s) 115 and a power source 117 located within the housing 204. The audio tuning system 106, amplifier(s) 115 and power source 117 may be coupled to the base 217 of the housing 204. The audio tuning system 106 may be any one of the audio tuning system embodiments described in this specification and may include any combination of one or more of: an equaliser 109, a bass optimisation module 110, a phase improvement module 111 and/or a volume adjustment module 170. As previously described, the audio tuning system 106 may be a digitally implemented system including a digital signal processing circuit, or an analogue implemented system including analogue signal processing circuitry, or any combination thereof. The audio tuning system 106 may be operatively coupled to the audio source device 102 via the cable 300 shown in FIG. 10. Alternatively, the audio tuning system 106 may be wirelessly operatively coupled to the audio source device 102. Audio signals for both output channels may be received by the audio tuning system 106 via a suitable communications interface 107 and processed by the tuning system to optimise the signals for each output channel before being sent to the amplifier 105 of each channel. The processed signals for the other channel may be sent wirelessly or via a cable running through headband 203 for example.

In yet another variation, the audio tuning system 106 may be fully or partially implemented within the audio source device 102. In this case, the headphone interface device 201 may not comprise any electronic circuitry, or it may only comprise an amplifier 115, or it may comprise at least a communications interface and some signal processing circuitry for further signal optimisation before being sent to the respective transducer(s) 105.

In some embodiments each headphone interface device 201 comprises a separate audio tuning system 106 for the respective channel.

In a preferred embodiment any one or more of the equaliser 109, the phase improvement module 111 and/or the bass optimisation module 110 is/are integral with personal audio device 200 and personal audio device 200 is designed to operate in conjunction with one or more of these modules 109-111 simultaneously during audio playback (i.e. approximately during the entire a period the device 200 is in normal use)). Alternatively, equaliser 109 the phase improvement module 111 and/or the bass optimisation module 110 is/are not integral with personal audio device 200, however nonetheless, personal audio device 200 is designed to operate in conjunction with one or more of these modules 109-111 simultaneously during audio playback. In this way the requirement for transducer(s) 2205 to provide bass extension though a low fundamental diaphragm resonance frequency may be relieved thereby permitting a reduction in unwanted diaphragm resonance, all else being equal. Such reduction may be achieved by, for example, a stiffening of diaphragm surround 210. Alternatively, the transducer design may not be altered and one or more of the modules 109-111 may provide improved bass extension compared to if the transducer is operated with no equalisation. Preferably transducer 205 is mounted to housing 204 via a suspension system 216 to address excitation of housing 204 and other resonances, such that a high proportion of unwanted resonances of device 201 are addressed. Preferably equaliser 109 is programmed to make audio system 100 achieve a substantially diffuse field frequency response target.

Note that in the case that personal audio device 200 is designed to operate in conjunction with equaliser 109 and/or phase improvement module 111 and/or bass optimisation module 110 during audio playback/normal use, its frequency response and other characteristics need not necessarily make for subjectively high sound quality in the event that personal audio device 200 happens to be used without such modules 109-111. For example bass roll-off may occur at a higher frequency than is typical.

In the case that any combination of equaliser 109, phase improvement module 111 and/or bass optimisation module 110 are not integral with personal audio device 200, however nonetheless is/are designed to operate in conjunction with personal audio device 200 during audio playback, the personal audio device 200 and/or associate audio source 102 and/or associated remote computing device 103 preferably includes one or more safety features which may help to prevent damage to said device or to any other device which may be inadvertently subjected to an audio signal containing heavily boosted bass frequencies or other non-typical signal features which may potentially cause damage. Preferably such features involve a method of determining the identity of personal audio device 200 and/or audio source 102 before sending and/or accepting an audio signal. Preferably such involves sending and/or receiving of a signal or code before sending and/or accepting an audio signal. Alternatively the identity of personal audio device 200 may be determine by sensing impedance of a transducer which may be achieved using, for example, methods described in U.S. Pat. No. 9,247,365B1. Preferably a warning is given to a user to check that a correct device is connected. Such warning may take the form of a light or sound or message or other communication via a user interface, or a note in a user manual, for example. Such safety features may provide an advantage that audio signals can be more heavily modified by module 109 and/or by module 111 according to known properties of a particular device, with reduced risk of damage to any other device.

Frequency Range of Operation

Preferably, the personal audio device 200 has a FRO that includes the frequency band from 100 Hz to 10 kHz, or more preferably includes the frequency band from 80 Hz to 12 kHz, or most preferably includes the frequency band from 60 Hz to 14 kHz.

Some Variations

The electro-acoustic transducer of this embodiment is a linear action transducer. However, it will be appreciated that in alternative embodiments (as will be described in section 2.4 below for example) a rotational action transducer may alternatively be used in the personal audio device.

It will be appreciated that the internal electro-acoustic transducer mechanism may alternatively be implemented in an earphone device (as will be described for audio device 400 for example) or other personal audio device such as a mobile phone or a hearing aid for example.

The audio device 200 may comprise multiple transducers per channel.

Additional Advantages

The personal audio device 200 incorporating or cooperatively operating with the audio tuning system 106 of the invention also improves performance in the following ways. First, the flexible transducer suspension system 216 reduces transmission of vibration from the transducer to the housing 204, which helps to prevent or minimise excitation of resonance modes within the housing thereby improving waterfall plot measurements of the device 200 and improving audio reproduction. Combining the bass boost component of the equaliser 109 with this transducer suspension system 216 disproportionately magnifies the anti-resonance benefit provided by the suspension system 216. This is because the reduction in resonance of the housing 204 that is achieved by the addition of the suspension system 216, is not undone by resonances of the diaphragm and surround associated with extending the bass response via mechanical and acoustical design.

Second, in this embodiment, the diaphragm 206 moves with a mainly linear action during operation, but also may rotate very slightly on its axis of symmetry, due to the folding that may be in the diaphragm suspension 210. This design is advantageous because the lightness, comparatively high stiffness (compared to rubber or foam) and rigid geometry of the suspension 210. This helps to resist unwanted resonance at high frequencies, while still enabling greater excursion and lower fundamental frequency compared to a standard home audio dome treble driver having a compact rubber surround, for example. However, the diaphragm suspension 210 still has limits that are difficult to overcome. For example it is rare for such electro-acoustic transducers to have a fundamental diaphragm resonance frequency below 100 Hz, or if they do this may be in cheaper bass-oriented drivers with reduced treble sound quality. Some suffer treble breakup that is far worse than occurs in a high quality home audio treble driver.

The audio tuning system 106 including an equaliser 109 with a bass boost component solves this issue by increasing the level of low bass in the output audio signal of the personal audio device 200, for example at frequencies below the fundamental diaphragm resonance frequency. This has the effect of providing sufficiently low bass volume, again without worsening diaphragm 206 and housing 204 resonance/breakup problems at mid-range and treble frequencies.

Subjective 'impact' may be improved (e.g. kick drums 'kick') by the combination of two or preferably more of: extended bass response (equaliser 109, dynamic bass roll-off adjustment module 110); improved phase coherence at low frequencies (phase improvement module 111); more realistic sounding equalisation where the upper mid-range/lower treble range is close in level to a diffuse field target; Anti-resonance measures (transducer decoupling, metalized diaphragm, fluid air leaks that manage acoustical resonances);

The result of this embodiment is an audio system where both frequency response and energy storage characteristics may be highly optimised. In cases where a compromise must be struck, the mechanical and acoustic design of the personal audio device enables tailoring towards optimisation of energy storage characteristics instead of just towards optimisation of frequency response.

2.3 Earphone

Figure 12A:
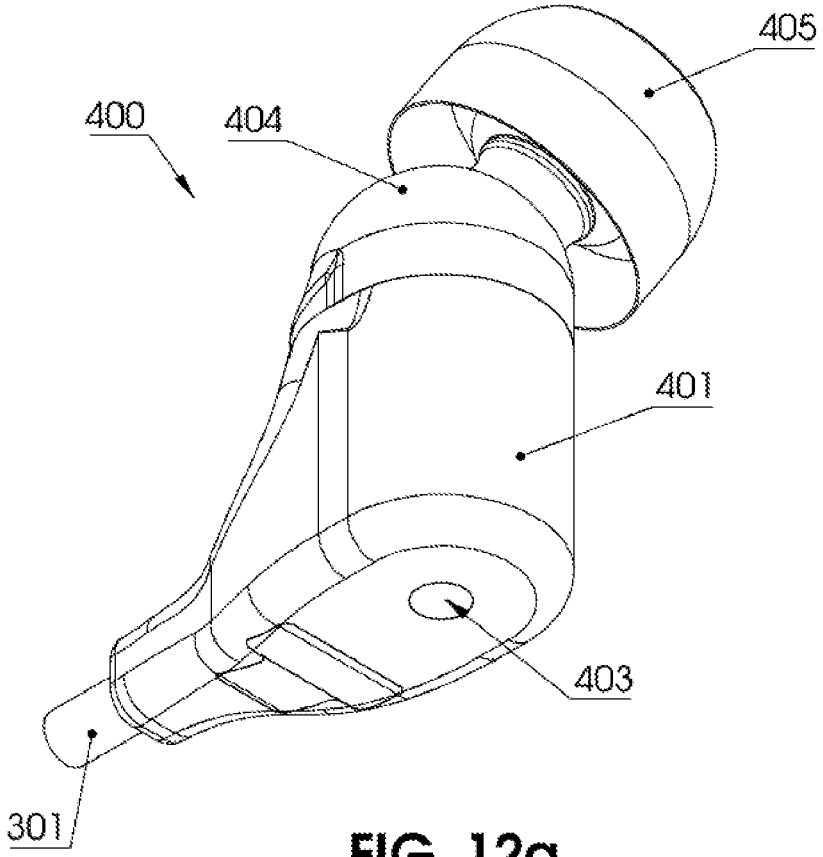
FIG. 12A is a bottom perspective view of an earphone device of the invention incorporating the audio tuning system of FIG. 3.
Figure 12B:
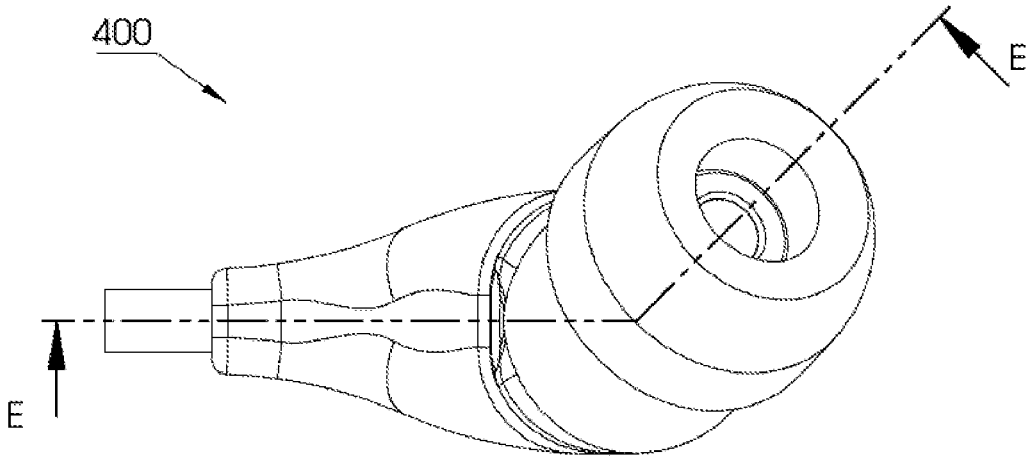
FIG. 12B is a top perspective view of the earphone device of FIG. 12A.
Figure 12C:
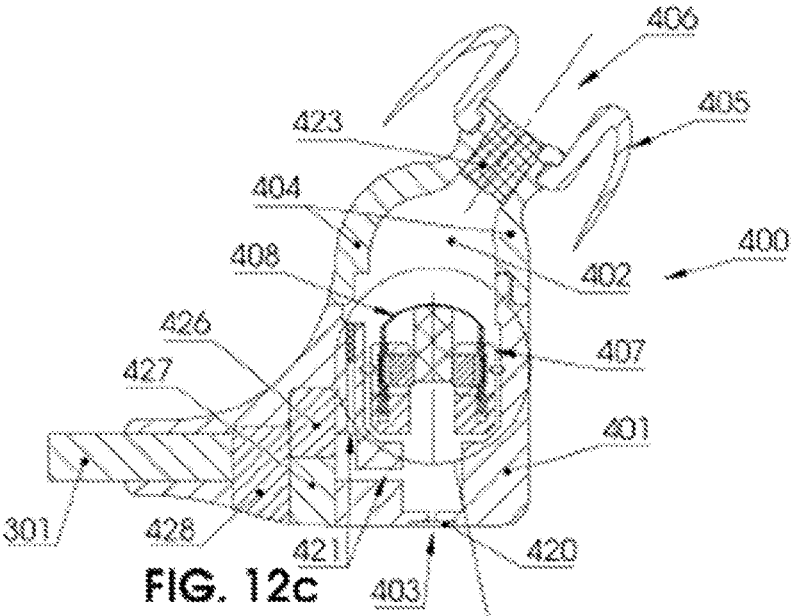
FIG. 12C is a cross-sectional view of the earphone device of FIG. 12A.
Figure 12D:
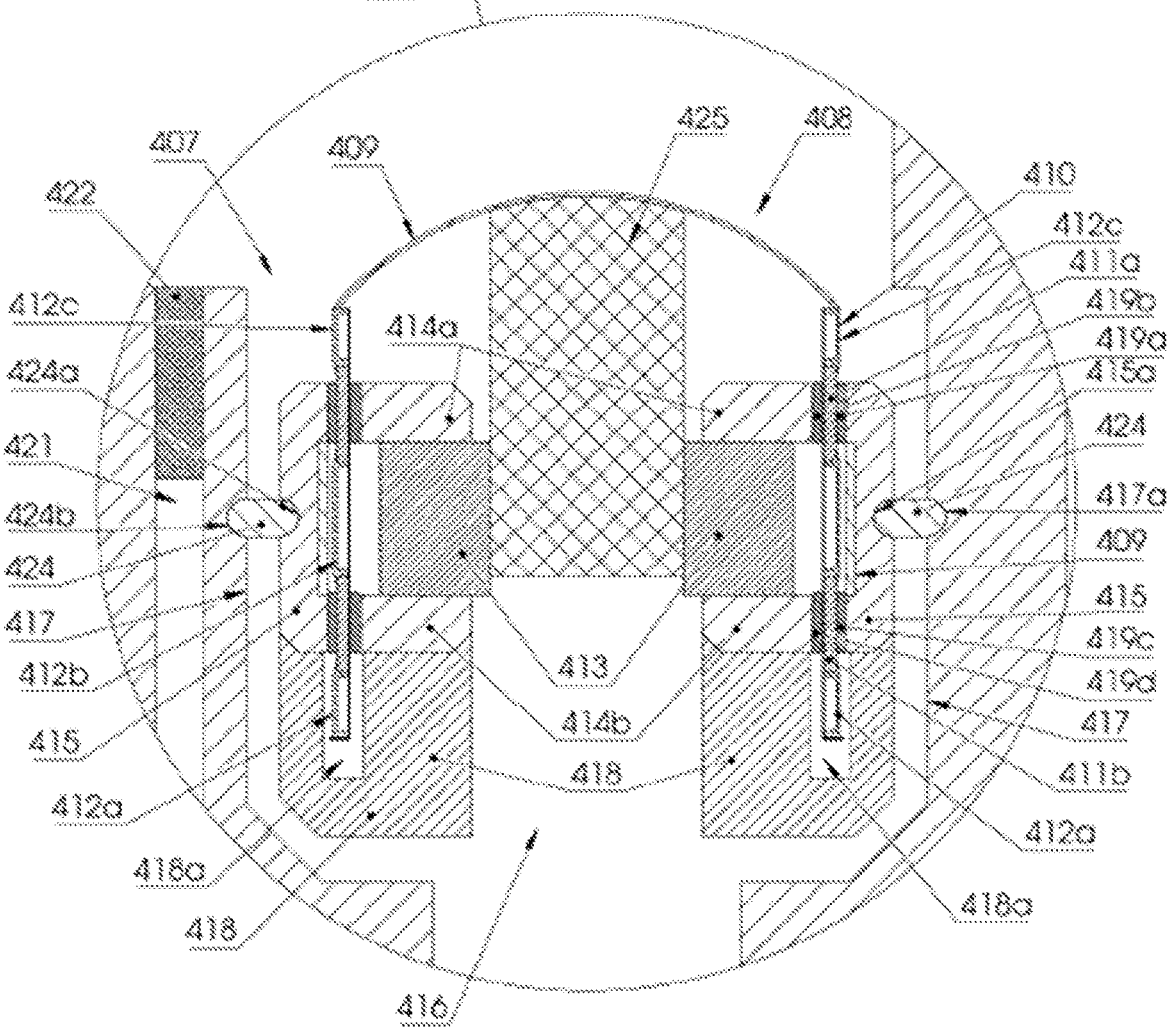
FIG. 12D is a close up cross-sectional view of the audio transducer inside the earphone device of FIG. 12A.

Referring to FIGS. 12A-12C, a second embodiment of a personal audio device is shown in the form of an earphone interface device 400. This device may be part of an earphone apparatus comprising a pair of earphone interface devices for a pair of output audio channels. Although the following description will be with reference to an earphone, it will be appreciated that the same system or assembly described may be implemented in any other personal audio device, including (but not limited to): headphones, mobile phones, hearing aids and the like. The figures shown and the embodiment will be described with reference to a single earphone interface device, however it will be appreciated that the personal audio device 400 may comprise a pair of earphone interface devices of the same or similar construction for a pair of output channels.

The earphone interface device 400 comprises a substantially hollow base 401 having at least one chamber for accommodating an electro-acoustic transducer assembly therein. The base 401 is substantially open at one end (facing cavity 402) and substantially closed at an opposing end apart from a small vent or air leak fluid passage 403. A housing or surround part 404, open at both ends couples the base at the open end and creates an air passage from the transducer assembly. The opposing end of the housing part is coupled to an ear mounting system or interface 405, such as an ear plug 405 having a vent 406. An air passage thus extends from the transducer assembly to the vent 406. It will be appreciated that the base 401 and the housing part 404 may be separate components that are coupled via any suitable mechanism (e.g. snap-fit engagement, adhesive, fasteners etc.) or integrally formed. Together, these parts 401 and 404 form a housing for the transducer assembly. Similarly, the housing part 404 and plug 405 may be separate components that are coupled via any suitable mechanism (e.g. snap-fit engagement, adhesive, fasteners etc.) or integrally formed. The device 400 preferably comprises a body shaped to reside within a user's ear, such as the user's concha or ear canal, so that it may locate the electro-acoustic transducer adjacent or within the user's ear canal. The plug 405 body may be formed or covered in a soft material for comfort, such as a soft plastics material like Silicone or similar. In situ and during use, the ear plug 405 is preferably configured to substantially seal, for example, against or within the ear canal. The base 401 comprises an internal surround within which the transducer base structure of the electro-acoustic transducer is rigidly coupled and supported.

The base 401 may house electronic components therein, such as an audio tuning system 106, amplifier(s) 115 and/or battery 117 and comprise a channel for receiving a connector 301 of a cable or other communications interface for communicating with an audio source device 102.

The electro-acoustic transducer 407 housed within the housing 401, 404 comprises a diaphragm 408 that is suspended relative to the base 401 and moveable via an excitation mechanism. In this embodiment, the excitation mechanism is an electromagnetic mechanism, however it will be appreciated that in alternative embodiments other mechanisms may be utilised, such as using motors and the like. In this embodiment, the electro-acoustic transducer is a linear action transducer wherein the diaphragm 408 is configured to reciprocate/oscillate substantially linearly during operation to transduce sound. It will be appreciated in alternative embodiments, the electro-acoustic transducer may be a rotational action transducer configured to rotatably oscillate relative to the base structure. The diaphragm 408 comprises a curved or domed diaphragm body 409. The diaphragm body 409 is preferably formed from a suitably rigid material, such titanium for example. In this embodiment, the diaphragm body 409 is substantially rigid such that it resists flexing or bending as it reciprocates during operation of the transducer. It will be appreciated however, that in alternative embodiments the diaphragm body 409 may be substantially flexible. The diaphragm body comprises a substantially smooth major surface on either side.

Extending from the periphery of the diaphragm body 409 and rigidly attached thereto is a longitudinal diaphragm base structure which comprises a diaphragm base frame 410 and a force transferring components 411*a* and 411*b* rigidly coupled thereto. The force transferring component 411*a* and 411*b* are a pair of coil windings that form part of the excitation mechanism. The diaphragm base frame 410 forms a substantially longitudinal former for the coil or coils to be wound about. In this embodiment a first coil 411*a* is wound closer to the dome 409 end of the base frame, and a second coil 411*b* is wound closer to the other end. It will be appreciated that any number and distribution of coil windings may be used and the invention is not intended to be limited to this example. In this embodiment, protruding guide members 412*a-c* locate on either side of the coil windings to help maintain the windings within in the appropriate location. The base frame 410 and guide members 412*a-c* are formed from different components and coupled to one another via any suitable mechanism (e.g. snap fit, adhesive, fasteners and the like) in this example, however it will be appreciated that these may be formed as a single integral component. The base frame extends from and is rigidly coupled to the periphery of the diaphragm body 409. In combination with the coil windings 411*a*, 411*b* and guide members 412*a-c*, this forms the diaphragm base structure. The diaphragm base structure in combination with the diaphragm body forms the diaphragm 408.

A magnetic structure comprising a permanent magnet 413, inner pole pieces 414*a* and 414*b*, and outer pole piece 415 forms the other part of the excitation mechanism and is cooperatively operative with the diaphragm base structure. The inner and outer pole pieces 414*a*, 414*b* and 415 are connected via a transducer base structure part 418 having a central aperture coterminous with the channel 416. The outer pole piece 415 of the magnet structure is bounded by, and flexibly connected to an inner wall 417 of the base 401. The inner pole pieces 414*a* and 414*b* are spaced to the outer pole piece 415 and, by action of the magnet 412, generate a magnetic field therebetween, concentrating magnetic flux at these two circular ring locations. These gaps match the number of coil windings. It will be appreciated that this number could be different depending on the number of coil windings. In a neutral position, each coil winding 411*a*, 411*b*, is aligned with one of the pair of gaps. In some embodiment there may be a mismatched number of gaps and coils, but the gaps are at least distributed such that one or more coils traverse therebetween during operation. In some embodiments the audio signal may be diverted to different coils dependant on, for example, diaphragm excursion.

The inner and outer pole pieces create a channel therebetween for one side of the force transferring component, including the coil former 410 and coil windings 411*a*, 411*b*, to extend through in situ and reciprocate within during operation. A recessed channel 418*a* within the transducer base structure part 418 aligns with these channels as does a cylindrical spacer ring 419 to allow the force transferring component to extend therewithin during operation.

In this embodiment, support and alignment of the force transferring component of the diaphragm 408 is maintained using ferromagnetic fluid 419*a-d* (herein referred to as ferrofluid). Ferrofluid is retained within each gap formed between the inner and outer pole pieces, by virtue of the fluid being magnetically attracted to the magnetic flux concentrating here, and the diaphragm base structure extends therethrough. In situ, within each gap, inner and outer ferrofluid rings attract towards and locate against to the inner and outer pole pieces respectively. During operation the diaphragm 408 reciprocates within and through the ferrofluid and is maintained in alignment with the gaps formed between the pole pieces by action of the ferrofluid. Preferably the ferrofluid is in close contact and/or substantially seals against the diaphragm such that it substantially prevents the flow of gases such as air therebetween.

A rear vent or air leak fluid passage 403 is formed in the base structure 401 that is on the one side of the diaphragm body 408. The fluid passage 403 is substantially aligned with the channel 416. The fluid passage 403 may comprise a permeable or porous element material 420, such as a mesh or open cell foamed material or fabric coupled to the base 401 for allowing the flow of gases, including air, therethrough whilst preventing the entry of other foreign materials into the device. It will be appreciated that this element or material 420 is preferable, but optional. A fluid passage 421 is located on a side of the surround and fluidly connects an air cavity 402 on a side of the diaphragm 408 configured to locate at or adjacent a user's ear with the air cavity 416 located on the opposing side of the diaphragm assembly (facing away from the ear mounting/interface side of the device). The fluid passage 421 may comprise a permeable or porous element or material 422, such as a mesh or foamed fabric or material coupled to the base 401 for allowing the flow of gases, including air, through this passage whilst also damping any unwanted resonances that might occur therewithin. It will be appreciated that this element or material 422 is preferable, but optional.

During operation, as the diaphragm 408 reciprocates by action of the excitation mechanism, sound is generated and traverses through the channel of the upper housing 404 and out the vent 406 of the ear plug 405. In some cases this channel may comprise an elongate throat or conduit leading to the ear mounting 405. Unwanted resonances may occur within this elongate throat or conduit of the housing part 404, and in the air cavity region 402, during operation. A permeable or porous material such as a foamed material 423 may be located within the throat to help dampen unwanted air resonances that might occur during operation within these regions. As will be appreciated, this material 423 is preferable, but optional.

Free Periphery

In personal audio applications, due to the small size, design of the diaphragm assembly suspension system is particularly difficult. In particular, it is difficult to achieve high diaphragm excursion and a low fundamental diaphragm resonance frequency, with a very small and lightweight diaphragm structure, without creating diaphragm and suspension resonances at around the high treble frequency range, and without adding undue mass.

In a conventional linear action type personal electro-acoustic transducer, where the diaphragm assembly is configured to reciprocate linearly, the relatively wide bandwidth requirement means that, unlike the case of a comparable sized home audio treble driver for example, there is a requirement for significant diaphragm excursion, and a requirement for high suspension compliance. This implies that there must be a significant area of the surround zone that is involved in flexing, in order to achieve high excursion, and that, in the case of a typical headphone or earphone driver, this wide zone must furthermore be approximately 100 times more compliant (e.g. 100 times less stiff to achieve a resonant frequency of Wn=100 Hz for instance) than the surround of a typical treble driver (that achieves a resonant frequency of Wn=1000 Hz for instance), in order to provide a fundamental resonance frequency for the diaphragm that is approximately 10 times lower in frequency.

This is why most headphones and earphones have a fundamental diaphragm resonance frequency higher than would be acceptable in home audio, with response generally rolling off below about 90 Hz, while also having treble performance that suffers more resonance than an equivalent home audio treble driver.

For example, whereas in home audio stereo systems bass response typically reduces below 35-40 Hz, a flagship model dynamic headphone typically has a fundamental diaphragm resonance frequency of around 100 Hz and the bass response typically reduces below around 80 Hz. Also comparison between waterfall plots of a high end home audio treble driver versus a flagship headphone typically shows that the home audio treble driver suffers significantly less from energy storage distortion issues, particularly at treble frequencies.

Diaphragm suspension is therefore an important design feature in personal audio applications. The use of an at least partially free periphery electro-acoustic transducer assembly can potentially improve the operation of a personal audio device requiring a suspension with relatively high compliance to movement. The personal audio device 400 for example comprises an electro-acoustic transducer 407 having a diaphragm 408 comprising a diaphragm body and an excitation mechanism configured to act on the diaphragm body to move the body in use in response to an electrical signal to generate sound. The audio device further comprises a housing that is formed in part by the base 401 and also by the housing part 404, which accommodates the electro-acoustic transducer 407. As shown in FIG. 12C, the diaphragm body 409 comprises an outer periphery that is free from physical connection with a surrounding structure such as with the interior surround and/or with the base structure 401.

The phrase "free from physical connection" as used in this context is intended to mean there is no direct or indirect physical connection between the associated free region of the diaphragm periphery and the housing. For example, the free or unconnected regions are preferably not connected to the housing either directly or via an intermediate solid component, such as a solid surround, a solid suspension or a solid sealing element, and are separated from the structure to which they are suspended or normally to be suspended by a gap. The gap is preferably a fluid gap, such as a gases or liquid gap.

Furthermore, the term housing in this context is also intended to cover any other surrounding structure that accommodates at least a substantial portion of the diaphragm structure therebetween or therewithin. For instance a baffle that may surround a portion of or an entire diaphragm, or even a wall extending from another part of the electro-acoustic transducer and surrounding at least a portion of the diaphragm structure may constitute a housing or at least a surrounding structure in this context. The phrase free from physical connection can therefore be interpreted as free from physical association with another surrounding solid part in some cases. The transducer base structure may be considered as such a solid surrounding part. In the rotational action embodiments of the invention for example, parts of the base region of the diaphragm may be considered to be physically connected and suspended relative to the transducer base structure by the associated hinge assembly. The remainder of the diaphragm periphery, however, may be free from connection and therefore the diaphragm comprises at least a partially free periphery.

The phrase "at least partially free from physical connection" (or other similar phrases such as "at least partially free periphery" or sometimes abbreviated as "free periphery") used in relation to the outer periphery in this specification is intended to mean an outer periphery where either:

- approximately the entire periphery is free from physical connection, or
- otherwise in the case where the periphery is physically connected to a surrounding structure/housing, at least one or more peripheral regions are free from physical connection such that these regions constitute a discontinuity in the connection about the perimeter between the periphery and the surrounding structure.

A diaphragm periphery that is physically connected along one or more edges along approximately an entire length of the periphery, but free from connection along one or more other peripheral edges or sides (such as the suspension shown in FIGS. 11*b* and 11*c*) does not constitute a diaphragm that comprises an outer periphery that is at least partially free from physical connection as in this case the entire peripheral length or perimeter is supported in at least one region, and there is no discontinuity in the connection about the perimeter.

As such, in the case where the electro-acoustic transducer comprises a solid suspension, including a solid surround or sealing element for example, preferably the solid suspension connects the diaphragm to the housing or surrounding structure with a discontinuity in the connection about the periphery. For example the suspension connects the diaphragm structure along a length that is less than 80% of the perimeter of the periphery. More preferably the suspension connects the diaphragm along a length that is less than 50% of the perimeter of the periphery. Most preferably the suspension connects the diaphragm along a length that is less than 20% of the perimeter of the periphery.

In this embodiment the diaphragm body periphery is free from physical connection along approximately the entire periphery. The diaphragm 408 including the diaphragm body 409 is free from physical connection with a surrounding structure, including the inner and outer pole pieces 414*a*, 414*b* and 415 of the excitation mechanism.

All moving parts of the diaphragm 408 including the diaphragm body 409 are therefore entirely free from physical connection with the interior of the housing 401, 404. It will be appreciated, entirely free from physical connection as used in this specification is intended to mean at least approximately entirely free from physical connection. In some cases, the wires leading to the coils, for example, may need to rigidly connect to a surrounding structure, however as will be appreciated by those skilled in the art this does not and is not intended to form a support or suspension for the diaphragm to which the phrases entirely or substantially free from physical connection are intended to relate.

Even in the case that a partially-free-periphery design is employed the area of the suspension components involved in flexing is dramatically reduced, and these components are comparatively more geometrically robust against internal resonances, in relation to the compliance and excursion provided. This helps to solve the 3-way compromise between diaphragm excursion, diaphragm fundamental resonance frequency and high-frequency resonances imposed by conventional suspensions. It will be appreciated that in alternative embodiments the diaphragm body and/or the diaphragm may be at least partially and significantly free from physical connection along, for example, at least 20 percent of a length, or at least 30% of the length of the outer periphery. More preferably the diaphragm body and/or diaphragm is substantially free from physical connection, for example along at least 50 percent of the length and most preferably at least 80 percent of the length.

Also, this embodiment shows an earphone device that comprises an ear plug configured to be located within the concha or ear canal entrance or ear canal of a user's ear. The benefits of an entirely, substantially or partially free periphery diaphragm design as described above and as shown in this embodiment are in some ways exaggerated in earphone applications since, because the transducer part of the device must typically be small enough to fit substantially inside the concha or ear canal of the ear or at least must be small enough that it can be retained without a headband, the low mass of the diaphragm makes it particularly difficult to reduce the fundamental resonance frequency. Also, the requirement for a small diaphragm assembly means that high excursion is particularly useful.

In this case the transducer has no to little unwanted resonances occurring within the audible bandwidth. Yet another advantage of an entirely, substantially or partially free periphery diaphragm in earphone applications is that, by virtue of the small size, relaxation or elimination of the constraints imposed by conventional suspensions leaves a diaphragm assembly, driver, and entire device which can be made to have few or even zero significant unwanted resonance modes, while also providing high volume excursion and bandwidth. As described above, unwanted resonance modes in a loudspeaker tend to store, and then release after a delay, vibrational energy of the diaphragm, which in turn tends to subjectively blur and muddy the reproduced audio.

Free Edge

Bass response is further extended by adaptive bass optimisation module 110, and this means that there is no need to compensate for a lack of low-bass by boosting the level of high bass. This implies that low treble frequencies may be increased in level closer to a diffuse field target, relative to high bass.

The reduction in resonance resulting from the free diaphragm periphery reduces frequency response peaks/troughs and subjective harshness, which permits treble levels to be raised further. And this may be achieved by the equaliser 109 with minimal detrimental effect on the energy storage characteristics of the system.

This means that the free-edge feature of this embodiment of the present invention combines particularly well both with adaptive bass optimisation module 110 and with equaliser 109.

Because the embodiment will sustain a more closely diffuse-field frequency response a capacitor may be used in series with the transducer to provide a passive 6 dB per octave bass attenuation. Preferably a resistor in parallel with a capacitor provides a low frequency shelf as described under section 1 of this specification Ferrofluid Support In this embodiment, the diaphragm 408, including all outer peripheral regions that are free from physical connection with the housing, is supported in operative position relative to the excitation mechanism of the base structure and relative to the housing interior by a fluid, and most preferably by a ferrofluid.

A ferrofluid does not constitute a solid component such as a solid suspension provided there is substantially no physical mechanical connection (as defined by the above criteria) made between the outer periphery of the diaphragm structure and the inner periphery of the surrounding structure.

A diaphragm that is free from physical connection with a surrounding body, but that is supported using ferromagnetic fluids to suspend the diaphragm relative to the excitation mechanism and/or transducer base structure as in earphone device 400, may also be highly effective in personal audio applications, since suspension resonances are practically eliminated yet high diaphragm excursion and high bandwidth may still be provided. Removal of the flexible diaphragm region and or flexible surround may additionally result in improvements including, but not limited to, increased linearity, reduced harmonic distortion and more linear phase response.

One problem that may occur in such with transducers is that, due to the capability to reduce the fundamental diaphragm resonance frequency without a corresponding worsening of high frequency resonance, the limitation on bass bandwidth quickly becomes volume excursion capability. Ordinarily, this implies that measures must be introduced to raise the fundamental diaphragm resonance frequency, thereby reducing efficiency at low frequencies, and possibly reducing linearity and worsening resonance issues in the process.

However in the case of embodiment 12 the adaptive bass optimisation module 110 may manage bass roll-off in a more optimal manner, preventing the diaphragm from running out of excursion without a need to mechanically raise its fundamental resonance frequency.

The ferrofluid preferably supports the diaphragm 408 to a degree that prevents contact or rubbing for example at the diaphragm periphery against the transducer base structure or excitation mechanism.

It will be appreciated that in alternative embodiments, the diaphragm 408 of the electro-acoustic transducer 407 may comprise an outer periphery that is entirely, substantially or at least partially free from physical connection with an interior of the housing or other surrounding structure (e.g. along at least 20 percent of the length of the edge for example), and that the sections of the diaphragm 408 that are not physically connected to the interior of the housing may be separated from the interior of the housing by a relatively small or narrow air gap.

The diaphragm 408 is of a type having motor coils attached at the perimeter so that the diaphragm 408 is self-supporting and does not rely on any surround to support the diaphragm body. The diaphragm suspension consists of suspension of the motor coil in a magnetic circuit gap via a ferromagnetic fluid contained within said gap. The ferromagnetic fluid imparts a centering force on the motor coil, which in turn suspends the diaphragm in the correct location.

Diaphragm

The diaphragm body 409 of diaphragm 408 is substantially rigid. The diaphragm body 409 is formed from a substantially rigid construction, such as from a rigid plastic, a high density foam, a metal material, or a reinforced structure for example. The diaphragm body 409 may a diaphragm body comprise one or more major faces, normal stress reinforcement being coupled adjacent at least one of the major faces for resisting compression-tension stresses experienced at or adjacent the face of the body during operation, and optionally at least one inner reinforcement member embedded within the body and oriented at an angle relative to at least one of the major faces for resisting and/or substantially mitigating shear deformation experienced by the body during operation. It will be appreciated however, that in alternative embodiments the diaphragm body may be substantially flexible.

In this embodiment, the diaphragm body comprises a thin domed membrane or some other type of relatively thin diaphragm body, but comprising a geometry that is sufficiently rigid against the primary whole-diaphragm bending modes in order that it maintains substantially rigid behaviour over the electro-acoustic transducer's intended operating bandwidth/FRO. The diaphragm may be thin as well as curved in a manner such that overall dimensions in a direction perpendicular to a major face, excluding components associated with the excitation mechanism (e.g. the depth of the dome), are at least 15% of a maximum distance across a major face (e.g. the diameter of the dome). This facilitates the possibility of a 3-dimensional geometry, being a three dimensional dome shaped curve in this case, which is relatively self-supporting, at least compared to more planar-type diaphragm designs where the diaphragm is not thick or at least curved. Preferably also, the overall dimension of the entire diaphragm 408 including components associated with the excitation mechanism, is at least 25% of a maximum distance across a major face in a direction perpendicular to a major face. This is because a diaphragm 408 having significant dimensions in three dimensions tends to have increased structural integrity in regards to resonance modes.

An overhung motor layout is be used whereby the coil windings 411*a* and 411*b* are each wider than their magnetic field gaps adjacent pole pieces 414*a* and 414*b* respectively. But in alternative embodiments an underhung or other motor coil layout may be used. The coil windings 411*a* and 411*b* are extended beyond the magnetic field gap in order to maintain a substantially consistent motor strength over the range of diaphragm excursion, since there will be a substantially constant number of the coil windings located within the magnetic field gaps adjacent pole pieces 414*a* and 414*b* when the diaphragm moves in either direction.

The dome diaphragm form with motor coil at the perimeter provides a three-dimensional geometry which, despite being a membrane, is substantially thick overall, and is comparatively robust against resonances. There is no unsupported membrane edge requiring support from a rubber diaphragm surround as is the case, for example, in a conventional cone-diaphragm speaker driver.

The remaining components of the diaphragm assembly, such as the force transferring component, may aid in maintaining rigidity of the diaphragm body 409 during operation.

Transducer Suspension System

The electro-acoustic transducer 407 is mounted to the housing 401, 404 via a suspension system 424. The suspension system 424 locates between the transducer base structure of the electro-acoustic transducer 407 and a part of the housing of the audio device, such as the base 401 or the housing part 404 for at least partially alleviating mechanical transmission of vibration between the diaphragm and the housing. The suspension system 424 is substantially to substantially mitigate transmission of mechanical vibration from the transducer 407 to the housing and vice versa. In the embodiment, the transducer 407 is mounted to an interior wall of the base 401 via one or more flexible mounts 424. The flexible mounts may comprise a substantially flexible annular ring 424. The inner peripheral edge 414*a* of the suspension ring 414 may be fixedly retained within a complementary recess or groove 415*a* at the outer periphery pole piece 415 (or other transducer base structure part). The outer peripheral edge 424*b* of the suspension ring 424 may be fixedly retained within a complementary recess or groove 417*a* at the inner periphery 417 of the base 401. The suspension ring 424 may be rigidly coupled to the transducer base structure and base 401 via any suitable mechanism, such as using adhesive.

The suspension ring 424 is substantially compliant and therefore is formed from a substantially flexible and/or resilient material and/or comprises a substantially flexible and/or resilient geometry. In this embodiment, the suspension ring 424 is made from silicone rubber, with a Young's modulus of approximately 2 MPa for example. Alternative many other materials and geometries are also acceptable, for example resilient steel flat springs, foam and the like. In this manner, electro-acoustic transducer 407 is compliantly coupled and suspended relative to the base 401 via the transducer suspension system 424. It will be appreciated that other flexible suspension systems may be used without departing from the scope of the invention.

Air Leak Fluid Passages

The ear plug/interface 405 is configured to provide a sufficient seal between a volume of air within a front cavity 402 inside the device, located at or adjacent the user's ear canal or concha in use, and a volume of air external to the device (such as the surrounding atmosphere). The geometry and/or material used for the ear plug may affect the sufficiency of the seal for example. As previously mentioned, the plug 405 may comprise a body shaped to reside snuggly within a user's ear, such as against the user's ear canal entrance, so that it may locate the electro-acoustic transducer adjacent the user's ear canal and seal against this location. The body of the plug may be formed or covered in a soft material for comfort and for sufficient sealing, such as a soft plastics material like Silicone or similar. It will be appreciated that other types of geometries and materials may alternatively be used for sufficient sealing as will be apparent to those skilled in the art.

In the preferred embodiment, the ear plug 405 is configured to sufficiently or substantially seal between the front cavity 402 on the ear canal side of the device and the volume of air external to the device in situ. A substantial seal is one that is configured to enhance the sound pressure at, at least, low bass frequencies (i.e. provide a bass boost) during operation for example. For example, the ear plug may be configured to substantially seal against the user's ear in situ to increase sound pressure generated inside the ear canal (at, at least, low bass frequencies) during operation. In some implementation, sound pressure, for example, may increase by an average of at least 2 dB, or more preferably at least 4 dB, or most preferably at least 6 dB, relative to sound pressure generated when the audio device is not creating a sufficient seal (when the same electrical input is applied) in situ. The volume of air enclosed within front cavity 402 may be substantially small to also aid with providing a bass boost during operation.

Because, due to resonance management and bass extension features as described above, the embodiment will sustain a more closely diffuse-field frequency response, the steady state bass level may be reduced compared to the low-treble level, in comparison to prior art earphones. This, in combination with relaxed restriction on maximum diaphragm excursion resulting from the free diaphragm periphery and ferrofluid diaphragm suspension, may mean that the degree of air sealing can be reduced compared to prior art earphones. This may help to reduce occlusion effect and/or manage unwanted resonances of the unnaturally closed-off ear canal and/or facilitate improved comfort.

The reduction in resonance resulting from the free diaphragm periphery reduces frequency response peaks/troughs and subjective harshness, which permits treble levels to be raised further. And this may be achieved by the equaliser 109 with minimal detrimental effect on the energy storage characteristics of the system.

This means that the free-edge feature of this embodiment of the present invention combines particularly well both with adaptive bass optimisation module 110 and with equaliser 109.

The audio device 400 further comprises at least one fluid passage 421 configured to provide a restrictive gases flow path from the first cavity to another volume of air during operation, to help dampen air resonances and/or moderate base boost. For example, the device 400 comprises a first, front air cavity 402 contained within the device housing part 404 and located on a side of the diaphragm that is configured to locate at or adjacent a user's ear canal or concha in use. The device 400 further comprises a second, rear air cavity 416 contained within the device base 401 and located on an opposing side of the diaphragm facing away or distal from the user's ear canal or concha in use. The fluid passage 421 fluidly connects the front and rear air cavities 402 and 416 such that air that is otherwise sealably retained within cavity 402 can restrictively flow into an external volume, to thereby dampen internal resonances and/or moderate bass boost in use. It is not essential that a separate flow restricting element 422 is used for the passage to provide a restrictive gases flow path, and the passage may be substantially open with no obstructive barriers and still be restrictive by having a reduced size, diameter or width. As will be explained in further detail below, the fluid passage 421 is configured to restrict air flow by either having a reduced diameter or width at the junction with the front cavity 402 or other adjacent cavity, or by otherwise incorporating a flow restricting element (sometimes known in the art as a resistive element), or both. In this embodiment, the fluid passage 421 comprises both.

Alternatively, or in addition, a fluid passage 403 of the device may fluidly connect the front air cavity 402 with a volume of air that is external to the device, e.g. with the external environment, via fluid passage 421 and the rear cavity 416. This fluid passage 403 is separate from any leak passage that might exist in practice, in the otherwise substantially sealed periphery of the output vent 406. In this embodiment, an air vent or aperture 403 is provided at an opposing end of the housing to the front cavity 402 (adjacent rear cavity 416) allowing for the passage of air from the front cavity 402 to a volume of air external to the device 400 via fluid passage 421 and rear cavity 416. The fluid passage 421 is configured to restrict air flow by either having a reduced diameter or width at the junction with the front cavity 402 or other adjacent cavity 416, or by otherwise incorporating a flow restricting element, or both. In this embodiment, the fluid passage 403 provides a restrictive flow path from the rear cavity 416 to the external volume of air.

It will be appreciated that in alternative embodiments any number of one or more fluid passages may be incorporated to provide for the leakage of air from the otherwise sealed cavity 402. In this embodiment both passages 421 and 403 are provided and work collectively to achieve this. In alternative variations however, one or more air vents may be located at or adjacent cavity 402 for example, (e.g. on the same side of the diaphragm assembly as cavity 402) and leading to a volume of air external to the device, such as the external environment.

It is generally simpler to make an ear pad or ear plug that consistently seals, across different ear and head shapes and different positioning, than it is to make a pad or plug which provides a consistent degree of air leakage. For this reason, in this embodiment of a personal audio device of the present invention, the ear pad or ear plug is designed to substantially seal, and the air leaks are introduced into the device to allow for resonance damping. The leaks are preferably positioned away from the interface between the user's ear or head and the device so that characteristics such as the location and resistance, as well as any reactance, are substantially independent of variations in ear shape and device positioning.

Each fluid passage allows air to escape from the first cavity 402 adjacent the user's ear or head during operation without passing between the user's head and the audio device, thereby affecting the seal.

Each or either fluid passage 421 or 403 preferably comprises a fluid flow restrictor. The fluid flow restrictor may comprise, for example, any combination of: an entry or input from the adjacent cavity of reduced size, width or diameter; and/or a fluid flow restricting element or barrier at the entry or within the passage such as a porous or permeable material. For example, the fluid passage may be an entirely open passage having a reduced diameter or width entry. Alternatively, or in addition the fluid passage may comprise a fluid flow restricting element such as a foam barrier or mesh fabric barrier at the entry or within the passage for subjecting gases traversing therethrough to some resistance. The fluid passage may comprise one or more small apertures.

Preferably the fluid passages 421 and 403 are sufficiently non-restrictive such that they result in a significant reduction in sound pressure within the ear canal during operation. A significant reduction in sound pressure for example may result in at least 10%, or more preferably at least 25%, or most preferably at least 50% reduction in sound pressure during operation of the device over a frequency range of 20 Hz to 80 Hz. This reduction of sound is relative to a similar audio device that does not comprise any fluid passages such that there is negligible leakage in sound pressure generated during operation. The significant reduction in sound pressure is preferably observed at least 50% of the time that the audio device is installed in a standard measurement device. Other reductions in sound pressure are also envisaged however and the invention is not intended to be limited to these examples.

In this embodiment, the fluid passage 421 comprises a reduced diameter at the junction with the front cavity 402 (and also with the rear cavity 416). The diameter is substantially uniform along the length of the passage but it will be appreciated that the diameter may be variable in some alternatives. The fluid passage 421 also comprises a permeable or porous flow restricting element or material 4220, such as a mesh or foamed fabric or inside the passage for allowing the flow of gases, including air, through this passage whilst also restricting the pressure or rate of flow therethrough to thereby reduce any unwanted resonances that might otherwise occur within the air cavity system comprising the ear canal, air cavity 402, fluid passage 421, air cavity 416 and fluid passage 403. The flow restricting material is located at an entry/input of the fluid passage 421 in this embodiment but it will be appreciated it may be located at an output and/or within the passage.

The fluid passage 403 also comprises a reduced diameter at the junction with the rear cavity 416. The fluid passage 403 also comprises a flow restricting element in the form of a mesh or foamed material 420 configured to allow the flow of gases, including air, through the passage whilst also restricting the pressure or rate of flow therethrough to thereby reduce any unwanted resonances that might otherwise occur within the air cavity system mentioned above. The flow restricting material is located at an output of the fluid passage 403 in this embodiment but it will be appreciated it may be located at an entry/input and/or within the passage.

Each fluid passage may extend anywhere within the device, such as adjacent the periphery of the diaphragm 408 and/or electro-acoustic transducer 407 or even through an aperture in the diaphragm 408 and/or electro-acoustic transducer 407.

In this embodiment, control of air resonances is improved via damping created by the fluid passage air leaks. Also, resonance control, as well as bass level moderation can be made relatively consistent across different listeners/users and with different device positioning.

In some embodiments, the channel of the audio device configured to locate directly adjacent or inside the user's ear canal and/or concha may comprise an elongate conduit or throat. This design may be also be susceptible to air resonances.

Therefore, in some implementations a sound dampener 423 and/or flow restrictor is located within this conduit to further dampen the internal resonances during operation.

For example, a foam insert 423 located in the throat of the vent 406 can achieve damping of resonances involving air moving between the cavity 402 and the ear canal. Foam may also affect the frequency response since the resistance affects high and low frequencies differently. Other porous or permeable elements configured to restrict flow of air may alternatively be used to dampen resonances within the throat of the device.

Earphones may modify the natural resonance characteristics of the ear and this can potentially modify the frequency and/or resonance characteristics of the ear canal plus concha system so that the brain is no longer calibrated to the frequency response of the system. For example, in the case of earphones where (after insertion of the earphone) the ear canal becomes substantially sealed off by an ear plug 405) at the entrance to the ear canal, this may cause the ear canal resonance to be altered from an open-ended tube type resonance to a closed tube type resonance. Additionally, resonances store and release energy with a delay, which tends to result in sound blurring. For these reasons it may be advantageous to mitigate resonances of the ear/earphone system, including via damping of such resonances. Therefore, introducing at least one fluid passage for the leakage of air from an air cavity located on a side of the diaphragm assembly adjacent the region configured to mount the user's ear, to another air cavity on an opposing side of the diaphragm assembly and/or to a volume of air external to the device, to damp resonances is particularly advantageous in the application of earphones as in this embodiment. Providing a restrictive flow path through this passage helps achieve resonance damping and/or bass boost moderation. It will be appreciated however, that these advantages can also be observed in a headphone application as well as in a hearing aid application.

This embodiment features a number of acoustical resonance control measures which, especially when used in combination with a low resonance free-periphery diaphragm, helps to make possible an increase in the calibration level of parts the frequency response towards, for example, lower and/or upper parts of the treble bandwidth. The level may be increased towards, or to, a diffuse field target. Such a calibration may be achieved by the equalisation module 109 without creation or worsening of resonances.

Therefore, in this embodiment, the fluid passages 421 and 403 provide advantages including: leakage past the diaphragm and through the vent 403 damps the (modified from natural state) ear canal resonance, and other resonance modes of the air cavity system comprising the ear canal, air cavity 402, fluid passage 421, air cavity 416 and fluid passage 403; and the leakage amount, location and any inherent reactance is consistent between users even if the degree of sealing against the ear varies, since leakage past the ear seal is less than the leakage within the device (i.e. past the diaphragm assembly and through the passages, without reliance on high manufacturing tolerances and across different listeners.

Frequency Range of Operation Preferably, the audio device 400 has a FRO that includes the frequency band from 100 Hz to 10 kHz, or more preferably includes the frequency band from 80 Hz to 12 kHz, or most preferably includes the frequency band from 60 Hz to 14 kHz.

Audio Tuning System

The above describes the construction of an earphone interface devices 400.

In this embodiment, the earphone interface device 400 further comprises an audio tuning system 106, one or more amplifier(s) 115 and a power source 117 located within the base 401 of the housing. The audio tuning system 106, amplifier(s) 115 and power source 117 may be coupled to the base 401 of the housing via any suitable method. The audio tuning system 106 may be any one of the audio tuning system embodiments described in this specification and may include any combination of one or more of: an equaliser 109, a bass optimisation module 110, a phase improvement module 111 and/or a volume adjustment module 170. As previously described, the audio tuning system 106 may be a digitally implemented system including a digital signal processing circuit, or an analogue implemented system including analogue signal processing circuitry, or any combination thereof. The audio tuning system 106 may be operatively coupled to the audio source device 102 via the connector 301. Alternatively, the audio tuning system 106 may be wirelessly operatively coupled to the audio source device 102. Audio signals for both output channels may be received by the audio tuning system 106 via a suitable communications interface 107 and processed by the tuning system to optimise the signals for each output channel in an earphone device comprising a second earphone interface device, before being sent to the amplifier 105 of each channel. The processed signals for the other channel may be sent wirelessly or via a cable for example.

In yet another variation, the audio tuning system 106 may be fully or partially implemented within the audio source device 102. In this case, the earphone interface device 400 may not comprise any electronic circuitry, or it may only comprise an amplifier 115, or it may comprise at least a communications interface and some signal processing circuitry for further signal optimisation before being sent to the respective transducer(s) 105.

In some embodiments each earphone interface device 400 of an earphone apparatus comprises a separate audio tuning system 106 for the respective channel.

In a preferred embodiment any one or more of the equaliser 109, the phase improvement module 111 and/or the bass optimisation module 110 is/are integral with personal audio device 200 and personal audio device 200 is designed to operate in conjunction with one or more of these modules 109-111 simultaneously during audio playback (i.e. approximately during the entire a period the device 200 is in normal use)). Alternatively, equaliser 109 the phase improvement module 111 and/or the bass optimisation module 110 is/are not integral with personal audio device 200, however nonetheless, personal audio device 200 is designed to operate in conjunction with one or more of these modules 109-111 simultaneously during audio playback.

Note that in the case that personal audio device 200 is designed to operate in conjunction with equaliser 109 and/or phase improvement module 111 and/or bass optimisation module 110 during audio playback/normal use, its frequency response and other characteristics need not necessarily make for subjectively high sound quality in the event that personal audio device 200 happens to be used without such modules 109-111. For example bass roll-off may occur at a higher frequency than is typical.

In the case that any combination of equaliser 109, phase improvement module 111 and/or bass optimisation module 110 are not integral with personal audio device 200, however nonetheless is/are designed to operate in conjunction with personal audio device 200 during audio playback, the personal audio device 200 and/or associate audio source 102 and/or associated remote computing device 103 preferably includes one or more safety features which may help to prevent damage to said device or to any other device which may be inadvertently subjected to an audio signal containing heavily boosted bass frequencies or other non-typical signal features which may potentially cause damage. Preferably such features involve a method of determining the identity of personal audio device 200 and/or audio source 102 before sending and/or accepting an audio signal. Preferably such involves sending and/or receiving of a signal or code before sending and/or accepting an audio signal. Alternatively the identity of personal audio device 200 may be determine by sensing impedance of a transducer which may be achieved using, for example, methods described in U.S. Pat. No. 9,247,365B1. Preferably a warning is given to a user to check that a correct device is connected. Such warning may take the form of a light or sound or message or other communication via a user interface, or a note in a user manual, for example.

Such safety features may provide an advantage that audio signals can be more heavily modified by module 109 and/or by module 111 according to known properties of a particular device, with reduced risk of damage to any other device.

Other Advantages

Subjective 'impact' may be improved (e.g. kick drums 'kick') by the combination of two or preferably more of: extended bass response (unsupported diaphragm periphery, equaliser 109, dynamic bass roll-off adjustment module 110); improved phase coherence at low frequencies (phase improvement module 111); more realistic sounding equalisation where the upper mid-range/lower treble range is close in level to a diffuse field target; Anti-resonance measures (unsupported diaphragm periphery, fluid air leaks that manage acoustical resonances, transducer decoupling).

The result of this embodiment is an audio system where both frequency response and energy storage characteristics may be highly optimised. In cases where a compromise must be struck, the mechanical and acoustic design of the personal audio device enables tailoring towards optimisation of energy storage characteristics instead of just towards optimisation of frequency response.

Some Variations

The electro-acoustic transducer of this embodiment is a linear action transducer. However, it will be appreciated that in alternative embodiments a rotational action transducer may alternatively be used in the personal audio device.

It will be appreciated that the internal electro-acoustic transducer mechanism may alternatively be implemented in a headphone device or other personal audio device such as a mobile phone or a hearing aid for example.

The audio device 400 may comprise multiple transducers as will be explained in further detail below with reference to other embodiments.

The diaphragm 408 of this embodiment may be suspended in a manner other than ferrofluid relative to the transducer base structure and surround, and separated by an air gap (instead of ferrofluid) in regions of the periphery that are not connected to the base structure and/or surround. For example in alternative embodiments the diaphragm periphery may be supported by compact flat springs or by isolated segments of foam.

The electro-acoustic transducer 407 may be suspended in a manner other than a flexible mount. For example, the electro-acoustic transducer 407 may be rigidly coupled to an interior of the housing, via any suitable fixing mechanism, such as an adhesive.

2.4 Mobile Phone

Referring to FIGS. 13A-13H a third embodiment of a personal audio device 700 of the invention is shown in the form of a mobile phone device 700. The mobile phone may be a smartphone, cell phone, or in alternative embodiments the device may be an audio source device that is configured to locate at or adjacent a user's ears during audio playback.

The mobile phone device 700 comprises a housing 701 for retaining the electronics of the device therein. The housing 701 comprises a recess or cavity 702 for receiving and retaining an electro-acoustic transducer K100 therewithin. There may be two or more transducers K100 within the device 700 in some configuration. The cavity 702 may be located at one end of the housing 701 or in any other suitable location for transmitting sound from the device. The cavity 702 may also retain an audio tuning system 106 and one or more amplifiers 115 associated with the transducer K100 therewithin, or alternatively these may be located elsewhere within the housing. In yet another alternative the audio tuning system 106 may be implemented in an external or remote device but communicatively coupled to the transducer K100 via a suitable communications interface of the device 700. The audio tuning system 106 and one or more amplifiers 115 are shown as a single component in the figures, however, it will be appreciated that these may be separate components that are coupled adjacent or otherwise in separate locations within the housing. Furthermore, the audio tuning system 106, amplifiers 115 and transducer K100 are powered by an on-board power source (not shown). This may be the existing power source of the device 700 or alternatively a separate dedicated power source that may also be located in cavity 702 for example. A cap element or plate 703 couples over the open end of the cavity 702 to conceal and protect the transducer and/or audio tuning system/amplifier(s) therewithin. The cap element 703 may comprise an aperture 704 that substantially aligns with the diaphragm of the transducer K100 for enabling the propagation of sound from the transducer to an external side of the device 700. The aperture may be covered with a grille 705 or other mesh to protect the internal components of the housing while still permitting the propagation of sound through the aperture. The cap element may be coupled over the housing 701 via any suitable mechanism including fasteners, adhesive, snap-fit engagement and the like. The housing may also include a port 706 for receiving an earphone or headphone connector for example. The port may operatively couple the audio tuning system 106 to adjust the tuning characteristics of the system based on whether audio signals are being sent to the device transducer(s) K100 or the earphone or headphone transducer(s).

Audio Transducer

The features of electro-acoustic transducer K100 are described in section 3.3 of this specification. The details of the transducer K100 will thus not be repeated in this section for conciseness. The transducer of this embodiment is an electro-acoustic implementation of audio transducer K100 described in section 3.3. Possible variations to the construction of the diaphragm K101 or any other component of the transducer K100 discussed under this section also applies to this embodiment. It will be appreciated that in some embodiments other electro-acoustic transducers may alternatively or additionally be inserted in the device 700, such as electro-acoustic transducer 407, electro-acoustic transducer 205 or an electro-acoustic implementation of audio transducer G900 described herein, without departing from the scope of the invention.

In another variation of transducer K100, the diaphragm K101 may be an alternative substantially rigid diaphragm construction. Instead of a diaphragm body being formed from a lattice as described under section 3.3, the diaphragm K101 may consist of a substantially thick foam core that is reinforced with internal shear stress reinforcement members (not shown). The members may be plates that are spaced across the diaphragm body and oriented substantially orthogonally relative to the normal stress reinforcement. Such a structure is also substantially rigid during operation.

Other feature of the diaphragm are similar to those described for K101 in section 3.3, except an external membrane is not required in this variation.

Free Periphery

In personal audio applications, due to the small size, design of the diaphragm assembly suspension system is particularly difficult. In particular, it is difficult to achieve high diaphragm excursion and a low fundamental diaphragm resonance frequency, with a very small and lightweight diaphragm structure, without creating diaphragm and suspension resonances at around the high treble frequency range, and without adding undue mass.

In a conventional linear action type personal electro-acoustic transducer, where the diaphragm assembly is configured to reciprocate linearly, the relatively wide bandwidth requirement means that, unlike the case of a comparable sized home audio treble driver for example, there is a requirement for significant diaphragm excursion, and a requirement for high suspension compliance. This inevitably leads to unwanted resonance at high frequencies.

This embodiment features a diaphragm that has a free periphery, and this is achieved through use of a rotational diaphragm suspension system. An air gap 711 around the periphery of diaphragm K132 is sufficiently narrow that there is effectively a seal. The gap may be approximately 0.1-0.7 mm, for example.

There is no flexible diaphragm surround component, so associated resonances are eliminated. In this case the transducer has no to little unwanted resonances occurring within the audible bandwidth. Yet another advantage of an entirely, substantially or partially free periphery diaphragm in earphone applications is that, by virtue of the small size, relaxation or elimination of the constraints imposed by conventional suspensions leaves a diaphragm assembly, driver, and entire device which can be made to have few or even zero significant unwanted resonance modes, while also providing high volume excursion and bandwidth. As described above, unwanted resonance modes in a loudspeaker tend to store, and then release after a delay, vibrational energy of the diaphragm, which in turn tends to subjectively blur and muddy the reproduced audio.

Bass response is further extended by equaliser 109, adaptive bass optimisation module 110 and phase correction module 111, and this means that there is reduced requirement to compensate for a lack of low-bass by boosting the level of high bass. This implies that low treble frequencies may be increased in level closer to a diffuse field target, relative to high bass. Of course if the device is producing sound for far-field listening, for example if it produces a ring-tone or 'speakerphone' mode us used then a diffuse field target will not be applicable. Preferably in this case the device will alter its frequency response calibration target accordingly.

The reduction in resonance resulting from the free diaphragm periphery reduces frequency response peaks/troughs and subjective harshness, which permits treble levels to be raised further. And this may be achieved by the equaliser 109 with minimal detrimental effect on the energy storage characteristics of the system.

This means that the free-edge feature of this embodiment of the present invention combines particularly well both with adaptive bass optimisation module 110 and with equaliser 109.

Transducer Housing

In this embodiment, the transducer surround K301 does not form part of a headphone cup housing but instead it is a separate component that is complementary in shape to the transducer K100 and that is configured to rigidly couple within the cavity 702 of the mobile device housing 700. The transducer surround part K301 may be coupled to the cavity via any suitable fastening mechanism such as via fasteners, adhesive, welding and the like. Alternatively the transducer surround part K301 may be integrally formed within the cavity 702. A transducer cap element K303 couples over the surround part via any suitable fastening mechanism and is also complementary in shape to the transducer K100. The cap element K303 consists of a grille K303*a* that is configured to locate adjacent aperture 704 in situ. The mounting of the transducer K100 within the surround part K301 and cap element K303 is detailed in section 3.3 of this specification. Collectively, the surround part K301 and transducer cap element K303 form a transducer housing.

Transducer Suspension System

The electro-acoustic transducer 407 is mounted to the housing 401, 404 via a suspension system 424. The suspension system 424 locates between the transducer base structure of the electro-acoustic transducer 407 and a part of the housing of the audio device, such as the base 401 or the housing part 404 for at least partially alleviating mechanical transmission of vibration between the diaphragm and the housing. The suspension system 424 is substantially to substantially mitigate transmission of mechanical vibration from the transducer 407 to the housing and vice versa. In the embodiment, the transducer 407 is mounted to an interior wall of the base 401 via one or more flexible mounts 424. The flexible mounts may comprise a substantially flexible annular ring 424. The inner peripheral edge 414*a* of the suspension ring 414 may be fixedly retained within a complementary recess or groove 415*a* at the outer periphery pole piece 415 (or other transducer base structure part). The outer peripheral edge 424*b* of the suspension ring 424 may be fixedly retained within a complementary recess or groove 417*a* at the inner periphery 417 of the base 401. The suspension ring 424 may be rigidly coupled to the transducer base structure and base 401 via any suitable mechanism, such as using adhesive.

The suspension ring 424 is substantially compliant and therefore is formed from a substantially flexible and/or resilient material and/or comprises a substantially flexible and/or resilient geometry. In this embodiment, the suspension ring 424 is made from silicone rubber, with a Young's modulus of approximately 2 MPa for example. Alternative many other materials and geometries are also acceptable, for example resilient steel flat springs, foam and the like. In this manner, electro-acoustic transducer 407 is compliantly coupled and suspended relative to the base 401 via the transducer suspension system 424. It will be appreciated that other flexible suspension systems may be used without departing from the scope of the invention.

Smartphones and other electronic devices are not optimised for use as loudspeaker enclosures and they are therefore prone to resonance. The transducer decoupling system mitigates such resonance.

This in turn leads to a possibility of increasing the level of higher frequency regions of the frequency response towards, or up to, a diffuse field target, which may be achieved by the equalisation module 109 without creation of energy storage issues, for the reason as follows.

As described above, most personal audio devices have mechanical and acoustical resonances, causing peaks and troughs in the frequency response as well as subjective 'harshness', particularly at treble frequencies. To compensate for this, it is commonplace to reduce system loudness with increasing frequency, compared to a diffuse field target.

While this may improve bass-treble balance, there is also a loss of subjective clarity in audio reproduction.

The transducer suspension system addresses a key source of resonance in personal audio devices which, optionally in combination with the free-periphery diaphragm and rotational action diaphragm suspension, facilitates a frequency response calibration that is closer to a diffuse field target. Equalisation module 109 is able to enact such calibrations without creating significant additional energy storage within the system as a whole.

Many personal audio devices based on dynamic transducers also exhibit a non-optimal bass roll-off/lack of low bass and it is common to compensate by increasing the overall bass level.

Equalisation, preferably based on known parameters of an audio channel such as is implemented by module 109, may extend low-bass response, as can dynamic adjustment of the bass roll-off as implemented by module 110, helping low-bass and reducing the requirement to raise bass levels overall. This may imply that low treble frequencies may be increased relative to high-bass frequencies. So equalisation to, or closer to, a DF target 109 may be useful in combination with low bass equalisation 109 (preferably based on known parameters of an audio channel) and dynamic adjustment of the bass roll-off 110, as well as with measures such as free-periphery diaphragm, rotational action diaphragm suspension and decoupling of a transducer via suspension that address resonance, since these features all have an effect of improving the performance of the headphone device 200 when calibrated to a more accurate diffuse field calibration target.

Air Leak Fluid Passages

Referring to FIGS. 13B-13H, the surround part K303 may comprise at least one fluids passage 707 configured to provide a gases flow path from a first cavity 708 within the transducer housing to an external volume of air 713. The first cavity 708 is located on a side of the diaphragm K101 that is adjacent the sound aperture 704 and dust mesh 705 of the device 700. In situ, the device 700 consists of a first, front air cavity 708 configured to locate adjacent a user's ear in situ, that is fluidly connected to a second, rear air cavity 710 on an opposing side of the diaphragm K101 configured to locate distal from the user's ear in situ, yet also divided by the moveable diaphragm. The rear cavity 710 is connected to the volume of air 709 internal to the transducer housing via the fluids passage 707. In some embodiments the air volume 709 is contained by a dedicated loudspeaker enclosure within the device, and in other embodiments air volume 709 may be part or all of the internal volume of the device.

Figure 13A:
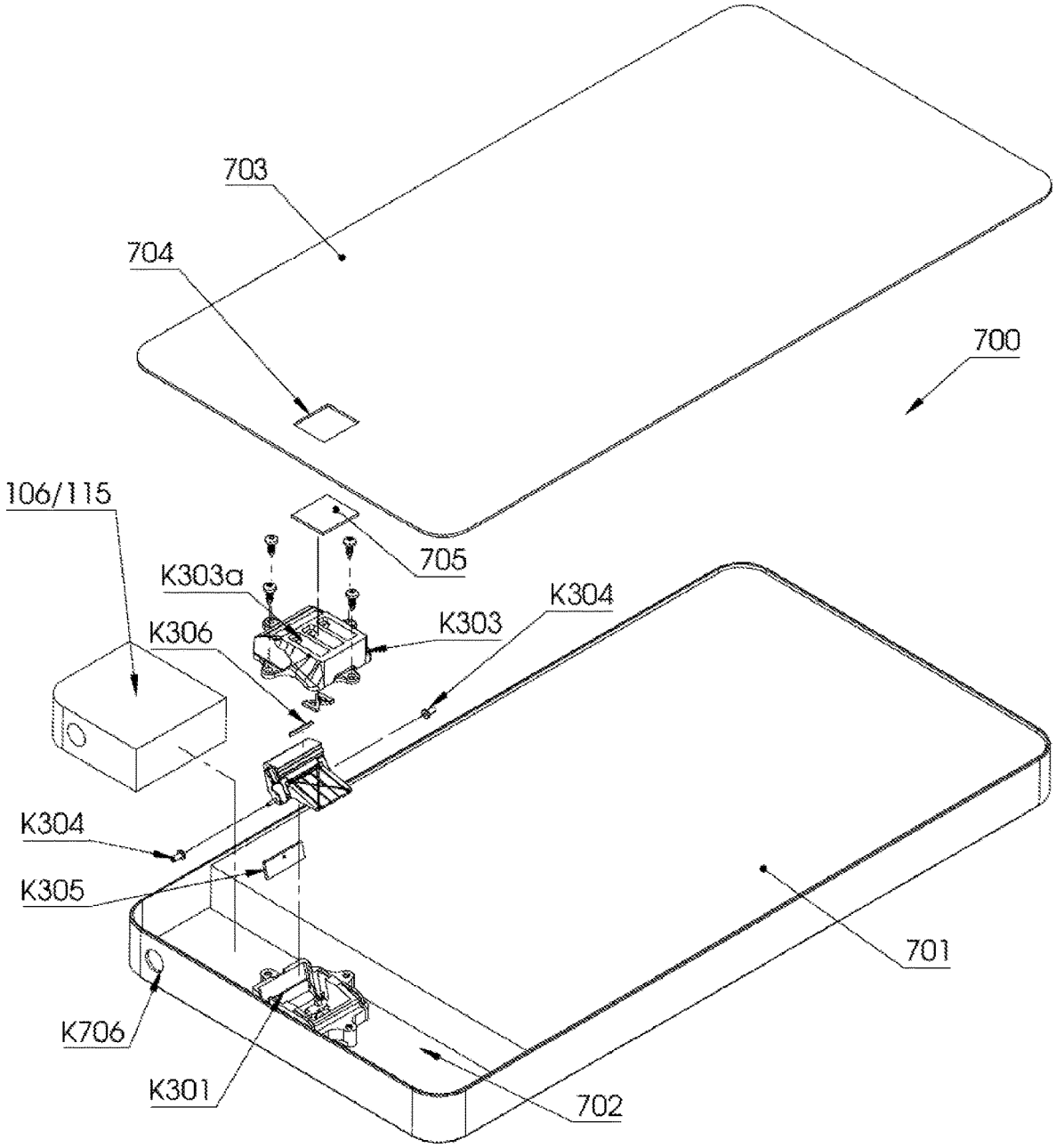
FIG. 13A is an exploded perspective view of a mobile phone device incorporating the audio tuning system of FIG. 3.
Figure 13B:
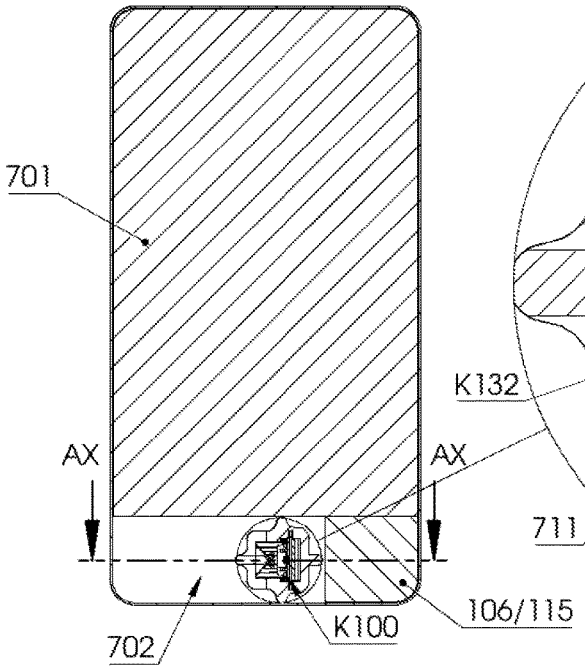
FIG. 13B is a cross-sectional top view of the device of FIG. 13A.
Figure 13C:
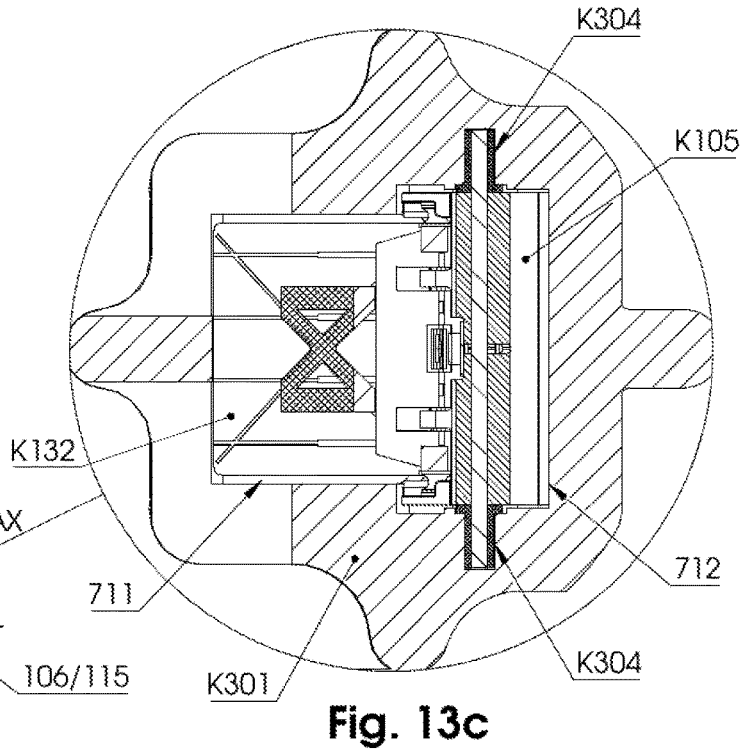
FIG. 13C is a close up cross-sectional top view showing the audio transducer inside the device of FIG. 13A.
Figure 13D:
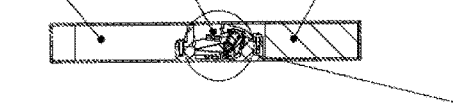
FIG. 13D is a side cross-sectional view showing the audio transducer and audio tuning system of the device of FIG. 13A.
Figure 13E:
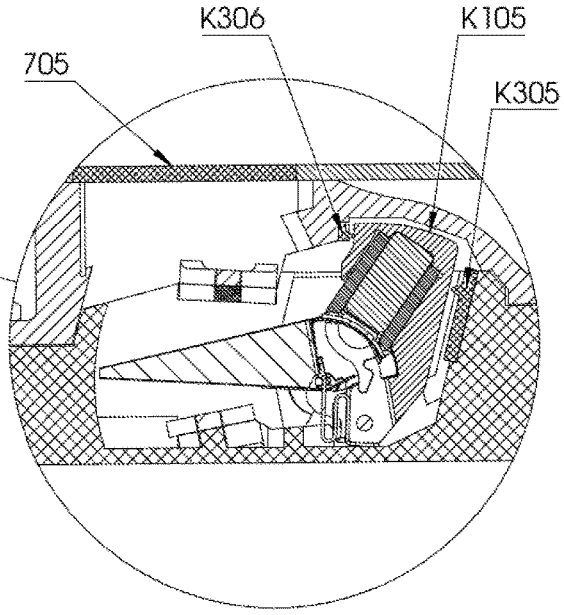
FIG. 13E is a close up side cross-sectional view of the audio transducer inside the device of FIG. 13A.
Figure 13F:
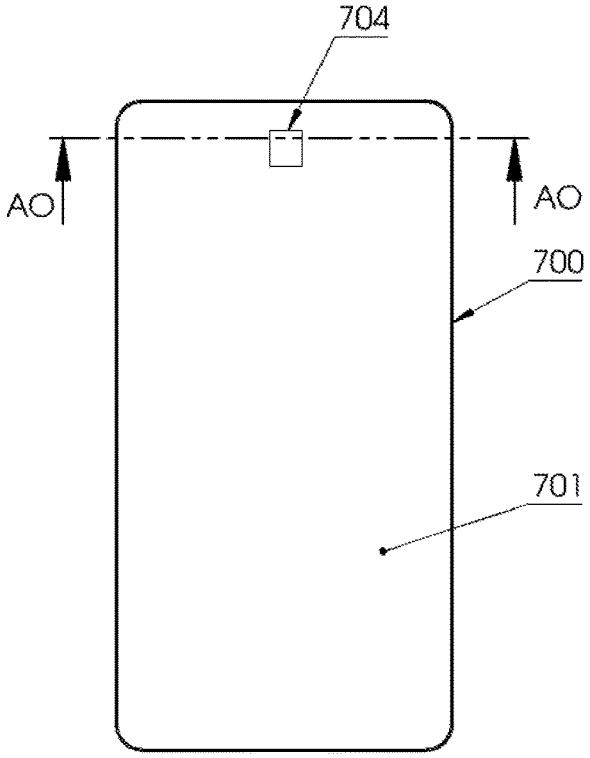
FIG. 13F is a top assembled view of the device of FIG. 13A.
Figure 13H:
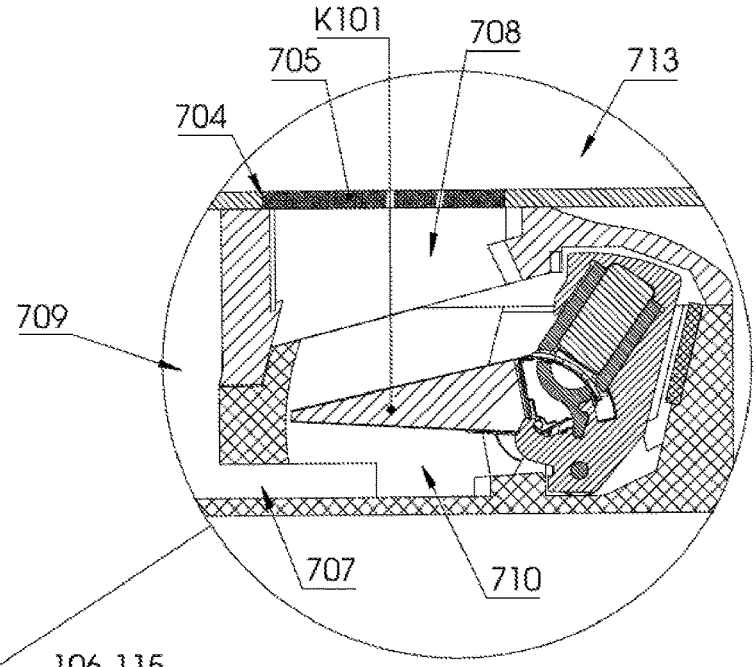
FIG. 13H is a close up side cross-sectional view of the audio transducer inside the device of FIG. 13A with details of a fluid passage.
Figure 13G:
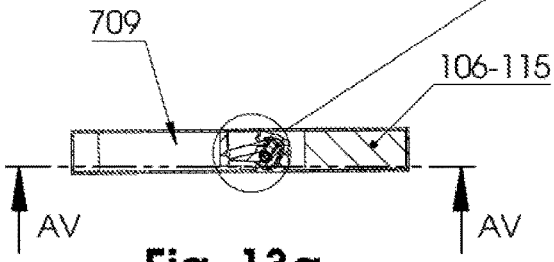
FIG. 13G is a side cross-sectional view showing the audio transducer and audio tuning system of the device of FIG. 13A with details of a fluid passage.

As shown in FIGS. 13C and 13E, in this embodiment, the transducer housing further comprises fluids passages 711 and 712 surrounding the diaphragm K101 and base block K105 of the transducer base structure that fluidly connect the front air cavity 708 with the rear cavity 710. Preferably these passages are sufficiently narrow in order that the diaphragm effectively seals and forms a divide between the front 708 and rear 710 cavities.

Audio Tuning System

In this embodiment, the mobile device 700 further comprises an audio tuning system 106, one or more amplifier(s) 115 and a power source 117 located within the cavity 702 of the housing 701. The audio tuning system 106, amplifier(s) 115 and power source 117 may be coupled to the housing via any suitable method. The audio tuning system 106 may be any one of the audio tuning system embodiments described in this specification and may include any combination of one or more of: an equaliser 109, a bass optimisation module 110, a phase improvement module 111 and/or a volume adjustment module 170. As previously described, the audio tuning system 106 may be a digitally implemented system including a digital signal processing circuit, or an analogue implemented system including analogue signal processing circuitry, or any combination thereof. The audio tuning system 106 may be operatively coupled to another personal audio device such as a headphone or earphone unit via a connector through port 706. Alternatively, the audio tuning system 106 may configured to wirelessly communicatively couple the external personal audio device. Audio signals processed by the audio tuning system 106 for external output channels may be sent by the audio tuning system 106 via a suitable communications interface 107.

In a configuration where the audio tuning system is configured to operatively couple the audio transducer(s) K100 of the device 700 as well as one or more other audio transducer(s) of an external personal audio device (such as a headphone or earphone unit), the audio tuning system 106 may consist of multiple configuration depending on the output channel that is operatively connected to the system 106. For instance, if the single output channel associated with transducer(s) K100 of device 700 is connected to the audio tuning system 106, then the audio tuning system is configured to utilise the characteristics of this channel to optimise the audio signals output through this channel. If on the other hand, an external personal audio device, for example one having a pair of output channels, is otherwise operatively connected to the audio tuning system 106, then the audio tuning system 106 may be configured to recognise this connection and utilise the characteristics of the output channels of the personal audio device to optimise the audio signals for these channels. For instance, the audio tuning system 106 may be configured to adjust equaliser, bass optimisation module, phase improvement module and/or volume control module settings according to the output channel that is operatively connected to the system 106. The multiple settings may be predetermined and pre-stored in memory that is accessible by the audio tuning system 106 in association with an identification code or similar data indicating the associated output channel/personal audio device. Multiple audio signal optimisation settings may be stored in memory that is local or remote and accessible by the audio tuning system 106. The settings may be collected by a user for example through a software application executable on the device 700 processor(s) or they may be automatically requested and acquired by the audio tuning system upon connection of the respective output channel(s) to the system 106. Otherwise, the settings may be determined by subjecting the connected output channel(s) to an audio signal and receiving data from one or more audio sensors indicative of the characteristics of the connected output channel(s) as described under section 1 of this specification.

In some embodiments, the audio tuning system 106 may be fully or partially implemented in software that is executable by one or more on-board processors of the device 700. For example, a software application may be downloadable on the device's 700 memory which contains the necessary settings and/or enables a user to input the necessary settings via the device's user interface, to process audio signals for one or more output channel(s) for optimisation as discussed under section 1 of this specification.

3. Lattice Diaphragm and Audio Transducers Incorporating the Same

3.1 Introduction

In another aspect, the invention relates to a diaphragm construction for audio transducers that may or may not be used in any one of the above described electro-acoustic transducer embodiments. The construction may also be used in any particular audio transducer application including electro-acoustic transducers for personal audio devices or for other loudspeaker systems including, home audio, car audio, computer audio and the like, and including acousto-electric transducers such as microphones.

Although a typical cone or dome diaphragm geometry provides rigidity in the primary piston direction, it is not possible for a thin membrane geometry to effectively resist every possible resonance modes through sheer rigidity so these modes are instead 'managed', for example through minimisation of excitation, or application of damping. Rigid materials and geometries may be employed to combat well-balanced resonances in a few cases but, because the diaphragm is a membrane, the design does not lend itself to achieving resonance-free behaviour over the entire operating bandwidth, and so there is almost always an element of resonance management in the design process behind the best speakers.

There exists a wide variety of different loudspeaker designs, including some having relatively thick rigid-type diaphragms as opposed to the thin membranes that are most common. Thick diaphragm constructions are intended to mitigate some of the mechanical resonance issues exhibited in thin-membrane diaphragms. However, at resonant frequencies, thick-design diaphragms can exhibit outer tension/compression and/or inner shear stresses which cause the diaphragm to deform, thereby affecting the quality of sound transducing.

Some examples of materials or structures used for relatively thick diaphragms, include: closed cell plastic foams, foam metals, honeycomb structures and open cell foams. Closed cell plastic foams, such as expanded polystyrene (EPS) or polymethacrylimide rigid foam, are common materials used for the core of a relatively thick diaphragm due to their relatively low densities. However, shear deformation of these cores may create a limit past which diaphragm breakup cannot be improved regardless of thickness and any support provided by outer reinforcement layers. Foam metals have a relatively higher specific modulus than the closed cell plastic foams and therefore more potential to resist shear deformation, however it is difficult to make closed cell metal foams sufficiently lightweight to make a diaphragm that is sufficiently thick in order to avoid bending deformation. Honeycomb cores are examples of lattices that vary in two dimensions but are uniform in a third dimension. These can resist shear effectively, however the density also makes it difficult to achieve a sufficient workable thickness. Open cell foams can be made to be lightweight, but they tend to have reduced stiffness due to the randomness of the cellular structure.

The following describes novel diaphragm structures and audio transducer assemblies incorporating the same that alleviate some of the shortcomings of the above described relatively thick diaphragm constructions. "Relatively thick diaphragms" in the audio transducer context is intended to mean diaphragms that are designed not to flex in order to produce or transduce sound. Unlike "relatively thin diaphragms" that are designed to flex during operation.

3.2 Lattice Diaphragm

A diaphragm configuration of the invention, designed to address shear deformation and other issues will now be described with reference to a first example shown in FIGS. 14A-14K. Many variations on the shape or form, material, density, mass and/or other properties of this diaphragm are possible and some variations will be described and illustrated using other examples but without limitation. The diaphragm is configured for use in an audio transducer assembly.

Diaphragm Body

Referring to FIGS. 14A-14I the diaphragm 500 comprises of a diaphragm body 501 that is formed from a three-dimensional lattice having a plurality of interconnected cells 502 of a pre-determined three-dimensional cell shape. Unlike a foam, the cells 502 are pre-determined and thus are non-random. Also, unlike a honeycomb structure, the cells 502 have a predetermined shape in three-dimensions. That is, the cell shape and hence the lattice varies in three-dimensions, unlike honeycomb structures that vary only in two-dimensions and are uniform in the third dimension. In this manner, the lattice is configured to transmit loads across the body and/or along the body via direct compression-tension pathways such that there is no or minimal bending to cell walls. Each cell comprises a plurality of nodes 504 spaced in three-dimensions and a plurality of members 505 extending in three-dimension to connect the nodes. The relative locations of cell nodes and connecting members makes up the cell shape. Cell shapes are preferably predetermined. The plurality of interconnected members 505 create interstices 507 within the diaphragm body 501. The material and three-dimensional configuration of the members 505 provides the diaphragm body 50 with increased strength and resistance to shear deformation compared to conventional materials, whereas the relatively large volume of interstices 507 reduces the overall mass of the body 501. In some embodiments, the interstices 507 may be filled with another lightweight material such as EPS.

The lattice is formed or constructed such that the diaphragm body 501 comprises at least one major side that is intended to move air with the diaphragm 500 is in use. Such a major side or sides may have a relatively large surface area compared to other minor sides of the diaphragm 500 for example, or it may otherwise have a surface area that is sufficiently sized to move the required level of air for transducing. In this embodiment the lattice is formed such that the body 501 comprises a pair of opposed major sides 503. Each major side 503 is substantially planar however other smooth surfaces that vary in three-dimensions may also be constructed. The major sides 503 preferably have a substantially solid plate or membrane coupled thereto to promote movement of air when the diaphragm is in use. The plate may be attached via any suitably rigid fastening mechanism, for example it may be adhered or welded to the lattice. Such plates may also act as normal reinforcement for resisting compression-tension stresses experienced at or adjacent the respective side 503 of the diaphragm 500 in use as will be described in further detail below.

The lattice comprises of cells 502 of substantially uniform three-dimensional shape. At least one or more sections of the lattice preferably comprise of repeated cells having substantially the same or similar three-dimensional shape. In some embodiments substantially the entire lattice or a substantial portion of the entire lattice may comprise of repeated cells 502 of substantially the same or similar three-dimensional shape. In other embodiments, two or more predetermined cell types may be utilised to form the lattice. Each cell type may consist of a different three-dimensional shape compared to other cell types. For example, the lattice may comprise an alternate arrangement of two or more differing cell shapes. The alternate arrangement may be per cell or per section of cells of the same type. Alternatively or in addition, the lattice may comprise multiple sections of cells, with each section including a different cell shape. Furthermore, in some embodiments the lattice may comprise a plurality of cells of the same shape but having varying sizes (such as varying internal volumes and/or member lengths). The size of cells may gradually reduce along a dimension, such as the length, width or radius of the lattice.

Figure 14A:
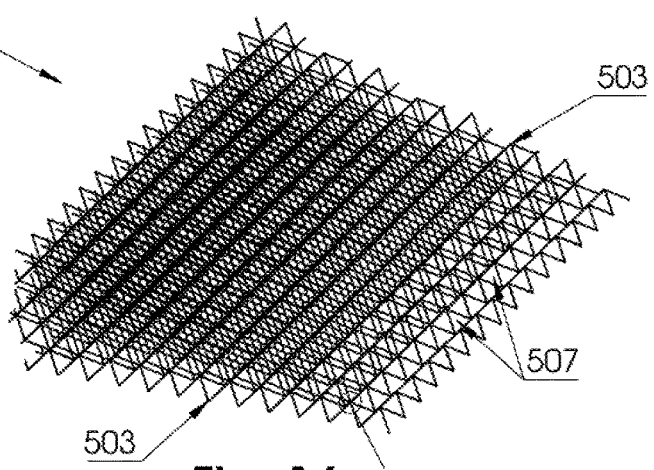
FIG. 14A shows a lattice audio transducer diaphragm constructions of a preferred embodiment of the invention.
Figure 14B:
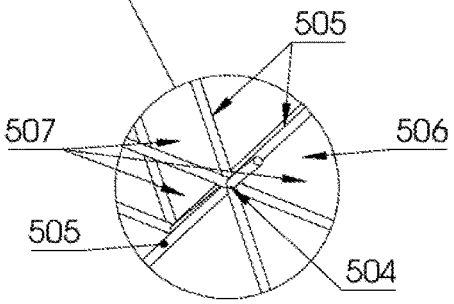
FIG. 14B shows a close up of a node unit of the lattice of FIG. 14A.
Figure 14C:
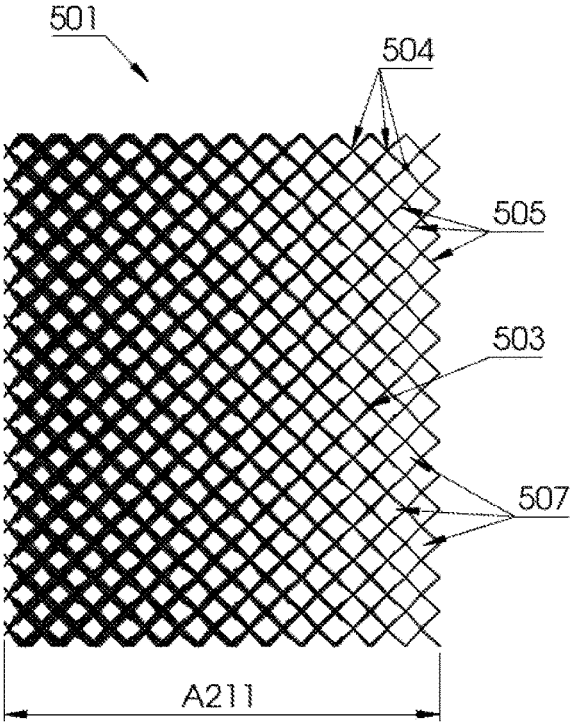
FIG. 14C is a top view of the lattice of FIG. 14A.
Figure 14D:
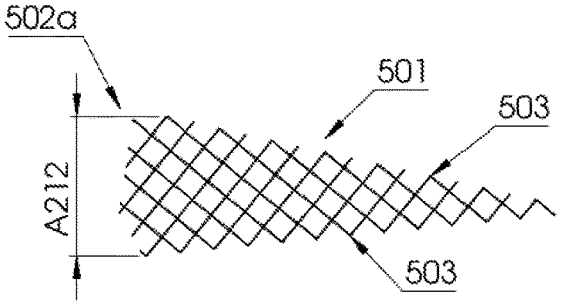
FIG. 14D is a side view of the lattice of FIG. 14A.
Figure 14E:
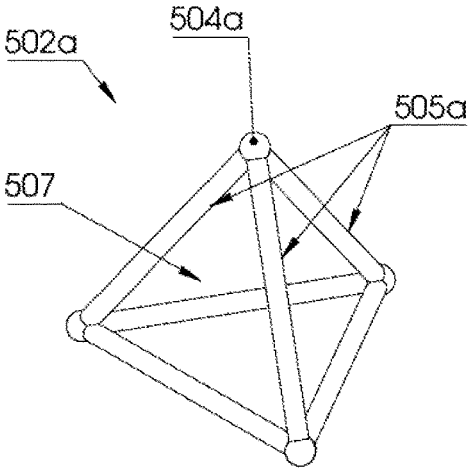
FIG. 14E is a perspective blown up view of a cell of the lattice of FIG. 14A.
Figure 14F:
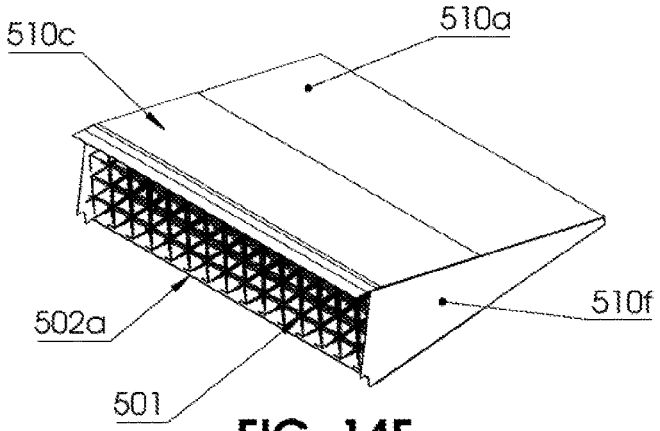
FIG. 14F is a perspective view of the diaphragm of FIG. 14A with outer reinforcement.
Figure 14G:
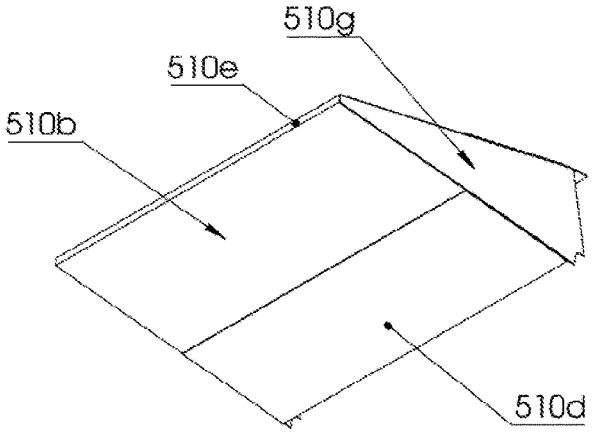
FIG. 14G is a bottom perspective view of the diaphragm of FIG. 14F.
Figure 14H:
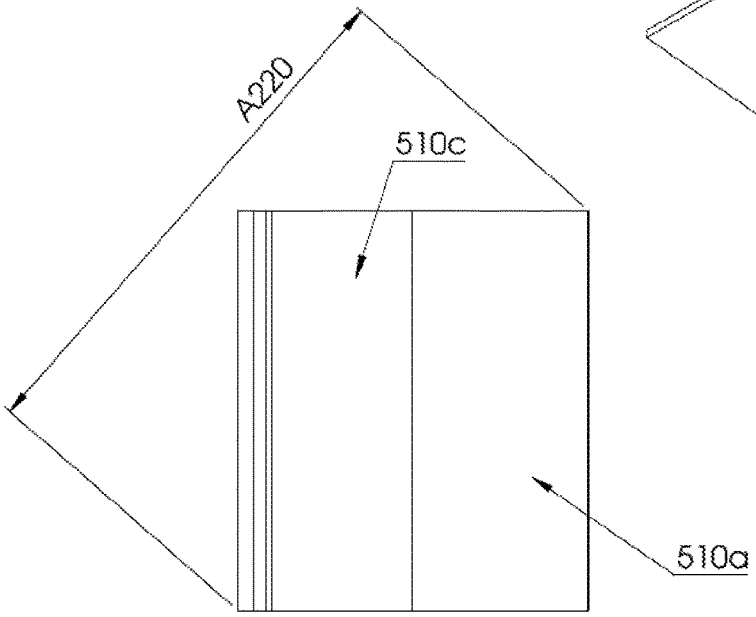
FIG. 14H is a top view of the diaphragm of FIG. 14F.
Figure 14I:
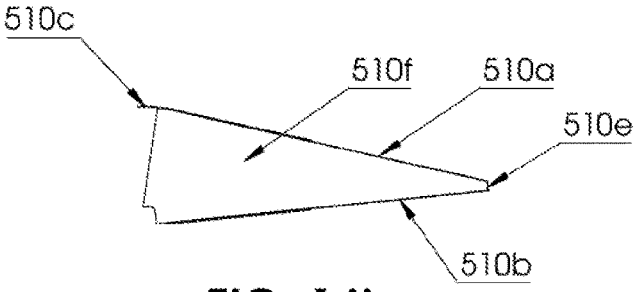
FIG. 14I is a side view of the diaphragm of FIG. 14F.
Figure 14J:
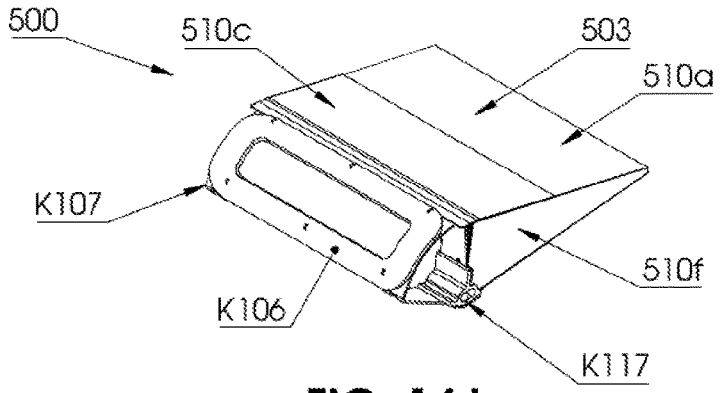
FIG. 14J is a perspective view of the diaphragm of FIG. 14F incorporating a diaphragm base structure.
Figure 14K:
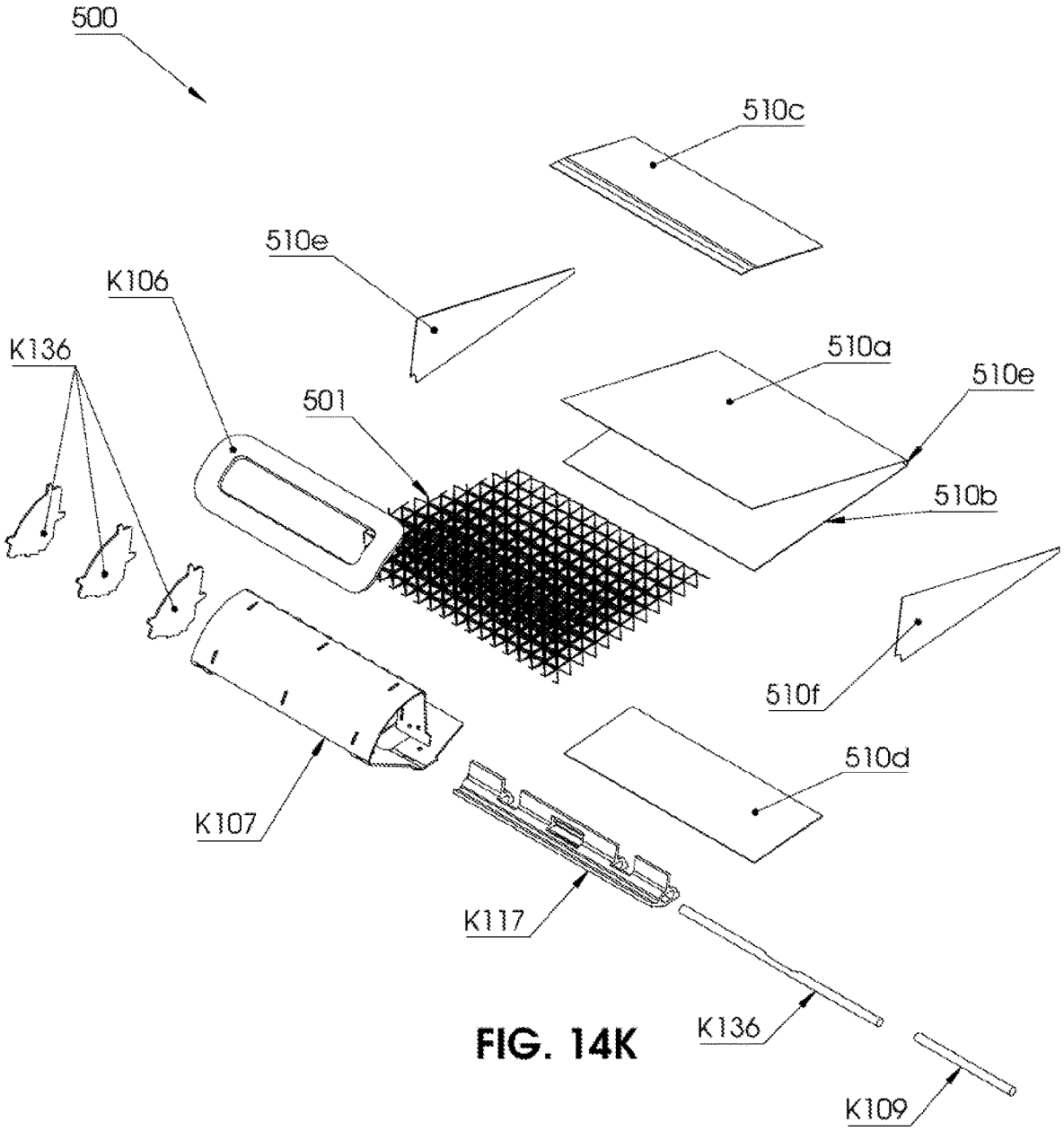
FIG. 14K is an exploded perspective view of the diaphragm of FIG. 14J.

FIG. 14E shows a single cell 502 of this embodiment. Each cell 502 in the lattice comprises a plurality of interconnected members 504 that form the predetermined cell shape. In this case the cell is a tetrahedron, however, other three-dimensional shapes may be used to build a lattice, such as cuboids, octahedrons, triangular prisms, or many other possible shapes that vary in three-dimensions, may be utilised without departing from the scope of the invention. Members 504 of the same or adjacent cells intersect at nodes 505. In this manner, each lattice comprises a plurality of interconnected predetermined node units 506. A node unit 506 consists of a central node 505 and a plurality of members 504 extending from the node 505. Each member 504 is preferably a substantially elongate strut. In this embodiment, each strut 504 is substantially linear. In alternative embodiments however, some or all elongate struts may be curved or bent into a pre-determined shape. The elongate struts 504 are preferably sufficiently thick to avoid or substantially alleviate localised resonances. The struts 504 are preferably substantially hollow but in some embodiments one or more of the struts may be substantially solid.

Each member 504 is also substantially rigid and the connection between members 504 at the nodes 505 is also substantially rigid. This creates a lattice construction that can transmit loads across and along the diaphragm body 501 substantially rigidly without load transmission being sabotaged by, for example, relatively large cell cavities and non-uniformities as is the case with foam structures for example. Such a rigid lattice construction may therefore provide effective resistance to shear deformation of the diaphragm body 501.

In preferred embodiments the lattice is formed from members 504 having a relatively high maximum specific modulus, for example, preferably at least 8 MPa/(kg/m^3), or most preferably at least 20 MPa/(kg/m^3). Many metals, ceramics or high modulus fibre-reinforced plastics materials may be suitable. For example the lattice members 504 may be formed from aluminium, titanium, beryllium or a carbon fibre reinforced plastics material. Different members 505 may have the same or different compositions. In the case of different compositions, different metal members 505 may be alloyed together for example. Also, the lattice 501 may be strengthened in some locations compared to others. For example, in locations configured to couple a transducing mechanism, the lattice may be strengthened using thicker and/or higher specific modulus materials relative to locations remote from the coupling location. The plurality of interconnected members 505 may be integrally formed or otherwise connected at nodes 504 via any suitably rigid fastening mechanism, such as via welding, soldering or any other suitable technique.

Also, the interconnection of members 504 to form the lattice structure, makes the lattice an open cell configuration. A majority of cells 502 are preferably open cells and in some embodiments substantially all cells 502 are open cells. The open cell configuration means that material of the diaphragm body 501 can be concentrated into elongate members 504 which are designed to avoid localised resonance, while the high proportion of voids (within each cell) significantly reduces the weight of the body 501. The relatively high proportion of voids permits the use of relatively dense materials, for example titanium, that have a relatively high specific modulus, as opposed to typically used plastics material. This further improves the specific shear modulus of the diaphragm body 501. Overall diaphragm body density remains sufficiently low so that the diaphragm body 501 can be made sufficiently thick to substantially resist resonances facilitated by deformation of the outer air movement layer(s) on the major sides(s) 503 of the diaphragm body 501. The open cell arrangement makes the lattice a synthetic porous material.

The three dimensional interconnected cells form a plurality of nodes 505 in the lattice that are each rigidly supported in all three dimensions by a plurality of members 504. In the preferred embodiment one or more nodes are over-constrained, implying that there must be more than four members 504 connected to the respective node 505. Note that an approximation is being made here that each strut cannot pass bending moments into vertices, based on the fact that if strut bending is the only constraint of the vertex in a particular direction then this may result in insufficient rigidity.

In some embodiments however, one or more nodes 505 may still be perfectly constrained using only three 504 members per node 505 to form the lattice. In this manner, the lattice may comprise a plurality of perfectly constrained and/or over-constrained node units.

Referring to FIG. 15A-15F, various configurations of node units 506 that may be used within diaphragm body lattice structures will now be described. It will be appreciated that these are only exemplary and other node units may be designed and implemented to build a lattice without departing from the scope of the invention. Furthermore, any two or more of these node units may be used to build a single diaphragm body lattice and the invention is not intended to be limited to a single unit type per lattice, although some proportions of node unit types are preferred as will be explained in further detail below. A lattice may consists of node units of the same type (meaning there are the same number of members extending from the same relative angles from the central node) but of varying sizes (meaning the members of one unit may vary in length relative to the members of another unit).

Figure 15A:
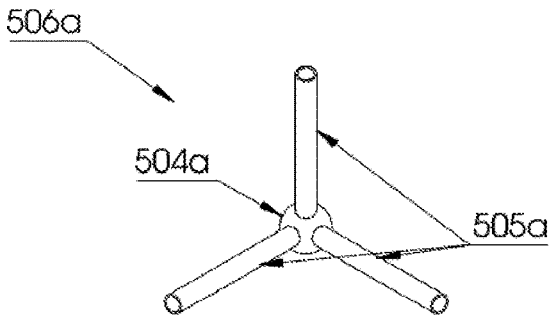
FIG. 15A is a close up view of a three member node unit example.

FIG. 15A shows a perfectly constrained node unit 506A having three angled members 505A connected at one end to a central node 504A. The members 505A are preferably substantially evenly, angularly spaced relative to one another in three-dimensional space. For instance, the three members 505A may extend along three substantially orthogonal axes. Other relative angles between the three members are also possible. This type of arrangement is referred to as a perfectly constrained node unit 506A. Preferably, again approximating the connection between members and vertices as being unable to transmit bending moments, the perfectly constrained node unit is constrained in all three dimensions.

Figure 15B:
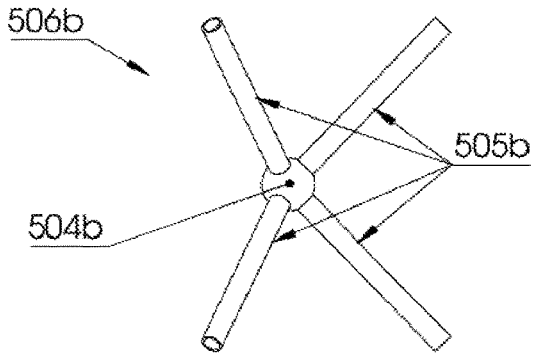
FIG. 15B is a close up view of a four member node unit example.

FIG. 15B shows an over-constrained node unit 506B including four angled members 505B connected at one end to a central node 504B. In this example, adjacent members are substantially, albeit no longer perfectly, orthogonal to one another in a common plane. The common planes of adjacent pairs are preferably angled relative to one another to give a three-dimensional form to the node unit 506B.

Figure 15C:
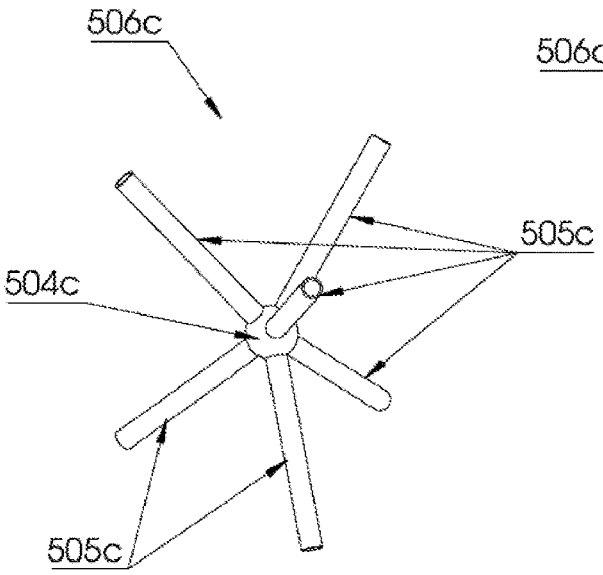
FIG. 15C is a close up view of a six member node unit example.

FIG. 15C shows another over-constrained node unit 506C including six angled members 505C connected at one end to a central node 504C. The six members 505C extend in three-dimensions at angles relative to one another. In some configurations, such node units 506C may be used as a constituent of a plurality of cuboid cells 502C of a lattice 501C for example as shown in FIG. 15E.

Figure 15D:
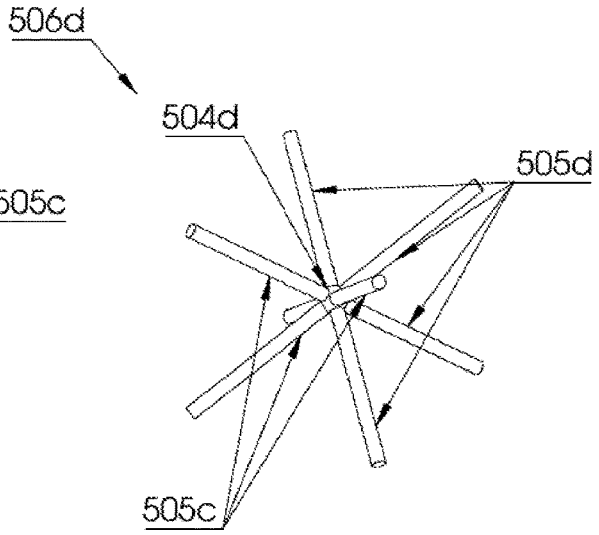
FIG. 15D is a close up view of an eight member node unit example.
Figure 15E:
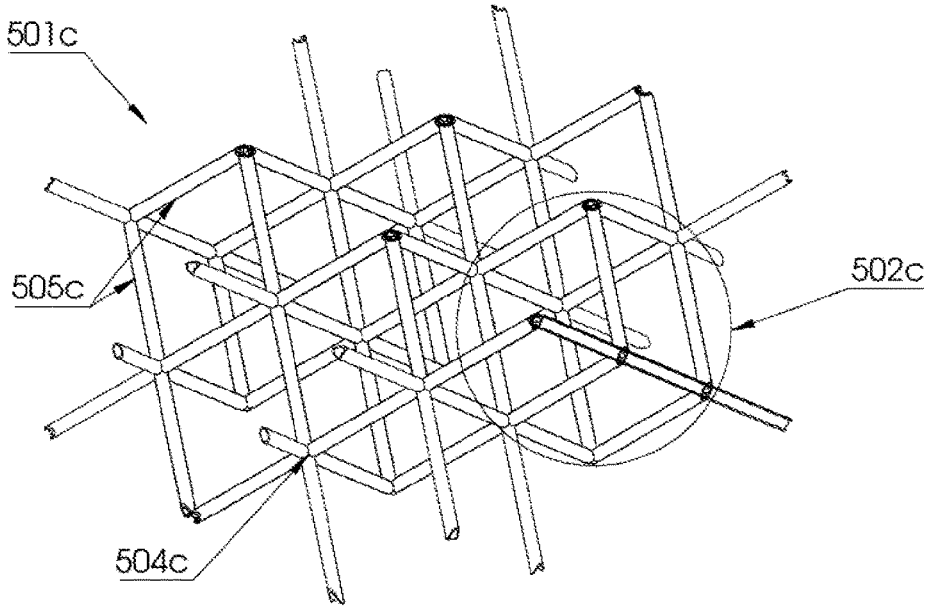
FIG. 15E is a close up view of a section of an exemplary lattice formed from repeated six member node units.
Figure 15F:
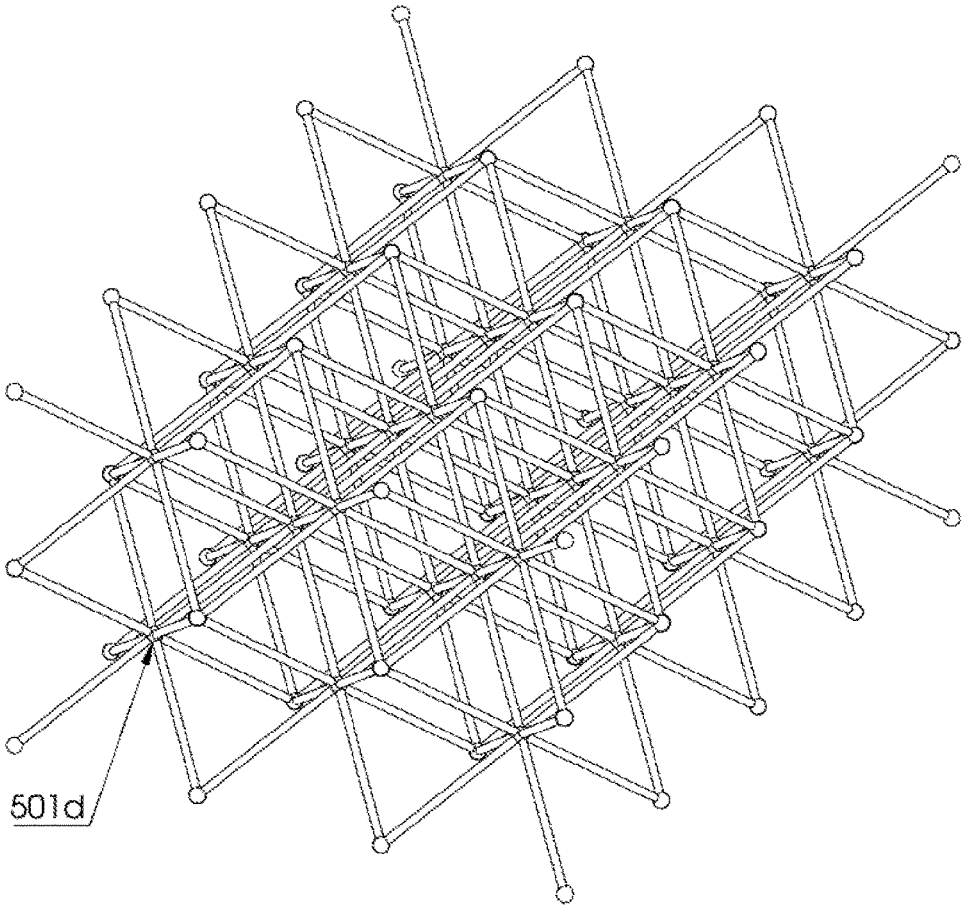
FIG. 15F is a close up view of a section of an exemplary lattice formed from repeated eight member node units.

FIG. 15D shows another over-constrained node unit 506D including eight angled members 505D connected at one end to a central node 504D. The eight members 505D extend in three-dimensions at angles relative to one another. These can be used as a constituent of a lattice 501D as shown in FIG. 15F for example.

Many other node unit configurations are possible and the invention is not intended to be limited to the examples given above. For example, one or more node units of the lattice structure may comprise any number of between three to twelve members 505 per node 504 and the members 505 of a node unit 506 may be of substantially the same or varying lengths.

In preferred embodiments, the members 505 of one or more node unit 506 in a lattice are arranged at angles relative to one another such that force applied to a respective node 505 by one member may be resisted by at least one other opposing member attached to the other side of the node. For example the opposing members may be substantially collinear (for example, at an angle of approximately 180 degrees relative to one another) as shown for the some members 505D of node unit 506D. Alternatively at least one opposing member may be relatively angled at less than approximately 50 degrees (relative to collinear), as shown for some of the members 505C of node unit 506C for example, such that incoming loads may be transmitted to other members acting to absorb the load primarily in tension-compression directions as opposed to acting to absorb load in bending or shear directions. To achieve this it is preferable that at least approximately 50%, or more preferably at approximately least 70% of node units in the diaphragm body lattice have at least six, or more preferably at least seven members 505 extending from the respective nodes 504. This is preferably excluding nodes that are at an exposed periphery/sides of the lattice.

It is also preferable that at least approximately 50%, or more preferably at least approximately 70% of node units in a diaphragm body lattice have less than ten or more preferably less than nine members 505 extending from the respective node 504. More than nine or ten members per node, may unnecessarily overly support each node and unduly increase the mass of the lattice structure. For instance, the equivalent mass of nine or ten members could be better utilised if distributed to fewer members that are thicker and possibly longer, meaning they could cover a larger area yet still remain substantially less prone to localised resonance due to their increased thickness. This in turn increases the cell size and reduces overall density. Also, having a larger number of members extending from each node may be useful if the lattice is required to resist loadings in numerous directions, however in this case a more optimal lattice is focused towards resisting shear loads, whilst still being able to support its own mass against, for example, localised strut bending or localised 'blobbing' (i.e. where a sub-zone of the lattice reciprocates) resonance modes.

Therefore a lesser number of struts angled to resist diaphragm shear may be more optimal in certain applications. In yet another preferred configuration a substantial proportion of the total mass of lattice members preferably are arranged to substantially resist shear deformation of the lattice. For example, at least approximately 50%, or more preferably at least approximately 70% of a total mass of lattice members 505 are made up of lattice members that are at an angle greater than approximately 30 degrees relative to a coronal plane of the diaphragm body 501.

Referring to FIGS. 14A-14K in this embodiment the major sides 503 of the diaphragm body 501 comprise of a substantially smooth (overall) outer profile to allow outer membranes 510*a*, 510*b* and/or normal stress reinforcement 510*c*, 510*d* to be adhered or otherwise coupled thereto. The surface is preferably reasonably planar, because the corresponding membranes and/or normal stress reinforcement provides more optimal rigidity if it is relatively straight and so becomes less prone to buckling, at least in locations and directions where it is not supported by the lattice. The diaphragm body 501 also comprises a substantially smooth (overall) outer profile at the minor sides connected the two major sides to allow outer membranes 510*f* and 510*e* to be coupled thereto. This seals the major and minor sides of the diaphragm body to allow it to push air or move in response to sound during operation. The bass region 502*a* is preferably also substantially sealed, and in this embodiment this is done using a diaphragm base structure. In some embodiments another sealing membrane may be coupled to this region. An opposing end to the base region is preferably also sealed by a membrane or membrane part 510*e*. The membrane is preferably a substantially solid plate. This has the effect of sealing the interstices 507 from the external environment.

In this embodiment the membranes are further reinforced with normal stress reinforcement plates 510C, 510*d* that are configure to locate adjacent the relatively thick base region 502*a* of on each major side 503. The normal stress reinforcements plates may extend partially along the length of each major side, as in this example, or alternatively along an entire or substantial portion of the length. In this embodiment, the normal stress reinforcement plates 510 provide additional support at the thicker region of the diaphragm body. Many other normal stress reinforcement variations are possible as described in further detail below. In some embodiments, the membranes 510*a* and 510*b* may be substituted entirely by normal stress reinforcement that extend along an entire surface area of the respective major side 503.

In this embodiment the diaphragm base structure K200 comprises a hinge system consisting of components K117, K136 and K109, a diaphragm base frame consisting of components K107 and K136 and a coil winding K106 of an excitation/transducing mechanism. The diaphragm base structure K200 is described in further detail in section 3.3.

The diaphragm 500 comprises a substantially wedge shaped body 501 and/or a body that is substantially triangular in cross-section. As will be explained in further detail below, this type of diaphragm shape is particularly advantageous in rotational action audio transducer applications. The membranes 510*a* and 510*b* covering the major sides 503 of the diaphragm body 501 may be formed into an integral component and connected or bent at end 510*e*. The membranes extend at an angle relative to one another from end 510*e* that is substantially the same as the relative angle between the major sides 503 of the diaphragm body 501.

Although in this example the general cross-sectional shape of the diaphragm body is preferably substantially triangular or wedge shaped, other geometries, such as rectangular, kite shaped or bowed profiles are also possible and the invention is not intended to be limited to the shape of this particular example. A diamond cross-sectional profile works well with linear action transducers, however other profiles are also possible in alternative variations, for example trapezoidal, rectangular, or bowed profiles. Approximately convex profiles, such as a trapezoidal profile, may have better break-up characteristics and may be lighter, and so may be preferable in some applications.

The diaphragm body 501 is substantially thick (at its thickest region). In this specification, and unless otherwise specified, reference to a substantially thick diaphragm body is intended mean a diaphragm body that comprises at least a maximum thickness, t, that is relatively thick compared to at least a greatest dimension of the body such as the maximum diagonal length A220 across the body (hereinafter also referred to as the maximum diaphragm body length or maximum length of the diaphragm body). In the case of a three-dimensional body (as is the case for most embodiments), the diagonal length dimension may extend across the thickness/depth and width of the body in three-dimensions. The diaphragm body may not necessarily comprise a uniform thickness that is substantially thick along one or more dimensions. The phrase relatively thick in relation to the greatest dimension may mean for example at least about 11% of the greatest dimension (such as the maximum body length A220). More preferably the maximum thickness, A212, is at least about 14% of the greatest dimension of the body A220. In this specification, the maximum thickness in relation to a substantially thick diaphragm body may also be related to the length dimension of the diaphragm body that is substantially perpendicular to the thickness dimension (hereinafter also referred to as the diaphragm body length A211). The phrase relatively thick in this context may mean at least about 15% of the diaphragm body length A211, or more preferably at least about 20% of the diaphragm body length A211.

The region of maximum thickness in this embodiment is considered the base region 502*a* of the diaphragm 500. In some embodiments, including this embodiment, the region of diaphragm centre of mass is considered the base region.

Method of Forming Diaphragm Body

The node units 506 and/or cells 502 and ultimately the lattice of the diaphragm body 501 may be formed via any suitable method. For instance the ends of each member 505 may be welded, soldered, adhered or otherwise rigidly attached to the respective nodes 504. Node units 506 and/or cells 502 may be formed and then connected to one another also via welding, soldering, adhesion or any other suitable rigid fastening mechanism.

In some embodiments, the multiple members/struts of a lattice may be formed by bending wire or by stamping metal sheets into three-dimensional layers, followed by attaching the multiple members using any suitable method such as adhesive or by welding.

The lattice may be also formed, for example, using various rapid prototyping technologies.

In another method, the lattice may be formed with integral members 505 making up the cells. For example a polymer template having a predetermined structure may be used to create the lattice. The polymer may be formed using ultraviolet (UV) curable resin. A reservoir of the liquid resin may be provided and a perforated mask may be disposed over the reservoir. Beams of UV light may then be directed through the perforated mask and into the curable resin. The orientation of the beams of light as well as the configuration of the perforated mask determine the final structure of the polymer template. The curable resin may then turn into a solid polymer in the regions where light beams have penetrated. Aligning the light beams at different intersecting angles thus forms a plurality of solid and interconnecting polymer fibres. These fibres may then be coated with the desired lattice material, such as metal. Once the coating hardens, the polymer fibres may be melted out of the lattice using heat or other suitable methods, resulting in the desired metal lattice.

Outer Membranes and Normal Stress Reinforcement

Referring to FIGS. 14F-14K, as previously mentioned in preferred embodiments of the lattice diaphragm construction the diaphragm 500 further comprises at least a substantially solid membrane layer 510*a*, 510*b* on at least each major side 503 of the diaphragm body 501. The solid membrane layer 510*a*, 510*b* may cover an entire surface area of the respective major side 503 or a percentage of the surface area sufficient to cause the desired level of movement of air or of the diaphragm when the diaphragm is in use. Preferably the outer membrane is substantially solid and covers an entire outer surface or envelops the entire lattice of the diaphragm body.

To construct the diaphragm 500, initially a three-dimensional lattice having a desired three-dimensional shape is formed, by interconnecting a plurality of cells and/or node units, each having a predetermined three-dimensional cell shape and/or a predetermined node unit shape respectively. This initial stage may be performed using any one of the lattice forming methods described above. The result is a diaphragm body 501 having at least on major side with a substantially planar profile, but preferably a pair of opposing sides with substantially planar profiles. A substantially solid membrane layer 510*a*, 510*b* can then be connected to each major side. This may be done via adhesive, welding, soldering or any other suitable rigid fastening mechanism. In a preferred method, the membranes 510*a*, 510*b* are coupled to the major sides of the lattice 501 by applying adhesive to exposed ends of the cells that are at the major sides and coupling the membrane layers against the adhesive. In some embodiments, the respective major side may be rested on a layer of adjective to consistently apply adhesive along at least a portion of the major side.

Similarly, in preferred embodiments, substantially solid sealing membrane layers may be adhered to one or more, and preferably all, peripheral faces of the diaphragm which are in close proximity to a surround, such as a housing. Preferably the gap size remains substantially small as the diaphragm moves. The sealing membrane(s) increase the distance over which air has to travel through the narrow air gap in order to get past the diaphragm, which may improve the degree of sealing of an enclosure.

The membrane(s) may also act as outer normal stress reinforcement configured to substantially resist compression-tension stresses experienced at or adjacent the major sides 503. In embodiments where the membrane is insufficient to act as normal stress reinforcement, a normal stress reinforcement layer 510*c*, 510*d* may be applied to each membrane 510*a*, 510*b* respectively. The following is a description of various types of normal stress reinforcements that may be applied directly on or adjacent the major sides 503 of the diaphragm body (potentially also forming the transducing membrane 510*a*, 510*b*), or applied on the membrane 510*a*, 510*b*.

Normal stress reinforcement may be coupled external to the body and on at least one side, and preferably at least one major side 503, or alternatively within the body, directly adjacent and substantially proximal the at least one major side 503 so to sufficiently resist compression-tension stresses when the diaphragm is in use. Unless otherwise stated, reference to a major side of a diaphragm body is intended to mean an outer side of the body that contributes significantly to the generation of sound pressure (in the case of an electroacoustic transducer) or that contributes significantly to movement of the diaphragm body in response to sound pressure (in the case of an acoustoelectric transducer) during operation, when coupled to a membrane or normal stress reinforcement. A major side is thus not necessarily the largest side of the diaphragm body.

This construction provides improved breakup behaviour through synergistic interactions between the components. Tension and/or compression loads associated with the primary/major/large-scale diaphragm breakup resonance modes are primarily resisted by the outer normal stress reinforcement, which has significant and maximal physical separation between the members in the preferred form (i.e. separation between the outer normal stress reinforcement plates across each major side is the full thickness of the diaphragm body) so that, due to the I-beam principle, diaphragm bending stiffness is increased. Shear associated with such modes is primarily resisted by the inner lattice of the body 501. The lattice acts to minimise buckling and localised transverse resonances of the normal stress reinforcement. The smooth major side 503 of the diaphragm body 501 may comprise a planar or alternatively a curved smooth profile (extending in three dimensions). Each normal stress reinforcement plate or member comprises one or more substantially smooth reinforcement plates or members having a profile corresponding to the associated major side and configured to couple over or directly adjacent to the associated major side of the diaphragm body 501. The reinforcement plate or member may comprise any profile or shape necessary for achieving sufficient resistance to compression-tension stresses experienced at or adjacent the corresponding major side 503 of the body during operation, and the invention is not intended to be limited to any particular profile. For instance, each reinforcement plate may be solid, it may be formed from a series of struts, a network of struts crossing over one other, or it may be perforated or recessed in some areas. Otherwise multiple plates or reinforcement members may be discretely applied to the respective major side. The periphery of each plate may be smooth or it may be notched.

Some lattice structures may be optimised to resist shear loadings and this may mean that they have reduced ability to resist loadings in one or more directions parallel to the coronal plane. To address this preferably, if there are parts of the lattice at the surface of a major face which have no outer reinforcement, there may instead be additional lattice members at or near such surface areas, with the additional members oriented substantially parallel to the coronal plane, so that there may be at least some ability to resist tension/compression loads at the surface. Preferably in this case such surface areas of the lattice can effectively resist such surface tension/compression loads in multiple directions and most preferably in all directions. This helps to ensure that the lattice is capable of supporting itself against localised 'blobbing' resonances in areas between where the normal reinforcement is applied. Likewise, depending on the lattice structure, additional structural support may be required at or close to non-major faces of the diaphragm to resist tension/compression loads in the plane of such diaphragm faces. Again such reinforcement may, if required, take the form of a solid reinforcing plate, which may also act as a sealing membrane, or it may take the form of additional lattice strut members oriented in the plane of the applicable peripheral face, or it may take the form of some other type of reinforcement. In some embodiments, if no reinforcement is applied on some face then no edge portion of a lattice member(s) that is left unsupported as this may be prone to resonance. Such members may be removed or else may be reinforced using additional members. A finite element method modal analysis is a suitable method for determining susceptibility to localised blobbing or single-member type resonances.

As previously mentioned, in this embodiment, substantially solid normal stress reinforcement plates 510*c* and 510*d* are coupled to the respective membranes 510*a* and 510*b* of each respective major side 503 of the body. These plates extend partially along a length of the body from the relatively thicker base region 502*a* toward the relatively thinner opposing end. The plates 510*c* and 510*d* may extend a sufficient length to provide the desired level of support against tension and compression at the major sides and as such may extend along a substantial portion or entirely over the surface area of each major side 503.

Figure 20A:
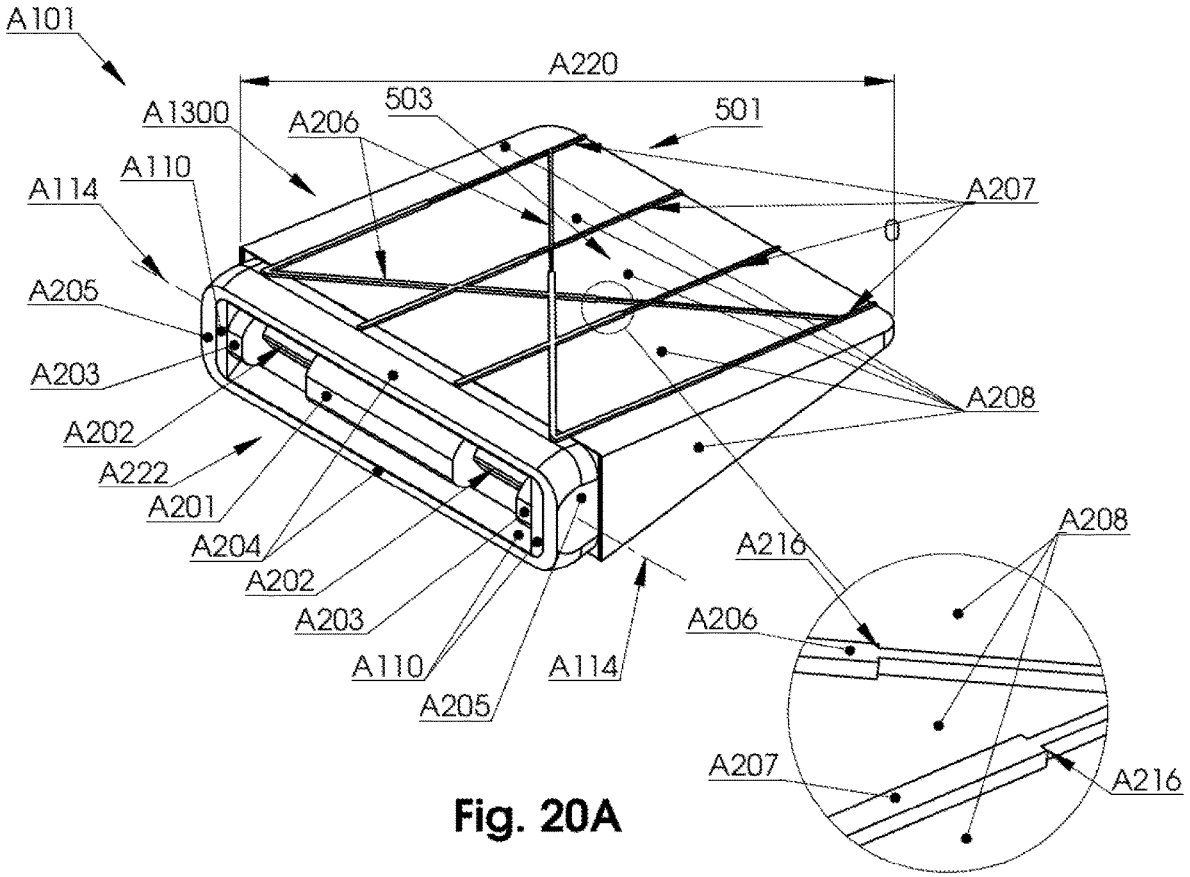
FIG. 20A is a 3D isometric view of a lattice diaphragm incorporating another form of normal stress reinforcement including struts.

Referring to FIGS. 20A-20F, possible normal stress reinforcement variations will now be briefly described. In these drawings, the body is shown as a solid body for clarity, however, it will be appreciated that this is constructed from a lattice structure. Preferably the normal stress reinforcement A206/A207 is oriented approximately parallel relative the at least one major side 503 and extends within a substantial portion of the area defined by each associated side. In the example of FIG. 20A, the normal stress reinforcement comprises a reinforcement plate A206/A207 on each of the opposing, major front and rear sides 503 of the diaphragm body 501 for resisting compression-tension stresses experienced by the body during operation Each normal stress reinforcement plate comprises a plurality of elongate or longitudinal struts A206/A207 extending along the corresponding major side of the diaphragm body 501. The struts may be coupled over solid membranes attached to the periphery of the lattice. A first series/group of substantially parallel and spaced struts A207 provided on each major side A214, A215 are configured to extend substantially longitudinally along the corresponding major side. The normal stress reinforcement plate further comprises one or more struts A206 (preferably a pair of struts) extending at an angle relative to the longitudinal axis of the corresponding major side and/or relative the group of parallel struts A207. The pair of struts A206 are angled relative to one another, preferably substantially orthogonally, and for example extend diagonally across the associated major side/over the parallel struts A207. The normal stress reinforcement plate in this embodiment thus comprises a network of angled struts extending along a substantial portion of the corresponding major side. It will be appreciated that a network of two or more struts may be provided in varying relative orientations in other alternative configurations provided they sufficiently cover or extend along the corresponding major side to sufficiently resist tension-compression stresses across that major side 503. This particular example is preferable in terms of performance due to the low diaphragm inertia and high stiffness. The struts A206 may be formed integrally with the struts A207 or they may be formed separately and rigidly coupled to one another via any suitable method known in the art of mechanical engineering.

The normal stress reinforcement plate on each major side may comprise a reduced mass region, in one or more areas that extend away and/or are most distal from a base region A222 of the diaphragm structure. For example, the normal stress reinforcement struts A206 and A207 on each major side 503 reduce in thickness and/or width as they extend away from the base region A222 of the diaphragm 500.

In other words, the normal stress reinforcement struts A206/A207 comprise a reduced thickness and/or width in regions distal from the base region A222 of the structure relative to the thickness and/or width in regions proximal to the base region. In this example, the normal stress reinforcement struts A206 and A207 reduce in width at locations A216 as seen in Figure A2*b*. The reduction in width is stepped A216 however alternatively this may be tapered/gradual. It will be appreciated that struts with uniform thickness, width and/or mass along their length are also possible.

Some or all the struts A206 and A207 may also connect securely to one of the long sides of the coil windings A204 of a transducing mechanism. All the reinforcement is well connected to the diaphragm body 501, with plenty of overlap provided in order to minimise compliance associated with these connections. These diaphragm parts are adhered to each other via an adhesive such as epoxy resin, however other fixing methods (e.g. fasteners, welding etc.) well known in the art may also or alternatively be used.

Each normal stress reinforcement plate A206/A207 is formed from a material having a relatively high specific modulus compared to a non-composite plastics material. Examples of suitable materials include a metal such as aluminium, a ceramic such as aluminium oxide, or a high modulus fibre such as in carbon fibre reinforced plastic. Other materials may be incorporated in alternative embodiments. In this example, the normal stress reinforcement struts A206 and A207 are made from an anisotropic, high modulus carbon fibre reinforced plastic, having a Young's modulus of approximately 450 GPa, a density of about 2000 kg/m^3 and a specific modulus of about 225 MPa/(kg/m^3) (all figures including the matrix binder). An alternative material could also be used, however to be sufficiently effective at resisting deformation the specific modulus is preferably at least 8 MPa/(kg/m^3), or more preferably at least 20 MPa/(kg/m^3), or most preferably at least 100 MPa/(kg/m^3).

It is also preferable that the reinforcing material has a higher density than the diaphragm body 501, for example at least 5 times higher. More preferably normal stress reinforcement material is at least 50 times the density of the body 501. Even more preferably normal stress reinforcement material is at least 100 times the density of the core material. This means there is a concentration of mass towards the major sides, which improves resistance to major diaphragm bending resonance modes in the same way that the moment of inertia of a beam is improved by use of an 'I' profile as opposed to a solid rectangle. It will be appreciated in alternative forms the normal stress reinforcement has a density value that is outside of these ranges.

In this example, suitable materials for use in the normal stress reinforcement could include Aluminium, Beryllium and Boron fibre reinforced plastic. Many metals, and ceramics are suitable. The Young's modulus of the fibres without the matrix binder is 900 GPa. Preferably the struts are made from an anisotropic material such as fibre reinforced plastic, and preferably the Young's modulus of the fibres that make up the composite is higher than 100 GPa, and more preferably higher than 200 GPa and most preferably higher than 400 GPa. Preferably the fibres are laid in a substantially unidirectional orientation through each strut and laid in substantially the same orientation as a longitudinal axis of the associated strut to maximise the stiffness that the strut provides in the direction of orientation.

The thickness of the normal stress reinforcement may be uniform along/across one or more dimensions of the reinforcement, or alternatively it may be varying along/across one or more dimensions.

FIGS. 20B-F show other possible variations to the form of the normal stress reinforcement. These are described below but it will be appreciated that the invention is not intended to be limited to these particular variations. Other variations as may be described in other sections of this specification and/or variations that would be envisaged by those skilled in the relevant art are also intended to be included within the scope of the invention. Other properties of the diaphragm including reinforcement material, reinforcement thickness and/or reinforcement connection type as in the above example are also applicable to the following normal stress reinforcement variations.

As described above, the normal stress reinforcement may comprise any combination of plates, foil, struts and/or other members for covering or extending along or close to some or all of the surface of a major side to resist tension-compression deformation.

Figure 20B:
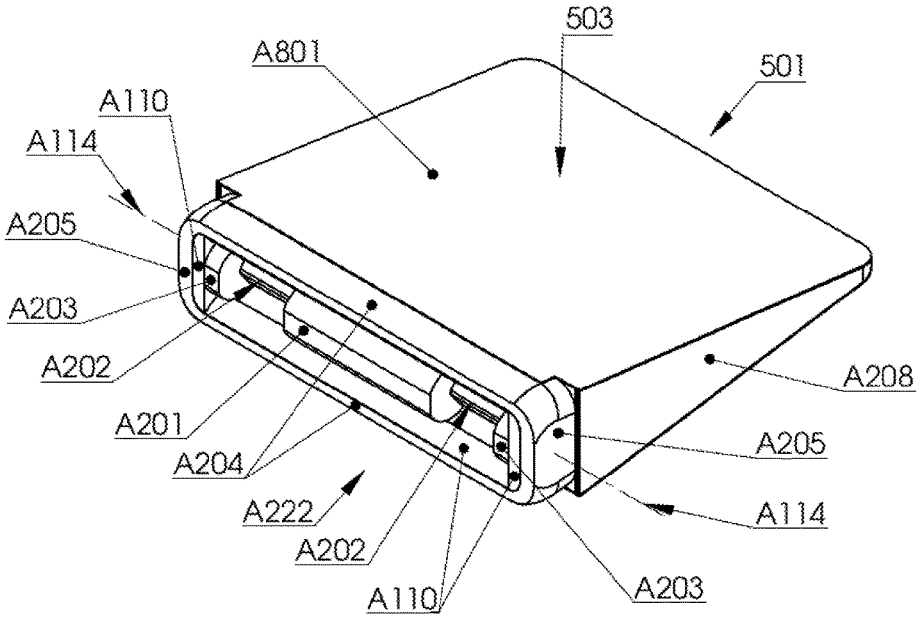
FIG. 20B is a 3D isometric view of a lattice diaphragm incorporating another form of normal stress reinforcement including solid plates.

A variation of the form of normal stress reinforcement is shown in FIG. 20B. In this example the normal stress reinforcement A801 comprises a foil or substantially solid and thin plate substantially covering an entire portion of each major side 503 of the diaphragm body. In this example, a separate membrane 508 is not required.

Figure 20C:
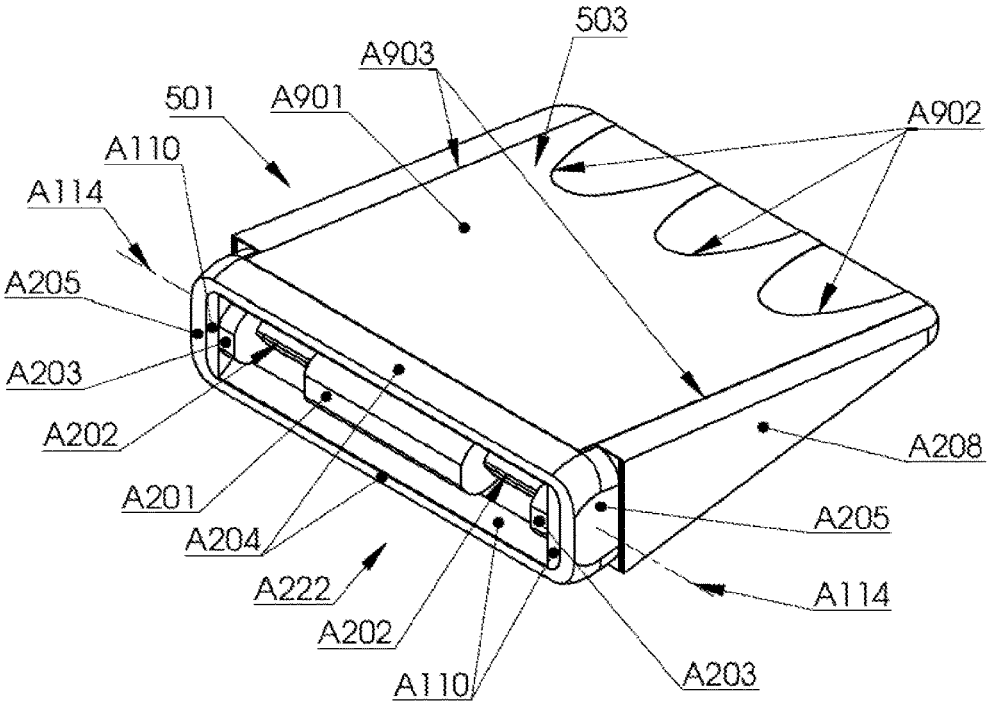
FIG. 20C is a 3D isometric view of a lattice diaphragm incorporating another form of normal stress reinforcement including recessed plates.

Another variation is shown in FIG. 20C. In this example, the diaphragm 500 comprises normal stress reinforcement A901 that are similar to normal stress reinforcement A801 shown in FIG. 20B, except that for at least one (but preferably each) major side of the diaphragm structure that incorporates normal stress reinforcement, normal stress reinforcement is omitted at or proximal to one or more peripheral edge regions of the major side located distal from the base region A222 of the diaphragm 500. Normal stress reinforcement is at least omitted at or proximal to one or more peripheral edge regions that are distal from the base region A222 of the diaphragm (e.g. the diaphragm centre of mass region and/or excitation mechanism). In this example, multiple disconnected regions A902 are devoid of reinforcement along and/or adjacent a peripheral edge region of the major side that opposes and/or is most distal from a base region A222 of the diaphragm body configured to couple part of an excitation mechanism in use (i.e. most distal from the diaphragm base frame). The regions A902 devoid of reinforcement are preferably located substantially between adjacent inner reinforcement plates A209. The edge region A902 of each major side that is devoid of reinforcement (close to the diaphragm structure terminal end/tip) is in the shape of three arcs, although many other shapes could suffice, such as rectangular, annular or triangular for example. In this example, for each major side with normal stress reinforcement, the diaphragm structure is also devoid of normal stress reinforcement at opposing longitudinal peripheral edge regions A903 at or adjacent the side edges of the major side extending between the base region A222 of the diaphragm body and the opposing terminal end. In this example each side edge region of each major side within which normal stress reinforcement is omitted is in the shape of a straight line or is substantially linear on, although many other shapes could suffice, such as a serpentine shape for example.

Figure 20D:
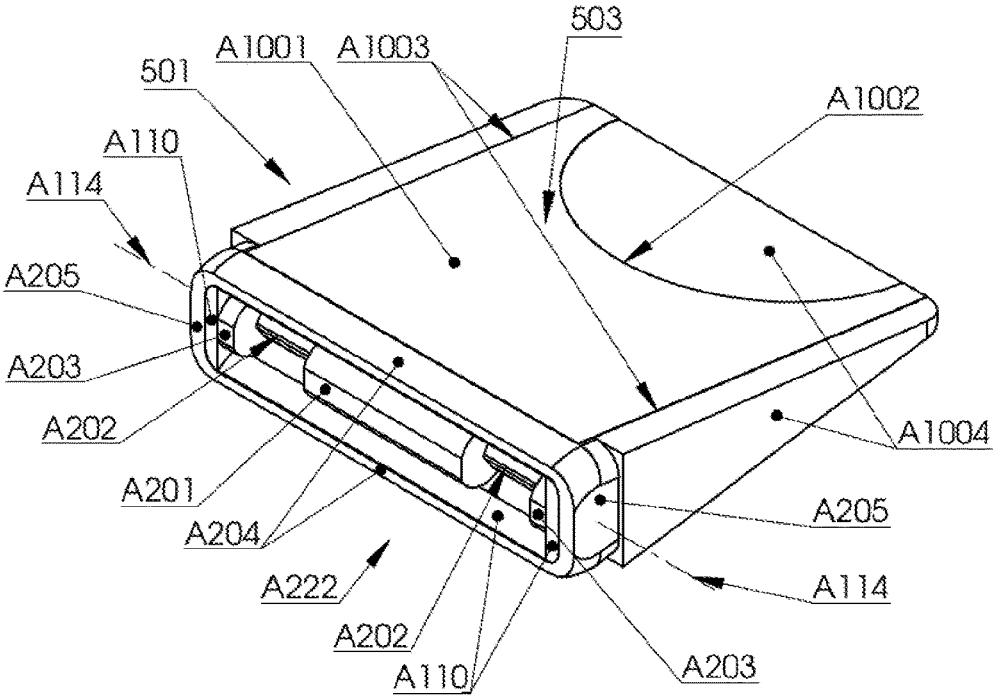
FIG. 20D is a 3D isometric view of a lattice diaphragm incorporating another form of normal stress reinforcement including another form of recessed plates.

FIG. 20D shows another similar variation the normal stress reinforcement, in which a region A1002 is devoid of normal stress reinforcement on either major side 503. In this variation, the region A1002 is substantially semi-circular and extends across a substantial portion of the width of the reinforcement A1001. Edge regions A1003 of each major side of the diaphragm structure at or proximal to either side of each major side 503 are also devoid of normal stress reinforcement in similar linear manner to the variation of FIG. 20C. Region A1002 may not be arcuate and/or regions A1003 may not be linear in alternative embodiments.

Figure 20E:
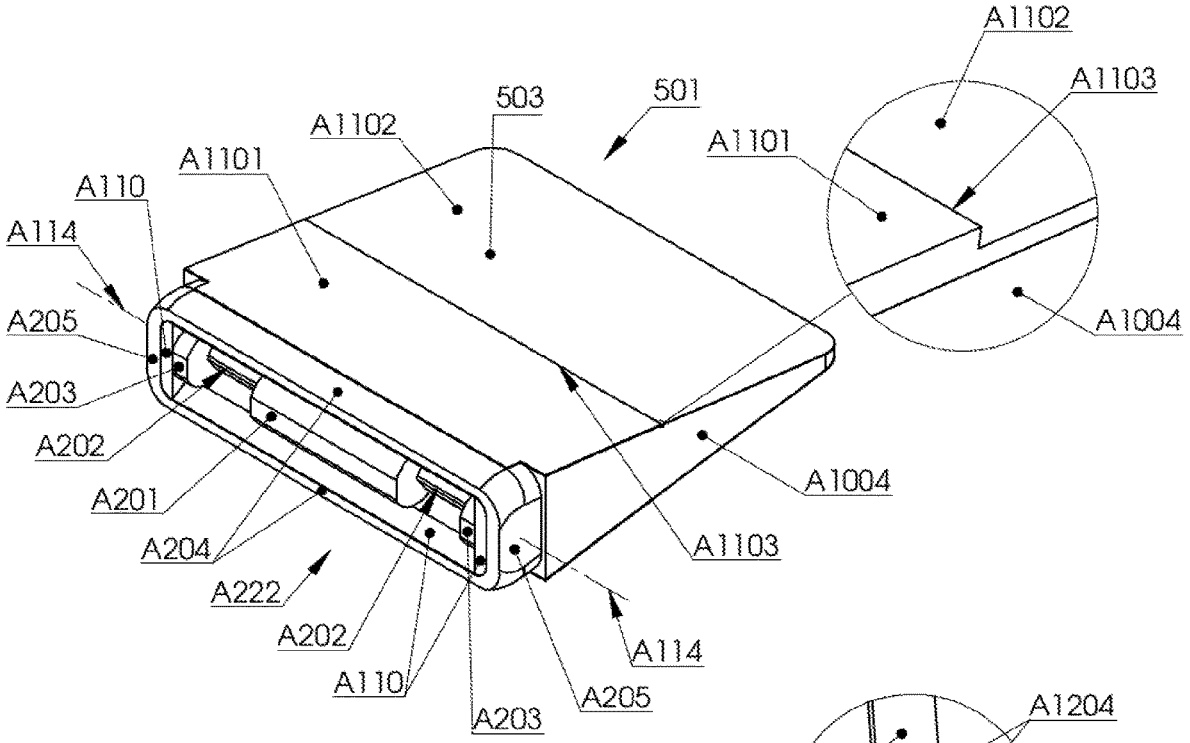
FIG. 20E is a 3D isometric view of a lattice diaphragm incorporating another form of normal stress reinforcement including stepped plates.

FIG. 20E shows another variation similar to the foil variation of FIG. 20B, except that the normal stress reinforcement at each major side comprises a reduced thickness at a region A1102 of the normal stress reinforcement (or of the associated major side) that is distal from the base region A222 of the diaphragm structure, relative to the thickness at a region proximal to the base of the diaphragm structure. The change in thickness reduces at step A1103. The thickness may be stepped or alternatively tapered/gradual. In this variation, the region of the diaphragm of reduced thickness A1102 at each major side is that most proximal to the tip/edge region of the major side that is most distal from the base region A222 of the diaphragm structure.

Figure 20F:
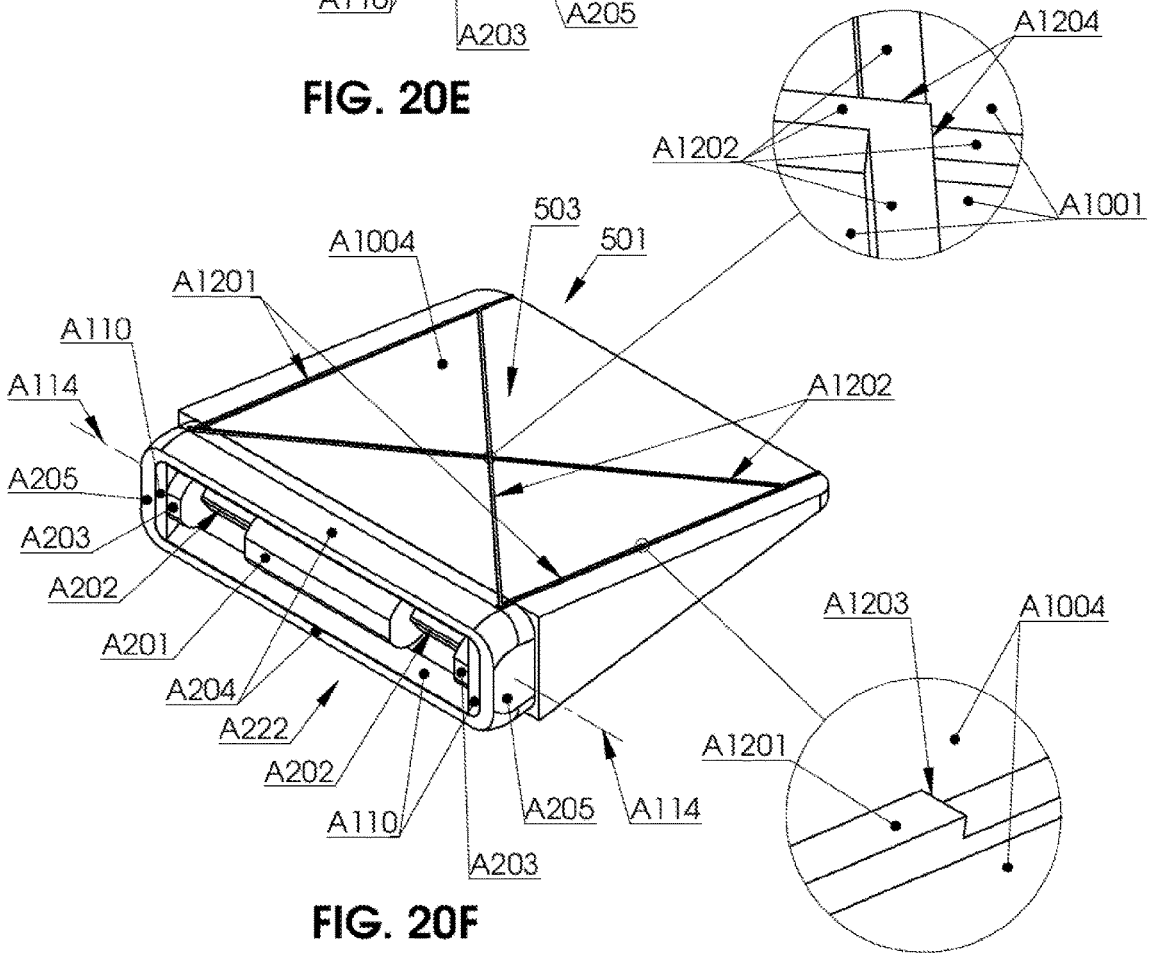
FIG. 20F is a 3D isometric view of a lattice diaphragm incorporating another of normal stress reinforcement including another form of struts.
Figures 21A, 21B, 21C:
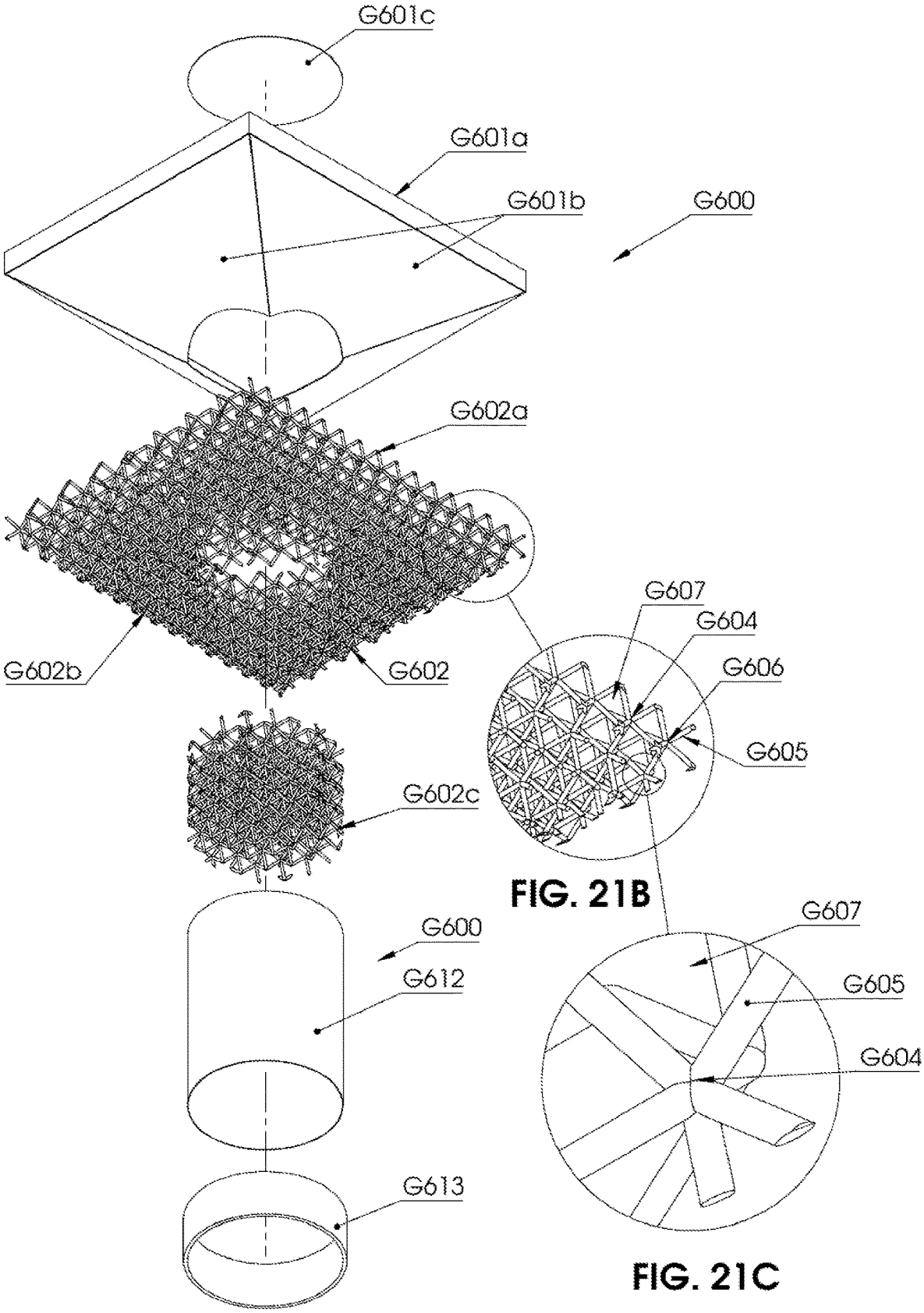
FIG. 21A shows an exploded isometric view of a further lattice diaphragm embodiment of the invention.
FIG. 21B shows a close up view of a section of the lattice of the diaphragm of FIG. 21A.
FIG. 21C shows a further close up of a node unit within the section of lattice of FIG. 21B
Figure 21D:
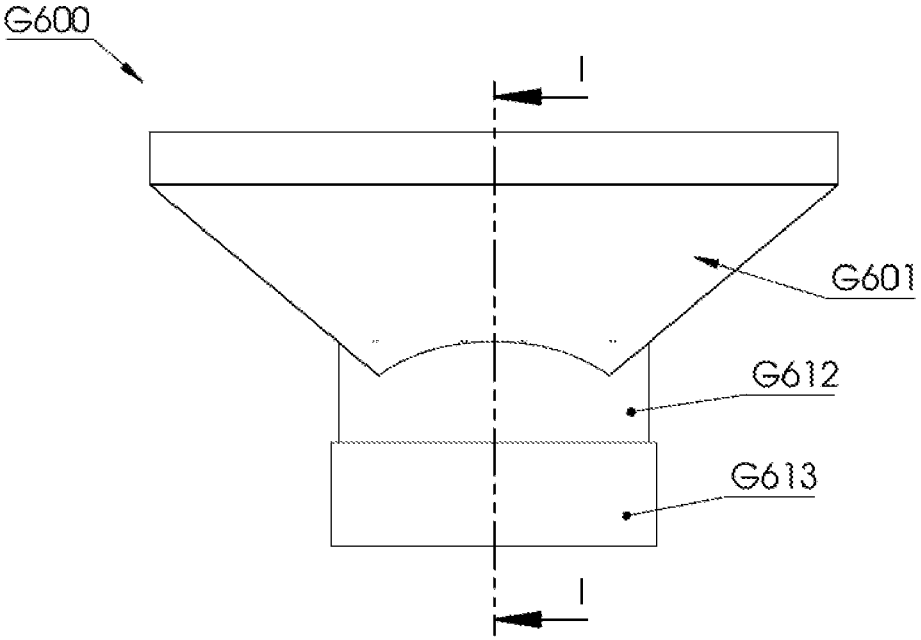
FIG. 21D shows a side view of the assembled diaphragm of FIG. 21A
Figure 21E:
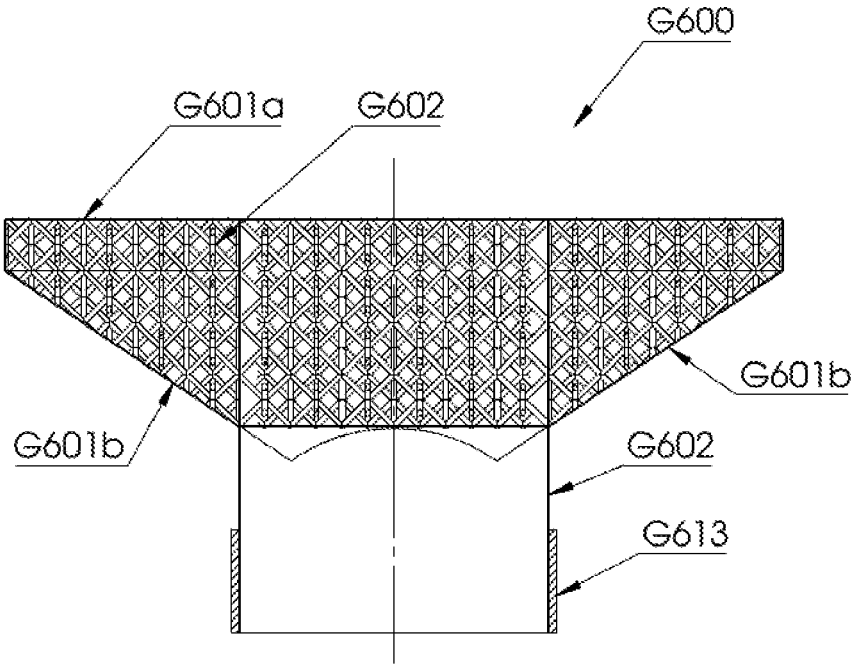
FIG. 21E shows a side cross-section of the assembled diaphragm of FIG. 21A.
Figure 22A:
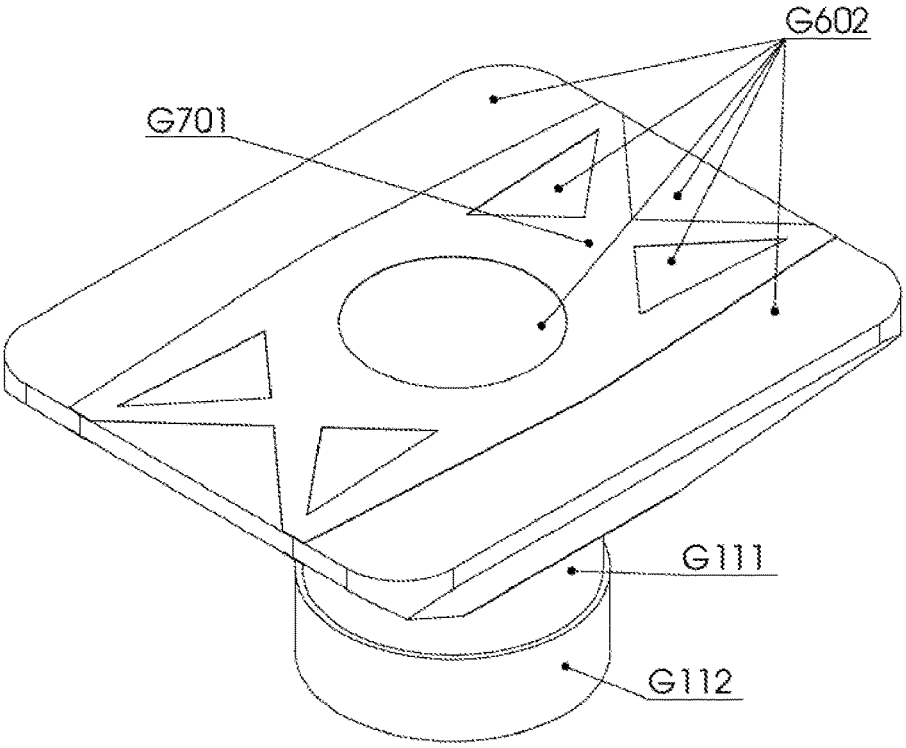
FIGS. 22A and 22B show top and bottom isometric views of a first normal stress reinforcement variation for the diaphragm of FIG. 21A.
Figure 22B:
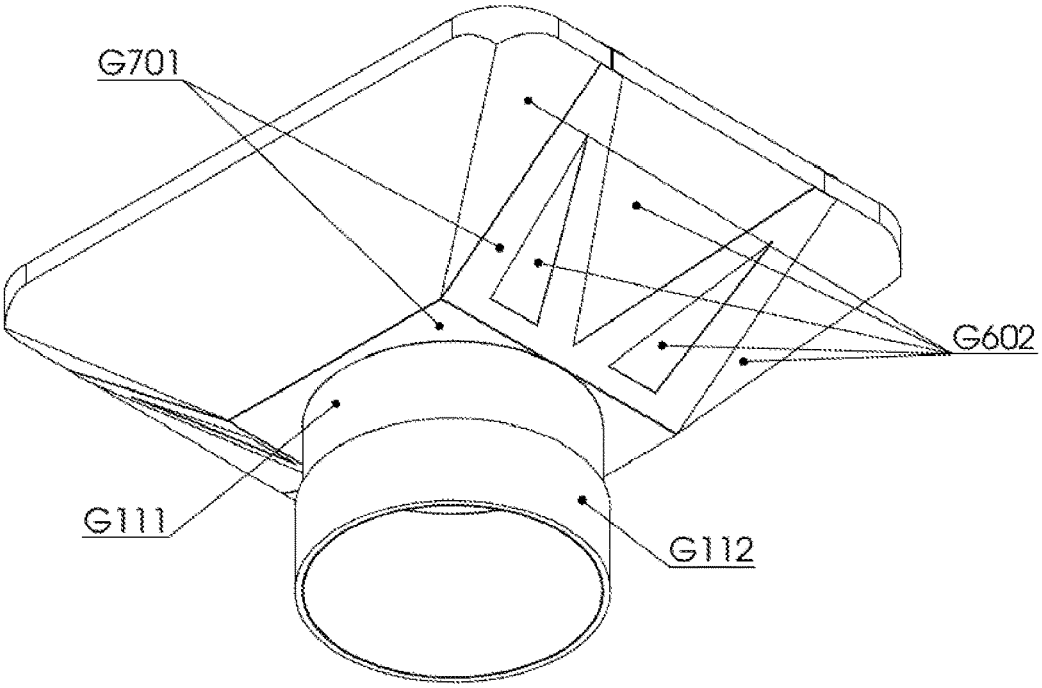
Figure 22C:
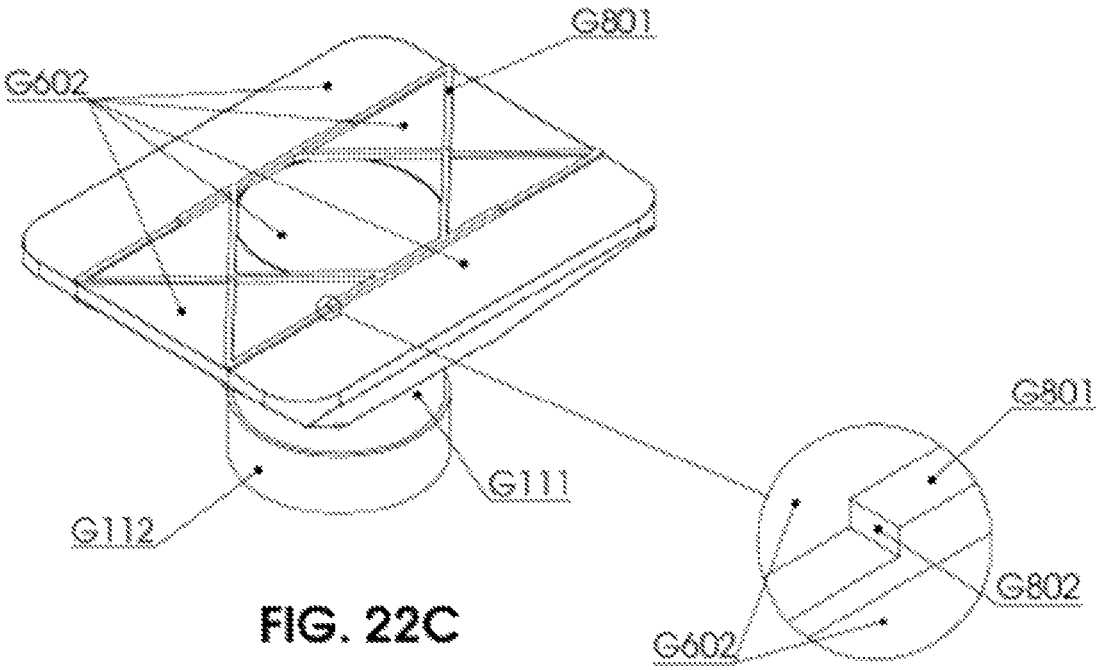
FIGS. 22C and 22D show top and bottom isometric views of a second normal stress reinforcement variation for the diaphragm of FIG. 21A.
Figure 22D:
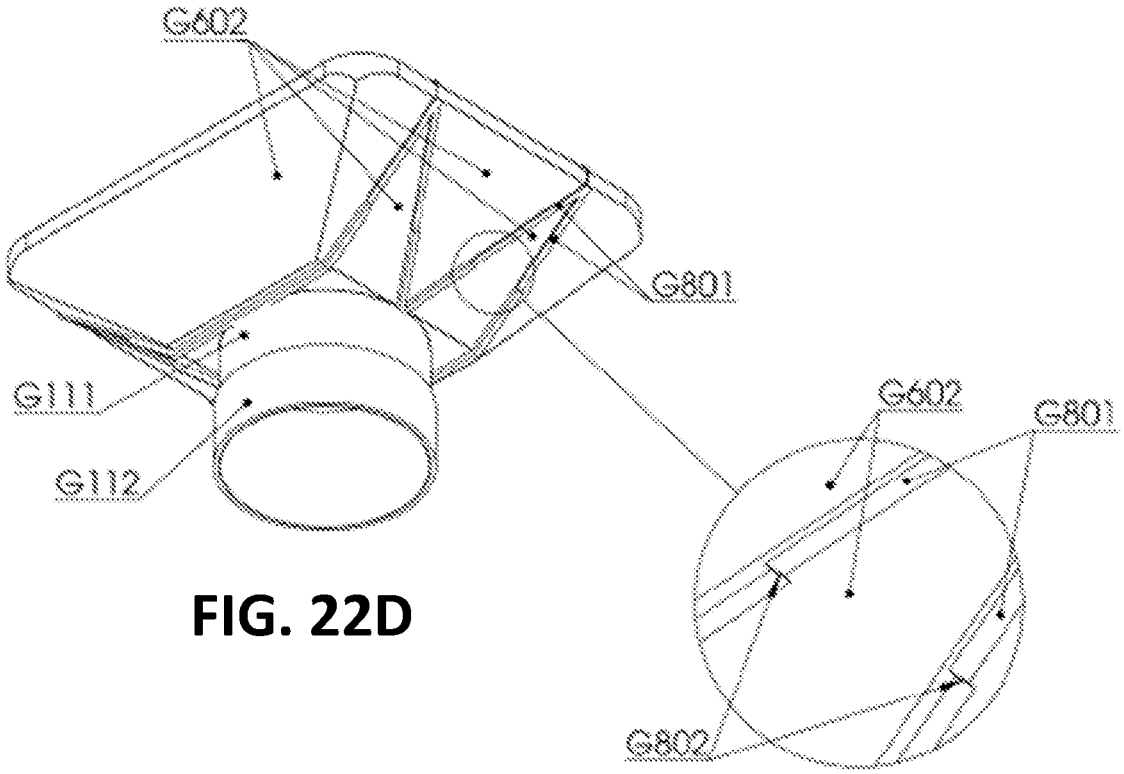
Figure 23A:
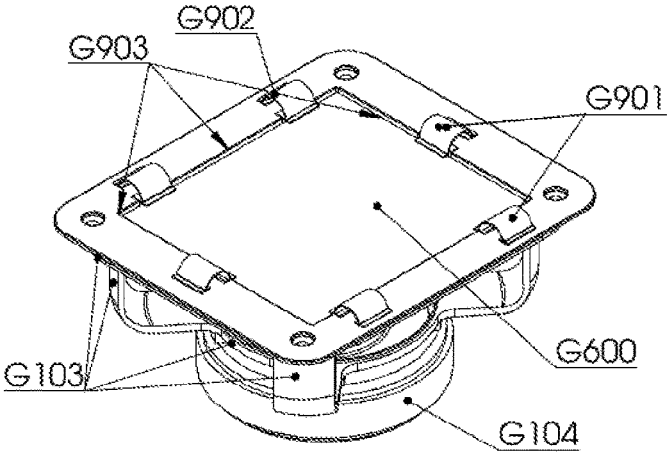
Figure 23B:
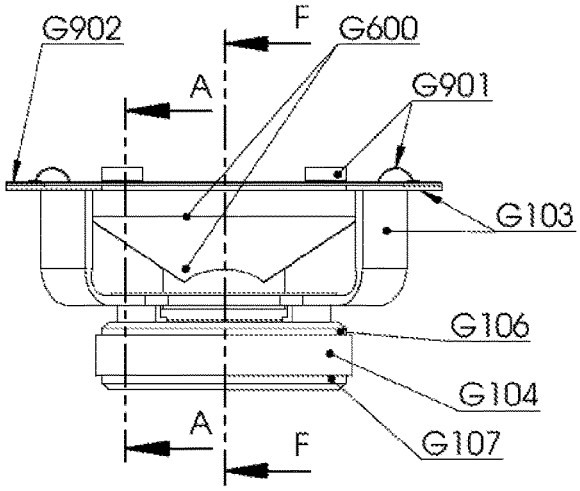
Figure 23C:
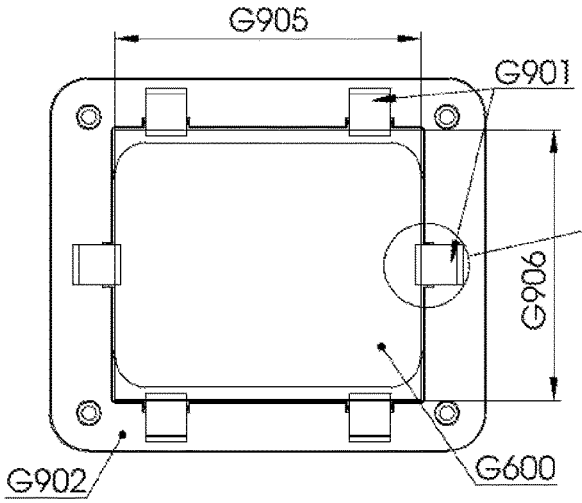
Figure 23D:
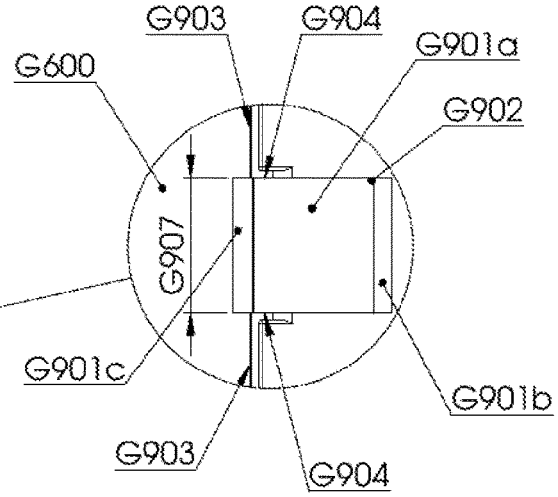
Figure 23F:
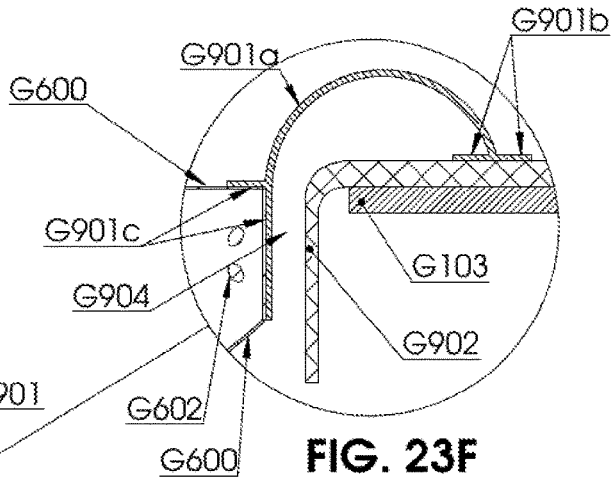
Figure 23E:
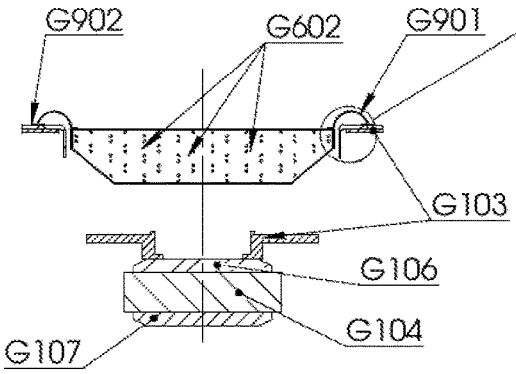
Figure 23H:
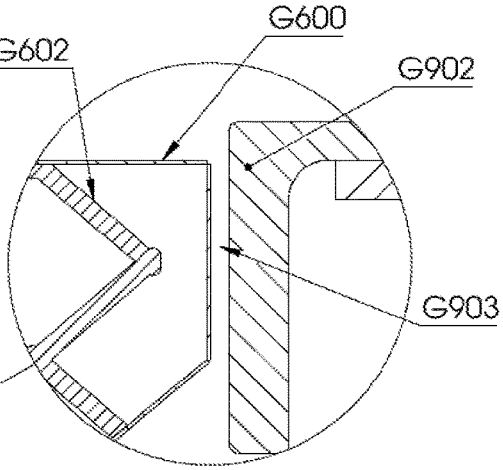
Figure 23G:
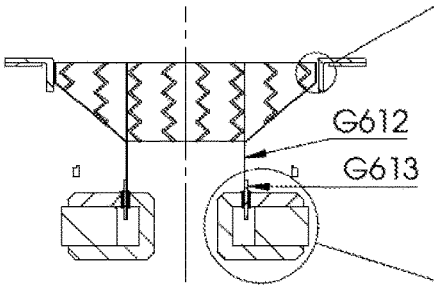
Figure 23I:
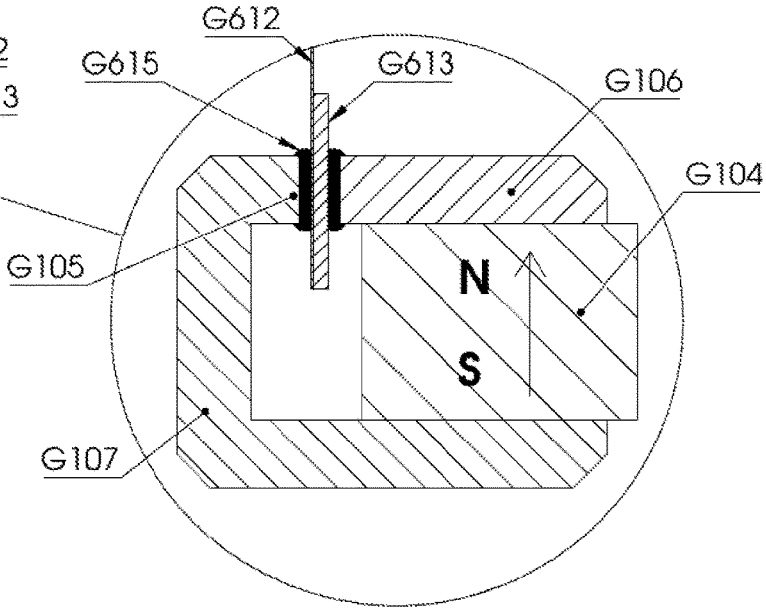
Figure 23J:
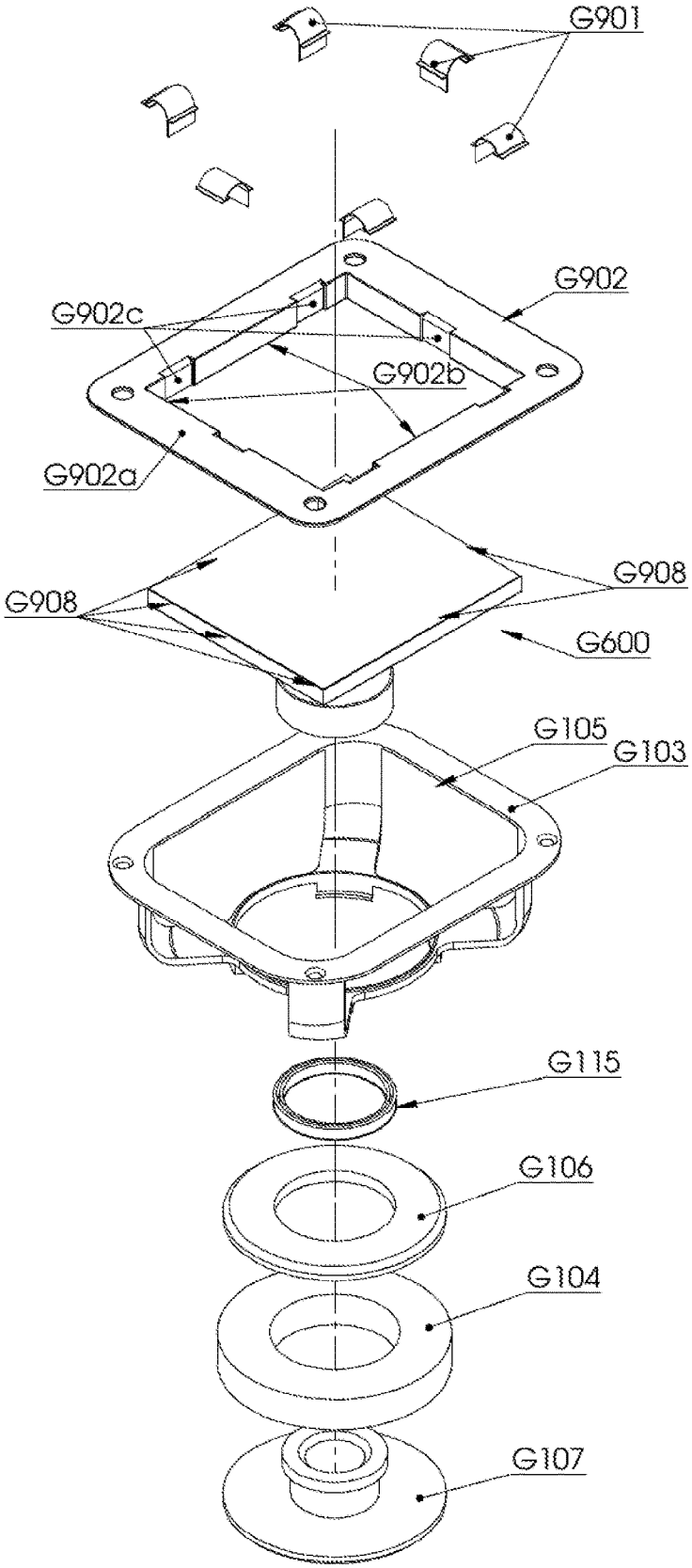

Another variation is shown in FIG. 20F. This variation is similar to the example described above with reference to FIG. 20A, in that a series of struts A1201 and A1202 are used to form the normal stress reinforcement on each major side of the diaphragm. In this embodiment, the struts A1202 extend longitudinally adjacent, but slightly spaced from the opposing sides of the diaphragm body of each major side, and the struts A1202 extend diagonally across each major side to form a single cross brace that extends to the ends of the opposing side struts A1202. The struts A1201 comprise a reduced thickness along a section of their length that is distal from the base region of the diaphragm (e.g. region configured to couple an excitation mechanism). The variation in thickness is stepped A1203, but alternatively it may be tapered/gradual. In alternative embodiments however, each strut A1202 may comprise a reduced width or a reduced mass, or may have a uniform thickness, width and/or mass along an entire portion of its length.

The above described diaphragm 500 may be utilised in any type of audio transducer assembly. For example, it may be implemented in any one of the audio transducers described in PCT patent application PCT/IB2016/055472 which is hereby incorporated by reference.

3.3 Audio Transducers Incorporating Lattice Diaphragm

An exemplary audio transducer embodiment incorporating a diaphragm K101 that is the same or similar to the above described diaphragm 500 will now be described in detail with reference to FIGS. 16A-O, 17, 18A-H and 19.

Figure 16B:
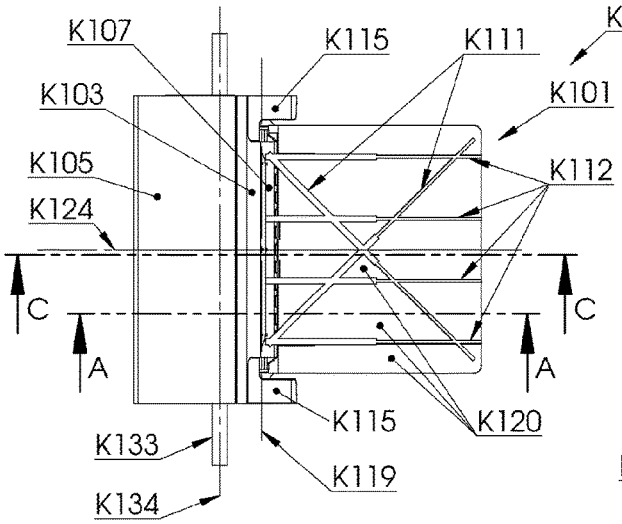
FIG. 16B being a plan view of the driver.
Figure 16A:
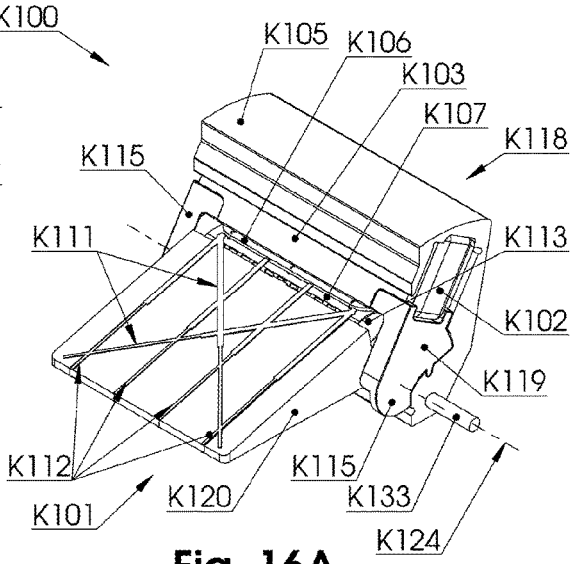
Figure 16C:
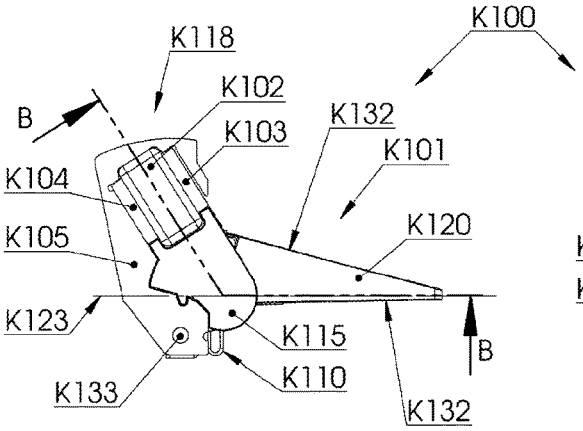
FIG. 16C being a side elevation view of the driver.
Figure 16D:
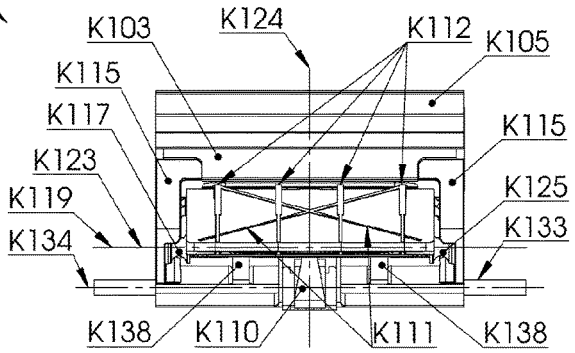
FIG. 16D being a front (tip of diaphragm) elevation view of the driver.
Figure 16E:
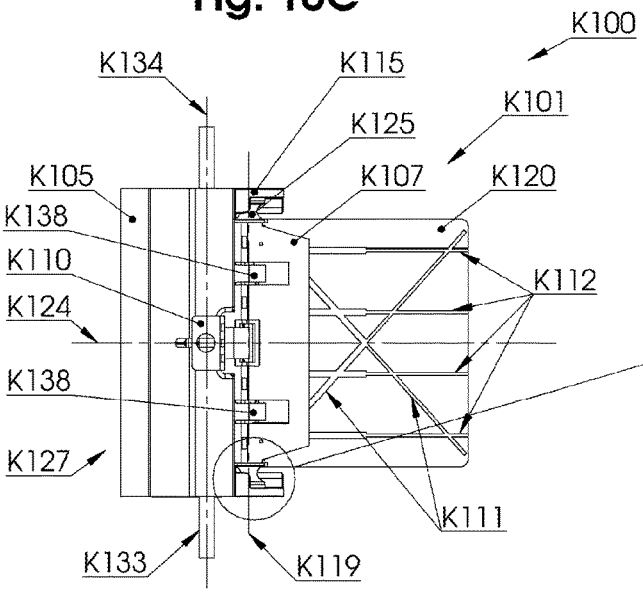
FIG. 16E being a bottom view of the driver.
Figure 16F:
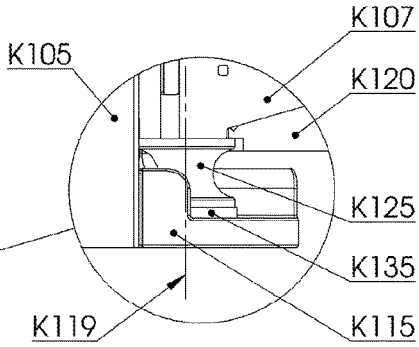
FIG. 16F detail view of a side member shown in FIG. 16E.
Figures 16G, 16H, 16I:
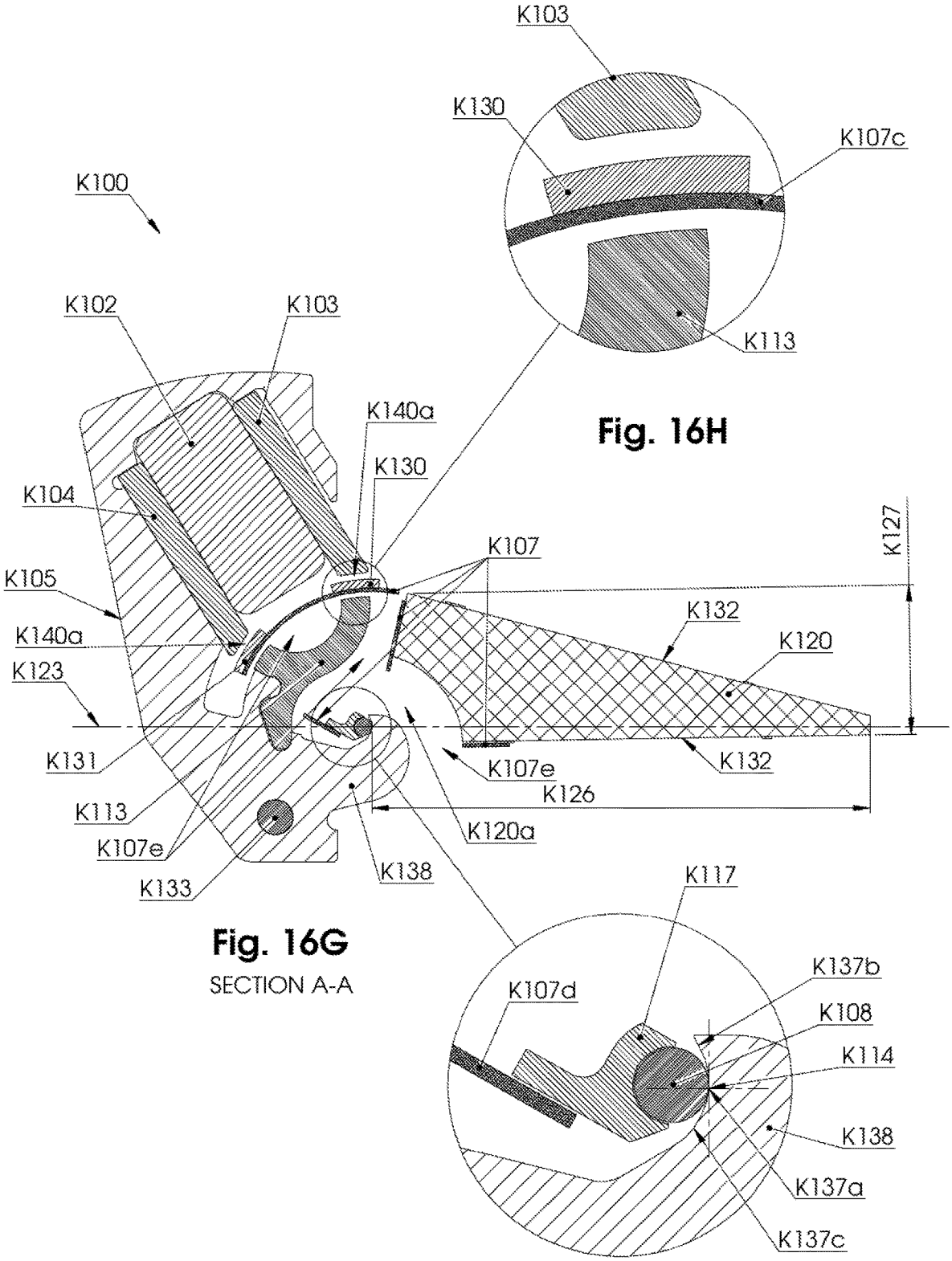
FIG. 16G being a cross-sectional view (section A-A of FIG. 16B)
FIG. 16H being a detail view of the magnetic flux gap shown in FIG. 16G, FIG. 16I being a detail view of the hinging joint shown in FIG. 16G, FIG. 16J being a cross-sectional view (section B-B of FIG. 16K), FIG. 16K being a detail view of the side member shown in FIG. 16J, FIG. 16L being a cross-sectional view (section C-C of FIG. 16B), FIG. 16M being a detail view of the biasing spring shown in FIG. 16L, FIG. 16N being an exploded 3D isometric view of the embodiment K driver, FIG. 16O being a detail view of the diaphragm base frame shown in FIG. 16N.
Figure 16J:
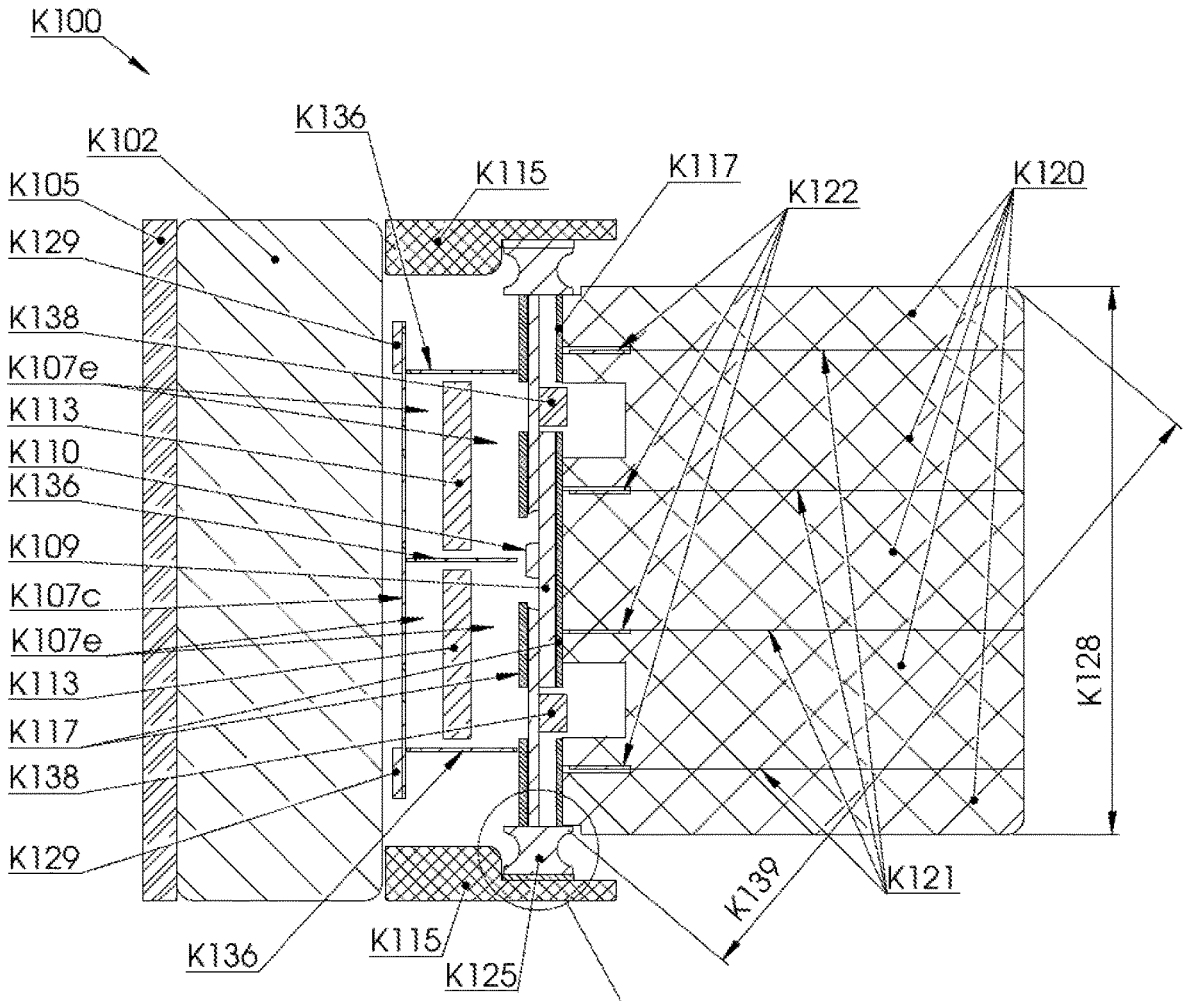
Figure 16K:
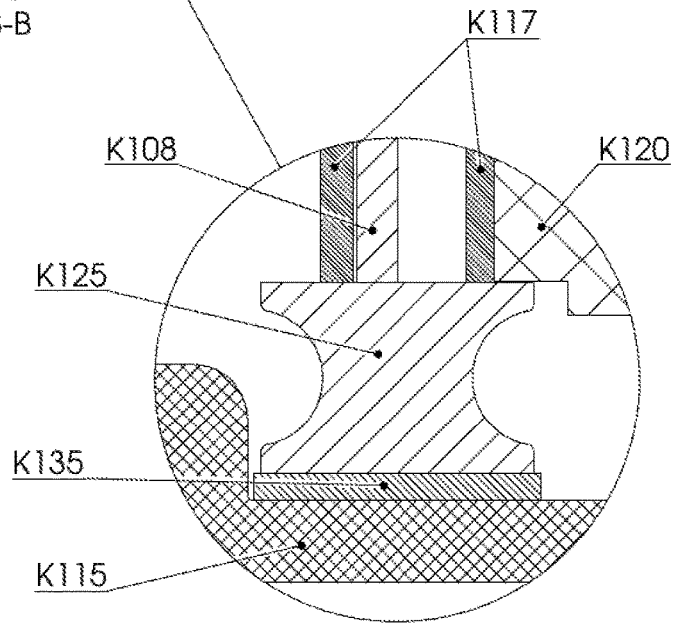
Figure 16L:
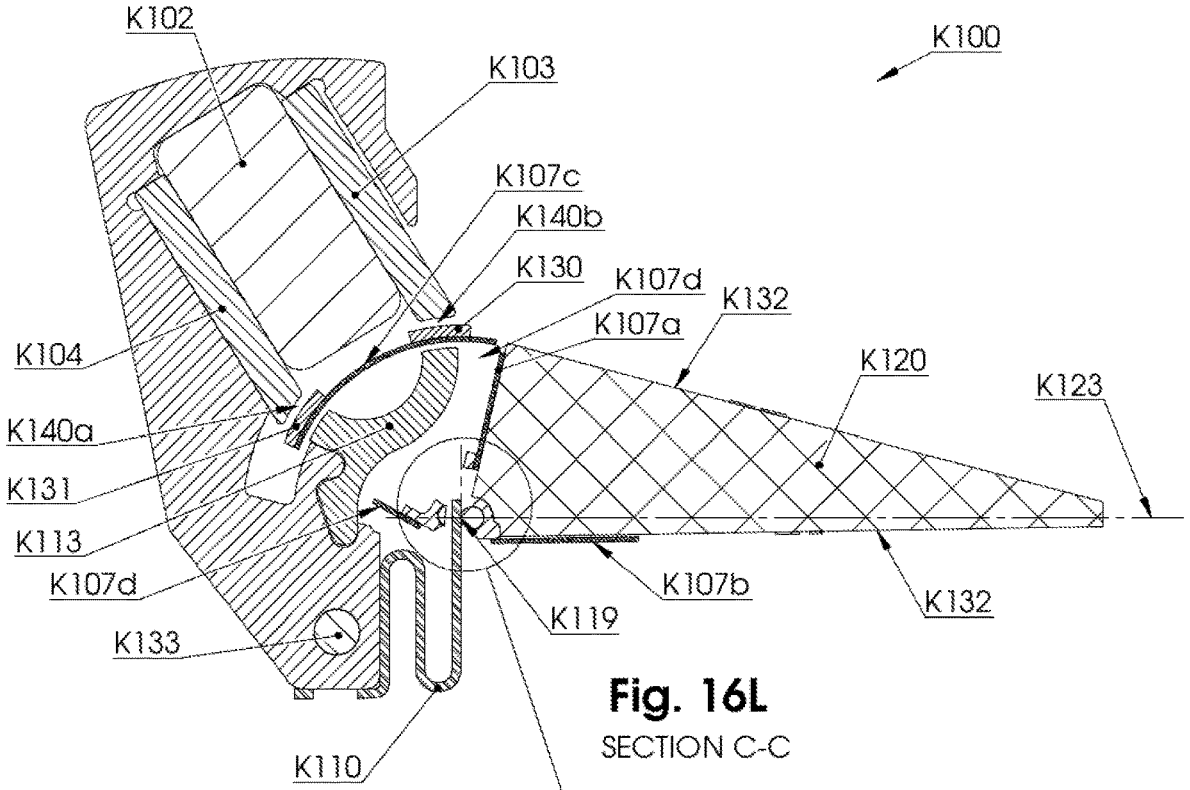
Figure 16M:
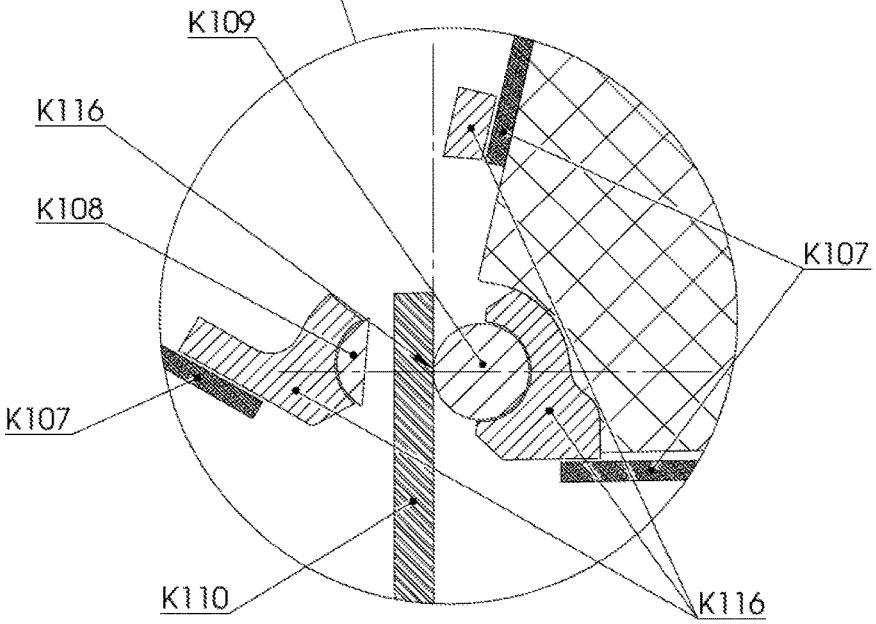
Figure 16N:
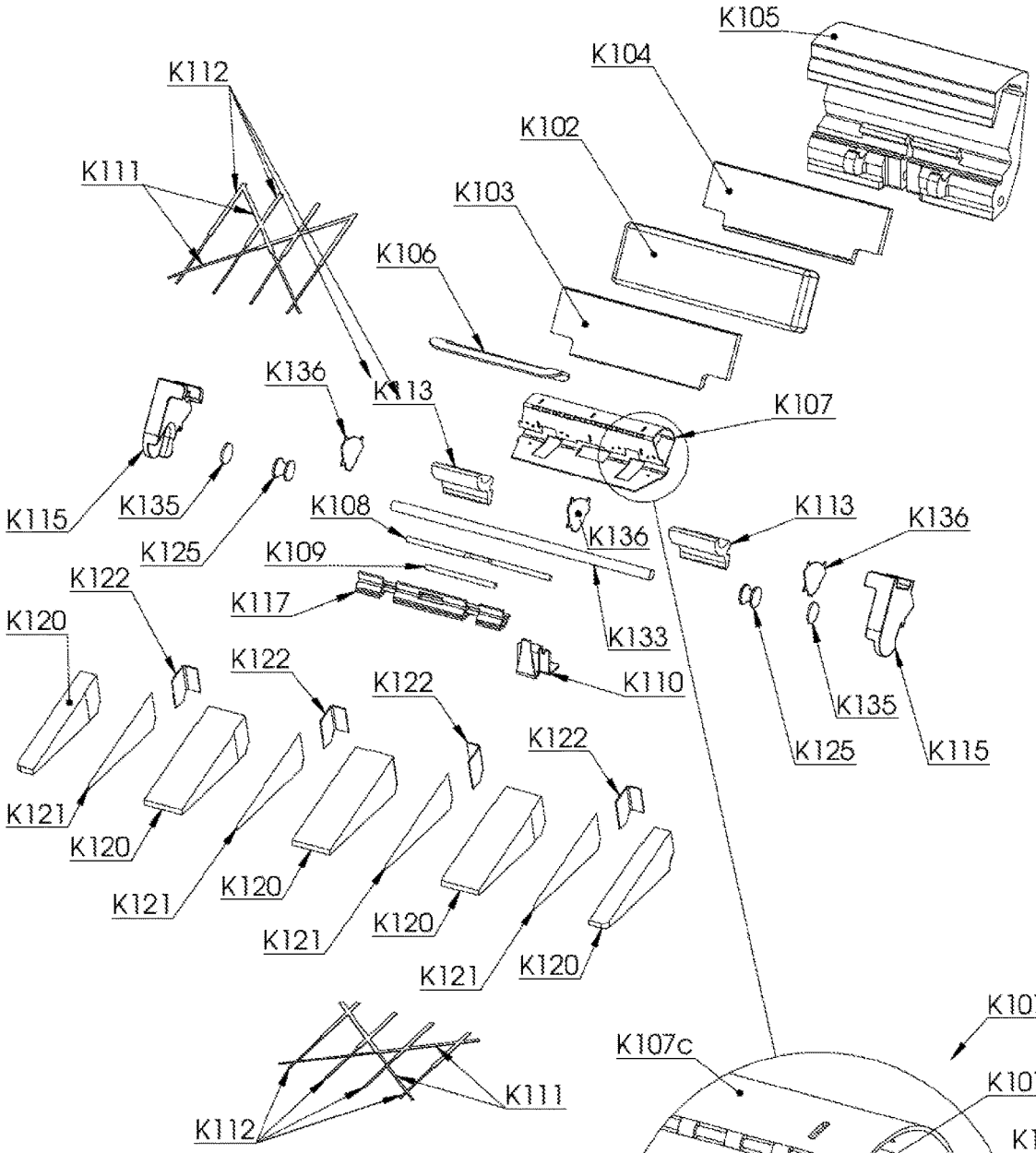
Figure 16O:
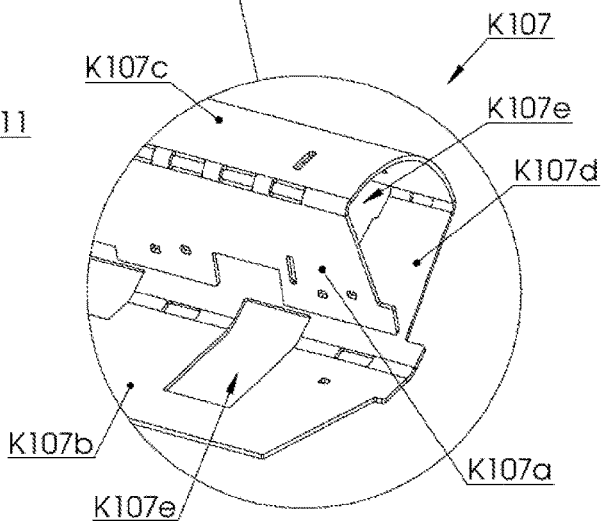
Figure 17:
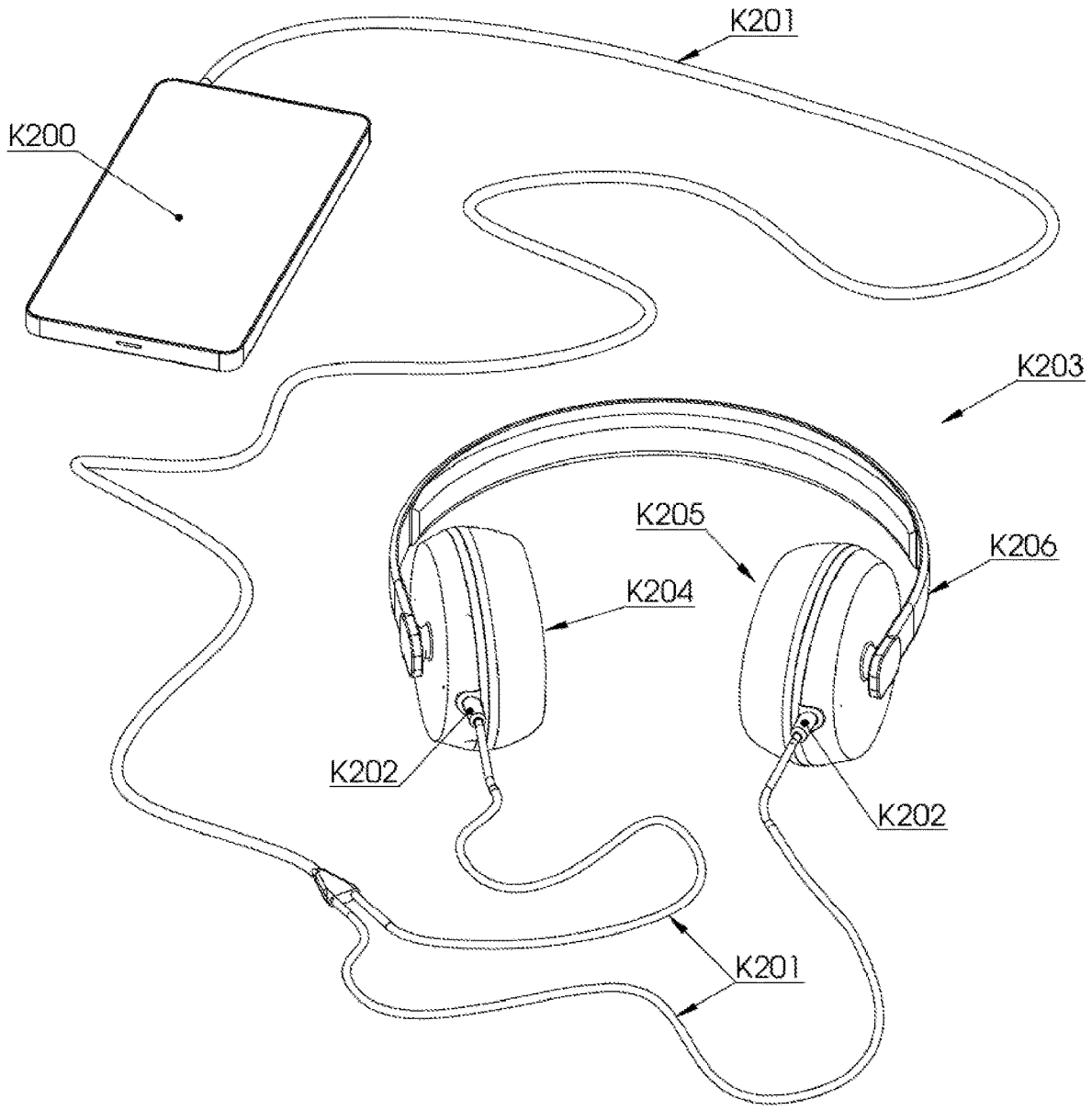
FIG. 17 shows a 3D isometric view, of an audio system comprising a smartphone connected to a pair of closed circumaural headphones, which uses the hinge-action loudspeaker driver of FIGS. 16A-O.

Referring to FIG. 16A-O, in this embodiment, the audio transducer is a rotational action transducer comprising a diaphragm K101 formed from a lattice core (as described above) that is rotatably coupled to a transducer base structure K118 via a hinge system configured to rotate the diaphragm about an associated axis of rotation K119 during operation. The transducer further comprises an excitation mechanism, such as an electromagnetic mechanism for transducing sound by imparting a substantially rotation motion on the diaphragm body in use. Parts of the excitation/transducing mechanism of the audio transducer that are connected to the associated diaphragm body are preferably connected rigidly.

In this embodiment, the diaphragm K101 has a geometry suitable for resisting acoustical breakup.

Diaphragm

The diaphragm K101 comprises a diaphragm body K120 formed from a three-dimensional lattice as described for diaphragm 500 in the preceding section. The diaphragm K101 may also comprise an outer membrane or any form of normal stress reinforcement on one or both major sides. The diaphragm body K120 also reduces in mass in regions distal from the centre of mass location (by tapering along its length to form a wedge shaped structure. Angular connection tabs K122 locate at a base end of the diaphragm body to enable the diaphragm base to rigidly connect to other components of the diaphragm K101. It will be appreciated that any form of diaphragm structure described in relation to diaphragm 500 may be employed in this audio transducer assembly.

The diaphragm K101 further comprises a diaphragm base frame K107 which rigidly connects to the base of the diaphragm body, to part of the hinge assembly and to the force transferring component of the excitation mechanism for moving the diaphragm in use. As shown in FIGS. 16L-16N the diaphragm base frame K107 comprises a first upright plate K107*a* and a second angled plate K107*b*, that are both substantially planar and angled relative to one another to correspond to the relative angle between one of the major sides K132 of the diaphragm body and the base face of the diaphragm body. These first and second plates are rigidly coupled to the diaphragm body at the base face and the aforementioned major side K132 respectively. The second angled plate K107*b* configured to couple the major side K132 also comprises a pair of spaced apertures K107*e* (as shown in FIGS. 16G, 16M and 16N) that are configured to align with the contact members K138 extending form the base block K105 of the transducer base structure and also with the recesses K120*a* formed at the base end of the diaphragm body. In this manner, in the assembled state of the audio transducer the contact members K138 extend through the corresponding apertures of the base frame K107 and also into the recesses K120*a* of the diaphragm body K120.

The diaphragm base frame K107 further comprises a third arcuate plate K107*c* extending from the first substantially upright plate K107*a* and connecting to a fourth angled and substantially planar plate K107*d* of the base frame that extends in a direction opposing the second plate K107*b*. The arcuate plate K107*c* is configured to couple a force transferring component such as the coils K130 in the assembled state. The coils K130 rigidly couple an outer face of the arcuate plate K107*c*. The arc of the plate is configured to correspond to the arc of a magnetic field gap K140*a* and K140*b* of the transducing mechanism formed by the transducer base structure. One or more arcuate plates K136 may be inserted within the diaphragm base frame cavity formed by the first, third and fourth plates of the frame K107. Preferably three plates are retained in this cavity, forming two inner cavities K107*e* within which the inner poles K113 of the transducing mechanism extend to operatively cooperate with the coils K130.

As shown in FIGS. 16L and 16M, in the assembled state the second K107*b* plate of the base frame K107 extends slightly past the associated major side of the diaphragm body K120. This provides an edge against which a longitudinal connector K117 rigidly connects. The connector K117 also rigidly connects a corresponding face of the diaphragm body at the base end. The connector comprises recesses that align with the apertures K107*e* of the second plate K107*b* of the base frame K107. An opposing side of the connector (to that which is connected to the diaphragm body) comprises a substantially concavely curved surface (at least in cross-section) in a central region of the connector along its length. The concavely curved surface is configured to receive and accommodate a contact pin of a hinge system biasing mechanism (which is described in further detail below). Extending from the part of the connector that couples the second plate K107*b* of the base frame K107, is an angled part configured to rigidly couple the fourth plate K107*d* of the diaphragm base frame K107. In this manner the connector K117 is rigidly coupled along its length to the base frame K107. This part also comprises a substantially concavely curved surface (at least in cross section) that extends along a substantial portion of the length of the connector K117 and that is configured to contact against and fixedly couple a hinge element K108 of the hinge system (described in further detail below). The hinge element K108 comprises a substantially convexly curved surface (at least in cross section) at least in sections of the hinge element K108 that extend across the recesses of the connector to engage the contact blocks K138 of the hinge system as will be explained in further detail below.

In this manner, in an assembled state, the diaphragm base structure is rigidly coupled to the base frame K107 and to the connector K117. In turn the base frame is also rigidly and fixedly coupled to the coils K130 of the transducing mechanism. The connector K117 is fixedly coupled to the hinge element K108 and to the contact pin K109 of the hinge assembly. These components in combination form the diaphragm K101.

Referring to FIGS. 16F, 16J and 16K the base frame K107, hinge element K108 and connector K117 preferably extend across the entire width of the diaphragm body K120 across the base side of the structure. Either end of these components are preferably coupled to the transducer base structure side block K115 via a substantially resilient connection member K125 and spacer disc or washer K135. Each side block K115 may be substantially rigid, for example formed from a substantially rigid plastics material or the like. The connection member K125 and/or washer K135 rigidly coupled to an inner wall of an associated side block K115. This arrangement compliantly positions the diaphragm base frame assembly (including connector K117 and the hinge element K118) to base component K105 of the transducer base structure. This mechanism is contributing to the overall hinge assembly. The two connection members K125 provide a restoring force to the diaphragm that:

1) contributes to positioning the diaphragm into a neutral or rest position, and as such is a significant determining factor of the final transducer fundamental frequency Wn; and
2) contributes to positioning the hinge element K108 relative to the contact member K138, so that in the unusual case of a bump or knock or other exhibited external force, the parts will re-align into a neutral position where parts of the diaphragm do not contact and rub against the surrounding parts.

As such, this mechanism, as well as contributing to the overall hinging assembly, also acts as a diaphragm restoring mechanism.

Hinge System

Referring to FIGS. 16G-16J, the hinge system of this embodiment is a contact hinge system. The hinge system comprises a hinge assembly having a pair of hinge joints on either side of the assembly. Each hinge joint comprises a contact member that provides a contact surface and a hinge element configured to abut and roll against the contact surface. Each hinge joint is configured to allow the hinge element to move relative to the contact member, while maintaining a consistent physical contact with the contact surface, and the hinge element is biased towards the contact surface.

A hinge element, in the form of a hinge shaft K108 is rigidly coupled on one side via a connector K117 to the diaphragm base frame K107. On an opposing side, the hinge shaft K108 is rollably or pivotally coupled to a contact members K138. As shown in FIG. 16I, in this embodiment, each contact member comprises a concavely curved contact surface K137 to enable the free side of the shaft K108 to roll thereagainst. The concave K137 surface comprises a larger curvature radius than that of shaft K108. Each contact member K138 is a base block of the transducer base structure assembly K118 base component K105 that extends laterally from the base structure assembly toward the diaphragm assembly. A pair of base blocks K138 extend from either side of the base component K105 to rollably or pivotally couple with either end of the shaft K108 thereby forming two separated hinge joints. The base blocks may extend into a corresponding recess formed at the base end of the diaphragm structure. The contact hinge joints are preferably closely associate with both the diaphragm structure and the transducer base structure.

Referring to FIGS. 16L and 16M, the hinge shaft K108 is resiliently and/or compliantly held in place against the contact surfaces K137 of the base blocks K138 by a biasing mechanism of the hinge system. The biasing mechanism includes a substantially resilient member K110 in the form of a compression spring, and a contact pin K109. The spring K110 is rigidly coupled to the base structure K105 at one end and engages the contact pin K109 at the opposing end at a contact location K116. The resilient contact spring K110 is biased toward the contact pin K109 and is held at least slightly in compression in situ. In situ, the contact pin K109 is rigidly coupled to the diaphragm base frame K107 via a connector K117 and extends between the contact members K138 fixedly against a corresponding concavely curved surface of the connector K117. The contact pin K109 and corresponding biasing spring K110 are preferably located centrally between the hinge joints. This arrangement compliantly pulls the diaphragm base structure, including the base frame K107, the connector K117 and the hinge shaft K108 against the contact base blocks K138 of the hinge joints. In this manner, the shaft K108 contacts the curved surfaces K137 of base blocks K138 at two contact locations.

The geometry of the hinge system is designed with the approximate rotational axis K119 (shown in FIG. 16B) of the transducer coinciding with the two locations of contact K137 between the diaphragm assembly K101 and the transducer base structure K118, and preferably also at the location of contact between the contact pin K109 and the contact spring K110. This configuration helps to minimise the restoring force generated by these components, and so helps reduce the fundamental resonance Wn of the transducer.

In some forms one of the hinge element or the contact member comprises a contact surface having one or more raised portions or projections configured to prevent the other of the hinge element or contact member from moving beyond the raised portion or projection when an external force is exhibited or applied to the audio transducer.

Depending upon the application it may also be useful to provide stoppers that prevent impacts to potentially fragile components such as the motor coil. These may be independent from stoppers acting on the contact surfaces.

In this embodiment the hinge element K108, comprises at least in part, a convex cross-sectional profile, when viewed in a plane perpendicular to the axis of rotation, such as in FIG. 16I, and a contact member K138, being base block protrusion of base component K105K, comprising a contact surface K137 that is substantially concave. This configuration contributes to the re-centring of the hinge mechanism in situations where the hinge element is forced to move away from the central, neutral region K137*a* of the contact surface. The concavely raised edge regions K137*b* or K137*c* of the contact surface that locate on either side of the central region, will cause the associated hinge element K108 to re-centralize back towards the central region K137*a* in the event that the element is forced to move beyond its intended position. This feature is advantageous in the case of a minor impact, such as when a transducer is knocked or dropped and the contact points K114 slip, as the geometry described would prevent excess slippage that may potentially cause contact resulting in audible rattling distortion during operation of the device.

Further refinements to this structure are preferable whereby during normal operation there are no locations where the convex surface of the hinge element K108, can contact the concave surface K137 in a place where the convex radius is larger than the concave radius, when viewed in cross-sectional profile in a plane perpendicular to the axis of rotation. This configuration substantially prevents an impact between surfaces that could, conceivably, repeat without causing centring, thereby generating an ongoing rattle distortion. Instead, centring can only be caused by a gradient at the contacting surfaces, which means that any distortion created by sliding on the gradient is necessarily associated with a correction in the centring location, thereby reducing the chance of any ongoing distortion.

Preferably the diaphragm K101 is rigidly attached to the force transferring component K106, as opposed to if it is compliantly attached, or if it is attached via another component particularly if the geometry of the other component is slender. The force transferring component is preferably of a type that remains substantially rigid in-use, since this helps to minimize resonance.

Electrodynamic type motors are preferred due to their highly linear behaviour over a wide range of diaphragm excursion. The excitation mechanism may comprise a force transferring component in the form of an electrically conducting component, preferably a coil K106, which receives an electrical current representing an audio signal. Preferably the electrically conducting component is located in a magnetic field, which preferably is provided by a permanent magnet.

In this embodiment, the transducer base structure K118 comprises a substantially thick and squat geometry and includes the magnetic assembly of the electromagnetic excitation mechanism. The base structure comprises a base component K105, a permanent magnet K102, outer pole pieces K103 and K104 coupled to the magnet K102 spaced from opposing inner pole pieces K113 located within the cavity of the diaphragm base frame K107 of the diaphragm. The opposing outer and inner pole pieces have opposing surfaces that create a substantially curved or arcuate channel therebetween. An arcuate plate of the diaphragm base frame comprises a surface that corresponds in shape to this arcuate magnetic field channel. One or more coil windings K106 is/are coupled to the diaphragm base frame arcuate plate and extend within the channel in situ. Preferably, in a neutral position the coils are aligned with the location of the corresponding inner and outer poles to enhance cooperation between these components. During operation, each coil winding K106 and part of the base frame K107 reciprocate within this channel, as the remainder of the diaphragm oscillates and pivots about the axis of rotation K119.

Housing

The audio transducer of this embodiment may be implemented in a personal audio device, such as a headphone cup or alternatively in any other personal audio device or any other desired loudspeaker or microphone application. The invention is not intended to be limited to the application described below.

Referring to FIGS. 18A-18H, in this embodiment the audio transducer is shown housed within a surround K301. The surround K301 is enclosed by an outer cap K302. These two parts form the housing K204 for the transducer. The housing may be a headphone cup of a headphone device for example. The surround and outer cap may be fixedly and rigidly coupled to one another via any suitable method, for example via a snap-fit engagement, adhesive or fasteners K316. The surround K301 includes an inner cap K303 that extends proximal to and over part of the audio transducer to help provide mounting and decoupling of the transducer from the surround K301 (and housing K204). The inner cap K303 may be integrally formed with the surround K301 or otherwise separately formed and fixedly and rigidly coupled to the surround K301 via any suitable method, for example via a snap-fit engagement, adhesive or fasteners K317. The surround comprises a cavity for retaining the transducer therein and is open at both sides of the cavity. On one side, the opening forms an output aperture K325 through which sound propagates from the transducer assembly during operation. Referring to FIG. 19, the output aperture is configured to locate at or adjacent a user's ear K410 when the device is in use. A soft ear pad K309 extends about the periphery of the surround K301 on an opposing side to the outer cap K302 and about the output aperture K325. The soft ear pad K309 comprises a compliant inner K310 that may be formed from any suitable material well known in the art such as a foam material that is comfortable to the user. The inner K310 may be lined with a non-breathable fabric outer layer K311 and also a breathable fabric or mesh inner layer K312. Also, an open meshed fabric K318 may extend over the output aperture K325.

In this embodiment the audio device is configured to apply pressure to the human head K408 and to substantially seal at locations K409 situated beyond the outer part of the ear K410, as is typical for a circumaural headphone. It may also apply pressure to one or more other parts of the head K408 and to the ear K410. Other pad configurations such as but not limited to a supraaural configuration are also possible. The soft ear pad K309 preferably generates a substantial seal about the user's ear to thereby substantially seal a volume of air inside the device from a volume of air K414 external to the device in situ. The ear pad K309 is configured to provide a sufficient seal between a volume of air within a front cavity K406 inside the device, located at or adjacent the user's ear K410 in use, and a volume of air external to the device K414 (such as the surrounding atmosphere). The geometry and/or material used for the pad inner K310 and outer fabric K311 may affect the sufficiency of the seal K409 for example.

A substantial seal is one that is configured to enhance the sound pressure at, at least low bass frequencies (i.e. provide a bass boost) during operation for example. For example, the ear pad may be configured to substantially seal against the user's ear/head in situ to increase sound pressure generated inside the ear (at, at least low bass frequencies) during operation. In some implementation, sound pressure, for example, may increase by an average of at least 2 dB, or more preferably at least 4 dB, or most preferably at least 6 dB, relative to sound pressure generated when the audio device is not creating a sufficient seal in situ. The volume of air enclosed within front cavity K406 may be substantially small to also aid with providing a bass boost during operation.

As mentioned, the device of this embodiment provides a bass boost by substantial sealing of air around the ear from air surrounding the device. In some variations, the ear pad K309 consists of a porous and compressible inner K310 made from a material such as a foam, for example an open-cell foam such as low-resilience polyurethane foam or polyether foam, which is covered by an outer fabric K311 that is substantially non-porous and is located at an exterior periphery of the pad K301 (e.g. facing outward and parts of which are configured to contact the user's head/ears in use). Internal parts of the ear pad K309 that face the interior of the device are either left uncovered or else are covered in an inner fabric K312 that is porous, such that sound waves surrounding the ear are able to propagate inside the porous foam, where their energy may be dissipated to help control internal air resonances.

This also means that air cavity K406 is connected to and thereby extended to comprise the volume of the porous ear pad inner K310. This may result in further benefits including an improvement in passive attenuation of ambient noise, because sound pressure that moves from the surrounding air K414 to air cavity K406, for example via leaks between ear pad K309 and a wearer's head K408 or else via air passages K320, 321, 322 and 324, will take longer to fill a larger air volume K406 that is connected to volume K310.

This variation addresses unwanted mechanical resonances of the transducer, especially of the diaphragm and surround, and provides improved diaphragm excursion and fundamental diaphragm resonance frequency, while simultaneously addressing internal air resonances via damping. Internal air resonances may be addressed in the front cavity K406, the rear cavity K405, and any other cavity contained within or by the device and/or the user's head.

Preferably, the compliant interface/ear pad K309 comprises a permeable fabric K318 covering the output aperture K325. Breathable cotton velour or polyester mesh are examples of suitable materials.

The outer cap K302 is preferably pivotally coupled to a respective end of the headband K206. For example, the outer cap K302 may comprise a pivot screw K308 that is rotatably coupled to a pivot nut K401 of the respective end of the headband K206. This enables the headband position to be adjusted by the user for comfort. Any suitable hinging mechanism may be used. Alternatively, the headband may be fixedly coupled to the headband.

Mounting System

In this embodiment, the audio transducer is mounted within the surround K301 via a mounting system that is configured to alleviate transmission of mechanical vibration between components, so as to "decouple" the components. The suspension system is thus herein referred to as a decoupling mounting system. The decoupling mounting system is configured to compliantly mount the audio transducer base structure K118 to the surround K301 such that the components are capable of moving relative to one another along at least one translational axis, but preferably along three orthogonal translational axes during operation of the associated transducer. Alternatively, but more preferably in addition to this relative translational movement, the decoupling system compliantly mounts the two components such that they are capable of pivoting relative to one another about at least one rotational axis, but preferably about three orthogonal rotational axes during operation of the associated transducer. In this manner, the decoupling mounting system at least partially alleviates mechanical transmission of vibration between the diaphragm and the surround K301, the inner cap K303 and the outer cap K302.

Figure 18A:
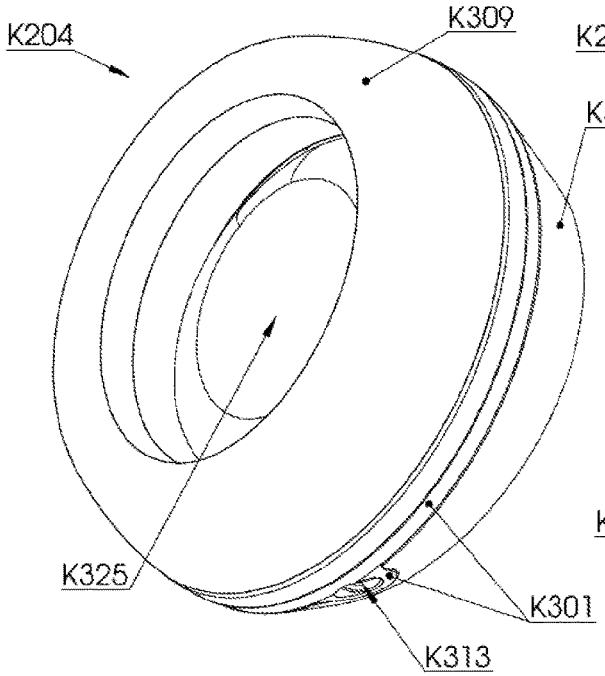
Figure 18B:
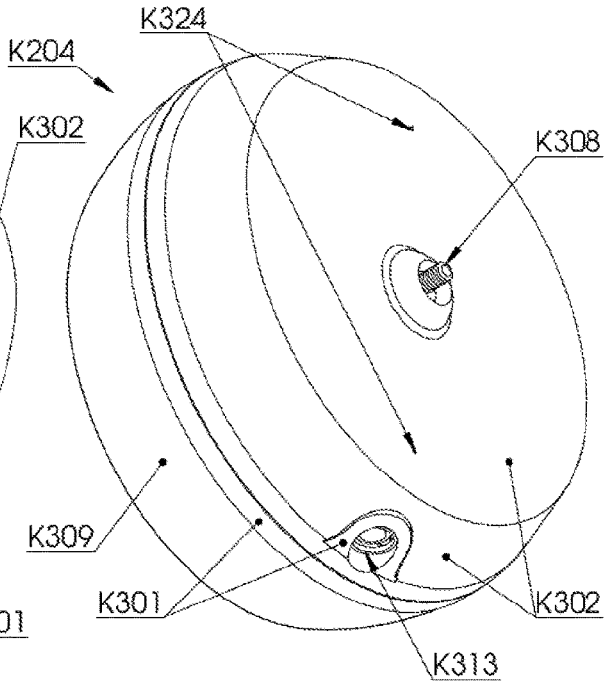
Figure 18C:
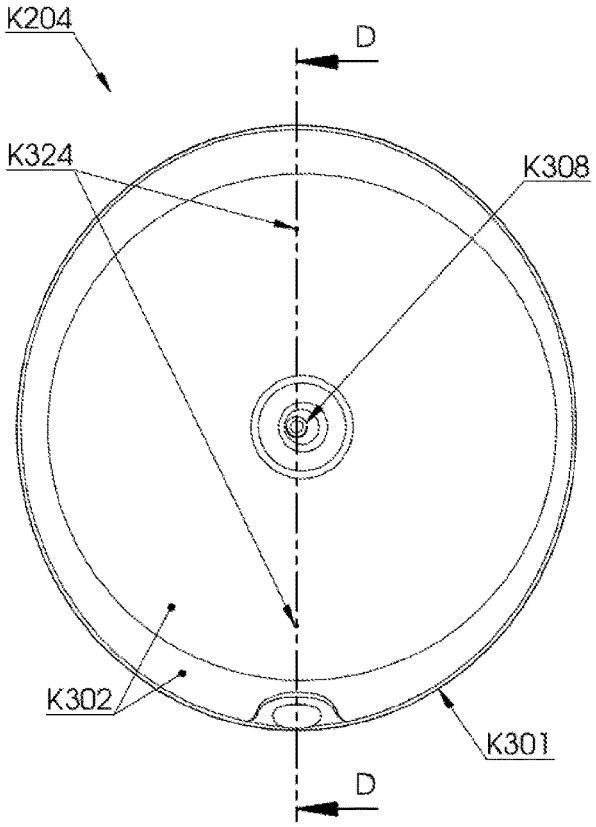
Figure 18D:
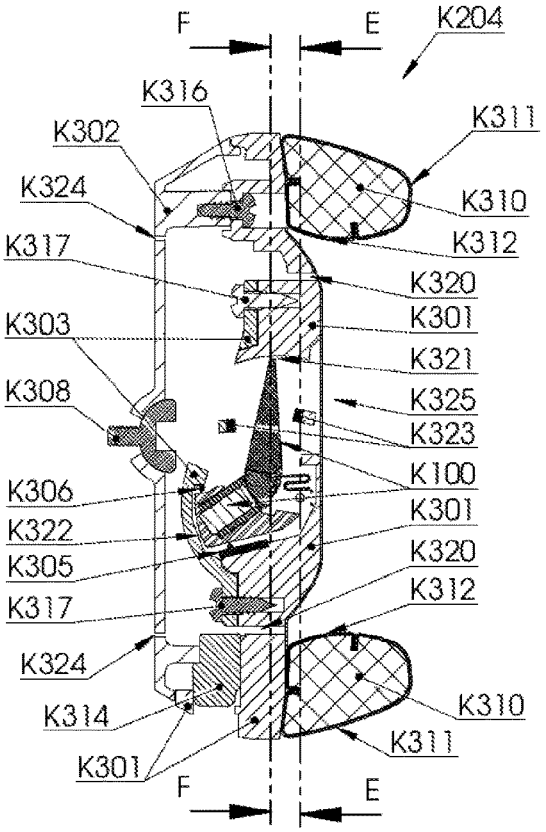
Figure 18E:
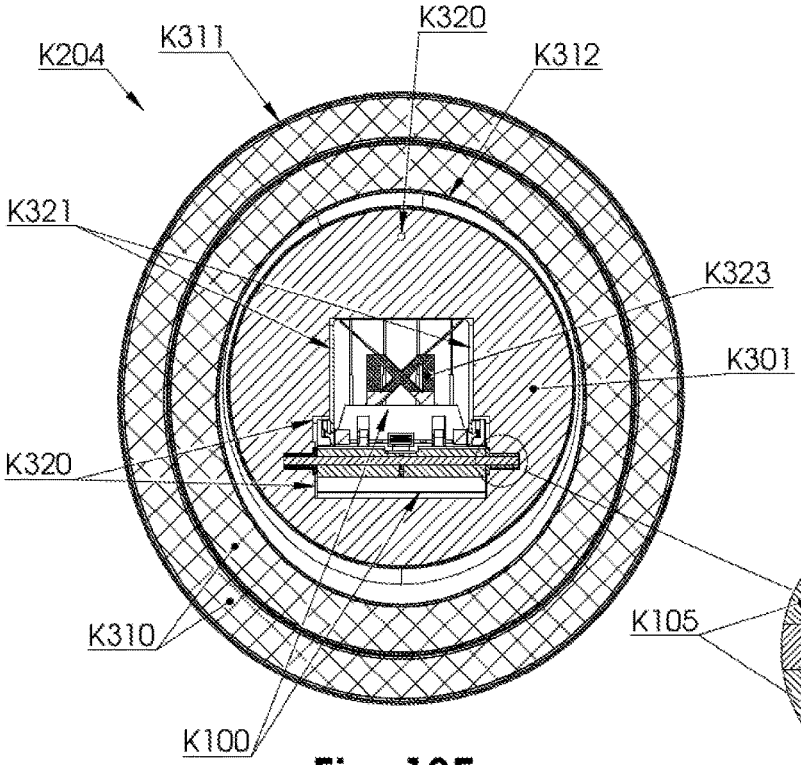
Figure 18F:
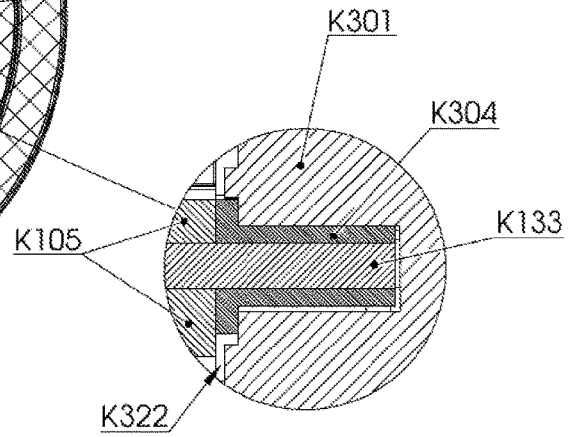
Figure 18G:
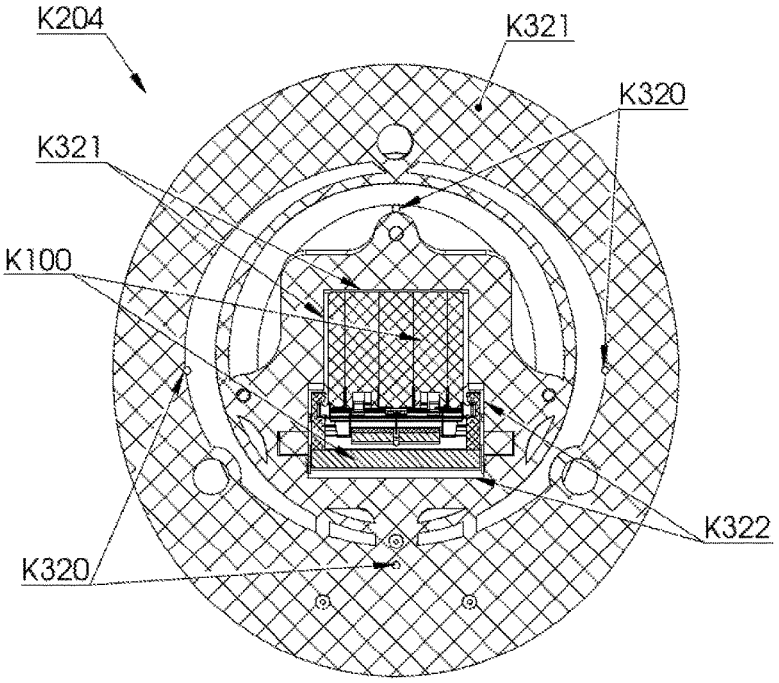
Figure 18H:
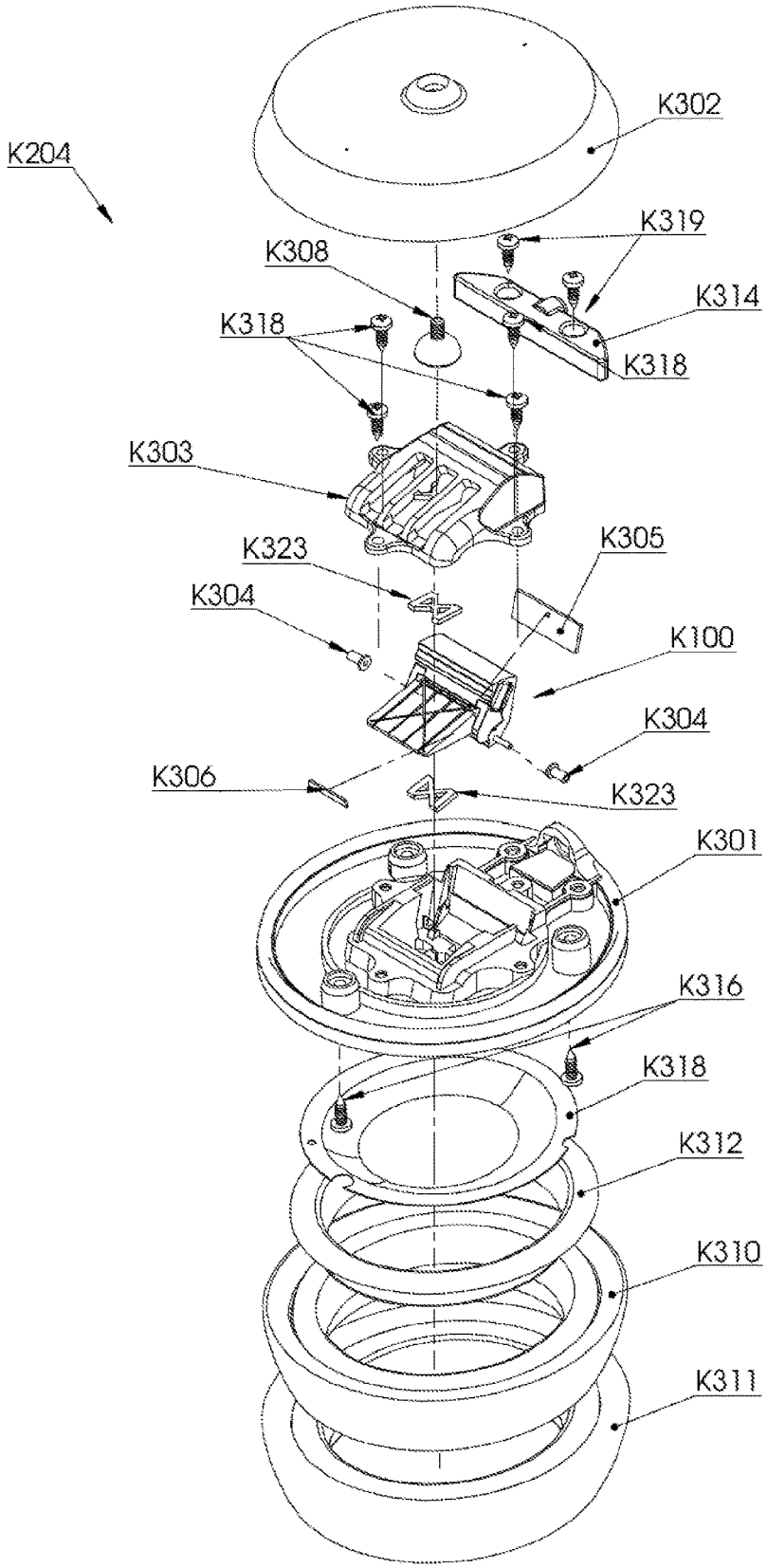
Figure 19:
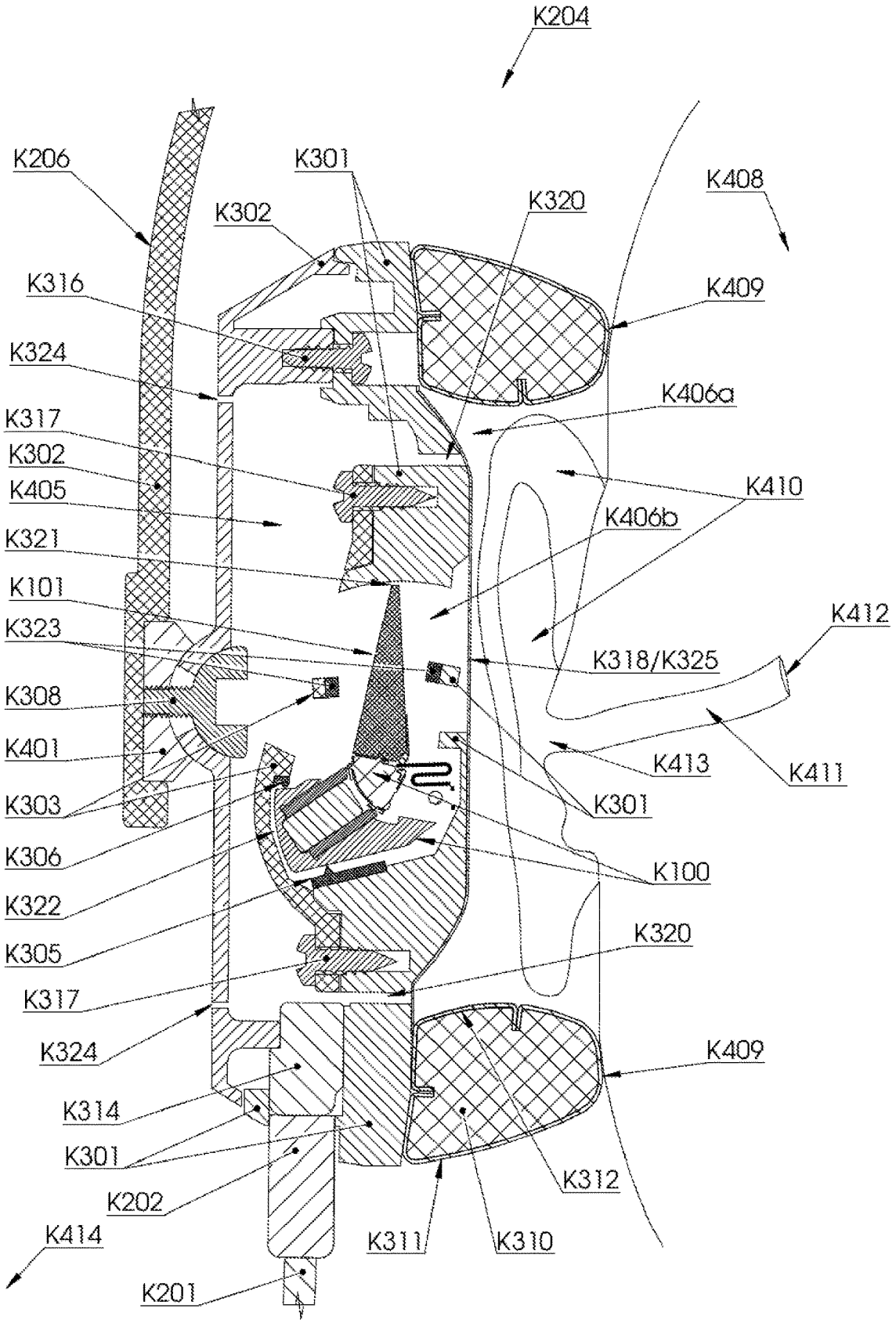
FIG. 19 shows a schematic/cross-sectional view, including the shown in FIG. 18C ear cup, but also showing it in situ, held against a human ear and head by the headband of the headphone in FIG. 17.

As shown in FIGS. 18D-18F, the mounting system comprises a pair of decoupling pins K133 extending laterally from either side of the transducer base structure. The decoupling pins K133 are located such that their longitudinal axes substantially coincide with a location of a node axis of the transducer assembly. A node axis is the axis about which the transducer base structure rotates due to reaction and/or resonance forces exhibited during diaphragm oscillation. In practice, the location of the node axis may change during operation. The location to which the decoupling pins coincide, corresponds to the location of the node axis when the transducer assembly is operated in a hypothetical unsupported state, and operated at frequencies substantially lower than those at which unwanted diaphragm resonances occur. In this embodiment the node axis is located at or proximal to the base component K105. The decoupling pins K133 extend substantially orthogonal to a longitudinal axis of the transducer assembly from the sides between the upper and lower major sides of the base structure K118, and are rigidly coupled and/or integral with the base structure K118. A bush K304 is mounted about each pin K133. A washer may also be coupled between the bush and the associated side of the transducer base structure in some configurations. The bushes and washers are herein referred to as "node axis mounts". The node axis mounts are configured to couple corresponding internal sides of the surround K301 via any suitable method, such as via adhesive for example.

The decoupling mounting system further comprises one or more decoupling pads K305 and K306 located on opposing faces of the transducer base structure K118. The pads K305 and K306 provide an interface between the associate base structure face and a corresponding internal wall/face of the surround K301 (including internal cap K303), to help decouple the components. The decoupling pads are preferably located at a region of the transducer base structure that is distal from the node axis location. For example, they are located at or adjacent an edge, side or end of the base structure K118 that is distal from the diaphragm K101 in this embodiment as the node axis is located close to the diaphragm axis of rotation. Each pad is preferably longitudinal in shape. In the preferred form, each pad K305, K306 comprises a pyramid shaped body having a tapering width along the depth of the body. Preferably the apex of the pyramid is coupled to the associated face of the transducer base structure K118 and the opposing base of the pyramid is configured to couple the associated face of the transducer surround in situ. This orientation may be reversed in some implementations however. It will be appreciated that in alternative embodiments the decoupling mounting system may comprise multiple pads distributed about one or more of the faces of the transducer base structure. Such mounts are herein referred to as "distal mounts".

The node axis mounts and the distal mounts are sufficiently compliant in terms of relative movement between the two components to which they are each attached. For instance, the node axis mounts and the distal mounts may be sufficiently flexible to allow relative movement between the two components they are attached to. They may comprise flexible or resilient members or materials for achieving compliance.

The mounts preferably comprise a low Young's modulus relative to at least one but preferably both components they are attached to (for example relative to the transducer base structure and housing of the audio device). The mounts are preferably also sufficiently damped. For instance, the node axis mounts may be made from a substantially flexible plastics material, such as a silicone rubber, and the pads may also be made from a substantially flexible material such as silicone rubber. The pads are preferably formed from a shock and vibration absorbing material, such as a silicone rubber or more preferably a viscoelastic urethane polymer for example. Alternatively, the node axis mounts and/or the distal mounts may be formed from a flexible and/or resilient member such as metal decoupling springs. Other substantially compliant members, elements or mechanisms such as magnetic levitation that comprise a sufficient degree of compliance to movement, to suspend the transducer may also be used in alternative configurations.

In this embodiment, the decoupling system at the node axis mounts has a lower compliance (i.e. is stiffer or forms a stiffer connection between associated parts) relative to the decoupling system at the distal mounts. This may be achieved through the use of different materials, and/or in the case of this embodiment, this is achieved by altering the geometries (such as the shape, form and/or profile) of the node axis mounts relative to the distal mounts. This difference in geometry means that the node axis mounts comprise a larger contact surface area with the base structure and surround relative to the distal mounts, thereby reducing the compliance of the connection between these parts.

A narrow and substantially uniform gap/space K322 is formed between the transducer base structure K118 and the surround/inner cap K301/K303 when the transducer is assembled within the surround. In some embodiments the gap may not be uniform. This narrow gap K322 may extend about at least a substantial portion of the perimeter (and preferably the entire perimeter) of the base structure K118. A width of each air gap defined by the distance between the outer periphery of the transducer base structure K118 and the surround/inner cap K301/K303 is less than 1.5 mm, or more preferably is less than 1 mm, or even more preferably is less than 0.5 mm. These values are exemplary and other values outside this range may also be suitable.

A narrow gap/space K321 exists between a portion or the entire perimeter of the diaphragm K101 and the surround K301.

The audio device further comprises diaphragm excursion stoppers K323 which are also connected to surround K301 or inner cap K303. There may be one or more such stoppers. In situ, there may be one or more (in this example three) stoppers K323 extending longitudinally and substantially uniformly spaced along each face at a region proximal to the diaphragm structure of the assembly K301. These stoppers K323 have an angled surface that is positioned to contact the diaphragm in the case of any unusual event, such as if the device is dropped or if a very loud audio signal is presented, that may cause over-excursion of the diaphragm. The angled surface is configured to locate adjacent the diaphragm body in situ, to match the angle of the diaphragm body if the diaphragm is caused to inadvertently rotate to this point. The stoppers K323 are made from a substantially soft material, such as an expanded polystyrene foam, to avoid damaging the diaphragm. The material is preferably relatively softer than that of the diaphragm body for example (e.g. it may be of a relatively lighter density than the polystyrene of which the diaphragm body) to alleviate damage. The stoppers K323 have a large surface area so as to effectively decelerate the diaphragm, but not so large as to block too much air flow and/or create enclosed air cavities that are prone to resonance.

Substantially Unsupported Diaphragm Periphery

In an assembled state, the diaphragm K101 comprises an outer periphery that is free from physical connection with a surrounding structure such as the surround K301. A free periphery in relation to a diaphragm is described in detail in section 2.3 of this specification which also applies to this embodiment. By way of summary, the diaphragm periphery may be at least partially free from physical connection with a surround, for example along at least 20 percent of the periphery in some embodiments. In this embodiment the diaphragm K101 is approximately entirely free from physical connection (apart from at the hinge joints) with a surrounding structure including the surround and the transducer base structure. The unconnected, free portions of the periphery of the diaphragm structure are separated from the surround by relatively small air gaps K321 and K320. It will be appreciated that the periphery may otherwise be substantially free from physical connection, along at least 50% or at least 80% of the length or perimeter of the outer periphery for example.

Preferably the width of the air gaps K321 and K320 defined by the distance between the outer periphery of the diaphragm body and the housing/surround K301 is less than $1/10^{th}$, and more preferably less than $1/20^{th}$ of a diaphragm body length K126. For example, a width of each air gap defined by the distance between the outer periphery of the diaphragm body and the surround is less than 1.5 mm, or more preferably is less than 1 mm, or even more preferably is less than 0.5 mm. These values are exemplary and other values outside this range may also be suitable.

3.4 Lattice Diaphragm in Combination with Ferrofluid

Another audio transducer embodiment G900 incorporating a diaphragm G600 that is constructed from a lattice structure and supported by a ferrofluid will now be described with reference to FIGS. 21A-21E, 22A-22F and 23A-23J.

Diaphragm Body

Referring to FIGS. 21A-21E another lattice diaphragm construction G600 is shown consisting of a diaphragm body G602 formed from a three-dimensional lattice structure having a plurality of interconnected cells of predetermined three-dimensional cell shapes. The diaphragm comprises of a substantially solid outer membrane construction G601 that is complementary to the outer profile of the diaphragm body G602. Preferably the outer membrane is substantially solid and covers an entire outer surface or envelops the entire lattice of the diaphragm body. The lattice may consists of a plurality of elongate members G605 that are interconnected at a plurality of nodes G604 to form interstices G607 therebetween. The number of members G605 per node unit may be optimised within the lattice to improve strength and reduce weight as described under section 3.2. Also the relative angles between members G605 may be optimised to improve strength and reduce weight as described under section 3.2. The material and methods used to construct the diaphragm G600 are also as described for diaphragm 500 under section 3.2.

In this example, the diaphragm body G602 and lattice are formed into a predetermined trapezoidal prism shape. Other shapes are possible and not intended to be excluded from the invention. In a preferred form of this embodiment, the diaphragm body G602 is constructed from a micro-lattice consisting of a plurality of interconnected elongate members G605.

The core lattice is a uniformly repeating cell has cell dimensions 5 mm×5 mm×5 mm. The cell dimensions are sufficiently small such that locations of connection to the foil outer reinforcement are sufficiently closely spaced that localised resonance modes of the outer reinforcement are avoided within the operating bandwidth.

In this example, the outer membrane also acts as normal stress reinforcement and consists of plates G601A and G601B on either opposing major side of the diaphragm body. These plates differ in form. A first normal stress reinforcement plate G601A is substantially flat and planar to correspond to the form of the associated upper major side G602A of the body G602. A second normal stress reinforcement plate G601B on the opposing major side G602B comprises a hollow trapezoidal prism shape (having four angled major sides extending outwardly from a central major region) to correspond to the form of the associated lower major sides G602B (note in this embodiment all four angled lower major sides G602B and the upper major side G602A are considered major sides). The outer reinforcement may be aluminium foil or any other suitably rigid material as described under section 3.2.

FIGS. 22A-22F show two variations of the normal stress reinforcements of this example. In these variations the amount/mass of outer normal stress reinforcement G601 is reduced at regions G608 proximal to the edges of the associated major side. For instance in the FIGS. 22A and 22B variation, the width of the upper normal stress reinforcement plate is reduced, a triangular void or notch is located at either end of the normal stress reinforcement and two additional triangular apertures are formed on either side and adjacent each triangular void. The lower normal stress reinforcement plate has two opposing angled major sides omitted. The two other opposing angled major sides have triangular voids formed at their terminal ends and two additional triangular apertures are formed on either side and adjacent the triangular void.

In the FIGS. 22C-22F variation, the normal stress reinforcement plates comprise a series of struts. The struts along the upper major side comprise a pair of longitudinal struts extending substantially parallel and distal to the longitudinal edges of the major side. A pair of cross-struts are then located at either end and extend between the pair of longitudinal struts. On the underside of the diaphragm body, the normal stress reinforcement comprises a series of struts that form an enclosed shape including a pair of side-by-side triangular teeth on each one of a pair of opposing angular major sides, and a pair of longitudinal struts extending along the edge of a central major side between the angular major sides and connecting to the teeth of each angular major side. In this variation, the normal stress reinforcement reduces in thickness in terminal regions G801 via steps G802 to thereby further reduce the amount/mass of normal stress reinforcement in these outer regions. It will be appreciated that in each of these variants, the voids and the apertures may take on alternative forms such as arcuate, annular or the like. It will also be appreciated that in the figure G8 variant, while the reduction in thickness is stepped at G802, this may alternatively be gradual in other embodiments.

As mentioned above, preferably all embodiments have, if not continuous outer reinforcement on at least one major face, at least a sealing membrane that performs the role of substantially sealing the diaphragm body so that it may perform the function of movement of air or being moved by air. In alternative embodiments sealing is provided by foam in the interstices of the lattice.

Referring back to FIGS. 21A-21E, the diaphragm G600 further comprises a diaphragm base structure G610 consisting of a transferring component of a transducing mechanism. In this example the transferring component includes a former G612 and a coil winding G613 wound about an end of the former G612. The transferring component G611 is coupled to one of the major sides G602B of the diaphragm body G602 to enable linear movement of the diaphragm body when in use. The former may be substantially hollow to receive and couple to a corresponding part G602C of the lattice. The former and body part G602C may be coupled via any suitable mechanism, such as welding, soldering or adhesive for example.

Audio Transducer

Referring to FIGS. 23A-J, the diaphragm G600 is shown implemented in a linear action audio transducer G900. The audio transducer may be utilised in a personal audio application or in far field loudspeaker application, such as a home audio or car audio system.

The audio transducer may comprise a diaphragm housing or surround G103 configured to accommodate at least the diaphragm G600. In situ, the transducer base structure G610 of the diaphragm G600 is configured to operatively couple a transducer base structure including permanent magnet G104 and inner and outer magnet poles G106 and G107 respectively. In particular the coil winding G613 is received within a space between the poles G106 and G107 to reciprocate therebetween during operation.

Free Periphery

The audio transducer G900 is an example of a partially free periphery implementation. In situ the diaphragm assembly is accommodated within the housing. The diaphragm G600 is suspended relative to the housing G103 via multiple suspension members G901. There is a discontinuity in the suspension about the perimeter, so this embodiment constitutes a free edge design, in which one or more outer peripheral regions G908 of the diaphragm G600 are free from physical connection with the surround G902. At the free periphery regions G908, an air gap G903 exists between the outer periphery of the diaphragm structure and the surrounding structure G902 (at locations G902*b* of the structure G902). The surrounding structure G902 may be rigidly coupled to a basket G103.

As shown, preferably the one or more peripheral regions G908 that are free from physical connection constitute at least 20% of an entire perimeter of the diaphragm (e.g. approximately 2×G906+2×G905). More preferably the one or more free peripheral regions constitute at least 50%, or at least 80% of the perimeter. This lack of physical connection provides advantages over embodiments having a higher degree of connection about the perimeter of the diaphragm structure. One advantage is that a lower fundamental diaphragm resonance frequency Wn is facilitated, another is that, as surrounds are prone to adverse mechanical resonances, reducing the area and peripheral length of the sound propagating component can provide benefits to sound quality. A periphery that is even partially free from physical connection, e.g. along approximately 20% of the perimeter, still provides a significant advantage in bandwidth of operation (e.g. by lowering the fundamental frequency Wn) and reducing distortion produced by breakup of the surround. As another example, if a periphery is made to be partially free from physical connection and the surround material that remains is thickened such that the fundamental diaphragm frequency remains unchanged, then this may cause resonance modes inherent in the surround to increase in frequency. The parts of the peripheral regions of the diaphragm G908 that are free from connection are separated from the surrounding structure G902 by an air gap G903. Preferably this gap is substantially small. For example it may be between 0.2-4 mm in some applications.

The diaphragm suspension members G901 connect the diaphragm G600 to the major face G902*a* of the surrounding structure G902, which in this case is a guide plate G902 of the basket G103. In combination with the spider G105 this provides a diaphragm suspension system that operationally suspends the diaphragm assembly G600 within the basket and magnet assembly. Each diaphragm suspension member G901 consists of a flexible region G901*a*, and connection tabs G901*b* and G901*c*. Tabs G901*c* provide surface area to attach to the guide plate major face G902*a*. The tabs G901*c* attach to the outer reinforcement G601 and the core G602 at the outer periphery of the diaphragm structure. In this embodiment the diaphragm suspension members G901 are made from a rubber. Other suitable materials include metals, such as spring steel and titanium, carbon fibre, silicon, closed cell foams and plastics. These components are solid suspension components (e.g. not a fluid suspension). The geometry, for example the length G907, and the width of region G901*a* has a large effect on the compliance of the suspension system. The combination of material geometry and Young's modulus should preferably be compliant to provide this transducer a substantially low fundamental frequency Wn.

In alternative embodiments the diaphragm suspension comprises relatively long and slender carbon fibre struts mounted on a short flexible elbow. Such suspensions are developed by Fertin Acoustics. EP1940199A1 discloses further suspension systems that may be utilised in embodiments of the present invention.

FerroFluid

The audio transducer further comprises a transducer base structure of a substantially thick and compact geometry, comprising a permanent magnet G104, inner pole pieces G107 that extend along or about one or more sides of the magnet and outer pole pieces G106 that also extend along or about one or more major sides of the magnet. The inner and outer pole pieces are separated to thereby provide a channel therebetween for receiving a force generating component G112 of the transducer. A former or other diaphragm base frame G612 is coupled to and extends laterally from a central base region of the diaphragm G60 toward the transducer base structure. The force generating component which comprises one or more coils G113 in this embodiment is wound tightly and rigidly coupled to an end of the base frame adjacent the transducer base structure. The diaphragm base frame G112 is formed from a substantially rigid material and is substantially elongate and may comprise a cylindrical shape. One end of the base frame may be rigidly coupled to the lattice part G602C or otherwise to the outer reinforcement G601 or any combination thereof.

An overhung motor layout is be used whereby the coil winding G613 is wider than the magnetic field gap adjacent pole pieces G106 and G107 respectively. But in alternative embodiments an underhung or other motor coil layout may be used. The coil winding G613 is extended beyond the magnetic field gap in order to maintain a substantially consistent motor strength over the range of diaphragm excursion, since there will be a substantially constant number of the coil winding located within the magnetic field gap adjacent pole pieces G106 and G107 when the diaphragm moves in either direction.

The coil G613 extends within the channel formed between the magnetic pole pieces in situ which causes excitation during operation. Support and alignment of the force transferring component G110 of the diaphragm G600 is maintained using ferromagnetic fluid G615 (herein referred to as ferrofluid). Ferrofluid is retained within each gap formed between the inner and outer pole pieces, by virtue of the fluid being magnetically attracted to the magnetic flux concentrating here, and the diaphragm base structure extends therethrough. In situ, within each gap, inner and outer ferrofluid rings attract towards and locate against to the inner and outer pole pieces respectively. During operation the diaphragm G600 reciprocates within and through the ferrofluid and is maintained in alignment with the gaps formed between the pole pieces by action of the ferrofluid. Preferably the ferrofluid is in close contact and/or substantially seals against the diaphragm such that it substantially prevents the flow of gases such as air therebetween.

The ferrofluid preferably supports the diaphragm to a degree that prevents contact or rubbing for example at the diaphragm periphery against the transducer base structure or excitation mechanism.

In some variations of this embodiment, a pair of coils are separately located on the former and may engage with a single or a pair of magnetic gaps with ferrofluid support provided therebetween. In such a variation the coils preferably comprise a relatively small radius and close proximity to one another so that magnetic flux is utilised effectively and diaphragm excursion and driver efficiency are optimised. In this embodiment the pair of coils are able to resist rocking of the diaphragm as well as translations perpendicular to the direction of the diaphragm's primary piston motion, and indeed the ferrofluid may provide sufficient constraint such that no further constraint is required. This means that mechanical diaphragm suspension components such as G901 may not be required, and the diaphragm may be made to have a fully unsupported periphery. In this case some form of diaphragm restoring force must be applied to maintain the coil windings at the correct location inside the magnet gap. This role may be performed, for example, by a small piece of open cell foam, or alternatively a coil former G612 may be shaped such that ferrofluid is progressively displaced from the magnet gap as diaphragm excursion increases away from its equilibrium.

A problem with audio transducers where a significant amount of diaphragm support is provided by a ferromagnetic fluid is that centring force/diaphragm support of fluid is weak, so coil area has to be large and/or the diaphragm has to be relatively light in order for the ferrofluid to provide sufficient support that avoids rubbing of the coil under high excursion or if the transducer is shaken for example. Conventional methods for enabling ferrofluid support in an audio transducer assembly include reducing diaphragm thickness or increasing the diameter of the coil relative to the diaphragm. The first solution has the problem of being prone to unwanted resonance and insufficient internal damping. The second solution necessitates a sparsely distributed magnetic field, which typically results in a transducer with relatively low volume excursion capabilities for a given size.

The audio transducer G900 provides a diaphragm G600 that can be made relatively thick and rigid to substantially reduce or mitigate unwanted resonance modes, while remaining relatively lightweight to be effectively supported by ferrofluid without the need for a relatively large diameter coil. The relatively smaller coil diameter optimises diaphragm excursion and transducer efficiency. The ferrofluid support reduces, and in some embodiments eliminates, the need for a physical, flexible suspension meaning that audio degradation associated with unwanted resonance modes associated with such suspensions are also reduced or eliminated. This construction enables the design of a transducer that can achieve a more desirable trade-off between diaphragm excursion, fundamental diaphragm resonance frequency and transducer resonances including diaphragm and suspension resonances.

The foregoing description of the invention includes preferred embodiments audio transducer and audio device embodiments. The description also includes various embodiments, examples and principles of design and construction of other systems, assemblies, structures, devices, methods and mechanisms relating to audio transducers. Many modifications to the audio transducer embodiments and to the other related systems, assemblies, structures, devices, methods and mechanisms disclosed herein may be made, as would be apparent to those skilled in the relevant art, without departing from the spirit and scope of the invention as defined by the accompanying claims.

The invention claimed is:

1. An audio system comprising:

an audio device having:

at least one output audio channel comprising:

a housing; and at least one electro-acoustic transducer associated with the housing that is operable to convert an input audio signal into sound; and an audio tuning system operatively coupled to the one or more output audio channels, comprising:

a bass control module configured to adaptively adjust a lower cut-off frequency of a frequency response of each of the at least one output audio channel(s) of the audio system for an input audio signal received by the respective at least one output audio channel, by:

making shorter-term adjustments to a lower cut-off frequency of the frequency response relative to a baseline lower cut-off frequency of the frequency response; and making longer-term adjustments to the baseline lower cut-off frequency.

2. An audio system as claimed in claim 1 wherein each electro-acoustic transducer is flexibly mounted relative to the housing via a suspension system to at least partially alleviate mechanical transmission of vibration between the electro-acoustic transducer and the housing during operation.

3. An audio system as claimed in claim 1 wherein the audio tuning system is onboard the audio device and located within the housing of at least one output audio channel.

4. An audio system as claimed in claim 1 wherein the audio tuning system is onboard a device separate to, but configured to operate with, the audio device.

5. An audio system as claimed in claim 1 wherein the audio tuning system further comprises an equaliser configured to alter a frequency response of the audio system for one or more of the output channel(s) in accordance with at least one predetermined equalisation frequency response.

6. An audio system as claimed in claim 5 wherein one of the predetermined equalisation frequency response(s) for each output channel is based on a diffuse field frequency response.

7. An audio system as claimed in claim 6 wherein the equaliser comprises an adjustable frequency response, with at least one default response that is a predetermined frequency response based on the diffuse field frequency response.

8. An audio system as claimed in claim 5 wherein an input of the bass control module is operatively coupled to an output of the equaliser.

9. An audio system as claimed in claim 1 wherein the system further comprises one or more adaptive volume control module, each configured to:

compare a value of an operating parameter indicative of an associated output audio channel to one or more predetermined threshold criteria; and adjust a received audio signal to generate a volume adjusted output signal if the value of the operating parameter is not in accordance with the one or more predetermined threshold criteria.

10. An audio system as claimed in claim 9 wherein the operating parameter includes one or more of: a maximum operating voltage threshold of the electro-acoustic transducer(s) of the associated output audio channel and/or a maximum operational current threshold of the electro-acoustic transducer(s) of the associated output audio channel and/or a maximum diaphragm displacement threshold of the electro-acoustic transducer(s) of the associated output audio channel and/or a maximum output of an amplifier of the associated output audio channel.

11. An audio system as claimed in claim 10 wherein the bass control module is configured to receive or determine from one or more inputs a value or values indicative of one or more of the operating parameter(s) and to make shorter-term and/or longer-term adjustments accordingly.

12. An audio system as claimed in claim 10 wherein the bass control module is configured to:

determine from the input audio signal at least one value indicative of a maximum diaphragm displacement that is or would be exhibited by the electro-acoustic transducer(s) of a respective output audio channel(s) when subjected to the input audio signal, wherein each maximum diaphragm displacement value is associated with a particular lower cut-off frequency of the audio system frequency response;

compare each maximum displacement value to a predetermined maximum diaphragm displacement threshold for the respective output audio channel(s); and adjust the lower cut-off frequency of the audio system frequency response according to the comparison of each maximum displacement value to the predetermined maximum diaphragm displacement threshold for the respective output audio channel(s) to ensure the maximum diaphragm displacement of the electro-acoustic transducer(s) of the respective output audio channel(s) is at or below the predetermined maximum diaphragm displacement threshold.

13. An audio system as claimed in claim 1 wherein the diaphragm of one or more of the electro-acoustic transducers comprises one or more peripheral regions that are free from physical connection with an interior of the housing.

14. An audio system as claimed in claim 13 wherein the peripheral regions that are free from physical connection with the interior of the housing constitute at least 20% of a length or perimeter of an outer periphery of the diaphragm.

15. An audio system as claimed in claim 1 wherein the audio device is a headphone comprising:

a first headphone output audio channel including a housing configured to couple about a first ear of a user and at least one transducer located within the housing; and a second headphone output audio channel including a housing configured to couple about a second ear of the user and at least one transducer located within the housing.

16. An audio system as claimed in claim 1 wherein the audio device is an earphone comprising:

a first earphone output audio channel including a housing configured to locate inside a first ear of a user and at least one transducer located within the housing; and a second earphone output audio channel including a housing configured to locate inside a second ear of the user and at least one transducer located within the housing.

17. An audio system as claimed in claim 1 wherein the personal audio device is a mobile phone comprising one or more output audio channels.

18. An audio system as claimed in claim 1 wherein the audio tuning system further comprises a phase improvement module operatively coupled to each of the output channel(s) and configured to receive input audio signal(s) and generate phase adjusted output audio signals for each output audio channel based on a phase response of the output audio channel.

19. An audio system as claimed in claim 18 wherein the phase response of the output audio channel is predetermined.

20. An audio system as claimed in claim 18 wherein the phase response of the output audio channel consists of multiple varying phases across multiple frequency bands, and wherein the phase improvement module is configured to adjust a phase of the input audio signal across one or more of the multiple frequency bands to generate a phase adjusted output audio signal with a substantially consistent phase across the multiple frequency bands.

21. An audio system as claimed in 18 wherein the phase improvement module further comprises at least one audio mixer associated with a series first and second integrators, wherein the audio mixer is configured to receive any combination of two or more of: the input audio signal received by the first integrator, the integrated audio signal and the double-integrated audio signal and combine the received signals to generate an output phase improved audio signal.

22. An audio system as claimed in claim 1 wherein the diaphragm of each transducer remains rigid during operation over the transducer's frequency range of operation and/or substantially over the audible frequency.

23. An audio system as claimed in claim 22 further comprising normal stress reinforcement coupled at or adjacent at least one major face of the diaphragm, and wherein a mass per unit area of the normal stress reinforcement at one or more peripheral regions of the diaphragm distal from a centre of mass of the diaphragm is less than a mass per unit area of the normal stress reinforcement at one or more regions at or proximal to the centre of mass of the diaphragm.

24. An audio system as claimed in claim 1 wherein the diaphragm of each transducer comprises a diaphragm body having a maximum thickness that is at least about 11% of a maximum length dimension of the diaphragm body.

25. An audio system as claimed in claim 1 wherein the bass control module is configured to make longer-term adjustments to the baseline lower cut-off frequency based on an input or measure indicative of an average time period between two or more adjacent shorter-term adjustments of the lower cut-off frequency.

26. An audio system as claimed in claim 25 wherein the bass control module is configured to make longer-term adjustments to the baseline lower cut-off frequency based on an input or measure indicative of a frequency of the shorter-term adjustments of the lower cut-off frequency.

27. An audio system as claimed in claim 25 wherein the bass control module is configured to adjust the baseline lower cut-off frequency when the input or measure indicative of an average time period between two or more adjacent shorter-term adjustments of the lower cut-off frequency does not satisfy a threshold criteria or criterion.

28. An audio system as claimed in claim 25 wherein the bass control module is configured to make the longer-term adjustments by adjusting the baseline lower cut-off frequency to maintain the input or measure to within a threshold criterion or criteria while maximizing a bass extension of the output audio channel.

29. An audio system as claimed in claim 1 wherein the shorter-term adjustments primarily comprise a temporary adjustment in the lower cut-off frequency relative to the baseline lower cut-off frequency.

30. An audio system as claimed in claim 29 wherein the shorter-term adjustments primarily comprise the temporary adjustment in the lower cut-off frequency followed by a return to the baseline lower cut-off frequency.

31. An audio system as claimed in claim 29 wherein the temporary adjustment is a temporary increase in the lower cut-off frequency.

32. An audio system as claimed in claim 1 wherein an average time period between two or more adjacent shorter-term adjustments of the lower cut-off frequency is less than an average time period between two or more adjacent longer-term adjustments of the baseline lower cut-off frequency.

33. An audio system as claimed in claim 1 wherein the bass control module is configured to adjust the lower cut-off frequency based on a value or values of one or more operating parameters of the respective output audio channel.

34. An audio system as claimed in claim 33 wherein the bass control module is configured to adjust the lower cut-off frequency when the value or values of one or more operating parameters exceed, or are predicted to exceed, a threshold criterion or criteria associated with the respective operating parameter(s) to maintain the value or values of the operating parameter(s) to within the threshold criterion or criteria.

35. An audio system as claimed in claim 34 wherein the bass control module is configured to adjust the lower cut-off frequency to maintain the value or values of the operating parameter(s) to within the threshold criterion or criteria while substantially maximizing a bass extension of the output audio channel.

36. An audio system as claimed in claim 34 wherein the bass control module is configured to make the shorter-term adjustments by adjusting the lower cut-off frequency to maintain the value or values of the operating parameter(s) to within a threshold criterion or criteria while maximizing a bass extension of the output audio channel.

37. An audio system as claimed in claim 33 wherein bass control module is configured to make the shorter-term adjustments to the lower cut-off frequency based on the value or values of the operating parameter(s).

38. An audio system as claimed in claim 33 wherein the bass control module is configured to determine the value or values of the operating parameters using a predetermined model of the respective output audio channel and the input audio signal.

39. An audio device as claimed in claim 38 wherein the model is a mathematical model generated using one or more inputs or measures indicative of one or more of the following characteristics of the respective output audio channel:

- a combined moving mass of a diaphragm assembly and air load of the respective output audio channel;
- of a combined damping acting on the diaphragm due to mechanical, electrical and/or acoustical sources;
- a combined stiffness acting on the diaphragm assembly due to mechanical and/or acoustical sources; and/or
- a total responsiveness of the audio system.

40. An audio device as claimed in claim 1 wherein the bass control module is configured to adjust the lower cut-off frequency by adjusting the lower cut-off frequency of an adjustable pre-integration high pass filter to which the input audio signal is subjected.

41. An audio device as claimed in claim 40 wherein the pre-integration high pass filter is a linear phase filter.

42. A method for tuning an audio device having at least one output audio channel including an electro-acoustic transducer operable to convert an input audio signal into sound, the method comprising:

adaptively adjusting a lower cut-off frequency of a frequency response of each of the output audio channel(s) for an input audio signal received by the respective output audio channel by:

making shorter-term adjustments to a lower cut-off frequency of the frequency response relative to a baseline lower cut-off frequency of the frequency response; and making longer-term adjustments to the baseline lower cut-off frequency.

43. An audio tuning device for tuning an audio device having at least one output audio channel including an electro-acoustic transducer operable to convert an input audio signal into sound, the audio tuning device comprising a bass control module configured to adaptively adjust a lower cut-off frequency of a frequency response of each of the output audio channel(s) for an input audio signal received by the respective output audio channel by:

making shorter-term adjustments to a lower cut-off frequency of the frequency response relative to a baseline lower cut-off frequency of the frequency response; and making longer-term adjustments to the baseline lower cut-off frequency.

* * * * *